US007687229B2

(12) United States Patent
Deguchi et al.

(10) Patent No.: US 7,687,229 B2
(45) Date of Patent: Mar. 30, 2010

(54) SILVER HALIDE COLOR PHOTOGRAPHIC LIGHT-SENSITIVE MATERIAL AND IMAGE FORMING METHOD

(75) Inventors: Yasuaki Deguchi, Minami-ashigara (JP); Kiyoshi Takeuchi, Minami-ashigara (JP); Mamoru Sakurazawa, Minami-ashigara (JP); Makoto Yamada, Minami-ashigara (JP); Takehiko Satou, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 312 days.

(21) Appl. No.: 11/660,978

(22) PCT Filed: Aug. 23, 2005

(86) PCT No.: PCT/JP2005/015604

§ 371 (c)(1),
(2), (4) Date: May 21, 2007

(87) PCT Pub. No.: WO2006/022405

PCT Pub. Date: Mar. 2, 2006

(65) Prior Publication Data

US 2007/0298348 A1 Dec. 27, 2007

(30) Foreign Application Priority Data

| | | |
|---|---|---|
| Aug. 24, 2004 | (JP) | 2004-244296 |
| Sep. 30, 2004 | (JP) | 2004-286333 |
| Sep. 30, 2004 | (JP) | 2004-286402 |
| Sep. 30, 2004 | (JP) | 2004-286447 |
| Sep. 30, 2004 | (JP) | 2004-286477 |
| Sep. 30, 2004 | (JP) | 2004-286554 |
| Sep. 30, 2004 | (JP) | 2004-286581 |

(51) Int. Cl.

| | |
|---|---|
| ***G03C 11/00*** | (2006.01) |
| ***G03C 7/46*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/546; 430/502; 430/503; 430/504; 430/505; 430/506; 430/517; 430/559; 430/543; 430/631; 430/553; 430/551; 430/556; 430/557; 430/390; 430/372; 430/374; 430/376

(58) Field of Classification Search ..... 430/502–506, 430/517, 559, 543, 546, 631, 553, 551, 556, 430/557, 390–391, 372, 374, 376
See application file for complete search history.

(56) References Cited

U.S. PATENT DOCUMENTS

| | | | | |
|---|---|---|---|---|
| 4,946,765 | A | 8/1990 | Hahm | |
| 5,206,125 | A | 4/1993 | Ogawa | |
| 5,270,153 | A | 12/1993 | Suzuki et al. | |
| 5,460,929 | A * | 10/1995 | Nagaoka et al. | 430/503 |
| 5,578,441 | A * | 11/1996 | Nagaoka et al. | 430/599 |
| 5,691,125 | A * | 11/1997 | Hara et al. | 430/505 |
| 5,948,601 | A | 9/1999 | Rieger | |
| 2002/0031736 | A1 | 3/2002 | Nakamine et al. | |
| 2003/0073047 | A1 | 4/2003 | Takeuchi et al. | |
| 2004/0122238 | A1 | 6/2004 | Takeuchi et al. | |

FOREIGN PATENT DOCUMENTS

| | | | |
|---|---|---|---|
| EP | 0 488 248 | A1 | 6/1992 |
| JP | 2-100046 | A | 4/1990 |
| JP | 3-156451 | A | 7/1991 |
| JP | 7-152128 | A | 6/1995 |
| JP | 7-239538 | A | 9/1995 |
| JP | 9-34069 | A | 2/1997 |
| JP | 9-50101 | A | 2/1997 |
| JP | 2001-342189 | A | 12/2001 |
| JP | 2002-287311 | A | 10/2002 |
| JP | 2002-287312 | A | 10/2002 |
| JP | 2003-96327 | | 4/2003 |
| JP | 2003-173007 | A | 6/2003 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material having, on a support, at least each one light-sensitive silver halide emulsion layers containing yellow-, magenta-, or cyan-dye-forming-coupler, and at least one light-insensitive hydrophilic colloid layer, wherein at least one of the dye-forming couplers is a dye-forming coupler that forms an azomethine dye having a solubility of $1\times10^{-8}$ mol/L to $5\times10^{-3}$ mol/L in ethyl acetate; and an image forming method using the light-sensitive material.

32 Claims, No Drawings

SILVER HALIDE COLOR PHOTOGRAPHIC LIGHT-SENSITIVE MATERIAL AND IMAGE FORMING METHOD

TECHNICAL FIELD

The present invention relates to a silver halide color photographic light-sensitive material and an image forming method. More specifically, the invention relates to a silver halide color photographic light-sensitive material and to an image forming method which each can provide images with excellent image preservability.

In addition, the present invention relates to a silver halide color photographic light-sensitive material and to an image forming method which each have rapid processing suitability and can provide images with excellent image preservability.

Further, the present invention relates to a silver halide color photographic light-sensitive material and to an image forming method which each can provide images of good quality even when treated by ultra-rapid processing.

BACKGROUND ART

As a material that provides a high quality image with image stability at a low price, a silver halide photographic light-sensitive material has been widely used until today. Demands for improvements on image quality, stability of quality and productivity by users have been remarkably increasing in recent years. As to the demands for improvements on image quality, it is wanted to improve pure whiteness, color reproduction, sharpness, etc. As to the demands for improvements on quality stability, it is necessary to improve production stability of a light-sensitive material, fastness with the lapse of time in the unexposed state, and performance stability during developing processing. As to the improvement in productivity, improvements on processing speed are wanted.

In photographic light-sensitive materials for direct view such as a color paper and a color reversal, first of all color reproduction is important. For improvement of color reproduction, it is essential that dyes formed by a coupling reaction between a dye-forming coupler (hereinafter sometimes referred to simply as "a coupler") and an oxidized product of aromatic primary amine compound (specifically an oxidized p-phenylenediamine-series color developing agent) have small unwanted absorption and they are excellent in absorption characteristics. In addition, it is important to reduce a residual color owing to remaining sensitizing dyes and dyes for prevention of irradiation (irradiation-neutralizing dyes) and also fogging. A secondary importance is to have high image preservability after formation of color images. Therefore, this industry has conducted studies of long-term stabilization of color images through effective control of decomposition of dyes by light and heat, e.g., with the aid of selection of couplers and high boiling organic solvents to be used, and addition of image stabilizers.

In recent photographic processing service business, color prints from digital information sources, such as digital cameras, have come to be obtained with ease and rapidity by virtue of widespread use of printing devices utilizing digital exposure, and there has been a growth in occasion to produce image outputs in the form of color prints. For the color printing business, efficiency enhancements including reduction in time period from print exposure to color development processing has been required mainly with the intention of increasing a production speed in photofinishing laboratory and improving customer service. Examples of a general method for improving rapid processing suitability of color photographic light-sensitive materials include:

(1) Reduction in a coating amount of organic materials by means of, for example, employing a coupler that forms a dye having a large molar extinction coefficient,
(2) Reduction in a coating amount of a silver halide emulsion attendant upon (1),
(3) Reduction in both a coating amount of a hydrophilic binder and a thickness of the entire photographic constitutional layers attendant upon (1),
(4) Employment of a coupler having a high activity, and
(5) Employment of a silver halide emulsion that can be processed at a high developing speed.

In order to provide a photosensitive material suitable for ultra-rapid processing in color-development and desilvering steps, this industry also has tried reduction in coating amounts of silver in a photosensitive material by means of, for example, employment of a coupler that can form a dye having a high molar extinction coefficient and has made efforts to achieve [1] and [2] for the purpose of preventing undesired stains from occuring by leaving ingredients of processing solutions in processed prints.

Examples of couplers having high activity and high molecular extinction coefficient, suitable for the foregoing photosensitive materials, as improved couplers of conventional acylacetanilide-series compounds include 1-alkylcyclopropanecarbonylacetanilide-series compounds (cf. JP-A-4-218042 ("JP-A" means unexamined published Japanese patent application)), cyclic malonediamide-type yellow couplers (cf. JP-A-5-11416), heterocyclic acetanilide yellow couplers (cf. JP-A-2003-173007), pyrazoloazole magenta couplers (cf. JP-A-63-041851 and JP-A-6-043611), pyrroloazole-type cyan couplers (cf EP-A1-0488248 and EP-A1-0291197) and pyrrolotriazole-type cyan couplers (cf. JP-A-2001-342189 and JP-A-2002-287311).

Such couplers are generally formed into fine-particle dispersions of lipophilic components including couplers and other ingredients soluble in organic solvents and incorporated in hydrophilic colloid layers. More specifically, the lipophilic components include couplers, high boiling organic solvents, polymers insoluble in water and soluble in organic solvents, and various other organic materials used, e.g., for prevention of color-mixing and image stabilization. Of these organic materials, high boiling organic solvents have been studied in this industry also because they not only have been used as coupler solvents, but also they affect many photographic properties, such as the fastness of photosensitive materials after production, color forming performance upon color development processing, and the preservability of color images after formed.

However, it was not always sufficient to merely adopt the above couplers capable of forming dyes with high molecular extinction coefficient for achievement of further improvements in rapid processing suitability through the aforementioned reductions in coating amounts of organic materials and the total thickness of photographic constituent layers. Although a photosensitive material suitable for washing and drying steps in ultra-rapid processing can be obtained by reduction in usage of organic materials other than couplers, such as high boiling organic solvents, and its accompanying reduction in usage of gelatin binder, cases sometimes occurred in which color formation characteristics, hue and image preservability are impaired. Further, there were cases where organic materials in a photosensitive material migrated between their constituent layers during time-lapse storage to aggravate undesirable uneven density. Of these migrations, fears have been entertained as to interlayer migration of color-mixing inhibitors in particular.

There are known photographic elements and arts, such as the photographic element having a color enhancing layer between an emulsion layer and a color-mixing inhibiting layer (cf U.S. Pat. No. 5,576,159), the color photographic light-sensitive materials wherein a coupler-containing layer and an emulsion layer are adjacent to each other as separate layers (cf. JP-A-4-75055 and EP-0062202-A1), the multilayered photographic element made up of light-sensitive layers and light-insensitive dye-forming layers without containing any color-mixing inhibiting layer (cf. U.S. Pat. No. 6,268,116), and the art of forming a color-mixing inhibiting interlayer into a multilayer structure made up of light-insensitive inter layers having color-mixing inhibiting property different from one another (cf JP-A-4-110844).

However, when ultra-rapid processing is carried out actually, it is further required to overcome various problems including compatibility between the foregoing rapid processing suitability and image preservability.

DISCLOSURE OF INVENTION

According to the present invention, there is provided the following means:

(1) A silver halide color photographic light-sensitive material having, on a support, at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer, and at least one light-insensitive hydrophilic colloid layer, characterized in that:

at least one of the dye-forming couplers is a dye-forming coupler that forms an azomethine dye having a solubility of $1\times10^{-8}$ mol/L to $5\times10^{-3}$ mol/L in ethyl acetate by reaction with an oxidized aromatic primary amine compound.

(2) The silver halide color photographic light-sensitive material according to the above item (1), characterized by containing the dye-forming coupler in an amount of 18 mass % to 100 mass % based on the total lipophilic components in a layer containing the dye-forming coupler.

(3) The silver halide color photographic light-sensitive material according to the above item (1), which satisfies at least one of the following conditions a) and b):

a) any emulsion layer, other than the light-sensitive silver halide emulsion layer present in the position most distant from the support, of at least the three dye-forming-coupler-containing light-sensitive silver halide emulsion layers, contains the dye-forming coupler that forms the azomethine dye; and b) at least one of the light-insensitive hydrophilic colloid layers is a dye-forming-coupler-containing light-insensitive color-forming layer and the light-insensitive color-forming layer is adjacent to at least one dye-forming-coupler-containing light-sensitive silver halide emulsion layer.

(4) The silver halide color photographic light-sensitive material according to the above item (1), characterized in that the support is a reflective support, the dye-forming coupler that forms the azomethine dye is contained in an amount of 18 mass % or more but less than 100 mass % based on the total lipophilic components in a layer containing the dye-forming coupler, and as the lipophilic component, at least one compound represented by any of formulae [S-I], [S-II], [S-III], [S-IV] and [S-V] is contained;

Formula [S-I]

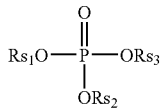

wherein $Rs_1$, $Rs_2$ and $Rs_3$ each independently represent an alkyl group, a cycloalkyl group, an alkenyl group or an aryl group, and each of these groups may be substituted; and the total number of carbon atoms contained in groups represented by $Rs_1$, $Rs_2$ and $Rs_3$ is from 12 to 60; at least one of $Rs_1$, $Rs_2$ and $Rs_3$ represents a linking group, to form a dimmer or a polymer whose order is higher than said dimer.

$Rs_4$-($COORs_5$)sm Formula [S-II]

wherein $Rs_4$ represents a linking group having no aromatic group; $Rs_5$ represents an alkyl, cycloalkyl, alkenyl or alkynyl group having 20 or less carbon atoms; sm represents an integer from 2 or more and 5 or less; and when sm is 2 or more, plural —$COORs_5$s may be the same or different from each other;

$Rs_6$-($OCORs_7$)sn Formula [S-III]

wherein $Rs_6$ represents a linking group; $Rs_7$ represents an alkyl, cycloalkyl, alkenyl or alkynyl group having 20 or less carbon atoms; sn represents an integer from 2 or more and 5 or less; and when sn is 2 or more, plural —$OCORs_7$s may be the same or different from each other;

Formula [S-IV]

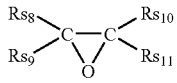

wherein $Rs_8$, $Rs_9$, $Rs_{10}$ and $Rs_{11}$ each independently represent a hydrogen atom, an aliphatic group, an aliphatic oxycarbonyl group, an aromatic oxycarbonyl group or a carbamoyl group, in which the total number of carbon atoms contained in Rs8, Rs9, $Rs_{10}$ and $Rs_{11}$ is 8 to 60; and Rs8 and Rs9, Rs8 and $Rs_{10}$, or $Rs_{10}$ and $Rs_{11}$ may bond with each other, to form a five- to seven-membered ring, respectively; with the proviso that all of Rs8, Rs9, $Rs_{10}$ and $Rs_{11}$ simultaneously do not represent a hydrogen atom;

$Rs_{12}$-($COORs_{13}$)sp Formula [S -V]

wherein $Rs_{12}$ represents an aromatic linking group; $Rs_{13}$ represents an alkyl, cycloalkyl, alkenyl or alkynyl group having 20 or less carbon atoms; sp represents an integer from 3 or more and 5 or less; and when sp is 2 or more, plural —$COORs_{13}$s may be the same or different from each other;

(5) The silver halide color photographic light-sensitive material according to the above item (1), characterized in that the support is a reflective support, the dye-forming coupler that forms the azomethine dye is contained in an amount of 18 mass % or more but less than 100 mass % based on the total lipophilic components in a layer containing the dye-forming coupler, and as the lipophilic component, at least one compound represented by any of formulae [ST-I], [ST-II], [ST-III], [ST-IV] and [ST-V] is contained;

Formula [ST-I]

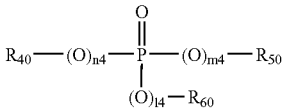

wherein $R_{40}$, $R_{50}$ and $R_{60}$ each independently represent an aliphatic group or an aromatic group; and 14, m4 and n4 each independently represent 0 or 1, with the proviso that 14, m4 and n4 simultaneously are not 1;

$R_A$—NH—$SO_2$—$R_B$ Formula [ST-II]

wherein $R_A$ and $R_B$ each independently represent a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic oxy group, or —N($R_C$)($R_D$), in which $R_C$ and $R_D$ each independently represent a hydrogen atom, an alkyl group or an aryl group; and $R_A$ and $R_B$ each may be the same or different from each other;

HO-(J')-COOY Formula [ST-III]

wherein J' represents a divalent organic group; and Y represents an alkyl group, a cycloalkyl group, an aryl group, an alkenyl group, an alkynyl group, a cycloalkenyl group or a heterocyclic group;

$R_{51}$—O-($CH_2$-$J_5$-$CH_2$O)$_{15}$$R_{52}$ Formula [ST-IV]

wherein $R_{51}$ and $R_{52}$ each independently represent an aliphatic group or —$COR_{53}$, in which $R_{53}$ represents an aliphatic group; $J_5$ represents a divalent organic group or simply a connecting bond; and 15 represents an integer from 0 to 6; and $R_{54}$—$Y_{54}$ Formula [ST-V]

wherein $R_{54}$ represents a hydrophobic group having the total number of carbon atoms of 10 or more; and $Y_{54}$ represents a monovalent organic group containing an alcoholic hydroxyl group.

(6) The silver halide color photographic light-sensitive material according to the above item (1), characterized in that the support is a reflective support, the dye-forming coupler that forms the azomethine dye is contained in an amount of 18 mass % or more but less than 100 mass % based on the total lipophilic components in a layer containing the dye-forming coupler, and as the lipophilic component, at least one polymer soluble in an organic solvent is contained.

(7) The silver halide color photographic light-sensitive material according to the above item (1), characterized in that the dye-forming coupler that forms the azomethine dye and at least one compound selected from a group consisting of compounds represented by any of formulae (Ph-1), (Ph-2), (E-1) to (E-3) and (TS-I) to (TS-VII), metal complexes, and ultraviolet absorbents are contained in at least one light-sensitive silver halide emulsion layer containing the dye-forming coupler, and a proportion of the dye-forming coupler to the total lipophilic components in the emulsion layer containing the dye-forming coupler is from 18 mass % to 99 mass %;

Formula Ph-1

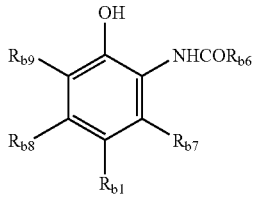

Formula Ph-2

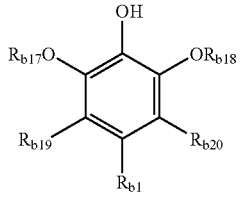

Wherein, in formula [Ph-1] and [Ph-2], $R_{b1}$ represents an aryl group, an aromatic group, a carbamoyl group, an acylamino group, a carbonyl group or a sulfonyl group; $R_{b6}$ represents an aliphatic group, an aryl group, an amino group or an acyl group; $R_{b7}$ to $R_{b9}$, $R_{b19}$ and $R_{b20}$ each independently represent a hydrogen atom, a halogen atom, a hydroxyl group, an aliphatic group, an aryl group, a heterocyclic group, an alkyloxy group, an aryloxy group, a heterocyclicoxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group or an arylthio group; and $R_{b17}$ and $R_{b18}$ each independently represent an aliphatic group or an aryl group.

Formula (E-1)

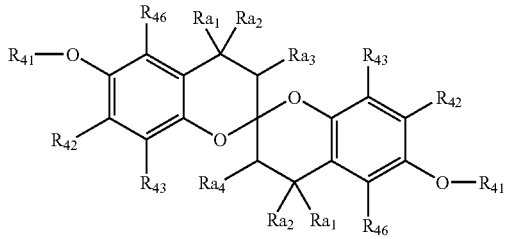

Formula (E-2)

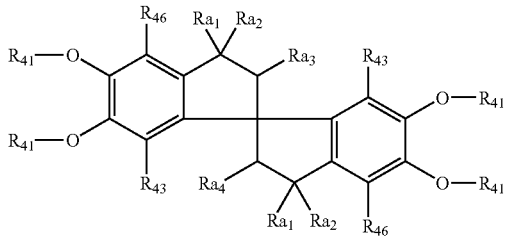

Formula (E-3)

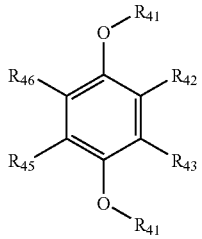

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si ($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and Ra1 to Ra4 each independently represent a hydrogen atom, or an aliphatic group.

Formula (TS-I)

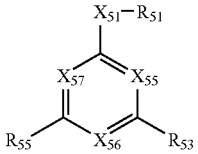

Formula (TS-II)

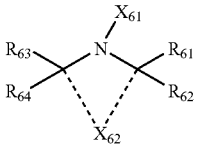

Formula (TS-III)

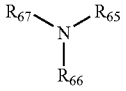

Formula (TS-IV)

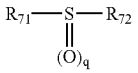

Formula (TS-V)

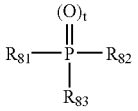

Formula (TS-VI)

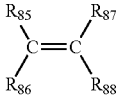

Formula (TS-VII)

wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$)($R_{60}$), in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; X55 represents —N═ or —C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total number of carbon atoms of the compound represented by formula (TS-I) is 10 or more; and the compound represented by formula (TS-I) is neither identical to the compound represented by any one of formulae (Ph-1) to (Ph-2) nor the compound represented by any one of formulae (E-1) to (E-3);

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, a carbamoly group, a hydroxy group, or an oxy radical group; $X_{62}$ represents a group of non-metal atoms necessary to form a 5- to 7-membered ring; and the total number of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and both $R_{65}$ and $R_{66}$ are not hydrogen atoms at the same time;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and all of $R_{85}$, $R_{86}$, $R_{87}$, and $R_{88}$ cannot simultaneously represent a hydrogen atom; any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and wherein, in formula (TS-VII), $R_{91}$ represents an hydrophobic group having total carbon atoms of 10 or more; and Y91 represents a monovalent organic group containing an alcoholic hydroxyl group;

(8) The silver halide color photographic light-sensitive material according to the above item (1), characterized by containing the dye-forming coupler in an amount of 18 mass % or more but 100 mass % or less based on the total lipophilic components in a layer containing the dye-forming coupler, and containing at least one compound represented by formula (CMP) in at least one of the light-insensitive hydrophilic colloid layers;

Formula (CMP)

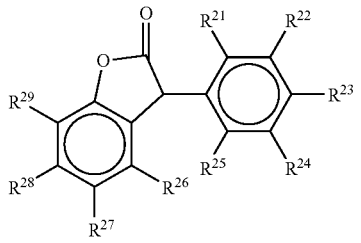

wherein, in formula (CMP), $R^{21}$ to $R^{29}$ may be the same or different, and each represents a hydrogen atom or a substituent, provided that at least one of $R^{21}$ to $R^{29}$ is a substituent, or any of $R^{21}$ to $R^{29}$ may be a divalent group, to form a dimer or a multimer, or a homopolymer or copolymer by binding to a polymer chain.

(9) The silver halide color photographic light-sensitive material according to any one of the above items (1) to (8), characterized in that the azomethine dye has a solubility of $1\times10^{-8}$ mol/L to $7\times10^{-4}$ mol/L in ethyl acetate.

(10) The silver halide color photographic light-sensitive material according to any one of the above items (1) to (9), characterized in that the azomethine dye has its absorption maximum wavelength in a range of 570 nm to 700 nm.

(11) The silver halide color photographic light-sensitive material according to any one of the above items (1) to (10), characterized in that a silver halide emulsion layer containing at least one dye-forming coupler that forms the azomethine dye has a coating amount of total dye-forming couplers in a range of 0.18 mmol/$m^2$ to 0.28 mmol/$m^2$ and a maximum optical reflection density of 2.0 or above at a maximum absorption wavelength of the dyes after dye formation.

(12) The silver halide color photographic light-sensitive material according to any one of the above items (1) to (11), characterized in that the dye-forming coupler that forms the azomethine dye is a coupler represented by formula (CP-I);

Formula (CP-I)

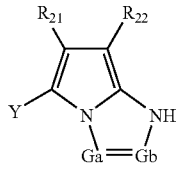

wherein, in formula (CP-I), Ga represents —C($R_{23}$)═ or —N═, Gb represents —C($R_{23}$)═ when Ga represents —N═, or Gb represents —N═ when Ga represents —C($R_{23}$)═, $R_{21}$ and $R_{22}$ each independently represent an electron-attracting group having a Hammett's substituent constant cup value of 0.20 to 1.0; $R_{23}$ represents a substituent; and Y represents a hydrogen atom or a group capable of being split-off upon a coupling reaction with an oxidized developing agent.

(13) The silver halide color photographic light-sensitive material according to any one of the above items (1) to (12), characterized by containing at least one dye-forming coupler represented by formula (I);

Formula (I)

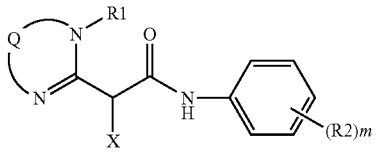

wherein Q represents a group of non-metal atoms that forms a 5- to 7-membered ring in combination with the —N═C—N(R1)-; R1 represents a substituent; R2 represents a substituent; m represents an integer of 0 or more and 5 or less; when m is 2 or more, R2s may be the same or different, and they may combine together to form a ring; and X represents a hydrogen atom, or a group capable of being split-off upon a coupling reaction with an oxidized product of a developing agent;

(14) The silver halide color photographic light-sensitive material according to any one of the above items (1) to (13), characterized in that the oxidized product of the aromatic primary amine compound is an oxidation product of 4-amino-3-methyl-N-ethyl-N-(β-methanesulfonamidoethyl)aniline.

(15) The silver halide color photographic light-sensitive material according to any one of the above items (1) to (14), characterized in that the dye-forming coupler that forms the azomethine dye is contained in an amount of 24 mass % to 80 mass % based on the total lipophilic components in a layer containing the dye-forming-coupler.

(16) The silver halide color photographic light-sensitive material according to the above item (3), characterized by having two or more light-insensitive hydrophilic colloid layers and meeting the following condition c):

c) that the two or more light-insensitive hydrophilic colloid layers are composed of a non-color-forming interlayer containing a color-mixing inhibitor and a non-color-forming interlayer containing substantially no color-mixing inhibitor, and the non-color-forming interlayer containing a color-mixing inhibitor is provided between and adjacent to the non-color-forming interlayer containing substantially no color-mixing inhibitor and a silver halide emulsion layer.

(17) The silver halide color photographic light-sensitive material according to any one of the above items (1) to (16), characterized in that a total coating amount of hydrophilic colloids is 6.0 g/$m^2$ or below.

(18) The silver halide color photographic light-sensitive material according to any one of the above items (1) to (17), characterized in that a total coating amount of silver is 0.45 g/$m^2$ or below.

(19) The silver halide color photographic light-sensitive material according to the above item (3), characterized by meeting both the conditions a) and b) as described in the above item (3).

(20) The silver halide color photographic light-sensitive material according to the above item (3), characterized in that the dye-forming coupler that forms the azomethine dye is incorporated in a hydrophobic fine-particle dispersion of a layer containing the coupler in an amount of 18 mass % to 80 mass % based on total lipophilic components in the layer.

(21) The silver halide color photographic light-sensitive material according to the above item (6), characterized in that the polymer soluble in an organic solvent is contained in an amount of 5 mass % to 100 mass % based on the dye-forming coupler that forms the azomethine dye.

(22) An image forming method, comprises exposing a silver halide color photographic light-sensitive material having, on a support, at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer and at least one light-insensitive hydrophilic colloid layer, and subjectiong the exposed light-sensitive material to development-processing characterized in that:

at least one of the dye-forming couplers is a dye-forming coupler that forms an azomethine dye having a solubility of $1\times10^{-8}$ mol/L to $5\times10^{-3}$ mol/L in ethyl acetate by reaction with an oxidized product of an aromatic primary amine compound.

(23) The image forming method according to the above item (22), characterized in that the silver halide color photographic light-sensitive material contains the dye-forming coupler that forms the azomethine dye in an amount of 18 mass % to 100 mass % based on the total lipophilic components in a layer containing the dye-forming coupler.

(24) The image forming method according to the above item (22), characterized in that the silver halide color photographic light-sensitive material meets at least one of the following conditions that:

a) any emulsion layer, other than the light-sensitive silver halide emulsion layer present in the position most distant from the support, of at least three dye-forming-coupler-containing light-sensitive silver halide emulsion layers contains the dye-forming coupler that forms the azomethine dye; and b) at least one of the light-insensitive hydrophilic colloid layers is a dye-forming-coupler-containing light-insensitive color-forming layer and the light-insensitive color-forming layer is adjacent to at least one dye-forming-coupler-containing light-sensitive silver halide emulsion layer.

(25) The image forming method according to the above item (22), characterized in that the support is a reflective support, the silver halide color photographic light-sensitive material contains the dye-forming coupler that forms the azomethine dye in an amount of 18 mass % or more but less than 100 mass % based on the total lipophilic components in a layer containing the dye-forming coupler, and as the lipophilic component, at least one compound represented by any of the formulae [S-I], [S-II], [S-III], [S-IV] and [S-V] is contained.

(26) The image forming method according to the above item (22), characterized in that the support is a reflective support, the silver halide color photographic light-sensitive material contains the dye-forming coupler that forms the azomethine dye in an amount of 18 mass % or more but less than 100 mass % based on the total lipophilic components in a layer containing the dye-forming coupler, and as the lipophilic component, at least one compound represented by any of the formulae [ST-I], [ST-II], [ST-III], [ST-IV] and [ST-V] is contained.

(27) The image forming method according to the above item (22), characterized in that the support is a reflective support, the silver halide color photographic light-sensitive material contains the dye-forming coupler that forms the azomethine dye in an amount of 18 mass % or more but less than 100 mass % based on the total lipophilic components in a layer containing the dye-forming coupler, and as the lipophilic component, at least one polymer soluble in an organic solvent is contained.

(28) The image forming method according to the above item (22), characterized in that the silver halide color photographic light-sensitive material contains at least one compound selected from a group consisting of the compounds represented by any of the formulae (Ph-1), (Ph-2), (E-1) to (E-3) and (TS-I) to (TS-VII), metal complexes and ultraviolet absorbents in an emulsion layer containing the dye-forming coupler that forms the azomethine dye, and a proportion of the dye-forming coupler that forms the azomethine dye to total lipophilic components in the emulsion layer containing the dye-forming coupler that forms the azomethine dye is from 18 mass % to 99 mass %.

(29) The image forming method according to the above item (22), characterized in that the silver halide color photographic light-sensitive material contains the dye-forming coupler that forms the azomethine dye in an amount of 18 mass % to 100 mass % based on total lipophilic components in a layer containing the dye-forrning coupler, and contains at least one compound represented by the formula (CMP) in at least one of the light-insensitive hydrophilic colloid layers.

(30) The image forming method according to any one of the above items (22) to (29), characterized in that a silver halide emulsion layer containing at least one dye-forming coupler that forms the azomethine dye has a coating amount of total dye-forming couplers in a range of 0.18 mmol/$m^2$ to 0.28 mmol/$m^2$ and a maximum optical reflection density of 2.0 or above at a maximum absorption wavelength of the dyes after dye formation.

(31) The image forming method according to any one of the above items (22) to (30), characterized in that a color development time in the development-processing is 30 seconds or below.

(32) The image forming method according to any one of the above items (22) to (31), characterized in that the exposure is performed for $1\times10^{-4}$ sec or below.

(33) The image forming method according to the above item (24), characterized in that the silver halide color photographic light-sensitive material has two or more light-insensitive hydrophilic colloid layers and meets the following condition c):

c) that the two or more light-insensitive hydrophilic colloid layers are composed of a non-color-forming interlayer containing a color-mixing inhibitor and a non-color-forming interlayer containing substantially no color-mixing inhibitor and the non-color-forming interlayer containing a color-mixing inhibitor is provided between and adjacent to the non-color-forming interlayer containing substantially no color-mixing inhibitor and a silver halide emulsion layer.

According to the present invention, a silver halide color photographic light-sensitive material and an image forming method, each of which can ensure excellent image preservability can be provided. Further, the present invention can provide a silver halide color photographic light-sensitive material and an image forming method, which each ensure compatibility between excellent rapid-processing suitability and image preservability.

According to the present invention, it is also possible to provide a silver halide color photographic light-sensitive material and an image forming method, which each ensure excellent color reproducibility and image preservability against light or heat. According to the present invention, it is further possible to provide a silver halide color photographic light-sensitive material and an image forming method each ensuring excellent rapid-processing suitability also.

By using the silver halide color photographic light-sensitive material and the image forming method of the present invention, it is possible to produce photographs, especially color prints, which have excellent color reproducibility and are excellent in image preservability against light or heat even when rapid processing is carried out.

In accordance with the present invention, images having high developed color densities and excellent image preservability can be provided even when ultra-rapid processing is carried out.

Other and further features and advantages of the invention will appear more fully from the following description.

BEST MODE FOR CARRYING OUT THE INVENTION

The present invention is described below in detail.

In the present invention, the silver halide color photographic light-sensitive material having on a support (e.g., a reflective support) at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer and at least one light-insensitive hydrophilic colloid layer, contains, as at least one of the dye-forming couplers, a dye-forming coupler that forms an azomethine dye having a solubility of $1\times10^{-8}$ mol/L to $5\times10^{-3}$ mol/L in ethyl acetate (hereinafter also referred to as "a dye slightly soluble in an organic solvent") by reaction with an oxidized aromatic primary amine compound.

The term "solubility" as used herein refers to the volume molarity (the quantity by mole of solute contained in 1,000 $cm^3$ of saturated solution) at ordinary temperatures (20 to 25° C., specifically 25° C.). It is preferable to determine the solubility according to general operating procedures, specifically including preparation of a saturated solution reaching dissolution equilibrium, separation of solid and liquid phases, and determination of solute in the liquid phase. More specific ways to determine solubility are described, e.g., in *Shin-Jikken Kagaku Koza* (New Courses in Experimental Chemistry), Maruzen Co., Ltd.

The preferable range of a solubility of the dye in ethyl acetate is from $1\times10^{-8}$ mol/L to $5\times10^{-3}$ mol/L, more preferably from $1\times10^{-8}$ mol/L to $2\times10^{-3}$ mol/L, further preferably from $1\times10^{-8}$ mol/L to $7\times10^{-4}$ mol/L, most preferably from $1\times10^{-6}$ mol/L to $2\times10^{-4}$ mol/L.

In the present invention, the dye-forming coupler that forms the dye slightly soluble in the organic solvent is preferably contained in an amount of 18 mass % to 100 mass % based on the total lipophilic components in a layer containing the coupler (a color-forming layer containing the coupler).

The term "lipophilic components" as used herein refers to a hydrophobic and organic-solvent-soluble composition specifically including a coupler, a high boiling organic solvent, a polymer insoluble in water and soluble in organic solvents, water-insoluble organic materials added for the purposes of image stabilization and prevention of color-mixing and stains, and the like. These lipophilic components composed of such an organic-solvent-soluble composition can be generally obtained as a dispersion of fine particles in a hydrophilic binder, such as gelatin. The coupler for forming the dye slightly soluble in the organic solvent according to the present invention is preferably contained in an amount of 18 mass % to 100 mass %, more preferably contained in an amount of 18 mass % to 90 mass %, most preferably contained in an amount of 24 mass % to 80 mass %, based on the total lipophilic components including the coupler. In another embodiment of the present invention, the dye-forming coupler that forms the dye slightly soluble in the organic solvent is preferably contained in an amount of from 18 mass % to 99 mass %, more preferably contained in an amount of from 18 mass % to 90 mass %, most preferably contained in an amount of from 24 mass % to 80 mass %, of lipophilic components in a light-sensitive silver halide emulsion layer (a color-forming layer) containing the coupler.

In a silver halide emulsion layer, the dye-forming coupler that forms the dye slightly soluble in the organic solvent can be used alone or in combination with other dye-forming coupler(s). When the said other dye-forming couplers are used in combination, a solubility of dyes formed from other dye-forming couplers in ethyl acetate are not particularly limited to the preferable range mentioned above. When all of the dye-forming couplers used in combination form the dyes slightly soluble in the organic solvent, they may be used at any ratio. On the other hand, when a solubility of the dyes formed from other dye-forming couplers in ethyl acetate used in combination fall outside the foregoing preferable range, the ratio between the total moles of these other dye-forming couplers (more than one coupler is allowable) and the total moles of the couplers that form the dyes slightly soluble in the organic solvent (more than one coupler is allowable) is preferably from 6:4 to 0:10, more preferably from 5:5 to 0:10, most preferably from 5:5 to 1:9.

As to the total coating amount of dye-forming couplers in a silver halide emulsion layer containing at least one dye-forming coupler that forms the dye slightly soluble in the organic solvent, the smaller the better from the viewpoint of reduction in layer thickness. On the other hand, the optical reflection density at a maximum absorption wavelength after dye-image formation (the maximum absorption wavelength of the dye formed from the dye-forming coupler forming the dye slightly soluble in the organic solvent) is preferably at least 1.8 or above (preferably from 1.8 to 2.6), more preferably 2.0 or above (preferably from 2.0 to 2.5), most preferably 2.1 or above (preferably from 2.1 to 2.4).

The specific coating amount of dye-forming couplers for achieving the reflection density as mentioned above is preferably from 0.16 mmol/$m^2$ to 0.30 mmol/$m^2$, more preferably from 0.18 mmol/$m^2$ to 0.28 mmol/$m^2$, most preferably from 0.19 mmol/$m^2$ to 0.26 mmol/$m^2$.

The dye-forming couplers that form the dyes slightly soluble in the organic solvent, though may be couplers having any structures, are preferably cyan-dye-forming couplers, more preferably couplers that form dyes having their absorption maximum wavelengths in a range of 570 nm to 700 nm, further preferably from 580 nm to 660 nm, in a photographic constituent layer at the time of image formation. Examples of such cyan-dye-forming couplers include couplers represented by formulae (CP-I), (CP-II) and (CP-III) illustrated hereinafter.

In the present invention, it is preferable that the melting points of the dyes slightly soluble in the organic solvent are higher than those of the couplers forming these dyes. Specifically, the melting points of the dyes slightly soluble in the organic solvent are preferably higher by at least 0° C., more preferably higher by at least 30° C., most preferably higher by at least 60° C., than those of the couplers.

The coupler represented by formula (CP-I) will be explained in detail.

Formula (CP-I)

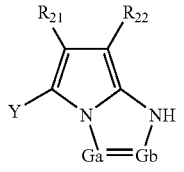

In the formula (CP-I), Ga represents —C($R_{23}$)= or —N=, Gb represents —C($R_{23}$)= when Ga represents —N=, or Gb represents —N= when Ga represents —C($R_{23}$)=. $R_{23}$ represents a substituent. Y represents a hydrogen atom or a group capable of being split-off upon a coupling reaction with an oxidized product of a developing agent. $R_2$, and $R_{22}$ each represent an electron attractive group of which the Hammett's substituent constant $\sigma_p$ value is 0.20 or more and 1.0 or less. It is preferable that the sum of each $\sigma_p$ value of $R_{21}$ and $R_{22}$ is 0.65 or more. The coupler to be used in the present invention has excellent ability as a cyan coupler by introducing such a strong electron-attractive group. The sum of each $\sigma_p$ value of $R_{21}$ and $R_{22}$ is more preferably 0.70 or more, and the upper limit of the sum is generally about 1.8.

In the present invention, $R_2$, and $R_{22}$ each are an electron attractive group of which the Hammett's substituent constant $\sigma_p$ value (hereinafter, referred to simply as "$\sigma_p$ value") is 0.20 or more and 1.0 or less. Preferably $R_2$, and $R_{22}$ are electron attractive group of which the $\sigma_p$ value is 0.30 or more and 0.8 or less. The Hammett rule is an empirical rule proposed by L. P. Hammett in 1935 to discuss quantitatively the influence of substituents on the reaction or equilibrium of benzene derivatives, and its validity is approved widely nowadays. The substituent constant determined with the Hammett rule includes $\sigma_p$ value and $\sigma_m$ value, and these values can be found in many general literatures. For example, such values are described in detail in e.g. "Lange's Handbook of Chemistry", 12th edition, (1979), edited by J. A. Dean (McGraw-Hill), "Kagaku No Ryoiki" (Region of Chemistry), extra edition, No. 122, pp. 96-103, (1979) (Nankodo), and "Chemical Reviews", Vol. 91, pp. 165-195, (1991). In the present invention, $R_{21}$ and $R_{22}$ are defined in terms of the Hammett substituent constant $\sigma_p$, but this does not mean that the substituent is limited to those having a value known in the literatures, which can be found in the above literatures; it is needless to say that even if the value is unknown in any literature, substituents which can have the value in the range if measured according to the Hammett rule are also included in the present invention.

Specific examples of the electron-attracting group $R_{21}$ and $R_{22}$ wherein the $\sigma_p$ value is 0.20 or more and 1.0 or less, include an acyl group, acyloxy group, carbamoyl group, aliphatic oxycarbonyl group, aryloxy carbonyl group, cyano group, nitro group, dialkyl phosphono group, diaryl phosphono group, diaryl phosphinyl group, alkyl sulfinyl group, aryl sulfinyl group, alkyl sulfonyl group, aryl sulfonyl group, sulfonyloxy group, acylthio group, sulfamoyl group, thiocyanate group, thiocarbonyl group, alkyl group substituted with at least two or more halogen atoms, alkoxy group substituted with at least two or more halogen atoms, aryloxy group substituted with at least two or more halogen atoms, alkylamino group substituted with at least two or more halogen atoms, alkylthio group substituted with at least two or more halogen atoms, aryl group substituted with another electron-attracting group with a $\sigma_p$ value of 0.20 or more, heterocyclic group, chlorine atom, bromine atom, azo group, and selenocyanate group. Among these substituents, those which can further have a substituent, may have the substituent such as those emplified as $R_{23}$ will be explained later.

It is to be noted that the aliphatic oxycarbonyl group may be provided with a straight-chain, branched or cyclic aliphatic moiety which may be saturated or may have an unsaturated bond. The aliphatic oxycarbonyl group includes alkoxycarbonyl, cycloalkoxycarbonyl, alkenyloxycarbonyl, alkynyloxycarbonyl and cycloalkenyloxycarbonyl, and the like.

Examples of the $\sigma_p$ value of typical electron attractive groups serving as 0.2 or more and 1.0 or less are as follows: bromine atom (0.23), chlorine atom (0.23), cyano group (0.66), nitro group (0.78), trifluoromethyl group (0.54), tribromomethyl group (0.29), trichloromethyl group (0.33), carboxyl group (0.45), acetyl group (0.50), benzoyl group (0.43), acetyloxy group (0.31), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60) and sulfamoyl group (0.57).

$R_{21}$ preferably represents a cyano group, an aliphatic oxycarbonyl group (which is a straight-chain or branched alkoxycarbonyl, aralkyloxycarbonyl, alkenyloxycarbonyl, alkynyloxycarbonyl, cycloalkoxycarbonyl or cycloalkenyloxycarbonyl group having 2 to 36 carbon atoms, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl or 2,6-di-t-butyl-4-methylcyclohexyloxycarbonyl), a dialkylphosphono group (which is a dialkylphosphono group having 2 to 36 carbon atoms, e.g., diethylphosphono or dimethylphosphono), an alkyl- or aryl-sulfonyl group (which is an alkyl- or aryl-sulfonyl group having 1 to 36 carbon atoms, e.g., methanesulfonyl group, butanesulfonyl group, benzenesulfonyl group or p-toluenesulfonyl group) or a fluorinated alkyl group (which is a fluorinated alkyl group having 1 to 36 carbon atoms, e.g., trifluoromethyl). $R_{21}$ is particularly preferably a cyano group, aliphatic oxycarbonyl group or fluorinated alkyl group.

$R_{22}$ preferably represents an aliphatic oxycarbonyl group such as those exemplified as $R_{21}$, carbamoyl group (which is a carbamoyl group having 1 to 36 carbon atoms, e.g., diphenylcarbamoyl or dioctylcarbamoyl), sulfamoyl group (which is a sulfamoyl group having 1 to 36 carbon atoms, e.g., dimethylsulfamoyl or dibutylsulfamoyl), dialkylphosphono group such as those exemplified as $R_{21}$, or diarylphosphono group (which is a diarylphosphono group having 12 to 50 carbon atoms, e.g., diphenylphosphono or di(p-toluyl) phosphono).

$R_{23}$ is preferably a substituent selected from an aliphatic group, aryl group, alkoxy group, aryloxy group, amino group, acylamino group, arylthio group, alkylthio group, ureido group, alkoxycarbonylamino group, carbamoyloxy group and heterocyclic thio group. These groups may be substituted with a substituent. $R_{23}$ is more preferably an aliphatic group (preferably an alkyl group or aralkyl group), aryl group, alkoxy group or acylamino group. These groups may be substituted with a substituent.

Y is preferably a hydrogen atom, halogen atom, aryloxy group, heterocyclic acyloxy group, dialkylphosphonooxy group, arylcarbonyloxy group, arylsulfonyloxy group, alkoxycarbonyloxy group or carbamoyloxy group. Further, the split-off group (releasing group) or a compound released from the split-off group preferably has the property of further reacting with an oxidized developing agent (preferably an oxidized aromatic primary amine color-developing agent). Examples of the split-off group include non-color-forming couplers, hydroquinone derivatives, aminophenol derivatives and sulfonamidophenol derivatives.

The coupler represented by formula (CP-1) is preferably represented by the following formula (CP-II).

Formula (CP-II)

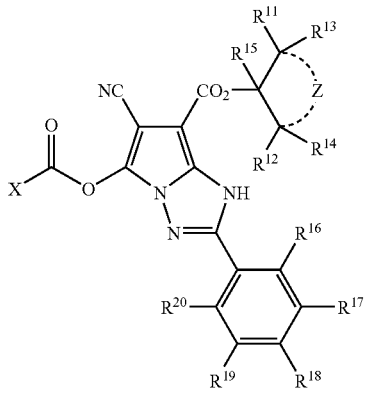

In formula (CP-II), $R^{11}$, $R^{12}$, $R^{13}$, $R^{14}$ and $R^{15}$ may be the same or different from each other, and each represent a hydrogen atom or a substituent. Z represents nonmetal atoms required to form a ring structure together with the carbon atoms on both ends and the nonmetal atoms constituting Z may have a substituent. X represents a hydrogen atom or a substituent. $R^{16}$, $R^{19}$ and $R^{20}$ may be the same or different from each other, and each represent a hydrogen atom or a substituent. $R^{17}$ represents an acylamino group, a substituted or unsubstituted amino group, an alkoxycarbonylamino group, a ureido group, or a nitrogen-containing heterocyclic group which binds via its nitrogen atom. $R^{18}$ represents an alkoxy group, an alkylthio group, an aryloxy group, an arylthio group, an acylamino group, a substituted or unsubstituted amino group, an alkoxycarbonylamino group, a ureido group, or a nitrogen-containing heterocyclic group binding via its nitrogen atom. $R^{16}$ and $R^{17}$, $R^{17}$ and $R^{18}$, $R^{18}$ and $R^{19}$, or $R^{19}$ and $R^{20}$ may combine with each other to form a 5- to 8-membered ring.

The coupler represented by formula (CP-II) is described below in detail.

In formula (CP-II), $R^{11}$, $R^{12}$, $R^{13}$, $R^{14}$ and $R^{15}$, which may be the same or different from each other, and each represent a hydrogen atom or a substituent. The substituent may be any group so long as it can substitute for a hydrogen atom on the carbon skeleton, and it is preferably a substituted or unsubstituted aliphatic group or a substituted or unsubstituted aryl group. Of these groups, more preferable examples are as follows:

$R^{11}$ and $R^{12}$ preferably represent an aliphatic group, such as straight-chain, branched or cyclic alkyl group, aralkyl group, alkenyl group, alkynyl group, cycloalkyl group and cycloalkenyl group having 1 to 36 carbon atoms, specifically, for example, methyl, ethyl, propyl, isopropyl, t-butyl, t-amyl, t-octyl, tridecyl, cyclopentyl and cyclohexyl. The number of carbon atoms in the aliphatic group is more preferably 1 to 12.

$R^{13}$, $R^{14}$ and $R^{15}$ preferably represent a hydrogen atom or an aliphatic group. The aliphatic group includes the groups mentioned above for $R^{11}$ and $R^{12}$. $R^{13}$, $R^{14}$ and $R^{15}$ are particularly preferably a hydrogen atom.

In formula (CP-II), Z represents a group of non-metallic atoms necessary for forming a ring structure together with the carbon atoms on both end, and this ring may be further substituted. The ring completed by Z is preferably a 5- to 8-membered ring, and it may be a saturated ring or may contain an unsaturated bond. The non-metallic atom is preferably a nitrogen atom, oxygen atom, sulfur atom or carbon atom, more preferably a carbon atom.

The ring formed with Z includes e.g. a cyclopentane ring, cyclohexane ring, cycloheptane ring, cyclooctane ring, cyclohexene ring, piperazine ring, oxane ring, thian ring or the like, and these rings may be further substituted.

The ring formed with Z is preferably a cyclohexane ring which may be substituted, particularly preferably a cyclohexane ring which is substituted at the 4-position with an alkyl group having 1 to 24 carbon atoms (which may be substituted).

In formula (CP-II), X represents a hydrogen atom or a substituent. The substituent is preferably a group accelerating the split-off of the group X—C(═O)O— at the time of oxidation coupling reaction. X is particularly preferably a heterocyclic group, a substituted or unsubstituted amino group or an aryl group. The heterocyclic group is preferably a 5- to 8-membered ring having 1 to 36 carbon atoms and containing a nitrogen atom, an oxygen atom or a sulfur atom. More preferably, it is a 5- or 6-membered ring bound via a nitrogen atom, among which the 6-membered ring is particularly preferable. These rings may form a condensed ring with a benzene ring or heterocycle. Examples thereof include imidazole, pyrazole, triazole, lactam compounds, piperidine, pyrrolidine, pyrrole, morpholine, pyrazoline, thiazolidine, pyrazoline and compounds formed by substitution of substitutable groups for hydrogen atoms in those compounds. Examples of a substituent preferable for such substitution include an alkyl group, an alkenyl group, an acylamino group, an alkylsulfonamido group, an arylsulfonamido group, and the like. The preferable substituent on the substituted amino group includes an aliphatic group, aryl group or heterocyclic group. The substituted amino group is substituted more preferably with two substituents than one substituent. The aliphatic group may be linear, branched or cyclic in structure, and examples thereof include an alkyl group, an aralkyl group, an alkenyl group, an alkynyl group, a cycloalkyl group and a cycloalkenyl group, which each contain no more than 36 carbon atoms and may be further substituted with a cyano group, an alkoxy group (e.g., methoxy), an alkoxycarbonyl group (e.g., ethoxycarbonyl), a halogen atom (e.g., chlorine), a hydroxyl group or a carboxyl group. The aryl group is preferably a group having 6 to 36 carbon atoms, more preferably a monocycle. Specific examples include phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl, 2,4-dichlorophenyl, and the like.

X is particularly preferably a di-substituted amino group having an alkoxycarbonyl-substituted aliphatic group.

In formula (CP-II), $R^{16}$, $R^{19}$ and $R^{20}$ each represent a hydrogen atom or a substituent. Each of $R^{16}$, $R^{19}$ and $R^{20}$ is preferably a hydrogen atom, a halogen atom, an alkyl group, an aryl group, a heterocyclic group, an alkoxy group, a cyano group, a nitro group, an acylamino group, an alkylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclyloxy group, an acyloxy group, a carbamoyloxy group, an aryloxycarbonylamino group, an imido group, a heterocyclylthio group, a sulfinyl group, a phosphonyl group, or an azolyl group. Of the above-recited ones, a hydrogen atom, an alkyl group, a halogen atom, an aryl group, a heterocyclic group, an alkoxy group, a cyano group, an acylamino group, an alkylamino group, an arylamino group, a ureido group, a sulfamoylamino group, an alkoxycarbonylamino group, a sulfonamido group, a carbamoyl group, a sulfamoyl group, a sulfonyl group, an alkoxycarbonyl group, an aryloxycarbonylamino group, an imido group and a phosphonyl group are preferable to the others, and a hydrogen atom, an alkyl group, an alkoxy group, an acylamino group and an alkoxycarbonylamino group are far preferred. Above all, a hydrogen atom is particularly preferable for each of $R^{16}$, $R^{19}$ and $R^{20}$.

In formula (CP-II), $R^{17}$ is an acylamino group (preferably an acylamino group having 2 to 36 carbon atoms, which may have a substituent, such as acetamido, t-butylamido, benzamido, tetradecanamido, 2-(2,4-di-t-amylphenoxy)butanamido, 4-(3-t-butyl-4-hydroxyphenoxy)butanamido or 2-{4-(4-hydroxyphenylsulfonyl)phenoxy}decanamido), a substituted or unsubstituted amino group (preferably an alkylamino group having 1 to 36 carbon atoms, which may have a substituent, such as methylamino, butylamino, dodecylamino, diethylamino or N-methyl-N-butylamino, or an anilino group having 6 to 36 carbon atoms, which may have a substituent, such as phenylamino, 2-chloroanilino, 2-chloro-5-tetradecanamidoanilino, 2-chloro-5-dodecyloxycarbonylanilino, N-methylanilino or 2-chloro-5-{2-(3-t-butyl-4-hydroxyphenoxy)dodecanamido}anilino), an alkoxycarbonylamino group (preferably an alkoxycarbonylamino group having 1 to 36 carbon atoms, which may have a substituent, such as methoxycarbonylamino), a ureido group (preferably a ureido group having 1 to 36 carbon atoms, which may have a substituent, such as 3,3-dimethylureido), or a nitrogen-containing heterocyclic group which binds via its nitrogen atom (preferably a 5- to 8-membered nitrogen-containing heterocyclic group which may have a substituent, such as 1-pyrrolidinyl, 1-piperidyl, 1-piperazinyl, 4-morpholinyl or indolinyl).

$R^{17}$ is preferably an acylamino group or a nitrogen-containing heterocyclic group which binds via its nitrogen atom, more preferably an acylamino group.

In formula (CP-II), $R^{18}$ is an alkoxy group (preferably an alkoxy group having 1 to 36 carbon atoms, which may have a substitutent, such as methoxy or ethoxy), an alkylthio group (preferably an alkylthio group having 1 to 36 carbon atoms, which may have a substituent, such as methylthio), an aryloxy group (preferably an aryloxy group having 6 to 36 carbon atoms, which may have a substituent, such as phenoxy), an arylthio group (preferably an arylthio group having 6 to 36 carbon atoms, which may have a substituent, such as phenylthio), an acylamino group (preferably an acylamino group having 2 to 36 carbon atoms, which may have a substituent, such as acetamido, t-butylamido, benzamido, tetradecanamido, 2-(2,4-di-t-amylphenoxy)butanamido, 4-(3-t-butyl-4-hydroxyphenoxy)butanamido or 2-{4-(4-hydroxyphenylsulfonyl)phenoxy}decanamido), a substituted or unsubstituted amino group (preferably an akylamino group having 1 to 36 carbon atoms, which may have a substituent, such as methylamino, butylamino, dodecylamino, diethylamino or N-methyl-N-butylamino, or an anilino group having 6 to 36 carbon atoms, which may have a substituent, such as phenylamino, 2-chloroanilino, 2-chloro-5-tetradecanamidoanilino, 2-chloro-5-dodecyloxycarbonylanilino, N-methylanilino or 2-chloro-5-{2-(3-t-butyl-4-hydroxyphenoxy) dodecanamido}anilino), an alkoxycarbonylamino group (preferably an alkoxycarbonylamino group having 1 to 36 carbon atoms, which may have a substituent, such as methoxycarbonylamino), a ureido group (preferably a ureido group having 1 to 36 carbon atoms, which may have a substituent, such as 3,3-dimethylureido), or a nitrogen-containing heterocyclic group which binds via its nitrogen atom (preferably a 5- to 8-membered nitrogen-containing heterocyclic group which may have a substituent, such as 1-pyrrolidinyl, 1-piperidyl, 1-piperazinyl, 4-morpholinyl or indolinyl).

$R^{18}$ is preferably an alkoxy group, an aryloxy group or an amino group, more preferably an alkoxy group.

In formula (CP-II), $R^{16}$ and $R^{17}$, $R^{17}$ and $R^{18}$, $R^{18}$ and $R^{19}$, or $R^{19}$ and $R^{20}$ may combine with each other to form a 5- to 8-membered ring (which fuses with the benzene ring to form, e.g., an indoline ring or a tetrahydronaphthalene ring).

The coupler represented by formula (CP-II) is far preferably represented by the following formula (CP-III).

Formula (CP-III)

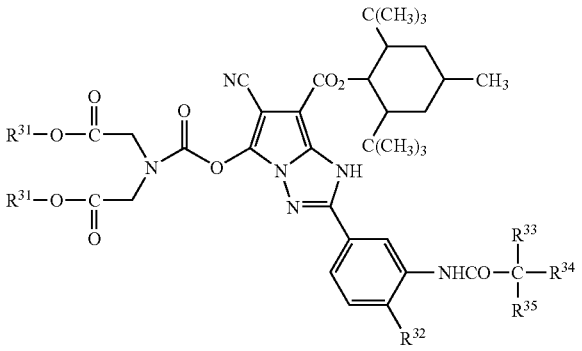

In formula (CP-III), $R^{31}$ represents an alkyl group. $R^{32}$ represents an alkoxy group. $R^{33}$, $R^{34}$ and $R^{35}$ each represent a hydrogen atom or an alkyl group. When $R^{33}$ and $R^{34}$ are each an alkyl group, they may combine with each other to form a 3- to 6-membered ring.

The coupler represented by formula (CP-III) is described below in detail.

In formula (CP-I), $R^{31}$ represents an alkyl group (preferably an alkoxy group having 1 to 36 carbon atoms, which may have a substituent, such as methyl or ethyl). $R^{31}$ is more preferably an ethyl group. $R^{32}$ represents an alkoxy group (preferably an alkoxy group having 1 to 36 carbon atoms, which may have a substituent, such as methoxy or ethoxy). $R^{32}$ is more preferably a methoxy group.

$R^{33}$, $R^{34}$ and $R^{35}$ each represent a hydrogen atom or an alkyl group (preferably an alkyl group having 1 to 36 carbon atoms, which may have a substituent, such as methyl, ethyl or chloromethyl). $R^{33}$, $R^{34}$ and $R^{35}$ each are more preferably a methyl group.

When $R^{33}$ and $R^{34}$ in formula (CP-III) are each an alkyl group, it is also preferable that they combine with each other to from a 3- to 6-membered ring (e.g., a cyclopropyl ring).

Specific examples of the coupler represented by formula (CP-III) according to the present invention (Exemplified Compounds CP-(1) to CP-(10)) are illustrated below, but these examples should not be construed as limiting the scope of the present invention in any way.

CP-(1)
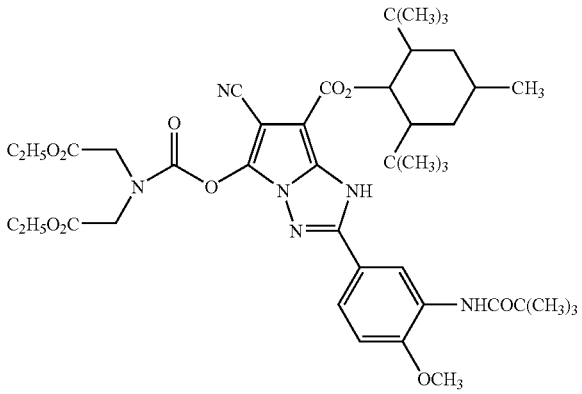
CP-(2)
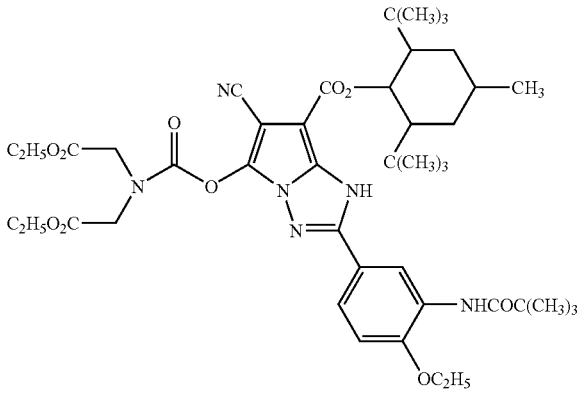
CP-(3)
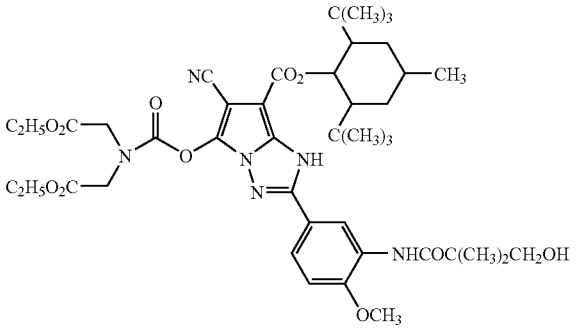
CP-(4)
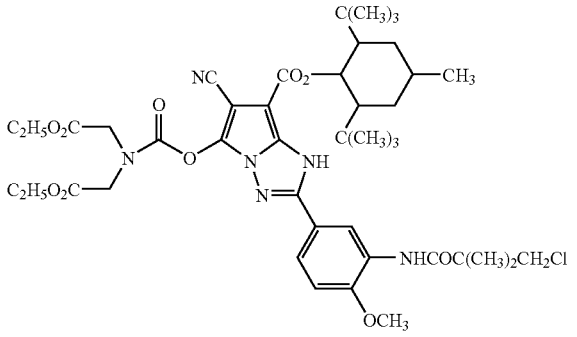
-continued
CP-(5)
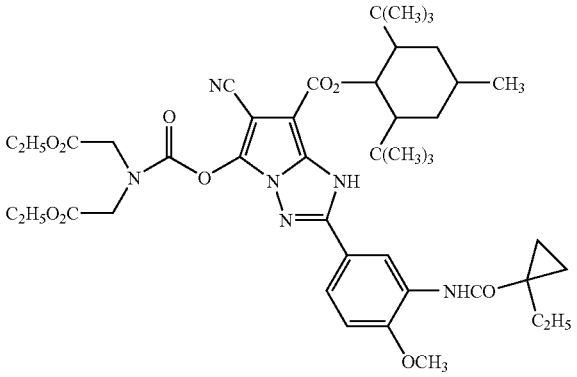
CP-(6)
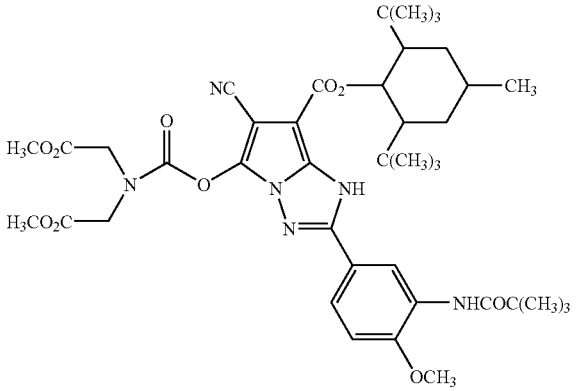
CP-(7)
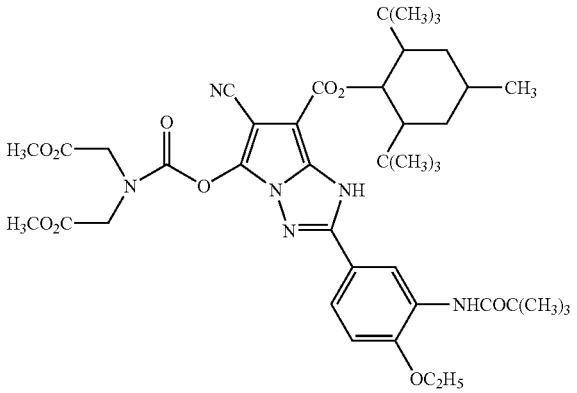
CP-(8)
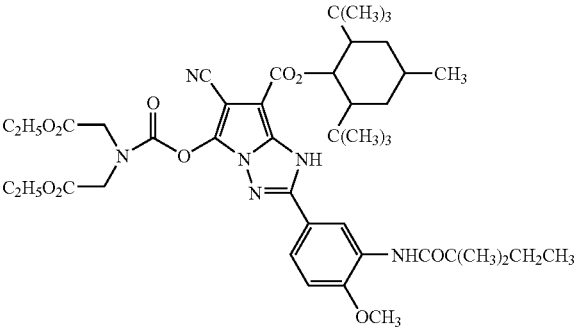

-continued

CP-(9)

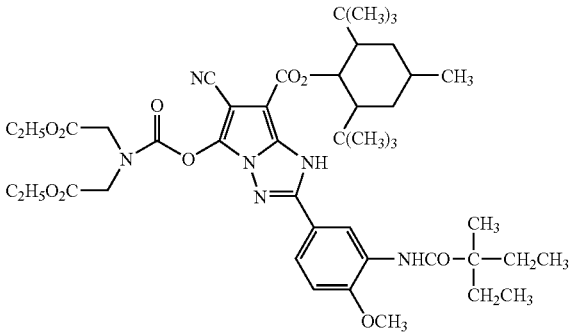

CP-(10)

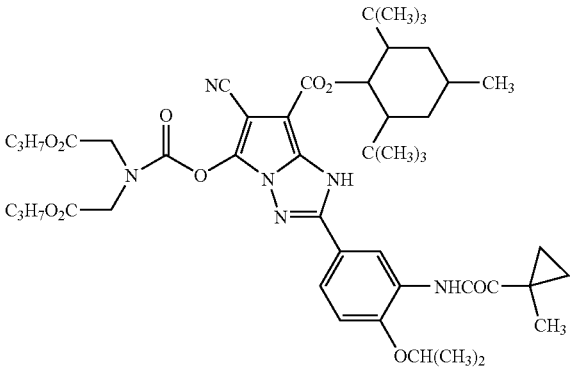

Dye-forming couplers represented by formula (CP-1) can be easily synthesized in accordance with the methods disclosed in JP-A-2001-342189 and JP-A-2002-287311, or methods conforming thereto.

It is preferable that the dye-forming couplers represented by formula (CP-I) be coated in an amount of generally 0.01 to 1 g/m$^2$, preferably 0.05 to 0.4 g/m$^2$, more preferably 0.1 to 0.3 g/m$^2$.

In the present invention, though any of high boiling organic solvents can be used as a solvent for the couplers forming the dyes slightly soluble in the organic solvent, the compounds (high boiling organic solvents) represented by any of the foregoing formulae [S-I] to [S-V] are preferably used as the coupler solvent. In the following, the compound (a high-boiling-point organic solvent) represented by any one of the formula [S-I] to [S-VI], will be explained in detail.

First, the high-boiling-point organic solvent, which is represented by the formula [S-I], will be explained.

In the formula [S-I], $Rs_1$, $Rs_2$, and $Rs_3$ each independently represent an alkyl group, a cycloalkyl group, an alkenyl group, or an aryl group, these groups each may further have a substituent, with the proviso that the total of the carbon atoms of the groups represented by $Rs_1$, $Rs_2$, and $Rs_3$ is 12 to 60, or at least one of $Rs_1$, $Rs_2$ and $Rs_3$ represents a linking group via which at least two molecules of the compound combine to form a dimer or a multimer whose order is higher than two.

The alkyl group is preferably a straight-chain or branched alkyl group having 1 to 32 carbon atoms. These alkyl groups include those having a substituent(s). Examples of the alkyl group include a straight-chain or branched butyl group, hexyl group, octyl group, dodecyl group, octadecyl group, and other groups. Among the alkyl groups, particularly preferred are those having 4 to 18 carbon atoms, and further preferred are those having 6 to 12 carbon atoms.

Examples of the cycloalkyl group include a cyclopentyl group, a cyclohexyl group, a cycloheptyl group, and other groups. These cycloalkyl groups include those having a substituent(s). Among the cycloalkyl groups, a cyclohexyl group is particularly preferable.

Examples of the alkenyl group include a butenyl group, a pentenyl group, a hexenyl group, a heptenyl group, an octenyl group, a decenyl group, a dodecenyl group, an octadecenyl group and other groups. These alkenyl groups include those having a substituent(s).

Examples of the aryl group include a phenyl group, a naphthyl group, and other groups. These groups include those having a substituent(s). Specific examples of the aryl group include phenyl, p-cresyl, m-cresyl, o-cresyl, p-chlorophenyl, p-t-butyl-phenyl, and other groups.

Specific examples of the high-boiling-point organic solvent represented by the formula [S-I] will be shown below, but the present invention should not be considered to be limited thereto.

| No. | $R_{S1}$ | $R_{S2}$ | $R_{S3}$ |
|---|---|---|---|
| S-I-1 | $-C_6H_{13}$ | $-C_6H_{13}$ | $-C_6H_{13}$ |
| S-I-2 | $-C_8H_{17}$ | $-C_8H_{17}$ | $-C_8H_{17}$ |
| S-I-3 | $-C_{12}H_{25}$ | $-C_{12}H_{25}$ | $-C_{12}H_{25}$ |
| S-I-4 | $-C_4H_9$ | $-C_8H_{17}$ | $-C_8H_{17}$ |
| S-I-5 | $-CH(CH_3)C_5H_{11}$ | $-CH(CH_3)C_5H_{11}$ | $-CH(CH_3)C_5H_{11}$ |
| S-I-6 | $-CH_2CH(CH_2)_3CH_3$ ($CH_2CH_3$) | $-CH_2CH(CH_2)_3CH_3$ ($CH_2CH_3$) | $-CH_2CH(CH_2)_3CH_3$ ($CH_2CH_3$) |
| S-I-7 | 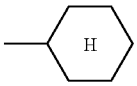 | 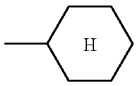 | 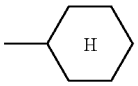 |

-continued
| No. | $R_{S1}$ | $R_{S2}$ | $R_{S3}$ |
|---|---|---|---|
| S-I-8 | 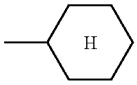 | $—C_6H_{13}$ | $—C_6H_{13}$ |
| S-I-9 | $—C_8H_{16}CH{=}CHC_8H_{17}$ | $—C_8H_{16}CH{=}CHC_8H_{17}$ | $—C_8H_{16}CH{=}CHC_8H_{17}$ |
| S-I-10 | 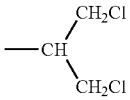 | 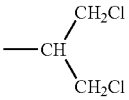 | 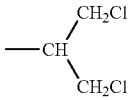 |
| S-I-11 | $—CH_2CH_2OC_4H_9$ | $—CH_2CH_2OC_4H_9$ | $—CH_2CH_2OC_4H_9$ |
| S-I-12 | 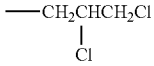 | 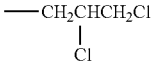 | 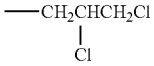 |
| S-I-13 | 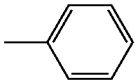 | 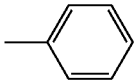 | 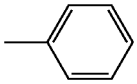 |
| S-I-14 | 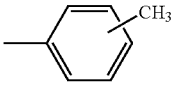 | 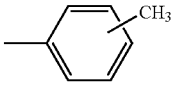 | 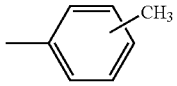 |
| S-I-15 | 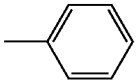 | 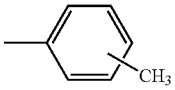 | 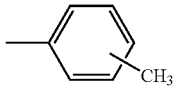 |
| S-I-16 | 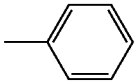 | 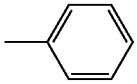 | 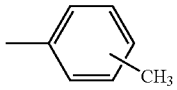 |
| S-I-17 | 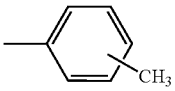 | 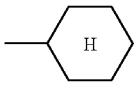 | 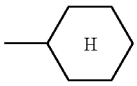 |
| S-I-18 | 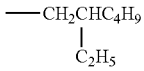 | 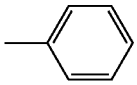 | 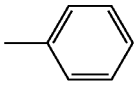 |
| S-I-19 | 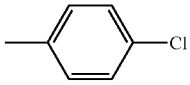 | 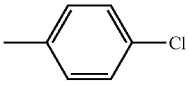 | 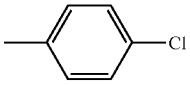 |
| S-I-20 | 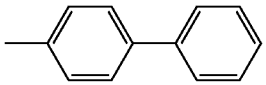 | 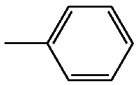 | 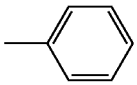 |
| S-I-21 | 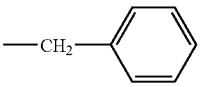 | 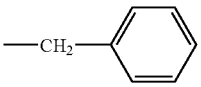 | 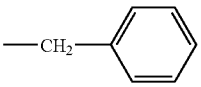 |
| S-I-22 | 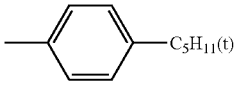 | 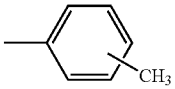 | 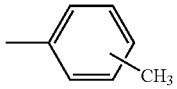 |
| S-I-23 | 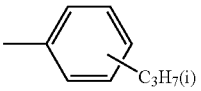 | 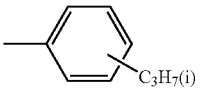 | 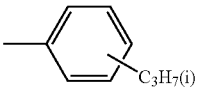 |

-continued

| No. | $R_{S1}$ | $R_{S2}$ | $R_{S3}$ |
|---|---|---|---|
| S-I-24 | 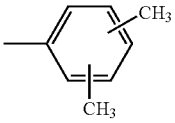 | 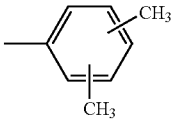 | 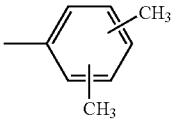 |
| S-I-25 | 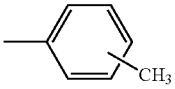 | 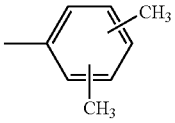 | 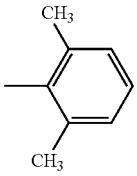 |
| S-I-26 | 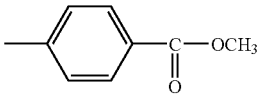 | 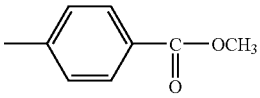 | 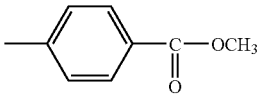 |
| S-I-27 | 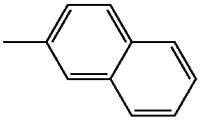 | 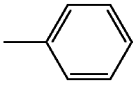 | 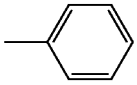 |
| S-I-28 | 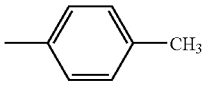 | 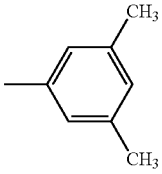 | 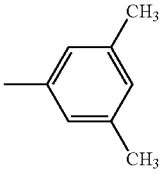 |
| S-I-29 | 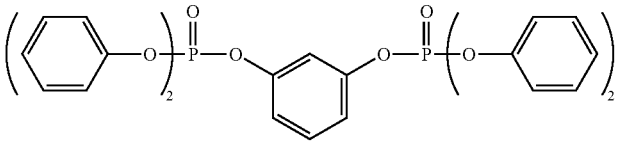 | | |
| S-I-30 | 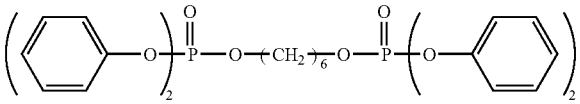 | | |

The high boiling point organic solvents represented by the formula [S-I] include phosphoric ester-based compounds described, for example, in JP-B-48-32727 ("JP-B" means examined Japanese patent publication), JP-A-53-13923, JP-A-54-119235, JP-A-54-119921, JP-A-59-119922, JP-A-55-25057, JP-A-55-36869, JP-A-56-81836, and the like. The high boiling point organic solvents can be synthesized according to the methods described in these official gazettes.

Next, the high boiling point organic solvent, which is represented by the formula [S-II], will be explained.

In the formula [S-II], $Rs_4$ represents a linking group having no aromatic group, which linking group is bivalent in the case where sm is 2, trivalent in the case where sm is 3, tetravalent in the case where sm is 4, and pentavalent in the case where sm is 5.

The linking group may be straight-chain, branched, or cyclic. The linking group may also have an unsaturated bond.

Examples of the linking group include an alkylidene group, a cycloalkylidene group, an alkylene group, a cycloalkylene group, an alkenylene group, a cycloalkenylene group, an alkanetriyl group, a cycloalkanetriyl group, an alkenetriyl group, a cycloalkenetriyl group, an alkanetetrayl group, a cycloalkanetetrayl group, an alkenetetrayl group, a cycloalkenetetrayl group, an alkanepentayl group, a cycloalkanepentayl group, an alkenepentayl group, and a cycloalkenepentayl group. Specific examples of these groups include methylene, ethylidene, isopropylidene, cyclohexylidene, ethylene, ethylethylene, propylene, trimethylene, tetramethylene, pentamethylene, hexamethylene, heptamethylene, octamethylene, undecamethylene, 2,2-dimethyltrimethylene, 1,2-cyclohexylene, 1,4-cyclohexylene, 3,4-epoxycyclohexane-1,2-ylene, 3,8-tricyclo[5.2.1.$0^{2,6}$]decylene, vinylene, propenylene, 4-cyclohexene-1,2-ylene, 2-pentenylene, 4-propyl-2-octenylene, 1,2,3-propanetriyl, 1,2,4-butanetriyl, 2-hydroxy-1,2,3-propanetriyl, 2-acetyloxy-1,2,3-propanetriyl, 1,5,8-octanetriyl, 1,2,3-propenetriyl, 2-propene-1,2,4-triyl, 2,6-octadiene-1,4,8-triyl, 1,2,3,4-butanetetrayl, 1,3-propanediyl-2-ylidene, 1,3,5,8-octanetetrayl, 1-butene-1,2,3,4-tetrayl, 3-octene-1,3,5,8-tetrayl, 1,2,3,4,5-pentanepentayl, 1,2,3,5,6-hexanepentayl, 2-pentene-1,2,3,4,5-pentayl, and 3,5-decadiene-1,2,3,9,10-pentayl.

Sm represents an integer of 2 to 5, preferably 2 or 3, more preferably 2. In the case where sm is 2 or more, the plural —$COORs_5$s may be the same or different from each other.

$Rs_5$ represents an alkyl group (number of carbon atoms is preferably 1 to 20), a cycloalkyl group (number of carbon atoms is preferably 3 to 20), an alkenyl group (number of carbon atoms is preferably 2 to 20), or an alkyl group (number of carbon atoms is preferably 2 to 20), each having 20 or less carbon atoms. Specific examples of $Rs_5$ are straight-chain or branched alkyl groups or cycloalkyl groups such as methyl, ethyl, n-butyl, pentyl, neopentyl, hexyl, cyclohexyl, octenyl, 2-ethylhexyl, decyl, dodecyl, hexadecyl, and eicosanyl; alkenyl groups such as 2-butenyl, 2-pentenyl, 2-nonyl-2-butenyl, and 1,2,5-octadienyl; and alkynyl groups such as 2-propynyl, 2-pentene-4-ynyl, and octane-5-ynyl. The groups represented by $Rs_5$ are alkyl groups, preferably.

$Rs_4$ and $Rs_5$ may each have a further substituent. Preferred examples of the substituent include an alkoxy group, an aryloxy group, an epoxy group, a hydroxyl group, an acyloxy group, an aryl group, an alkylthio group, an arylthio group, an acyl group, an acylamino group, a halogen atom and the like, more preferably an alkoxy group (e.g. methoxy, butoxy, butoxyethoxy), an epoxy group, a hydroxyl group, an acyloxy group (e.g. acetyloxy, propionyloxy, cyclohexanoyloxy) and a halogen atom (e.g. fluorine atom).

Hereinafter, specific examples of the high boiling point organic solvent represented by formula [S-II] will be shown, but the present invention should not be considered to be limited thereto.

S-II-1

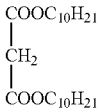

S-II-2

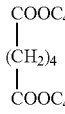

S-II-3

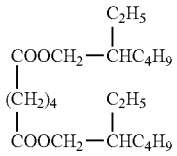

S-II-4

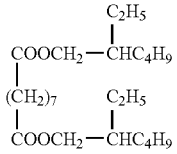

S-II-5

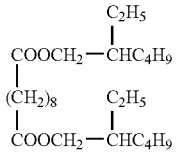

-continued

S-II-6

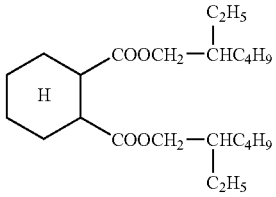

S-II-7

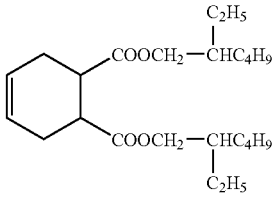

S-II-8

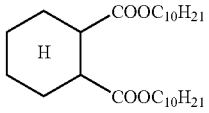

S-II-9

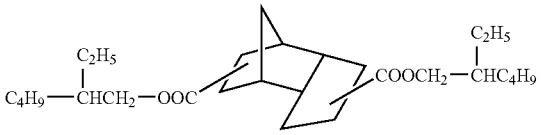

S-II-10

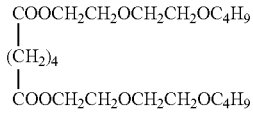

S-II-11

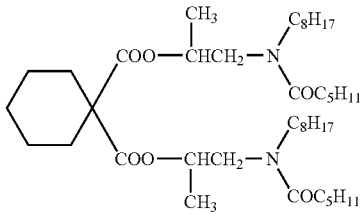

S-II-12

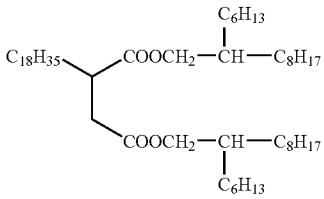

S-II-13

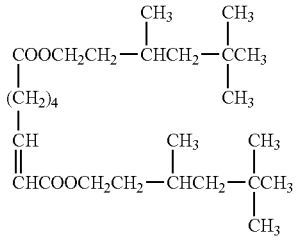

S-II-14

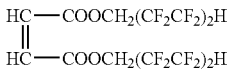

-continued

S-II-15

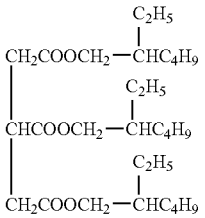

S-II-16

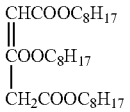

S-II-17

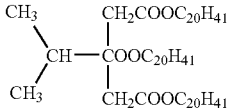

S-II-18

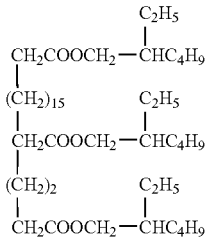

S-II-19

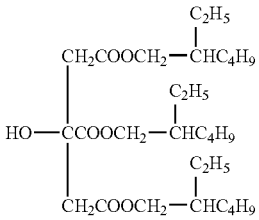

S-II-20

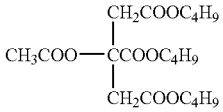

S-II-21

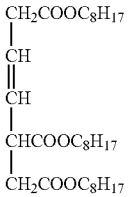

S-II-22

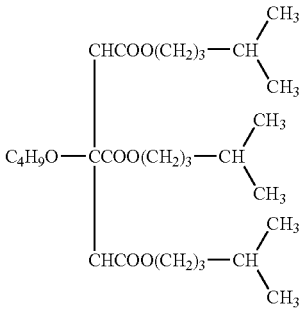

-continued

S-II-23

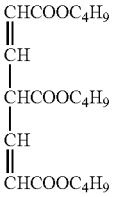

S-II-24

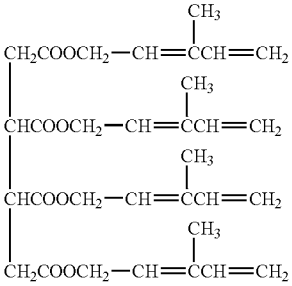

S-II-25

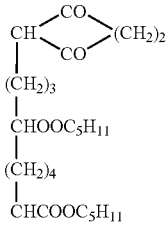

S-II-26

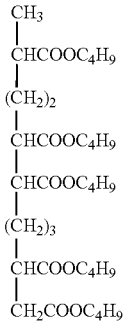

S-II-27

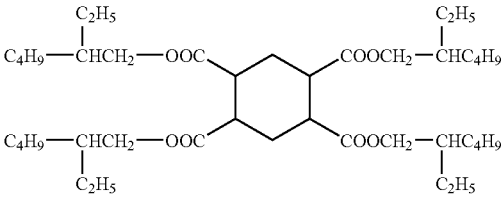

Next, the high boiling point organic solvent, which is represented by the formula [S-III], will be explained in detail.

In the formula [S-III], $Rs_6$ represents a linking group, which linking group is bivalent in the case where sn is 2, trivalent in the case where sn is 3, tetravalent in the case where sn is 4, and pentavalent in the case where sn is 5.

The linking group may be straight-chain, branched, or cyclic. The linking group may also have an unsaturated bond.

The above liking group is preferably one having no aromatic group. Examples of the linking group include an alkylidene group, a cycloalkylidene group, an alkylene group, a cycloalkylene group, an alkenylene group, a cycloalkenylene group, an alkanetriyl group, a cycloalkanetriyl group, an alkenetriyl group, a cycloalkenetriyl group, an alkanetetrayl group, a cycloalkanetetrayl group, an alkenetetrayl group, a cycloalkenetetrayl group, an alkanepentayl group, a cycloalkanepentayl group, an alkenepentayl group, and a cycloalkenepentayl group.

Specific examples of these groups include methylene, ethylidene, isopropylidene, cyclohexylidene, ethylene, ethylethylene, propylene, trimethylene, tetramethylene, pentamethylene, hexamethylene, heptamethylene, octamethylene, undecamethylene, 2,2-dimethyltrimethylene, 1,2-cyclohexylene, 1,4-cyclohexylene, 3,4-epoxycyclohexane-1,2-ylene, 3,8-tricyclo[5.2.1.0$^{2,6}$]decylene, vinylene, propenylene, 4-cyclohexene-1,2-ylene, 2-pentenylene, 4-propyl-2-octenylene, 1,2,3-propanetriyl, 1,2,4-butanetriyl, 2-hydroxy-1,2,3-propanetriyl, 2-acetyloxy-1,2,3-propanetriyl, 1,5,8-octanetriyl, 1,2,3-propenetriyl, 2-propene-1,2,4-triyl, 2,6-octadiene-1,4,8-triyl, 1,2,3,4-butanetetrayl, 1,3-propanediyl-2-ylidene, 1,3,5,8-octanetetrayl, 1-butene-1,2,3,4-tetrayl, 3-octene-1,3,5,8-tetrayl, 1,2,3,4,5-pentanepentayl. 1,2,3,5,6-hexanepentayl, 2-pentene-1,2,3,4,5-pentayl, and 3,5-decadiene-1,2,3,9,10-pentayl.

sn represents an integer of 2 to 5, preferably 2 or 3, more preferably 2. In the case where sn is 2 or more, the plural —OCORs$_7$s may be the same or different from each other.

Rs$_7$ represents an alkyl group (number of carbon atoms is preferably 1 to 20), a cycloalkyl group (number of carbon atoms is preferably 3 to 20), an alkenyl group (number of carbon atoms is preferably 2 to 20), or an alkynyl group (number of carbon atoms is preferably 2 to 20), each having 20 or less carbon atoms. Specific examples of Rs$_7$ are straight-chain or branched alkyl groups or cycloalkyl groups such as methyl, ethyl, n-butyl, pentyl, neopentyl, hexyl, cyclohexyl, octenyl, 2-ethylhexyl, decyl, dodecyl, hexadecyl, and eicosanyl; alkenyl groups such as 2-butenyl, 2-pentenyl, 2-nonyl-2-butenyl, and 2,5-octadienyl; and alkynyl groups such as 2-propynyl, 2-pentene-4-ynyl, and octane-5-ynyl. The groups represented by Rs$_7$ are alkyl groups, preferably.

Rs$_6$ and Rs$_7$ may each have a further substituent. Preferred examples of the substituent include an alkoxy group, an aryloxy group, an epoxy group, a hydroxyl group, an acyloxy group, an aryl group, an alkylthio group, an arylthio group, an acyl group, an acylamino group, a ketone group, a halogen atom and the like, more preferably an alkoxy group (e.g. methoxy, butoxy, butoxyethoxy), an epoxy group, a hydroxyl group, an acyloxy group (e.g. acetyloxy, propionyloxy, cyclohexanoyloxy) and a halogen atom (e.g. fluorine atom).

Hereinafter, specific examples of the high boiling point organic solvent represented by formula [S-III] will be shown, but the present invention should not be considered to be limited thereto.

S-III-1

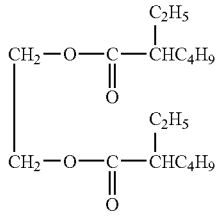

-continued

S-III-2

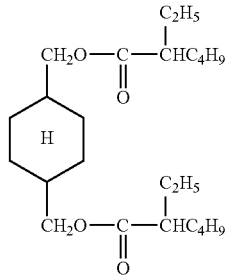

S-III-3

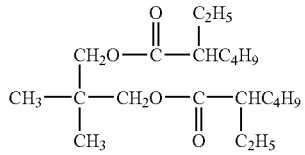

S-III-4

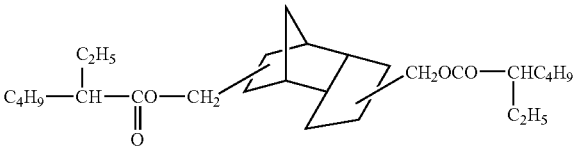

S-III-5

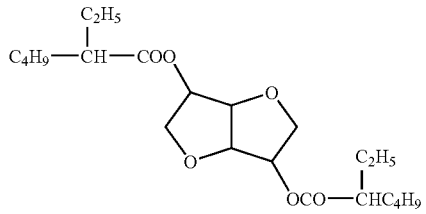

S-III-6

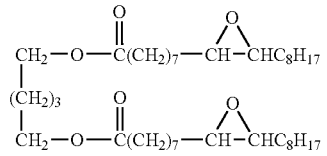

S-III-7

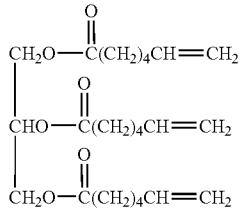

S-III-8

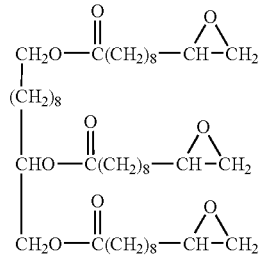

-continued

S-III-9

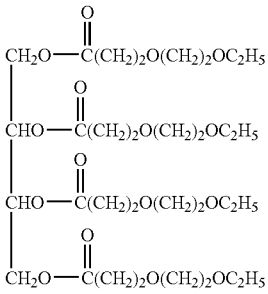

S-III-10

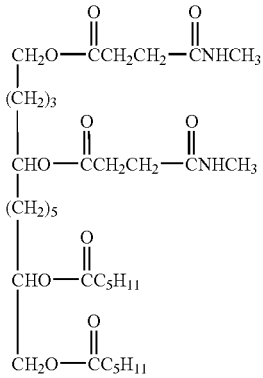

S-III-11

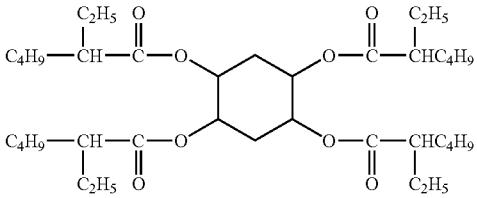

S-III-12

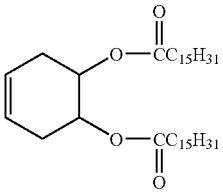

S-III-13

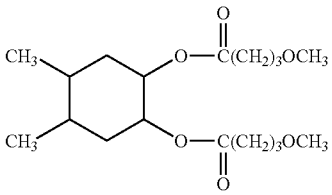

S-III-14

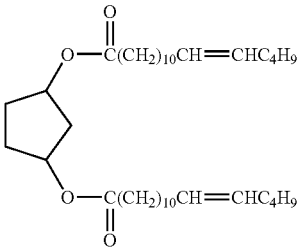

-continued

S-III-15

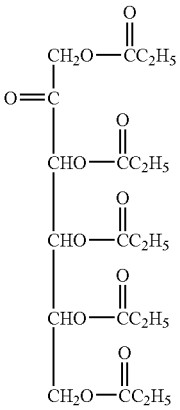

S-III-16

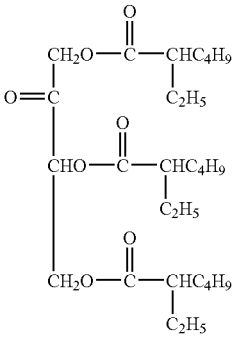

S-III-17

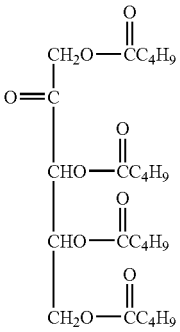

Next, the high boiling point organic solvent, which is represented by the formula [S-IV], will be explained.

In the formula [S-IV], $Rs_8$, $Rs_9$, $Rs_{10}$, and $Rs_{11}$ each independently represent a hydrogen atom, an aliphatic group, an aliphatic oxycarbonyl group (e.g., dodecyloxycarbonyl, allyloxycarbonyl), an aromatic ocycarbonyl group (e.g., phenoxycarbonyl), or an carbamoyl group (e.g., tetradecylcarbamoyl, phenyl-methylcarbamoyl), wherein all of $Rs_8$, $Rs_9$, $Rs_{10}$, and $Rs_{11}$ simultaneously do not represent a hydrogen atom, and the total of the carbon atoms of these groups is 8 to 60. These groups may each have a substituent(s).

In formula [S-IV], $Rs_8$ and $Rs_9$, $Rs_{10}$ and $Rs_{11}$, or $RS_8$ and $Rs_{10}$, may bond each other, to form a 5- to 7-membered ring, respectively.

In the formula [S-IV], it is preferable that at least one of $Rs_8$, $Rs_9$, $Rs_{10}$, and $Rs_{11}$ is a hydrogen atom and is more preferable that two of $Rs_8$, $Rs_9$, $Rs_{10}$, and $Rs_{11}$ are each a hydrogen atom.

In the formula [S-IV], it is preferable that at least one of $Rs_8$, $Rs_9$, $Rs_{10}$, and $Rs_{11}$ is an alkyl group substituted with an aryl- or alkyl-ether group, an ester group, or an amido group.

The compound according to the present invention, which is represented by the formula [S-IV], can be synthesized according to the methods in, for example, U.S. Pat. Nos. 4,239,851, 4,540,654.

Hereinafter, specific examples of the high boiling point organic solvent represented by formula [S-IV] will be shown, but the present invention should not be considered to be limited thereto.

S-IV-1

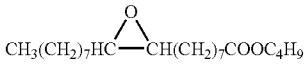

S-IV-2

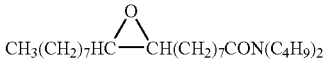

S-IV-3

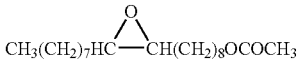

S-IV-4

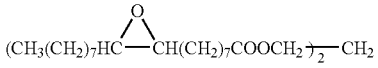

S-IV-5

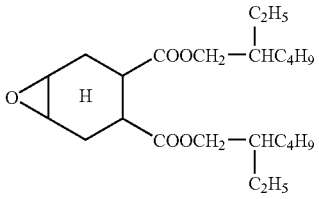

S-IV-6

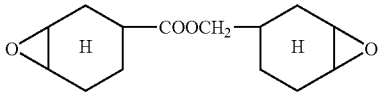

S-IV-7

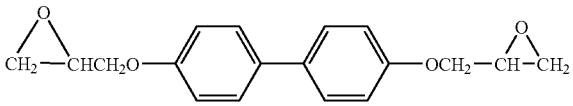

S-IV-8

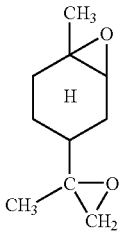

S-IV-9

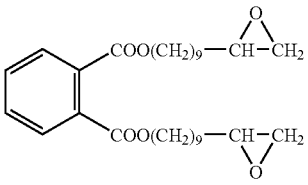

-continued

S-IV-10

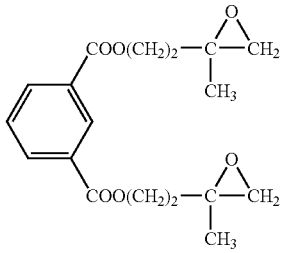

S-IV-11

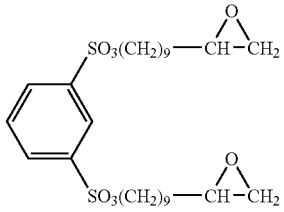

S-IV-12

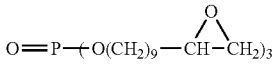

S-IV-13

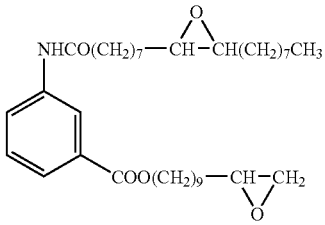

S-IV-14

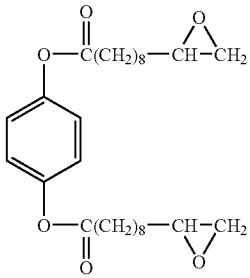

S-IV-15

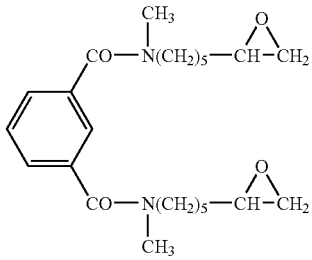

S-IV-16

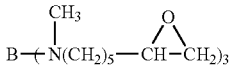

-continued

S-IV-17

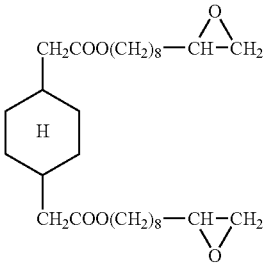

S-IV-18

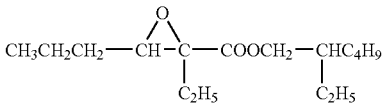

S-IV-19

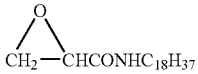

S-IV-20

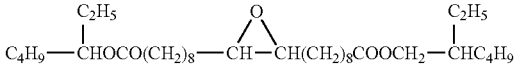

Next, the high boiling point organic solvent, which is represented by the formula [S-V], will be explained.

In the formula [S-V], $Rs_{12}$ represents an aromatic linking group which may have a substituent. sp represents an integer of 3 or more but 5 or less and is preferably 3 or 4. Besides, $Rs_{12}$ is a trivalent group in the case where sp is 3, a tetravalent group in the case where sp is 4, and a pentavalent group in the case where sp is 5. In the case where sp is 2 to 5, the plural —$COORs_{13}$ groups may be the same or different from each other. $Rs_{12}$ is preferably a benzenering group having a valency of sp.

$Rs_{13}$ represents an alkyl group (the number of carbon atoms is preferably 1 to 20), a cycloalkyl group (the number of carbon atoms is preferably 3 to 20), an alkenyl group (the number of carbon atoms is preferably 2 to 20), or an alkyl group (the number of carbon atoms is preferably 2 to 20), each having 20 or less carbon atoms. Specific examples of $Rs_{13}$ are straight-chain or branched alkyl groups or cycloalkyl groups such as methyl, ethyl, n-butyl, pentyl, neopentyl, hexyl, cyclohexyl, octenyl, 2-ethylhexyl, decyl, dodecyl, hexadecyl, and eicosanyl; alkenyl groups such as 2-butenyl, 2-pentenyl, 2-nonyl-2-butenyl, and 1,2,5-octadienyl; and alkynyl groups such as 2-propynyl, 2-pentene-4-ynyl, and octane-5-ynyl. The group represented by $Rs_{13}$ is an alkyl group, preferably.

$Rs_{13}$ may further have a substituent. Preferred examples of the substituent include an alkoxy group, an aryloxy group, an epoxy group, a hydroxyl group, an acyloxy group, an aryl group, an alkylthio group, an arylthio group, an acyl group, an acylamino group, a halogen atom and the like, more preferably an alkoxy group (e.g. methoxy, butoxy, butoxyethoxy), an epoxy group, a hydroxyl group, an acyloxy group (e.g. acetyloxy, propionyloxy, cyclohexanoyloxy) and a halogen atom (e.g. fluorine atom).

Hereinafter, specific examples of the high boiling point organic solvent represented by formula [S-V] will be shown, but the present invention should not be considered to be limited thereto.

S-V-1

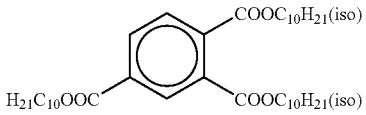

S-V-2

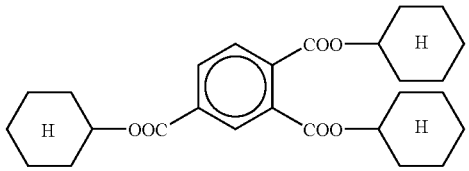

S-V-3

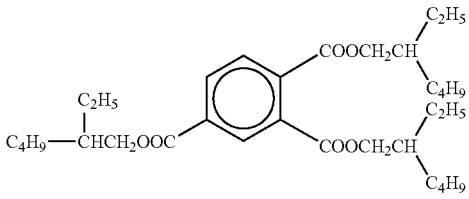

S-V-4

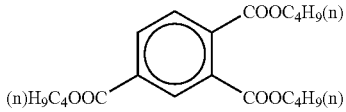

S-V-5

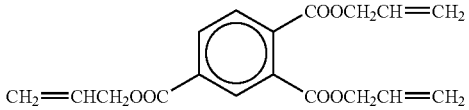

S-V-6

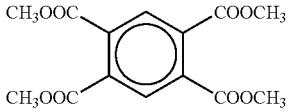

S-V-7

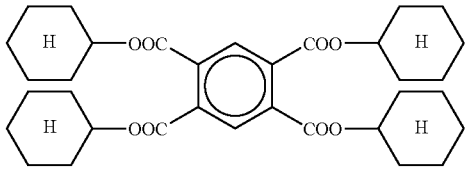

The compound represented by the formula [S-V] can be easily synthesized, according to, for example, a reaction between an acid halide of a corresponding carboxylic acid and a corresponding alcohol, or a transesterification reaction between the ester of a corresponding carboxylic acid and a corresponding alcohol.

The high boiling point organic solvent in the present invention means an organic solvent whose boiling point at 1 atm is 160° C. or higher.

In the present invention, the amount to be used of the high boiling point organic solvent represented by any one of the formulae [S-I] to [S-V] cannot be specified specifically, because the amount varies depending on the kind and amount to be used of the coupler in the present invention, but in the layer containing the coupler(s) forming the dye(s) slightly soluble in the organic solvent, the content of high boiling organic solvents in lipophilic components is preferably from 1 to 60 mass %, more preferably from 10 to 50 mass %. In addition, the high boiling point organic solvent (mass)/coupler (mass) ratio is preferably 0.05 to 20, more preferably 0.1 to 10, and most preferably 0.1 to 3.5.

In the present invention, it is also preferable to use the compound represented by any of the foregoing formulae [ST-I] to [ST-V].

Next, the compound represented by the formula [ST-I] will be explained.

Examples of the aliphatic groups represented by $R_{40}$, $R_{50}$, and $R_{60}$ include an alkyl group having 1 to 32 carbon atoms, an alkenyl group having 2 to 32 carbon atoms, an alkynyl group having 2 to 32 carbon atoms, a cycloalkyl group having 3 to 32 carbon atoms, and a cycloalkenyl group having 3 to 32 carbon atoms. The alkyl group, alkenyl group, and alkynyl group may be straight-chain or branched ones. These aliphatic groups include those having a substituent(s).

Examples of the aromatic groups represented by $R_{40}$, $Rs_{50}$, and $R_{60}$ include aryl groups (e.g., phenyl and the like), aromatic heterocyclic groups (e.g., pyridyl, furyl, and the like), and the like. These aromatic groups include those having a substituent(s).

Preferably $R_{40}$, $R_{50}$, and $R_{60}$ are each an alkyl group or an aryl group, wherein $R_{40}$, $R_{50}$, and $R_{60}$ may be the same or different from each other. The total number of carbon atoms of the groups represented by $R_{40}$, $R_{50}$, and $R_{60}$ is preferably 6 to 50.

Although the substituent on the aliphatic group or aromatic group represented by $R_{40}$, $R_{50}$, and $R_{60}$ is not particularly limited, preferred examples of the substituent include an alkoxy group, an aryloxy group, an acyl group, an acyloxy group, an alkoxycarbonyl group, an aryloxycarbonyl group, a carbamoyl group, a sulfamoyl group, an acylamino group, an amino group, and the like.

l4, m4, and n4 each independently represent 0 or 1, but all of l4, m4, and n4 simultaneously do not represent 1. That is, at least one of the aliphatic groups or aromatic groups represented by $R_{40}$, $R_{50}$, and $R_{60}$ is linked directly to the phosphorus atom. It is preferable that all of l4, m4, and n4 are 0.

Hereinafter, representative examples of the compound represented by formula [ST-I] will be shown, but the present invention should not be considered to be limited thereto.

ST-I-1

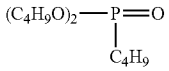

ST-I-2

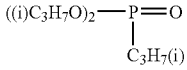

ST-I-3

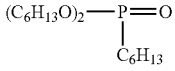

ST-I-4

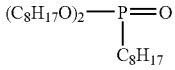

ST-I-5

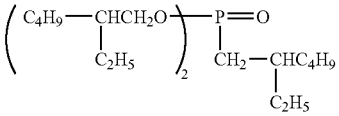

ST-I-6

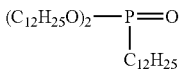

ST-I-7

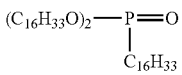

-continued

ST-I-8

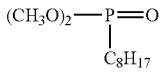

ST-I-9

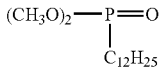

ST-I-10

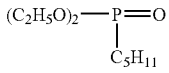

ST-I-11

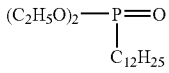

ST-I-12

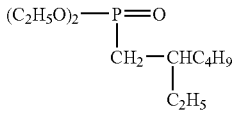

ST-I-13

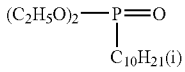

ST-I-14

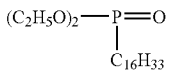

ST-I-15

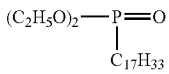

ST-I-16

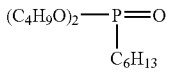

ST-I-17

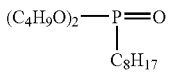

ST-I-18

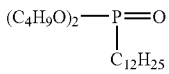

ST-I-19

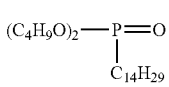

ST-I-20

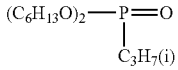

ST-I-21

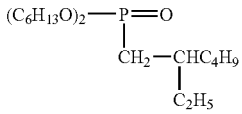

ST-I-22

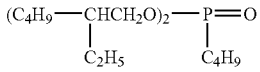

ST-I-23

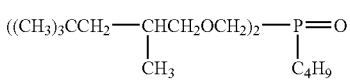

ST-I-24

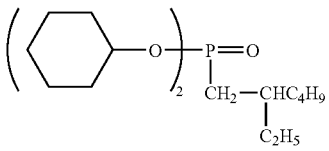

-continued

ST-I-25

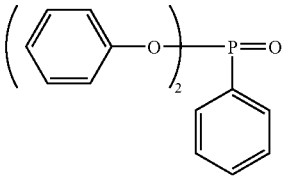

ST-I-26

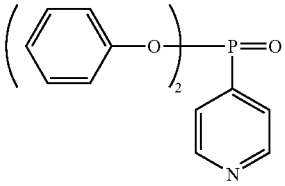

ST-I-27

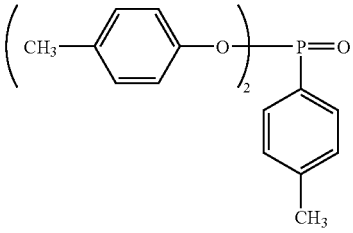

ST-I-28

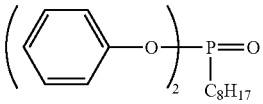

ST-I-29

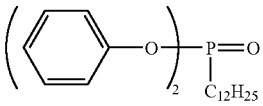

ST-I-30

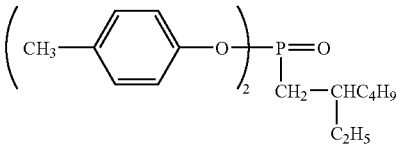

ST-I-31

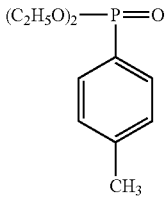

ST-I-32

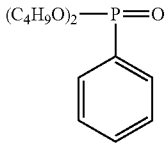

ST-I-33

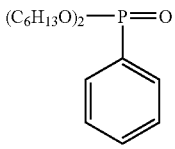

-continued

ST-I-34

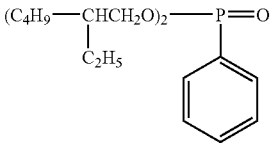

ST-I-35

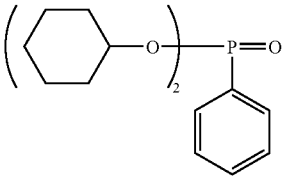

ST-I-36

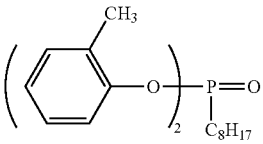

ST-I-37

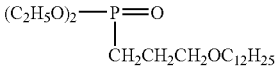

ST-I-38

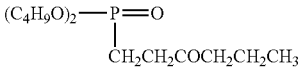

ST-I-39

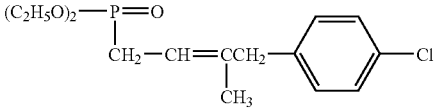

ST-I-40

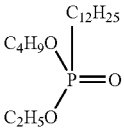

ST-I-41

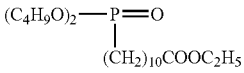

ST-I-42

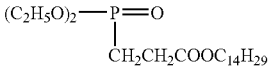

The compounds represented by the formula [ST-I] include the compounds described on pages 4 to 5 of JP-A-56-19049.

Some of the compounds represented by the formula [ST-I] are commercially available. Otherwise, these compounds can be synthesized according to the methods described in, for example, JP-A-56-19049; U.K. Patent No. 694,772; J. Am. Chem. Soc., 79, 6524 (1957); J. Org. Chem., 25, 1000 (1960) Org. Synth., 31, 33 (1951), and others.

Next, the compound represented by the formula [ST-II] will be explained.

In the formula [ST-II], example of the groups represented by $R_A$ and $R_B$ include an alkyl group having 1 to 32 carbon atoms, an alkenyl or alkynyl group having 2 to 32 carbon atoms, and a cycloalkyl or cycloalkenyl group having 3 to 12 carbon atoms. The alkyl group, alkenyl group, and alkynyl group may be straight-chain or branched ones. These groups include those having a substituent(s).

The aryl groups represented by $R_A$ and $R_B$ are preferably phenyl groups, which include those having a substituent(s). The heterocyclic groups represented by $R_A$ and $R_B$ are preferably 5- to 7-membered ones, which may be condensed with another ring, and include those having a substituent(s).

The alkoxy groups represented by $R_A$ and $R_B$ include those having a substituent(s). Examples of the alkoxy group include 2-ethoxyethoxy, pentadecyloxy, 2-dodecyloxyethoxy, phenethyloxyethoxy, and the like.

The aryloxy group is preferably a phenyloxy group, wherein the aryl nuclei may have a substituent(s). Examples of the aryloxy group include phenoxy, p-t-butylphenoxy, m-pentadecylphenoxy, and the like.

Further, the heterocycloxy group is preferably those having a 5- to 7-membered heterocycle which may have a substituent(s). Examples of the heterocycloxy group include 3,4,5,6-tetrahydropyranyl-2-oxy, 1-phenyltetrazole-5-oxy, and the like.

Among the compounds represented by the formula [ST-II], particularly preferred compounds are those represented by the following formula [ST-II'].

$$R_E—NHSO_2—R_F \qquad \text{Formula [ST-II']}$$

In the formula [ST-II'], $R_E$ and $R_F$ each independently represent an alkyl group or an aryl group each of which may have a substituent(s). It is more preferable that at least one of $R_E$ and $R_F$ is an aryl group, and it is most preferable that $R_E$ and $R_F$ each are an aryl group, a phenyl group in particular. In the case where $R_E$ is a phenyl group, it is particularly preferable that the Hammett $\sigma_p$ constant of the substituent in the para-position with respect to the sulfonamido group is −0.4 or more.

The alkyl group and the aryl group represented by $R_E$ and $R_F$ have the same meanings as the alkyl group and the aryl group represented by $R_A$ and $R_B$ in the formula [ST-II], respectively.

Further, the compounds represented by the formula [ST-II] may form a dimer or a polymer whose order is greater than two at $R_A$ and $R_B$. Further, $R_A$ and $R_B$ may bond together to form a 5- or 6-membered ring.

Still further, the total of the carbon atoms of the compound represented by the formula [ST-II] is preferably 8 or more, and particularly preferably 12 or more. The total of the carbon atoms is preferably 60 or less in any case.

Hereinafter, representative examples of the compound represented by formula [ST-II] will be shown, but the present invention should not be considered to be limited thereto.

| Compound No. | —$R_A$—$NHSO_2$—$R_B$ | |
|---|---|---|
| | $R_A$ | $R_B$ |
| ST-1 | 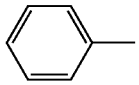 | 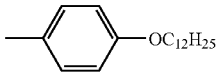 |
| ST-2 | 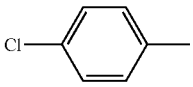 | 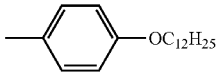 |
| ST-3 | 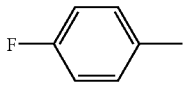 | 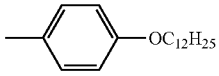 |

-continued

| Compound No. | —$R_A$—$NHSO_2$—$R_B$ | |
|---|---|---|
| | $R_A$ | $R_B$ |
| ST-4 | 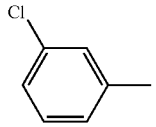 | 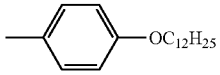 |
| ST-5 | 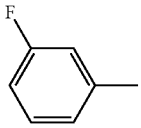 | 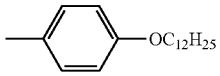 |
| ST-6 | 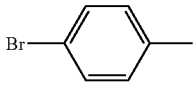 | 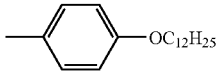 |
| ST-7 | 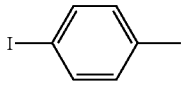 | 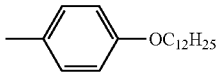 |
| ST-8 | 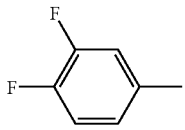 | 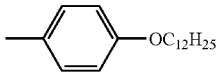 |
| ST-9 | 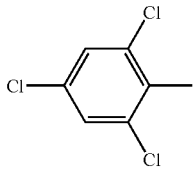 | 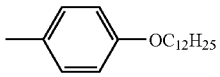 |
| ST-10 | 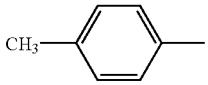 | 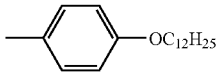 |
| ST-11 | 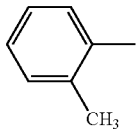 | 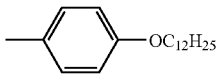 |
| ST-12 | 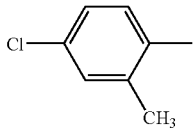 | 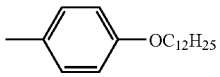 |
| ST-13 | 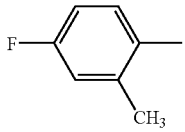 | 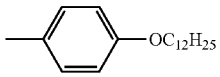 |
| ST-14 | 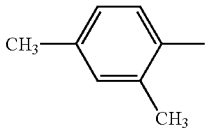 | 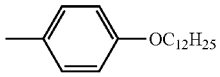 |

-continued

| Compound No. | —$R_A$—$NHSO_2$—$R_B$ $R_A$ | $R_B$ |
|---|---|---|
| ST-15 | 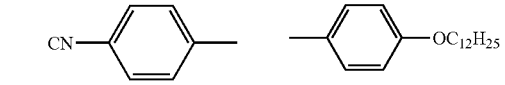 | |
| ST-16 | 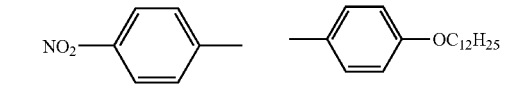 | |
| ST-17 | 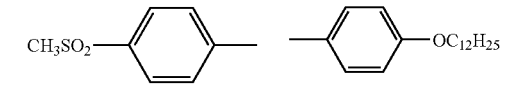 | |
| ST-18 | 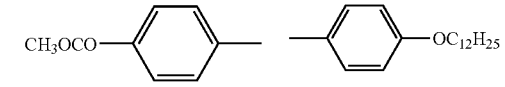 | |
| ST-19 | 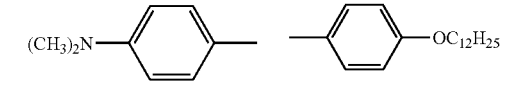 | |
| ST-20 | 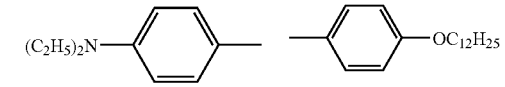 | |
| ST-21 | 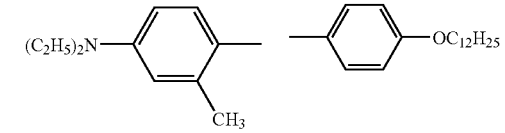 | |
| ST-22 | 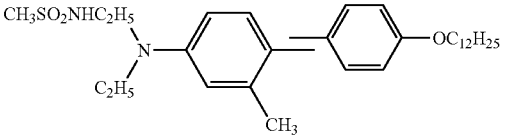 | |
| ST-23 | 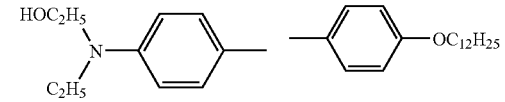 | |
| ST-24 | 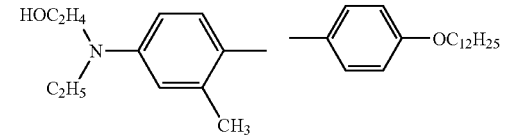 | |
| ST-25 | 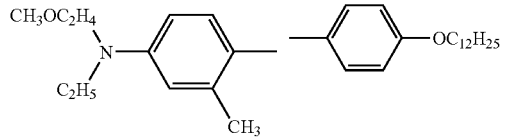 | |

The compound represented by the formula [ST-II] can be synthesized according to a conventionally known method such as the method described in JP-A-62-178258.

The amount to be used of the compound represented by the formula [ST-II] is preferably 5 to 500 mol %, more preferably 10 to 300 mol %, to the amount of the coupler.

Part of the compounds represented by the formula [ST-II] are described in JP-A-57-76543, JP-A-57-179842, JP-A-58-1139, JP-A-62-178258, and others.

Next, the compound represented by the formula [ST-III] will be explained. Examples of the bivalent organic group represented by J' include an alkylene group, and alkenylene group, a cycloalkylene group, an arylene group, a heterocyclic group, and a -J"-NH— group (wherein J" represents an arylene group). These groups may have a substituent(s).

It is preferable that the alkyl group, cycloalkyl group, aryl group, alkenyl group, alkynyl group, and cycloalkenyl group, which are each represented by Y, have carbon atoms in the range of 1 to 32. These alkyl group, alkenyl group, and alkynyl group may each be a straight-chain group or a branched group. Further, these groups include those having a substituent(s).

Further, the heterocyclic group represented by Y is preferably a nitrogen-containing heterocyclic group. Examples thereof include such groups as pyrrolyl, pyrazolyl, imidazolyl, pyridyl, pyrrolinyl, imidazolidinyl, imidazolinyl, piperazinyl, and piperidinyl. These heterocyclic groups include those having a substituent(s).

Hereinafter, representative examples of the compound represented by formula [ST-III] will be shown, but the present invention should not be considered to be limited thereto.

ST-III-1

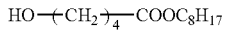

ST-III-2

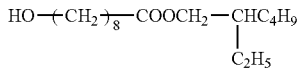

ST-III-3

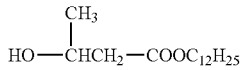

ST-III-4

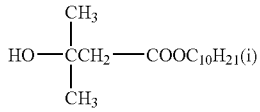

ST-III-5

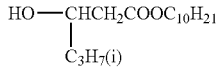

ST-III-6

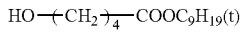

ST-III-7

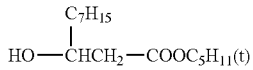

ST-III-8

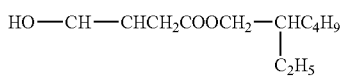

ST-III-9

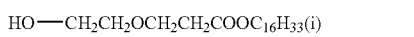

ST-III-10

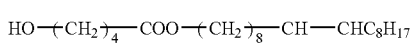

ST-III-11

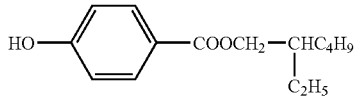

ST-III-12

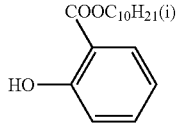

-continued

ST-III-13

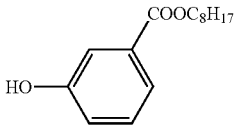

ST-III-14

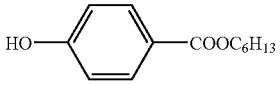

ST-III-15

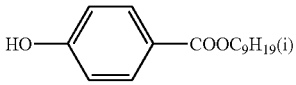

ST-III-16

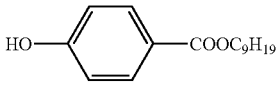

ST-III-17

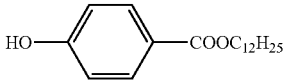

ST-III-18

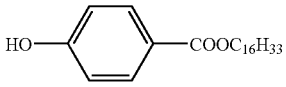

ST-III-19

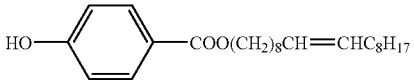

ST-III-20

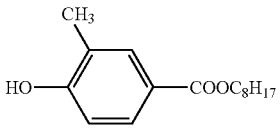

-continued

ST-III-21

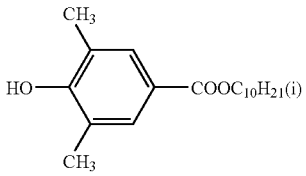

Among the compounds represented by the formula [ST-IV], particularly preferred compounds in the present invention are those represented by any of the following formulae [ST-IV-I] to [ST-IV-IV].

Formula (ST-IV-I)

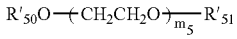

Formula (ST-IV-II)

Formula (ST-IV-III)

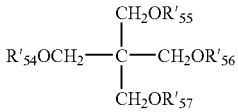

Formula (ST-IV-IV)

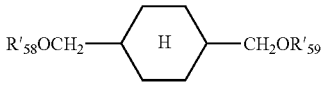

$R'_{50}$ to $R'_{59}$ in the above formulae each have the same meanings as $R_{51}$ and $R_{52}$ in the formula [ST-IV].

m5 represents an integer of 0 to 6 and n5 represents an integer of 1 to 10. Further, in the formula [ST-IV-III], any two selected from $R'_{54}$ to $R'_{57}$ may bond together to form a ring.

Further, the compounds described in JP-A-62-257152, JP-A-62-257153, and JP-A-62-272247 can also be used preferably in the present invention.

Hereinafter, representative examples of the compound represented by formula [ST-IV] will be shown, but the present invention should not be considered to be limited thereto.

$R_{51}O-(CH_2CH_2O)_{m_5}-R_{52}$

| No. | $R_{51}$ | $R_{52}$ | $m_5$ |
|---|---|---|---|
| ST-IV-1 | $-C_6H_{13}$ | $-C_6H_{13}$ | 1 |
| ST-IV-2 | $-C_6H_{13}$ | $-C_6H_{13}$ | 2 |
| ST-IV-3 | $-C_6H_{13}$ | $-C_6H_{13}$ | 3 |
| ST-IV-4 | $-C_6H_{13}$ | $-C_6H_{13}$ | 0 |
| ST-IV-5 | $-CH_2-CH(C_2H_5)C_4H_9$ | $-CH_2-CH(C_2H_5)C_4H_9$ | 1 |
| ST-IV-6 | $-CH_2-CH(C_2H_5)C_4H_9$ | $-CH_2-CH(C_2H_5)C_4H_9$ | 2 |
| ST-IV-7 | $-CH_2-CH(C_2H_5)C_4H_9$ | $-CH_2-CH(C_2H_5)C_4H_9$ | 3 |

-continued

| | | | |
|---|---|---|---|
| ST-IV-8 | $-CH_2-CH(C_2H_5)C_4H_9$ | $-CH_2-CH(C_2H_5)C_4H_9$ | 0 |
| ST-IV-9 | 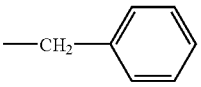 | 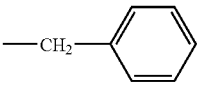 | 1 |
| ST-IV-10 | 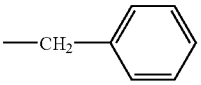 | 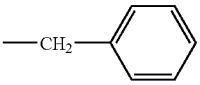 | 2 |
| ST-IV-11 | $-COCH_3$ | $-COCH_3$ | 1 |
| ST-IV-12 | $-COCH_3$ | $-COCH_3$ | 2 |
| ST-IV-13 | $-COCH_3$ | $-COCH_3$ | 3 |
| ST-IV-14 | $-COCH_3$ | $-COCH_3$ | 4 |
| ST-IV-15 | $-C_6H_{13}$ | $-COCH_3$ | 1 |
| ST-IV-16 | $-C_6H_{13}$ | $-COCH_3$ | 2 |
| ST-IV-17 | $-C_6H_{13}$ | $-COCH_3$ | 3 |
| ST-IV-18 | $-C_2H_5$ | $-CO-CH(C_2H_5)C_4H_9$ | 1 |
| ST-IV-19 | $-C_2H_5$ | $-CO-CH(C_2H_5)C_4H_9$ | 2 |
| ST-IV-20 | $-C_6H_{13}$ | $-CO-CH(C_2H_5)C_4H_9$ | 1 |
| ST-IV-21 | $-C_6H_{13}$ | $-CO-CH(C_2H_5)C_4H_9$ | 2 |
| ST-IV-22 | $-CH_2-CH(C_2H_5)C_4H_9$ | $-CO-CH(C_2H_5)C_4H_9$ | 1 |
| ST-IV-23 | $-CH_2-CH(C_2H_5)C_4H_9$ | $-CO-CH(C_2H_5)C_4H_9$ | 2 |
| ST-IV-24 | $-CO-CH(C_2H_5)C_4H_9$ | $-CO-CH(C_2H_5)C_4H_9$ | 1 |
| ST-IV-25 | $-CO-CH(C_2H_5)C_4H_9$ | $-CO-CH(C_2H_5)C_4H_9$ | 2 |
| ST-IV-26 | $-CH_2COOC_4H_9$ | $-CO-CH(C_2H_5)C_4H_9$ | 0 |
| S1-IV-27 | $-CH_2COOC_4H_9$ | $-CO-CH(C_2H_5)C_4H_9$ | 1 |
| ST-IV-28 | $-C_4H_9$ | $-C_4H_9$ | 2 |
| ST-IV-29 | $-C_4H_9$ | $-C_4H_9$ | 4 |
| ST-IV-30 | $-C_4H_9$ | $-C_4H_9$ | 6 |
| ST-IV-31 | 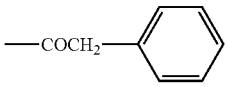 | 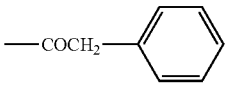 | 1 |
| ST-IV-32 | 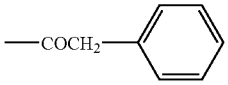 | 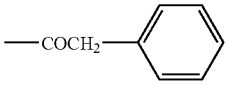 | 2 |

-continued

| | | | |
|---|---|---|---|
| ST-IV-33 | $—C_{12}H_{25}$ | $—C_{12}H_{25}$ | 0 |
| ST-IV-34 | $—C_{12}H_{25}$ | $—C_{12}H_{25}$ | 1 |
| ST-IV-35 | $—C_2H_5$ | $—CH_2COOC_4H_9$<br>\|<br>$—CCOOC_4H_9$<br>\|<br>$CH_2COOC_4H_9$ | 0 |
| ST-IV-36 | $—C_8H_{17}$ | $—CH_2COOC_4H_9$<br>\|<br>$—CCOOC_4H_9$<br>\|<br>$CH_2COOC_4H_9$ | 0 |
| ST-IV-37 | $—C_8H_{17}$ | $—CHCOOC_2H_5$<br>\|<br>$CH_2COOC_2H_5$ | 0 |
| ST-IV-38 | $—C_{12}H_{25}$ | $—CHCOOC_2H_5$<br>\|<br>$CHCOOC_2H_5$<br>\|<br>$OC_{12}H_{25}$ | 0 |
| ST-IV-39 | $—C_2H_5$ | $—CHCOOC_8H_{17}$<br>\|<br>$CHCOOC_8H_{17}$<br>\|<br>$OC_2H_5$ | 0 |

$R_{51}O—(CH_2)_{n_5}—OR_{52}$

| No. | $R_{51}$ | $R_{52}$ | $n_5$ |
|---|---|---|---|
| ST-IV-40 | $—C_4H_9$ | $—C_4H_9$ | 3 |
| ST-IV-41 | $—C_4H_9$ | $—C_4H_9$ | 4 |
| ST-IV-42 | $—C_4H_9$ | $—C_4H_9$ | 5 |
| ST-IV-43 | $—C_4H_9$ | $—C_4H_9$ | 6 |
| ST-IV-44 | $—C_8H_{17}$ | $—C_4H_9$ | 4 |
| ST-IV-45 | $—COCH_3$ | $—COCH_3$ | 1 |
| ST-IV-46 | $—COCH_3$ | $—COCH_3$ | 3 |
| ST-IV-47 | $—COCH_3$ | $—COCH_3$ | 4 |
| ST-IV-48 | $—COCH_3$ | $—COCH_3$ | 6 |
| ST-IV-49 | $—CH_2—CHC_4H_9$<br>\|<br>$C_2H_5$ | $—CH_2—CHC_4H_9$<br>\|<br>$C_2H_5$ | 3 |
| ST-IV-50 | $—CH_2—CHC_4H_9$<br>\|<br>$C_2H_5$ | $—CH_2—CHC_4H_9$<br>\|<br>$C_2H_5$ | 4 |
| ST-IV-51 | $—CH_2—CHC_4H_9$<br>\|<br>$C_2H_5$ | $—CH_2—CHC_4H_9$<br>\|<br>$C_2H_5$ | 5 |
| ST-IV-52 | $—CH_2—CHC_4H_9$<br>\|<br>$C_2H_5$ | $—CH_2—CHC_4H_9$<br>\|<br>$C_2H_5$ | 6 |
| ST-IV-53 | $—CH_2—CHC_4H_9$<br>\|<br>$C_2H_5$ | $—CO—CHC_4H_9$<br>\|<br>$C_2H_5$ | 3 |
| ST-IV-54 | $—CH_2—CHC_4H_9$<br>\|<br>$C_2H_5$ | $—CO—CHC_4H_9$<br>\|<br>$C_2H_5$ | 4 |
| ST-IV-55 | $—CH_2—CHC_4H_9$<br>\|<br>$C_2H_5$ | $—COCH_3$ | 3 |

-continued

| | | | |
|---|---|---|---|
| ST-IV-56 | $—C_6H_{13}$ | $—COCH_3$ | 3 |
| ST-IV-55 | $—C_{12}H_{25}$ | $—C_{12}H_{25}$ | 3 |
| ST-IV-58 | $—C_{12}H_{25}$ | $—C_{12}H_{25}$ | 4 |

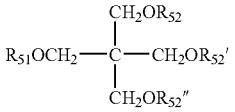

| No. | $R_{51}$ | $R_{52}$ | $R_{52'}$ | $R_{52''}$ |
|---|---|---|---|---|
| ST-IV-59 | $—C_4H_9$ | $—C_4H_9$ | $—C_4H_9$ | $—C_4H_9$ |
| ST-IV-60 | $—C_6H_{13}$ | $—C_6H_{13}$ | $—C_6H_{13}$ | $—C_6H_{13}$ |
| ST-IV-61 | $—C_8H_{17}$ | $—C_8H_{17}$ | $—C_8H_{17}$ | $—C_8H_{17}$ |
| ST-IV-62 | $—COCH_3$ | $—COCH_3$ | $—COCH_3$ | $—COCH_3$ |
| ST-IV-63 | $—COC_3H_7$(i) | $—COC_3H_7$(i) | $—COC_3H_7$(i) | $—COC_3H_7$(i) |
| ST-IV-64 | $—COC_4H_9$ | $—COC_4H_9$ | $—COC_4H_9$ | $—COC_4H_9$ |
| ST-IV-65 | $—CH_2—CH(C_2H_5)C_4H_9$ | $—CH_2—CH(C_2H_5)C_4H_9$ | $—CH_2—CH(C_2H_5)C_4H_9$ | $—CH_2—CH(C_2H_5)C_4H_9$ |
| ST-IV-66 | $—CO—CH(C_2H_5)C_4H_9$ | $—CO—CH(C_2H_5)C_4H_9$ | $—CO—CH(C_2H_5)C_4H_9$ | $—CO—CH(C_2H_5)C_4H_9$ |
| ST-IV-67 | $—COCH_3$ | $—COCH_3$ | $—C_4H_9$ | $—C_4H_9$ |
| ST-IV-68 | $—COCH_3$ | $—C_4H_9$ | $—C_4H_9$ | $—C_4H_9$ |

ST-IV-69

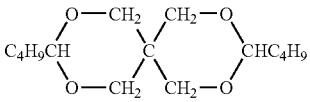

ST-IV-70

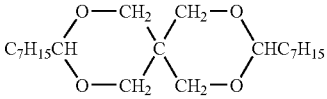

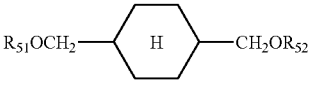

| No. | $R_{51}$ | $R_{52}$ |
|---|---|---|
| ST-IV-71 | $—COC_6H_{13}$ | $—COC_6H_{13}$ |
| ST-IV-72 | $—CO—CH(C_2H_5)C_4H_9$ | $—CO—CH(C_2H_5)C_4H_9$ |
| ST-IV-73 | $—COC_8H_{17}$ | $—COC_8H_{17}$ |
| ST-IV-74 | $—COC_8H_{17}$ | $—C_6H_{13}$ |
| ST-IV-75 | $—COC_8H_{17}$ | $—COC_6H_{13}$ |
| ST-IV-76 | $—COC_7H_{15}$ | $—COC_7H_{15}$ |
| ST-IV-77 | $—COC_7H_{15}$ | $—C_8H_{17}$ |
| ST-IV-78 | $—C_{12}H_{25}$ | $—C_{12}H_{25}$ |
| ST-IV-79 | $—C_{12}H_{25}$ | $—CO—CH(C_2H_5)C_4H_9$ |
| ST-IV-80 | $—COC_{12}H_{25}$ | $—CO—CH(C_2H_5)C_4H_9$ |

Some of the compounds represented by the formula [ST-IV] are commercially available. Otherwise, these compounds can be synthesized according to the methods described in, for example, JP-B-56-1616, JP-A-62-257152, JP-A-62-272247 and others.

Next, the compound represented by the formula [ST-V] will be explained.

$R_{54}$ represents a hydrophobic group in which the total of the carbon atoms is 10 or more (preferably 10 to 50 and more preferably 10 to 32), and which is preferably the aliphatic or aromatic group, more preferably the aliphatic group, as exemplified as $R_{40}$, $R_{50}$, and $R_{60}$ in the formula [ST-I]. $Y_{54}$ represents a monovalent organic group having an alcoholic hydroxyl group. $Y_{54}$ is preferably a monovalent organic group represented by the following formula (AL).

$$Y_{55}\text{-}(L_{55})m_{55} \qquad \text{Formula (AL)}$$

In the formula, $Y_{55}$ represents a group to give a compound formed by eliminating a hydrogen atom from one of the plural hydroxyl groups contained in a polyhydric alcohol. $L_{55}$ represents a bivalent linking group. $m_{55}$ represents 0 or 1. Preferred examples of the polyhydric alcohol, which becomes the group represented by $Y_{55}$ by the elimination of a hydrogen atom, are glycerin, polyglycerin, pentaerythritol, trimethylol propane, neopentyl glycol, sorbitan, sorbide, sorbit, saccharides, and the like. The bivalent linking groups represented by L are preferably —C(═O)— and —$SO_2$—.

A preferred compound in another form of the compound represented by the formula [ST-V] is a compound in which $R_{54}$ is an aliphatic group having 12 or more carbon atoms (preferably an alkyl or alkenyl group having 12 to 32 carbon atoms) and $Y_{54}$ is an OH group.

Hereinafter, representative examples of the compound represented by formula [ST-V] will be shown, but the present invention should not be considered to be limited thereto.

ST-V-1

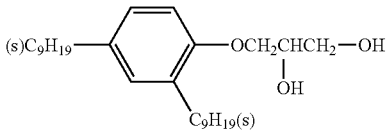

ST-V-2

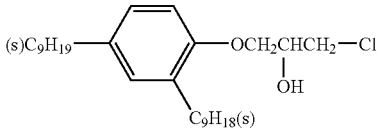

ST-V-3

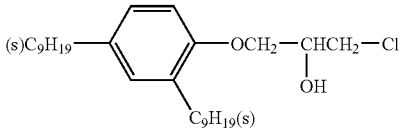

ST-V-4

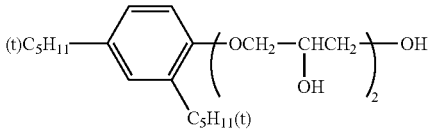

ST-V-5

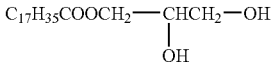

ST-V-6

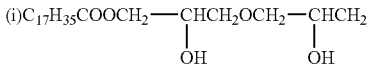

ST-V-7

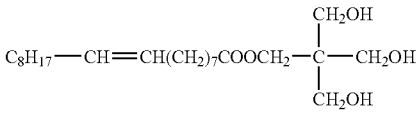

ST-V-8

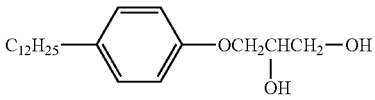

-continued

ST-V-9

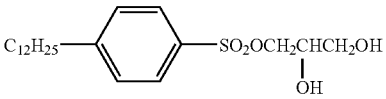

ST-V-10

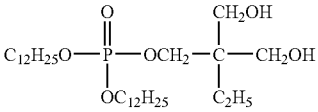

ST-V-11

Diglyceryl diisostearate

ST-V-12

Pentaerythritol dioleate

ST-V-13

Tetraglyceryl tristearate

ST-V-14

Decaglyceryl pentaoleate

ST-V-15

Sorbitan monooleate

ST-V-16

Sorbitan sesquioleate

ST-V-17

Sorbitan trioleate

ST-V-18

Sorbitan monostearate

ST-V-19

$C_8H_{16}CH{=}CH(CH_2)_8OH$

ST-V-20

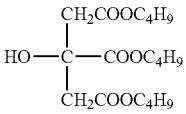

ST-V-21

$C_{12}H_{25}OH$

ST-V-22

$C_{14}H_{29}OH$

ST-V-23

$C_{16}H_{33}OH$

ST-V-24

$C_{18}H_{37}OH$

ST-V-25

$C_{20}H_{41}OH$

The compound, which is represented by any one of the formulae [ST-I] to [ST-V] in the present invention, is preferably used in a layer which is incorporated with a cyan dye-forming coupler represented by the formula (CP-I) in the present invention. It is preferable that the range of the amounts to be used of the compound, which is represented by any one of the formulae [ST-I] to [ST-V] in the present invention, is the same as the previously described range of the amounts to be used of the compound represented by any one of the formulae [S-I] to [S-VI]. Although it is preferable that the compound, which is represented by any one of the formulae [ST-I] to [ST-V] in the present invention, is used also as a high boiling point organic solvent, it is more preferable that this compound is used in combination with a high boiling point organic solvent in the present invention, or another high boiling point organic solvent (preferably in combination with any of the preferable high boiling point organic solvent represented by any one of the formulae [S-I] to [S-V] in the present invention).

When the compound represented by any of formulae [ST-I] to [ST-V] is used in combination with another high boiling organic solvent, the preferable ratio (by mass) between them is not particularly specified, but it is preferably from 1:50 to 50:1, more preferably from 1:10 to 10:1.

The preferable of the compounds represented by formulae [S-I] to [S-V] and [ST-I] to [ST-V], or the preferable combinations thereof are as follows.

Examples of a compound preferably used alone or compounds preferably used in combination from the viewpoint of developed color density under rapid processing include the compounds represented by formula [S-II], the compounds represented by formula [S-V], combinations of the compounds represented by formulae [ST-I] and [S-I], combinations of the compounds represented by formulae [ST-III] and [S-I], and combinations of the compounds represented by formulae [ST-IV] and [S-I]. The particularly preferred are the compounds represented by formula [S-I], combinations of the compounds represented by formulae [S-II] and [S-I], and combinations of the compounds represented by formulae [S-III] and [S-I].

The compounds preferred from the viewpoint of image preservability are the compounds represented by formula [S-I], the compounds represented by formula [S-III] and the compounds represented by formula [S-IV], and those preferred in particular are the compounds represented by formula [S-I], combinations of the compounds represented by formulae [S-V] and [S-I], combinations of the compounds represented by formulae [ST-V] and [S-I], and combinations of the compounds represented by [ST-V] and [S-V].

As a method for incorporating couplers and high boiling organic solvents in the silver halide emulsion layers according to the present invention, though various methods can be adopted in the invention, the preferred is a method of dissolving couplers according to the present invention in high boiling organic solvents according to the present invention and then dispersing the resulting solutions.

The high boiling organic solvents according to the present invention may be used alone, or as combinations of two or more thereof, or in combination with other high boiling organic solvents. In order to aid the dissolution, they can also be used in combination with low-boiling-point organic solvents or water-miscible organic solvents.

Examples of such low-boiling-point organic solvents include ethyl acetate, butyl acetate, cyclohexanone, isobutyl alcohol, methyl ethyl ketone and methyl cellosolve. Examples of such water-miscible organic solvents include methyl alcohol, ethyl alcohol, acetone, phenoxyethanol, tetrahydrofuran and dimethylformamide. These low-boiling organic solvents and water-miscible organic solvents can be removed by use of a washing method, in coating and drying procedures, or the like. Additionally, these organic solvents can be used as combinations of two or more thereof.

For the formation of lipophilic fine-particles by dispersing the coupler according to the present invention and the compound according to the present invention, by emulsification in a hydrophilic protective colloid, the dispersing operation is carried out by means of a mixer, a homogenizer, a colloid mill, a flow jet mixer, an ultrasonic apparatus, or the like, using a dispersing aid such as a surfactant. A process for removing a low boiling point organic solvent may be employed simultaneously with the dispersing operation.

An aqueous solution of gelatin is preferably used as the hydrophilic protective colloid. The average particle diameter of the lipophilic fine-particles is preferably 0.04 to 2 μm, and more preferably 0.06 to 0.4 μm. The particle diameter can be measured by Coulter model N4 (trade name) manufactured by U.K. Coulter Corp., or the like.

Further, as yellow dye-forming couplers (which may be referred to simply as a "yellow coupler" herein) that can be used in the photosensitive material of the present invention, preferably use can be made of acylacetamide-type yellow couplers in which the acyl group has a 3-membered to 5-membered cyclic structure, such as those described in European Patent No. 0447969 A1; malondianilide-type yellow couplers having a cyclic structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1, and 953875 A1; and acylacetamide-type yellow couplers having a dioxane structure, such as those described in U.S. Pat. No. 5,118,599, in addition to the yellow couplers described in the following Table 1. Of these couplers, the acylacetamide-type yellow couplers whose acyl groups are 1-alkylcyclopropane-1-carbonyl groups, or the malondianilide-type yellow couplers wherein either anilide forms an indoline ring, can be preferably used. These couplers may be used singly or in combination.

In the light-sensitive material of the present invention, at least one dye-forming coupler represented by the following formula (I) is preferably contained in any one of the light-sensitive material constituent layers.

Formula (I)

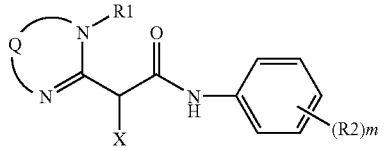

In formula (I), R1 represents a substituent other than a hydrogen atom. Examples of the substituent include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an alkylamino group and an anilino group), an acylamino group, an aminocarbonylamino group, an alkoxycarbonylamino group, an aryloxycarbonylamino group, a sulfamoylamino group, a sulfonamide group (an alkyl- or aryl-sulfonylamino group), a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group, and a silyl group.

The above-mentioned substituent may be further substituted with another substituent. Examples of this another substituent are the same to the above-mentioned examples of the substituent.

R1 is preferably a substituted or unsubstituted alkyl group. The total number of carbon atoms of R1 is preferably in the range of 1 to 60, more preferably in the range of 6 to 50, still more preferably in the range of 11 to 40, and most preferably in the range of 16 to 30. In the case that R1 is a substituted alkyl group, examples of the substituent on the alkyl group include those atoms and groups exemplified as the substituent of the above-mentioned R1. The number of carbon atoms in the alkyl group itself as R1 is preferably from 1 to 40, more preferably from 3 to 36, further preferably from 8 to 30. This order of preference does not particularly depend on Q, but it is preferable in the case where Q described below is a group represented by —C(—R11)=C(—R12)-CO— in particular.

R1 is preferably an unsubstituted alkyl group containing at least 11 carbon atoms or an alkyl group substituted with an alkoxy or aryloxy group at the 2-, 3- or 4-position, more preferably an unsubstituted alkyl group containing at least 16 carbon atoms, or an alkyl group substituted with an alkoxy or aryloxy group at the 3-position, most preferably a $C_{16}H_{33}$ group, a $C_{18}H_{37}$ group, a 3-lauryloxypropyl group or a 3-(2, 4-di-t-amylphenoxy)propyl group.

In formula (I), Q represents a group of nonmetallic atoms that forms a 5- to 7-membered ring in combination with the —N═C—N(R1)-. Preferably, the 5- to 7-membered ring thus formed is a substituted or unsubstituted, and monocyclic or condensed heterocycle. More preferably, the ring is one whose ring-forming atoms are selected from carbon, nitrogen and sulfur atoms. Still more preferably, Q represents a group represented by —C(—R11)=C(—R12)—$SO_2$— or —C(—R11)═C(—R12)-CO— (in the present specification, these expressions of the foregoing groups do not limit the bonding orientation of the groups in formula (I), to the ones shown by these expressions). Preferably, Q represents a group represented by —C(—R11)═C(—R12)-$SO_2$—. R11 and R12 are groups that bond each other to form a 5- to 7-membered ring together with the —C═C— moiety, or R11 and R12 each independently represent a hydrogen atom or a substituent. The 5- to 7-membered ring thus formed may be saturated or unsaturated, and the ring may be an alicyclic, aromatic or heterocyclic ring. Examples of the 5- to 7-membered ring include benzene, furan, thiophene, cyclopentane, and cyclohexane rings. Examples of the substituent are the same as described as the examples of the above-mentioned substituent of R1.

These substituents and the rings formed through bonding of multiple substituents may be further substituted with another substituent. Examples of this another substituent are the same as described as the examples of the above-mentioned substituent of R1.

In formula (I), R2 represents a substituent other than a hydrogen atom. Examples of the substituent include those exemplified as the substituent of the above-mentioned R1. R2 is preferably a halogen atom (e.g., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulfamoyl, N,N-diethylsulfamoyl), an alkylsulfonyl group (e.g., methane sulfonyl), an arylsulfonyl group (e.g., benzene sulfonyl), an alkylthio group (e.g., methylthio, dodecylthio), an arylthio group (e.g., phenylthio, naphthylthio), a cyano group, a carboxyl group, or a sulfo group. Additionally, R2 is preferably a halogen atom, an alkoxy group, an aryloxy group, an alkyl group, an alkylthio group or an arylthio group when it is situated in a position ortho to the —CONH— group.

In the present invention, the case is preferred where at least one R2 is situated in a position ortho to the —CONH— group.

In formula (I), m represents an integer of 0 or more and 5 or less. When m is 2 or more, R2s may be the same or different from each other, and they may bond together to form a ring.

m is preferably 0 to 3, more preferably 0 to 2, further preferably 1 to 2, and most preferably 2.

In formula (I), X represents a hydrogen atom, or a group capable of being split-off upon a coupling reaction with an oxidized product of a developing agent. Examples of the group capable of being split-off upon a coupling reaction with an oxidized product of a developing agent include a group that splits off with a nitrogen, oxygen, or sulfur atom; a halogen atom (e.g., chlorine, bromine), and the like.

Examples of the group that splits off with a nitrogen atom include a heterocyclic group (preferably a 5- to 7-membered substituted or unsubstituted, saturated or unsaturated aromatic (herein the term "aromatic" is used to embrace a substance that has (4n+2) cyclic conjugated electrons) or non-aromatic, monocyclic or condensed heterocyclic group; more preferably a 5- or 6-membered heterocyclic group having ring-forming atoms selected from carbon, nitrogen, and sulfur atoms and having at least one hetero atom selected from nitrogen, oxygen and sulfur atoms; specific examples of the heterocyclic group include succinimido, maleinimido, phthalimido, diglycolimido, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine parabanic acid, 1,2,4-triazolidine-3,5-dione, 2-pyridone, 4-pyridone, 2-pyrimidone, 6-pyridazone, 2-pyrazone, 2-amino-1,3,4-thiazolidine-4-one), a carbonamido group (e.g., acetamido, trifluoroacetamido), a sulfonamido group (e.g., methanesulfonamido, benzenesulfonamido), an arylazo group (e.g., phenylazo, naphthylazo), a carbamoylamino group (e.g., N-methyl carbamoylamino), and the like.

Preferred of the group that splits off with a nitrogen atom is a heterocyclic group, and more preferably it is an aromatic heterocyclic group having 1, 2, 3 or 4 ring-forming nitrogen atoms, or a heterocyclic group represented by the following formula (L):

Formula (L)

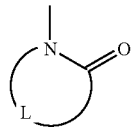

In formula (L), L represents a moiety that forms a 5- to 6-membered nitrogen-containing heterocycle with the —NC(═O)—.

Examples of the moiety are enumerated in the explanation of the above-mentioned heterocyclic group, and such moieties as enumerated above are more preferred. Particularly preferably L is a moiety that forms a 5-membered nitrogen-containing heterocycle.

Examples of the group that splits off with an oxygen atom include an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbamoyloxy), an aryloxycarbonyloxy group (e.g., phenoxycarbonyloxy), an alkoxycarbonyloxy group (e.g., methoxycarbonyloxy, ethoxycarbonyloxy), an alkylsulfonyloxy group (e.g., methanesulfonyloxy), an aryl sulfonyloxy group (e.g., benzenesulfonyloxy, toluenesulfonyloxy), and the like.

Preferred of the group that splits off with an oxygen atom are an aryloxy group, an acyloxy group and a heterocyclic oxy group.

Examples of the group that splits off with a sulfur atom include an arylthio group (e.g., phenylthio, naphthylthio), a heterocyclic thio group (e.g., tetrazolylthio, 1,3,4-thiadiazolylthio, 1,3,4-oxazolylthio, benzimidazolyl thio), an alkylthio group (e.g., methylthio, octylthio, hexadecylthio), an alkylsulfinyl group (e.g., methane sulfinyl), an arylsulfinyl group (e.g., benzenesulfinyl), an arylsulfonyl group (e.g., benzenesulfonyl), an alkylsulfonyl group (e.g., methansulfonyl), and the like.

Preferred of the group that splits off with a sulfur atom are an arylthio group and a heterocyclic thio group. A heterocyclic thio group is more preferred.

X may be substituted with a substituent. Examples of the substituent substituting on X include those exemplified as the above-mentioned substituent of R1.

X is preferably a group that splits off upon a coupling reaction with an oxidized product of a developing agent. Among these split-off groups, X is preferably a group that splits off with a nitrogen, oxygen, or sulfur atom, more preferably X is a group that splits off with a nitrogen atom, and further preferably X is one of the above-mentioned preferable examples of the group that splits off with a nitrogen atom, and they are preferable in the described order.

When it comes to further description of a group preferred as X, a group splitting off on their nitrogen atoms are preferred, and an aromatic heterocyclic group (preferably a 5-membered aromatic heterocyclic group, such as a pyrazole group which may have a substituent) containing at least two nitrogen atoms (preferably two nitrogen atoms) or a group represented by the foregoing formula (L) in particular are preferred as X.

X may be a photographically useful group. Examples of the photographically useful group include a development inhibitor, a desilvering accelerator, a redox compound, a dye, a coupler, and precursors of these compounds.

Additionally, it is preferred in the present invention that X is not the above-mentioned photographically useful group.

In order to render the coupler immobile in the light-sensitive material, at least one of Q, R1, X, and R2 has preferably 8 to 50 carbon atoms, more preferably 10 to 40 carbon atoms in total respectively, including carbon atoms of substituent(s) thereon.

Of the compounds represented by formula (I), the preferred can be represented by the following formula (II). The compounds represented by formula (II) are described below in detail.

Formula (II)

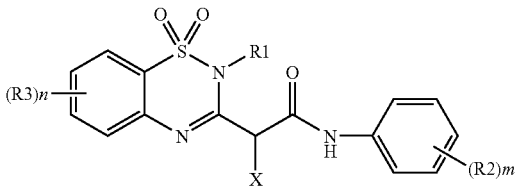

In formula (II), R1, R2, m, and X each have the same meanings as described in formula (I). Preferable ranges thereof are also the same.

In formula (II), R3 represents a substituent. Examples of the substituent include those groups and atoms exemplified as the above-mentioned substituent of R1. Preferably R3 is a halogen atom (e.g., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulfamoyl, N,N-diethylsulfamoyl), an alkylsulfonyl group (e.g., methane sulfonyl), an arylsulfonyl group (e.g., benzene sulfonyl), a cyano group, a carboxyl group, and a sulfo group.

n represents an integer of 0 or more but 4 or less. When n is 2 or more, the multiple R3s may be the same or different from each other, and the R3s may bond each other to form a ring.

Preferable specific examples of the couplers represented by formula (I) or (II) according to the present invention are shown below. However, the present invention is not limited to these compounds.

Herein, the present invention also embraces tautomers, in which the hydrogen atom at the coupling site (the hydrogen atom on the carbon atom to which X is substituting) is transferred on the nitrogen atom in the C═N portion bonding to the coupling site (the ring-constituting nitrogen atom that is not bonded with R1).

(1)

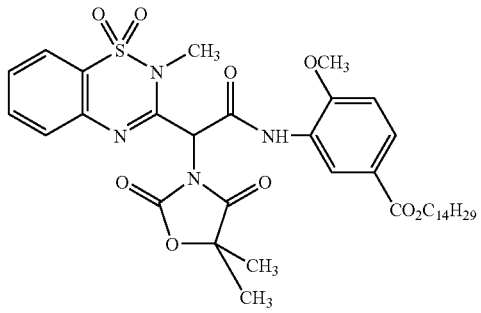

(2)

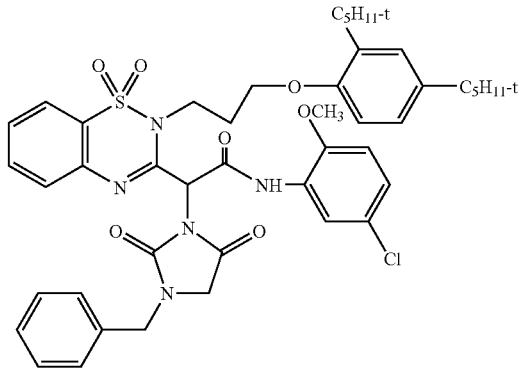

(3)

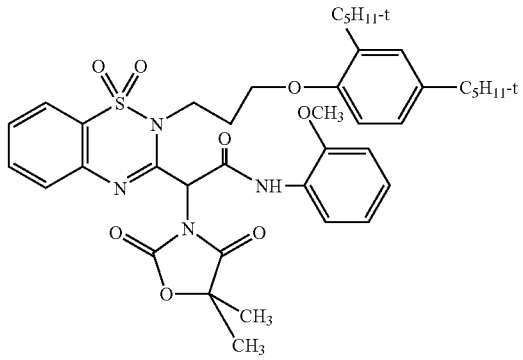

-continued
(4)
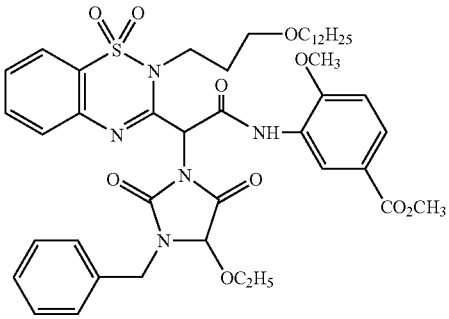
(5)
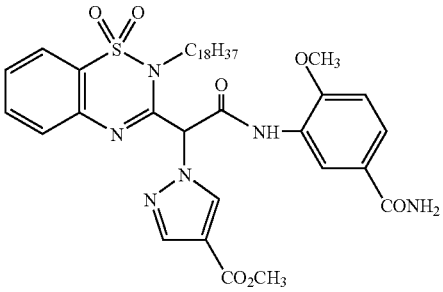
(6)
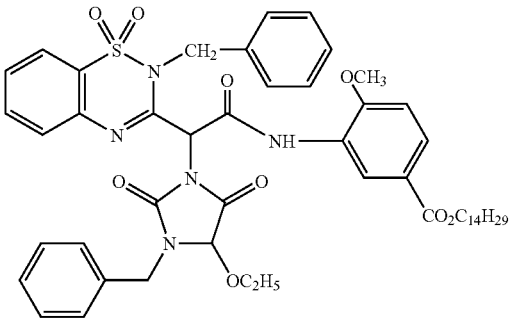
(7)
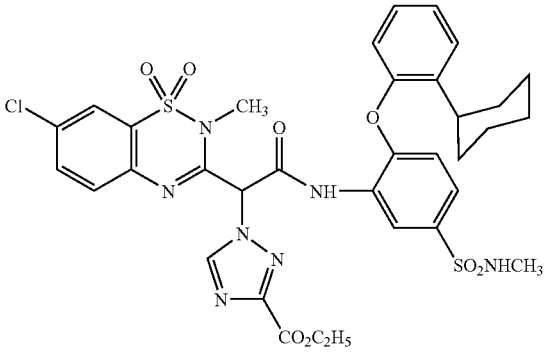
-continued
(8)
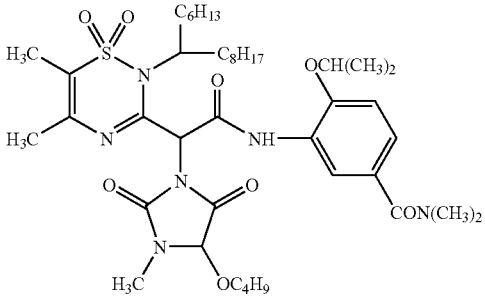
(9)
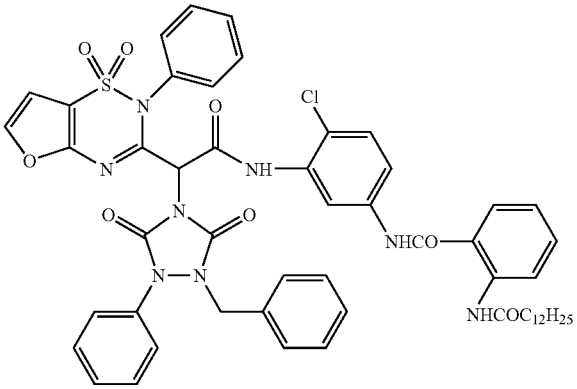
(10)
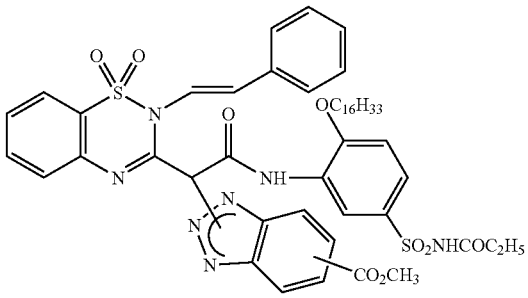
(11)
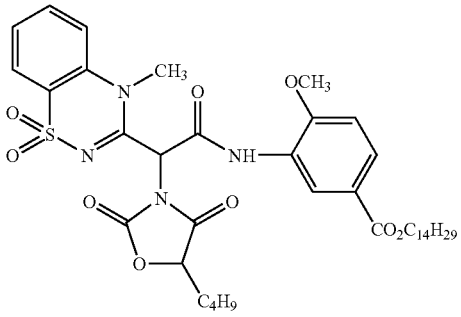

-continued
(12)
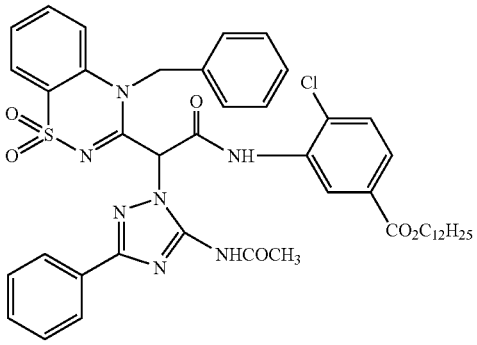
(13)
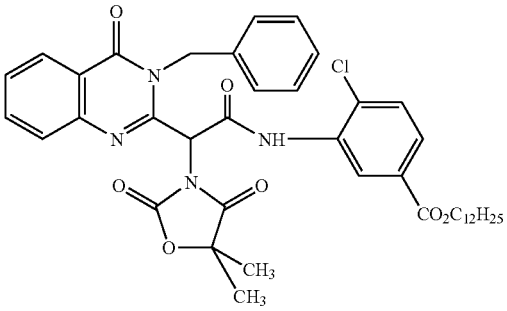
(14)
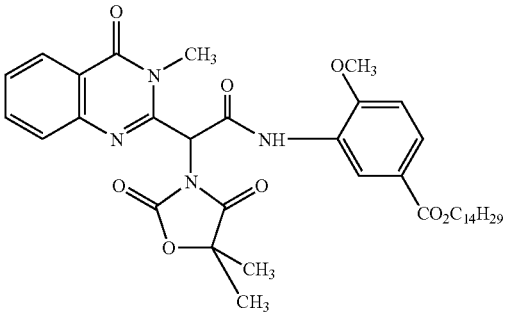
(15)
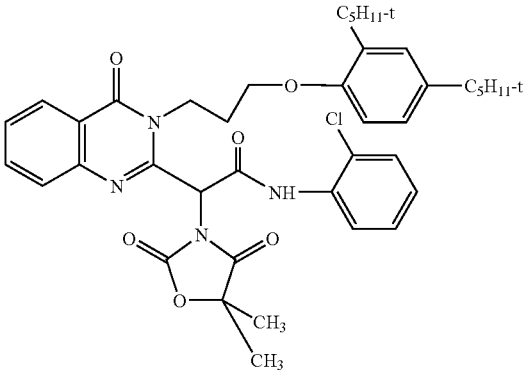
-continued
(16)
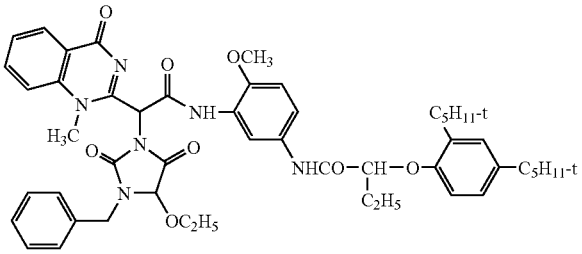
(17)
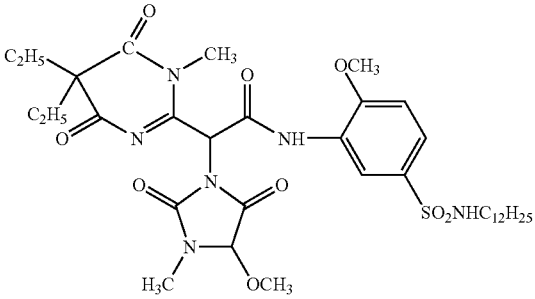
(18)
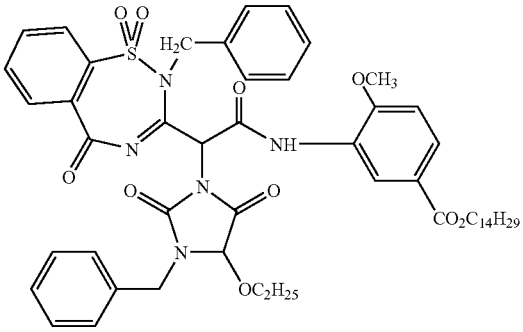
(19)
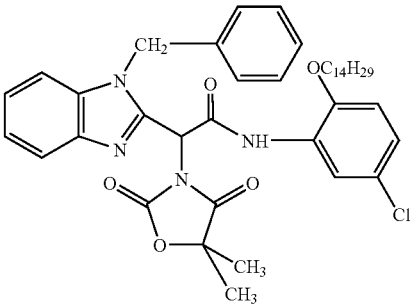
(20)
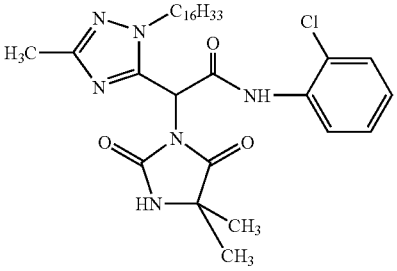

-continued
(21)
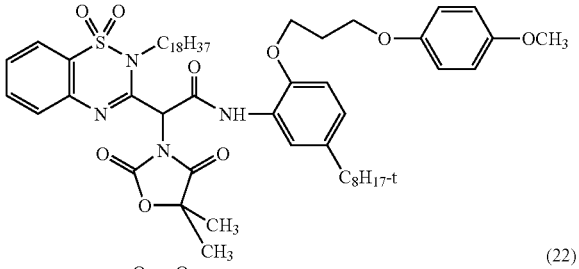
(22)
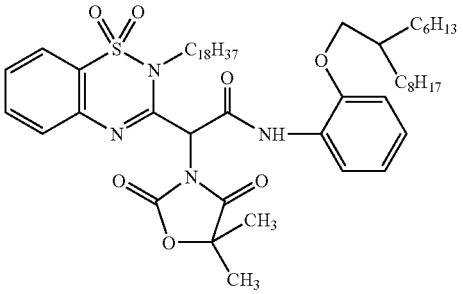
(23)
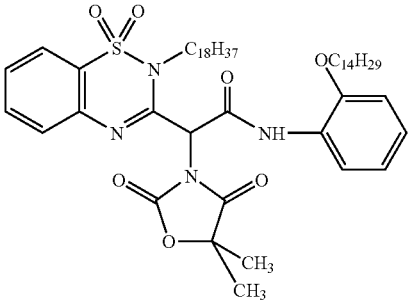
(24)
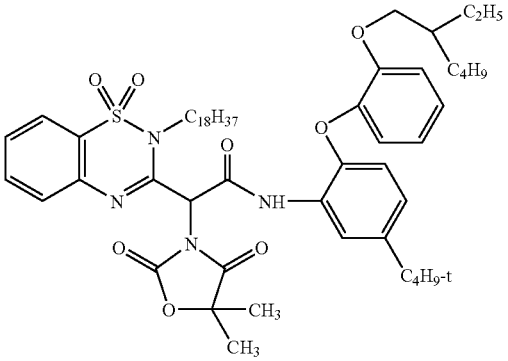
(25)
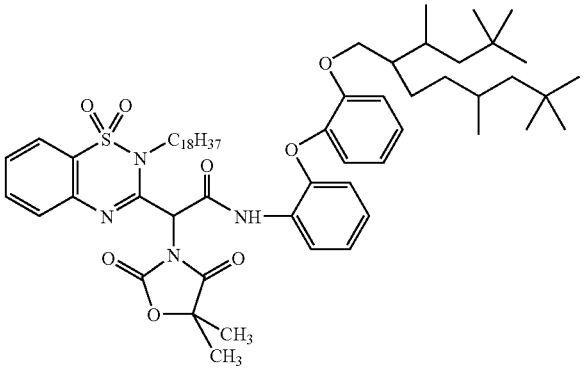
-continued
(26)
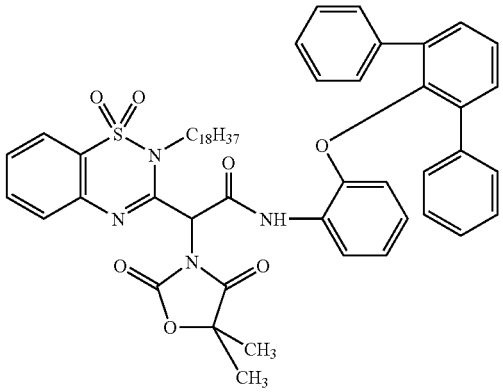
(27)
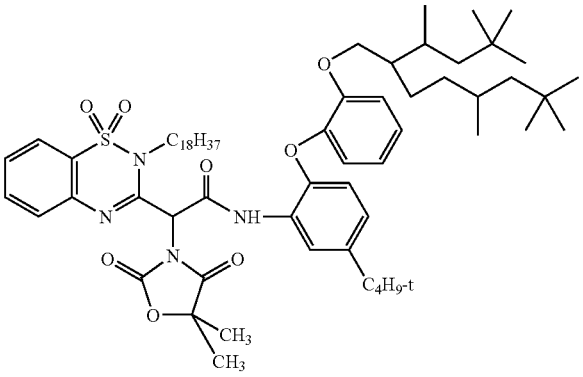
(28)
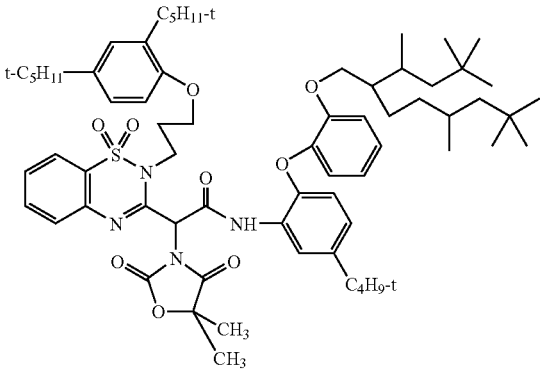
(29)
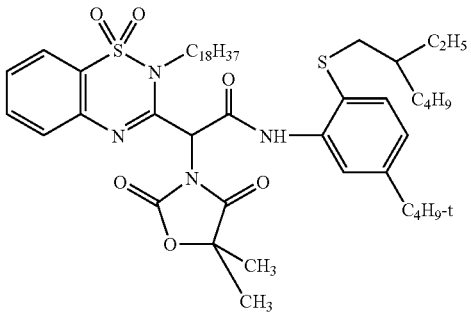

-continued
(30)
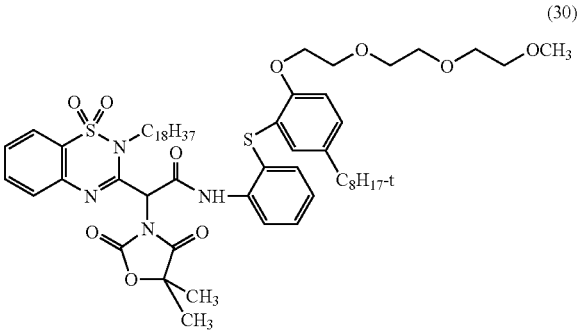
(31)
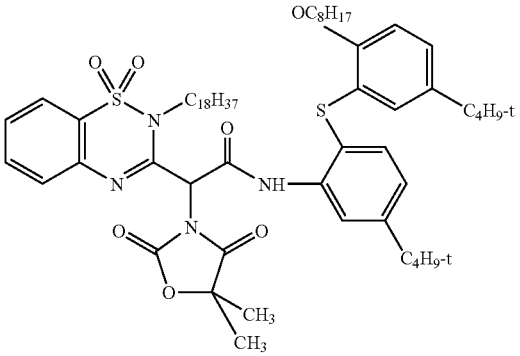
(32)
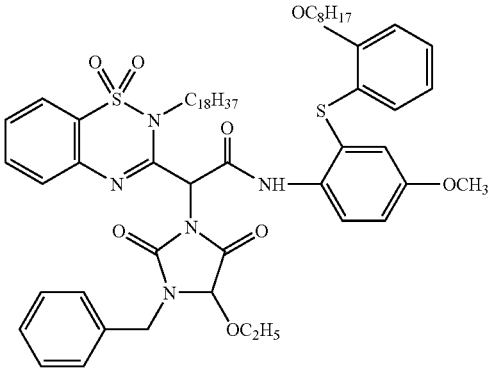
(33)
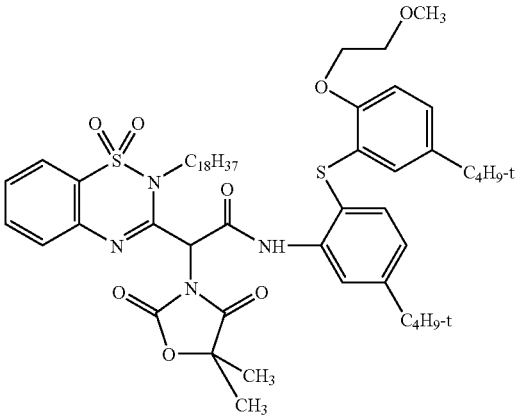
-continued
(34)
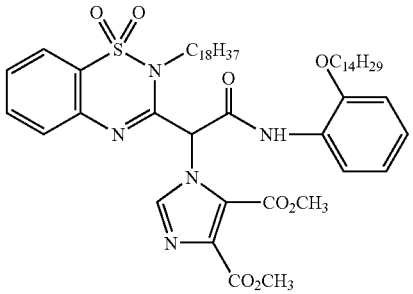
(35)
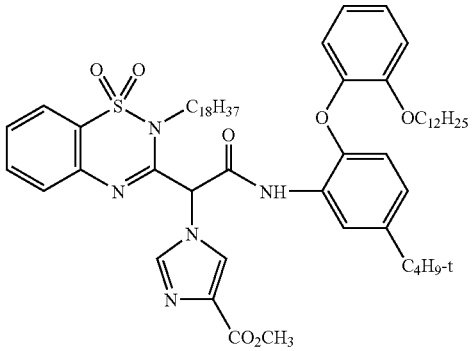
(36)
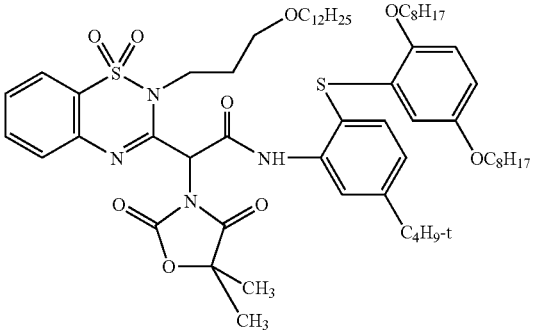
(37)
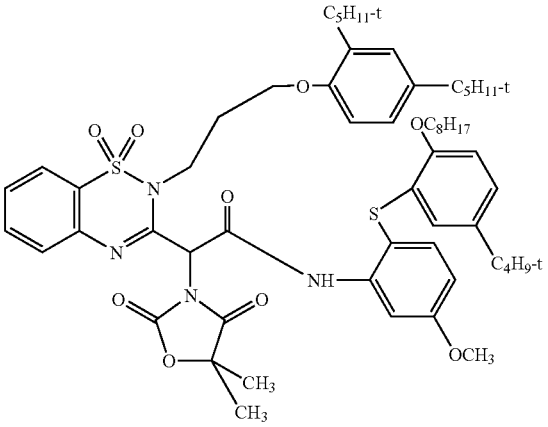

-continued
(38)
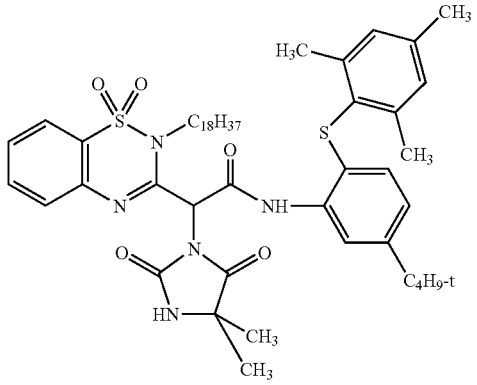
(39)
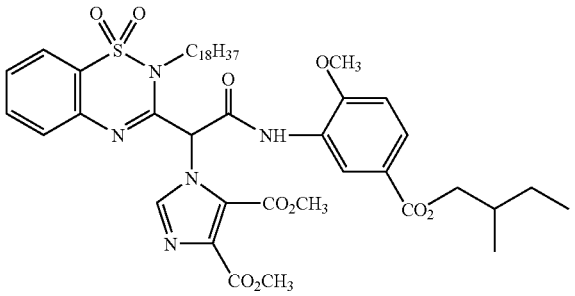
(40)
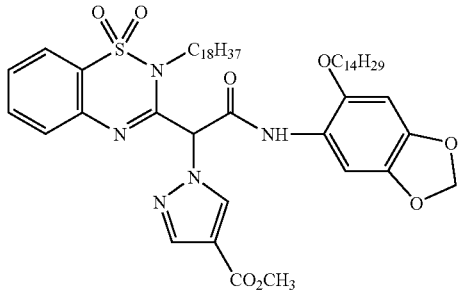
(41)
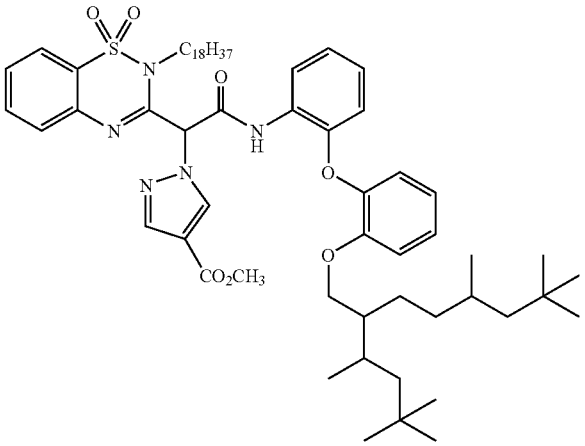
-continued
(42)
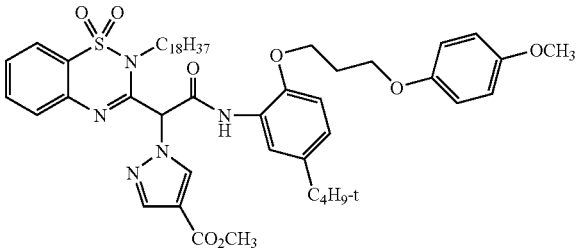
(43)
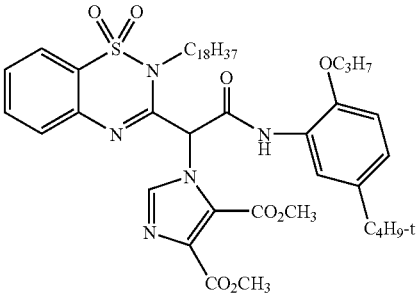
(44)
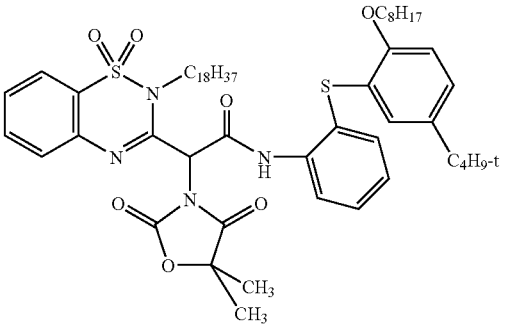
(45)
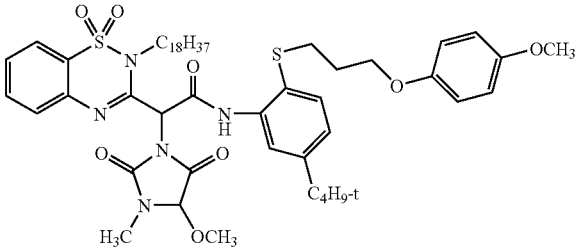
(46)
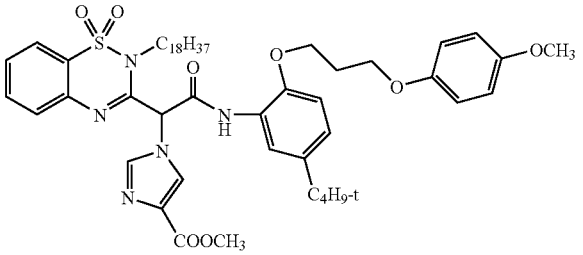

-continued (47)

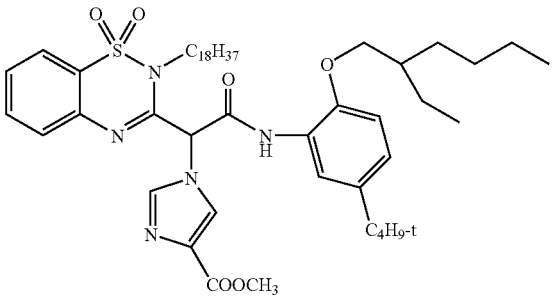

(48)

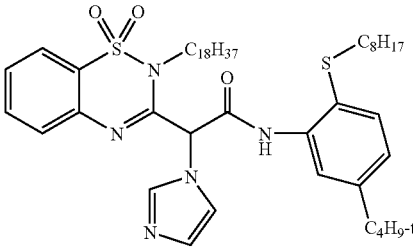

(49)

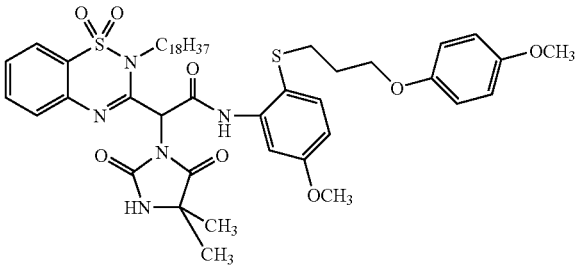

(50)

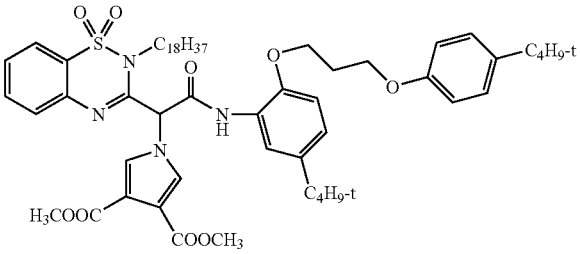

The dye-forming couplers represented by formula (I) can be easily synthesized using the method disclosed in JP-A-2003-173007, or methods conforming thereto.

In the silver halide photographic light-sensitive material of the present invention, the dye-forming coupler represented by formula (I) is preferably incorporated in an amount of $1\times10^{-3}$ mole to 1 mole per mole of silver halide, and more preferably incorporated in an amount of $2\times10^{-3}$ mole to $3\times10^{-1}$ mole per mole of silver halide.

The more preferable range of the amount of dye-forming coupler represented by formula (I) used in the silver halide photographic light-sensitive material of the present invention is from 0.2 mmol/m$^2$ to 0.5 mmol/m$^2$, most preferably from 0.25 mmol/m$^2$ to 0.40 mmol/m$^2$.

As to the sum total of coating amounts of couplers in the silver halide emulsion layer containing at least one dye-forming coupler represented by formula (I), the smaller the better from viewpoint of reduction in layer thickness. On the other hand, the optical reflection density at a maximum absorption wavelength in a photographic constituent layer after dye-image formation is generally at least 1.8 to 2.6, preferably 2.0 to 2.5, most preferably 2.1 to 2.4. Therefore, the more preferable range of coating amount of the dye-forming coupler represented by formula (I) in the present invention is preferably from 0.1 mmol/m$^2$ to 0.7 mmol/m$^2$, more preferably from 0.2 mmol/m$^2$ to 0.6 mmol/m$^2$, far preferably from 0.3 mmol/m$^2$ to 0.5 mmol/m$^2$, particularly preferably from 0.25 mmol/m$^2$ to 0.45 mmol/m$^2$.

Additionally, the dye-forming coupler represented by formula (I) may be used alone or in combination with another dye-forming coupler(s).

The magenta dye-forming coupler that can be used in the present invention can be a 5-pyrazolone-series magenta coupler or a pyrazoloazole-series magenta coupler, such as those described in the above-mentioned patent publications in the following Table 1. Among these, preferred are pyrazolotriazole couplers in which a secondary or tertiary alkyl group is directly bonded to the 2-, 3-, or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, pyrazoloazole couplers represented by formula (M-I) described in JP-A-8-122984 are preferred. The descriptions of paragraph Nos. 0009 to 0026 of the patent publication JP-A-8-122984 can be entirely applied to the present invention, and therefore are incorporated herein by reference as a part of the present specification. In addition, pyrazoloazole couplers having a steric hindrance group at both the 3- and 6-positions, as described in European Patent Nos. 854384 and 884640, can also be preferably used.

It is preferable that the photosensitive materials of the present invention form dye images through color development using a color developing composition containing a color developing agent. Preferable examples of the color-developing agent include known aromatic primary amine compounds (aromatic primary amine color-developing agents), particularly p-phenylenediamine derivatives. Typical examples are shown hereinbelow.

1) N,N-diethyl-p-phenylenediamine
2) 4-amino-3-methyl-N,N-diethylaniline
3) 4-amino-N-(β-hydroxyethyl)-N-methylaniline
4) 4-amino-N-ethyl-N-(β-hydroxyethyl)aniline
5) 4-amino-3-methyl-N-ethyl-N-(β-hydroxyethyl)aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-3-methyl-N-ethyl-N-(β-methanesulfonamidoethyl)aniline
9) 4-amino-N,N-diethyl-3-(β-hydroxyethyl)aniline
10) 4-amino-3-methyl-N-ethyl-N-(β-methoxyethyl)aniline
11) 4-amino-3-methyl-N-(β-ethoxyethyl)-N-ethylaniline
12) 4-amino-3-methyl-N-(3-carbamoylpropyl)-N-n-propylaniline
13) 4-amino-N-(4-carbamoylbutyl)-N-n-propyl-3-methylaniline
14) N-(4-amino-3-methylphenyl)-3-hydroxypyrrolidine
15) N-(4-amino-3-methylphenyl)-3-(hydroxymethyl)-pyrrolidine 16) N-(4-amino-3-methylphenyl)-3-pyrrolidinecarboxyamide Among the aforementioned p-phenylenediamine derivatives, the exemplified compounds 5), 6), 7), 8) and 12) are particularly preferable, the compounds 5) and 8) are further preferable, and the compound 8) is most preferable, from the viewpoint of absorption after dye forming and image preservability. These p-phenylenediamine derivatives each are generally in the form of a salt, such as a sulfate, hydrochloride, sulfite, naphthalene disulfonate and p-toluene sulfonate, in the state of a solid material.

The content of the aromatic primary amine developing agent in a processing agent or the concentration of the developing agent in the prepared solution is determined so that concentration becomes preferably 2 mmol to 200 mmol, more preferably 6 mmol to 100 mmol, and further preferably 10 mmol to 40 mmol, per 1 L of the developer.

Next, the polymer soluble in an organic solvent that can be preferably used in the present invention is described.

The term "polymer soluble in an organic solvent" that can be preferably used in the present invention means a polymer whose solubility in said organic solvent is preferably from 1 to 500 mass %, more preferably from 5 to 500 mass %.

The polymer soluble in an organic solvent that can be used in the present invention may be a homopolymer, or may be a copolymer. When the polymer is a copolymer, the polymerization form may be block copolymerization or graft copolymerization. As the homo- or co-polymer insoluble in water and soluble in an organic solvent (hereinafter, referred to as "copolymer according to the present invention"), various types can be used. For instance, those illustrated below can be preferably used.

(1) Vinyl-Based Polymers and Copolymers

The monomers, which are to be used for the formation of the vinyl-based polymers and copolymers according to the present invention, are specifically listed below:

Acrylates: for example, methyl acrylate, ethyl acrylate, n-propyl acrylate, isopropyl acrylate, n-butyl acrylate, tert-butyl acrylate, isobutyl acrylate, sec-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxyethyl acrylate, 2-butoxyethyl acrylate, 2-(2-ethoxyethoxy)ethyl acrylate, 2-(2-butoxyethoxy)ethyl acrylate, ω-methoxypolyethyleneglycol acrylate (number of moles added n=9), 1-bromo-2-methoxyethyl acrylate, 1,1-dichloro-2-ethoxyethyl acrylate;

Methacrylates: for example, methyl methacrylate, ethyl methacrylate, n-propyl methacrylate, isopropyl methacrylate, n-butyl methacrylate, tert-butyl methacrylate, isobutyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (number of moles added n=6);

Vinyl esters: for example, vinyl acetate, vinyl propionate, vinyl butylate, vinyl isobutylate, vinyl caproate, vinyl chloroacetate, vinyl methoxy acetate, vinylphenyl acetate, vinyl benzoate, vinyl salicylate;

Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide;

Methacrylamides: for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide;

Olefins: for example, dicyclopentadiene, ethylene, propylene, 1-butene, 1-pentene, vinyl chloride, vinylidene chloride, isoprene, chloroprene, butadiene, 2,3-dimethylbutadiene;

Styrenes: for example, styrene, methylstyrene, dimethylstyrene, trimethylstyrene, ethylstyrene, isopropylstyrene, chloromethylstyrene, methoxystyrene, chlorostyrene, dichlorostyrene, bromostyrene, methyl ester of vinylbenzoic acid;

Crotonates: for example, butyl crotonate, hexyl crotonate; Diesters of itaconic acid: for example, dimethyl itaconate, diethyl itaconate, dibutyl itaconate; Diesters of maleic acid: for example, diethyl maleate, dimethyl maleate, dibutyl maleate; Diesters of fumaric acid: for example, diethyl fumarate, dimethyl fumarate, dibutyl fumarate; and the like.

Examples of other monomers are as follows:

allyl compounds: for example, allyl acetate, allyl caproate, allyl laurate, allyl benzoate; vinyl ethers: for example, methyl vinyl ether, butyl vinyl ether, hexyl vinyl ether, methoxyethyl vinyl ether, dimethylaminoethyl vinyl ether; vinyl ketones: for example, methyl vinyl ketone, phenyl vinyl ketone, methoxyethyl vinyl ketone; vinyl-heterocyclic compounds: for example, vinylpyridine, N-vinylimidazole, N-vinyloxazolidone, N-vinyltriazole, N-vinylpyrrolidone; gycidyl esters: for example, glycidyl acrylate, glycidyl methacrylate; unsaturated nitriles: for example, acrylonitrile, methacrylonitrile; and the like.

The polymer that can be used in the present invention may be a homopolymer of any of the above-mentioned monomers or, if necessary, a copolymer of two or more of the above-mentioned monomers. Although the polymer that can be used in the present invention may comprise a monomer having an acid group to an extent that the polymer is not made water-soluble (the content of such a monomer is preferably 20% or less), the polymer that is entirely free of such a monomer is preferable. Examples of the monomer having an acid group include acrylic acid; methacrylic acid; itaconic acid; maleic acid; monoalkyl itaconate (e.g., monomethyl itaconate); monoalkyl maleate (e.g., monomethyl maleate); citraconic acid; styrenesulfonic acid; vinylbenzylsulfonic acid; acryloyloxyalkylsulfonic acid (e.g., acryloyloxymethylsulfonic acid); methacryloyloxyalkylsulfonic acid (e.g., methacryloyloxymethylsulfonic acid, methacryloyloxyethylsulfonic acid, methacryloyloxypropylsulfonic acid); acrylamidealkylsulfonic acid (e.g., 2-acrylamide-2-methylethanesulfonic acid, 2-acrylamide-2-methylpropanesulfonic acid, 2-acrylamide-2-methylbutanesulfonic acid); methacrylamidealkylsulfonic acid (e.g., 2-methacrylamide-2-methylethanesulfonic acid, 2-methacrylamide-2-methylpropanesulfonic acid, 2-methacrylamide-2-methylbutanesulfonic acid); acryloyloxyalkyl phosphate (e.g., acryloyloxyethyl phosphate, 3-acryloyloxypropyl-2-phosphate); methacryloyloxyalkyl phosphate (e.g., methacryloyloxyethyl phosphate, 3-methacryloyloxypropyl-2-phosphate); and the like.

These monomers having an acid group(s) may be a salt(s) of alkali metal (e.g., Na, K) or of an ammonium ion.

The monomers, which form the polymers that can be used in the present invention, are preferably acrylate-based monomers, methacrylate-based monomers, acrylamide-based monomers, and methacrylamide-based monomers.

The polymers, which are formed from the above-mentioned monomers, can be obtained by a solution polymerization process, a bulk polymerization process, a suspension polymerization process, or a latex polymerization process. Examples of the initiators, which can be used in the above-mentioned polymerization processes, include a water-soluble polymerization initiator and a lipophilic polymerization initiator.

Examples of the water-soluble polymerization initiator that can be used include persulfates, such as potassium persulfate, ammonium persulfate, and sodium persulfate; water-soluble azo compounds, such as sodium 4,4'-azobis-4-cyanovalerate, and 2,2'-azobis(2-amidinopropane) hydrochloride; and hydrogen peroxide.

Examples of the lipophilic polymerization initiator include lipophilic azo compounds, such as azobisisobutyronitrile, 2,2'-azobis(2,4-dimethylvaleronitrile), 2,2'-azobis(4-methoxy-2,4-dimethylvaleronitrile), 1,1'-azobis(cyclohexanone-1-carbonitrile), dimethyl 2,2'-azobisisobutyrate, and diethyl 2,2'-azobisisobutyrate, as well as benzoyl peroxide, lauryl peroxide, diisopropylperoxy dicarbonate, and di-tert-butylperoxide.

(2) As a Polyhydric Alcohol of a Polyester Resin Obtainable by the Condensation Between a Polyhydric Alcohol and a Polybasic Acid, Glycols Represented by HO—Ra—OH (Wherein Ra Represents a Hydrocarbon, Particularly an Aliphatic Hydrocarbon, Having 2 to about 12 Carbon Atoms) or a Polyalkylene Glycol are Effective. As the Polybasic Acid, Polybasic Acids Represented by HOOC—Rb—COOH (Wherein Rb Represents a Simple Linkage or a Hydrocarbon Having 1 to 12 Carbon Atoms) are Effective.

Specific examples of the polyhydric alcohol include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, glycerin, diglycerin, triglycerin, 1-methylglycerin, erythrite, mannite, sorbit, and the like.

Specific examples of the polybasic acid include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, methaconic acid, isopimelic acid, a cyclopentadiene/maleic anhydride adduct, a rosin/maleic anhydride adduct, and the like.

(3) Polyesters Obtainable by a Ring-Opening Polymerization Process

These polyesters are obtained from β-propiolactone, 6-caprolactone, dimethylpropiolactone, and the like.

(4) Others

Examples of other polymers include a polycarbonate resin obtained by a polycondensation reaction between a glycol or dihydric phenol and a carbonic ester or phosgene; a polyurethane resin obtained by a polyaddition reaction between a polyhydric alcohol and a polyvalent isocyanate; and a polyamide resin obtained from a polyvalent amine and a polybasic acid.

Although the number average molecular weight of the polymer that can be used in the present invention is not particularly limited, it is preferably 200,000 or less, more preferably 800 or more but 100,000 or less.

Hereinafter, specific examples of the polymer that can be used in the present invention will be shown, but the present invention should not be considered to be limited thereto (the compositions of the copolymers are indicated in terms of mass ratio). Additionally, the copolymers are not limited to block copolymers, but they may be graft copolymers.

PC-1) poly(N-sec-butylacrylamide)
PC-2) poly(N-tert-butylacrylamide)
PC-3) diacetoneacrylamide/methyl methacrylate copolymer (25:75)
PC-4) poly(cyclohexyl methacrylate)
PC-5) N-tert-butylacrylamide/methyl methacrylate copolymer (60:40)
PC-6) poly(N,N-dimethylacrylamide)
PC-7) poly(tert-butyl methacrylate)
PC-8) poly(vinyl acetate)
PC-9) poly(vinyl propionate)
PC-10) poly(methyl methacrylate)
PC-11) poly(ethyl methacrylate)
PC-12) poly(ethyl acrylate)
PC-13) vinyl acetate-vinyl alcohol copolymer (90:10)
PC-14) poly(n-butyl acrylate)
PC-15) poly(n-butyl methacrylate)
PC-16) poly(isobutyl methacrylate)
PC-17) poly(isopropyl methacrylate)
PC-18) poly(octyl acrylate)
PC-19) n-butyl acrylate/acrylamide copolymer (95:5)
PC-20) stearyl methacrylate/acrylic acid copolymer (90:10)
PC-21) methyl methacrylate/vinyl chloride copolymer (70:30)
PC-22) methyl methacrylate/styrene copolymer (90:10)
PC-23) methyl methacrylate/ethyl acrylate copolymer (50:50)
PC-24) n-butyl methacrylate/methyl methacrylate/styrene copolymer (50:20:30)
PC-25) vinyl acetate/acrylamide copolymer (85:15)
PC-26) vinyl chloride/vinyl acetate copolymer (65:35)
PC-27) methyl methacrylate/acrylonitrile copolymer (65:35)
PC-28) n-butyl methacrylate/pentyl methacrylate/N-vinyl-2-pyrrolidone copolymer (38:38:24)
PC-29) methyl methacrylate/n-butyl methacrylate/isobutyl methacrylate/acrylic acid copolymer (37:29:25:9)
PC-30) n-butyl methacrylate/acrylic acid (95:5)
PC-31) methyl methacrylate/acrylic acid copolymer (95:5)
PC-32) benzyl methacrylate/acrylic acid copolymer (93:7)

PC-33) n-butyl methacrylate/methyl methacrylate/benzyl methacrylate/acrylic acid copolymer (35:35:25:5)
PC-34) n-butyl methacrylate/methyl methacrylate/benzyl methacrylate copolymer (40:30:30)
PC-35) diacetoneacrylamide/methyl methacrylate copolymer (50:50)
PC-36) methyl vinyl ketone/isobutyl methacrylate copolymer (55:45)
PC-37) ethyl methacrylate/n-butyl acrylate copolymer (70:30)
PC-38) diacetoneacrylamide/n-butyl acrylate copolymer (60:40)
PC-39) methyl methacrylate/stearyl methacrylate/diacetoneacrylamide copolymer (40:40:20)
PC-40) n-butyl acrylate/stearyl methacrylate/diacetoneacrylamide copolymer (70:20:10)
PC-41) stearyl methacrylate/methyl methacrylate/acrylic acid copolymer (50:40:10)
PC-42) methyl methacrylate/styrene/vinylsulfonamide copolymer (70:20:10)
PC-43) methyl methacrylate/phenyl vinyl ketone copolymer (70:30)
PC-44) n-butyl acrylate/methyl methacrylate/n-butyl methacrylate copolymer (35:35:30)
PC-45) n-butyl methacrylate/N-vinyl-2-pyrrolidone copolymer (90:10)
PC-46) poly(pentyl acrylate)
PC-47) cyclohexyl methacrylate/methyl methacrylate/n-propyl methacrylate copolymer (37:29:34)
PC-48) poly(pentyl methacrylate)
PC-49) methyl methacrylate/n-butyl methacrylate copolymer (65:35)
PC-50) vinyl acetate/vinyl propionate copolymer (75:25)
PC-51) n-butyl methacrylate/sodium 3-acryloxybutane-1-sulfonate copolymer (97:3)
PC-52) n-butyl methacrylate/methyl methacrylate/acrylamide copolymer (35:35:30)
PC-53) n-butyl methacrylate/methyl methacrylate/vinyl chloride copolymer (37:36:27)
PC-54) n-butyl methacrylate/styrene copolymer (82:18)
PC-55) tert-butyl methacrylate/methyl methacrylate copolymer (70:30)
PC-56) poly(N-tert-butylmethacrylamide)
PC-57) N-tert-butylacrylamide/methylphenyl methacrylate copolymer (60:40)
PC-58) methyl methacrylate/acrylonitrile copolymer (70:30)
PC-59) methyl methacrylate/methyl vinyl ketone copolymer (28:72)
PC-60) methyl methacrylate/styrene copolymer (75:25)
PC-61) methyl methacrylate/hexyl methacrylate copolymer (70:30)
PC-62) butyl methacrylate/acrylic acid copolymer (85:15)
PC-63) methyl methacrylate/acrylic acid copolymer (80:20)
PC-64) methyl methacrylate/acrylic acid copolymer (98:2)
PC-65) methyl methacrylate/N-vinyl-2-pyrrolidone copolymer (90:10)
PC-66) n-butyl methacrylate/vinyl chloride copolymer (90:10)
PC-67) n-butyl methacrylate/styrene copolymer (70:30)
PC-68) 1,4-butanediol/adipic acid polyester
PC-69) ethylene glycousebacic acid polyester
PC-70) poly(caprolactam)
PC-71) poly(propiolactam)
PC-72) poly(dimethylpropiolactone)
PC-73) N-tert-butylacrylamide/dimethylaminoethylaramide copolymer (85:15)
PC-74) N-tert-butylmethacrylamide/vinylpyridine copolymer (95:5)
PC-75) diethyl maleate/n-butyl acrylate copolymer (65:35)
PC-76) N-tert-butylacrylamide/2-methoxyethyl acrylate copolymer (55:45)

The polymer of still another preferable mode that can be used in the present invention is a polymer substantially insoluble in water which comprises as a constituent element thereof a monomer unit having at least one aromatic group, and which has a number average molecular weight of 2,000 or less. The number average molecular weight is preferably 200 or more but less than 2,000, and more preferably 200 or more but 1,000 or less. The polymer that can be used in the present invention may be a so-called homopolymer composed of one kind of monomer unit, or a copolymer composed of two kinds or more of monomer units. In the case of a copolymer, it preferably comprises the monomer unit having the aromatic group, according to the present invention, in a proportion of 20% or more of the weight composition of the copolymer. The polymer structure is not particularly limited in so far as the above-mentioned condition is fulfilled. Examples of the polymer having the preferred polymer structure include a polymer whose constituent element is styrene, α-methylstyrene, β-methylstyrene, or a monomer having a substituent on the benzene ring of such a monomer; a polymer whose constituent element is an aromatic acrylamide, an aromatic methacrylamide, an aromatic acrylate, or an aromatic methacrylate. Examples of the aromatic group include a phenyl group, a naphthyl group, a benzyl group, a biphenyl group, and the like. These aromatic groups may have a substituent(s) such as an alkyl group, a halogen atom, and the like. In the case of a copolymer, comonomers listed, for example, in JP-A-63-264748 can be used preferably. From the viewpoints of availability of raw materials and stability of an emulsion with the lapse of time, a polymer derived from styrene, α-methylstyrene or β-methylstyrene is preferable.

Hereinafter specific examples of the polymer that can be used in the present invention will be shown, but the present invention should not be considered to be limited thereto. In the specific examples, l, m, and n may take any value only if the number average molecular weight of the polymer is less than 2,000.

Additionally, the copolymers are not limited to block copolymers, but they may be graft copolymers.

P-1

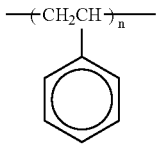

P-2

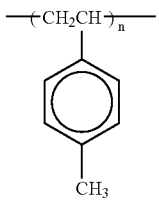

-continued
P-3
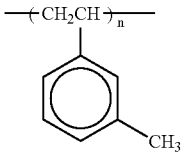
P-4
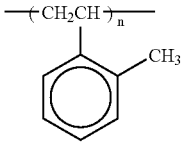
P-5
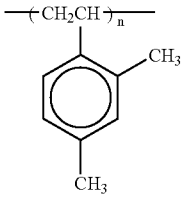
P-6
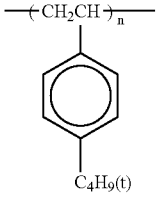
P-7
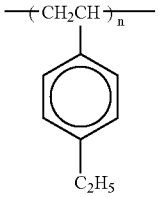
P-8
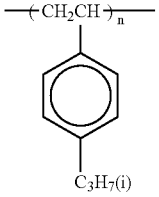
P-9
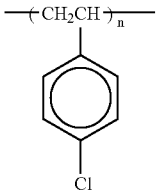
P-10
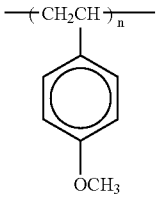
-continued
P-11
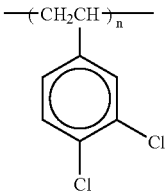
P-12
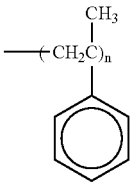
P-13
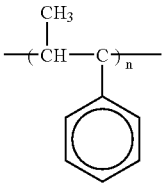
P-14
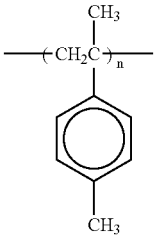
P-15
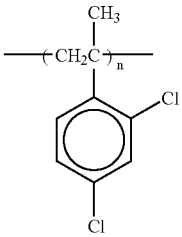
P-16
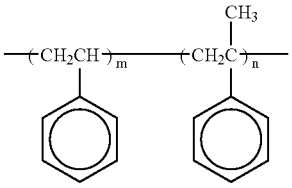
(m:n = 1:4)
P-17
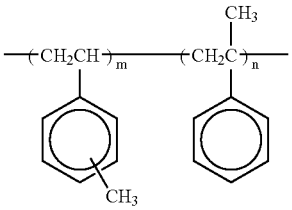
(m:n = 1:1)

-continued
P-18
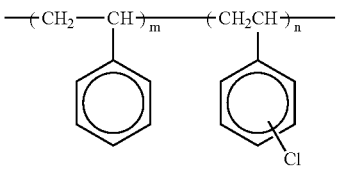
(m:n = 9:1)
P-19
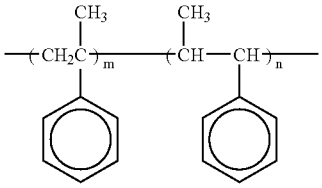
(m:n = 1:1)
P-20
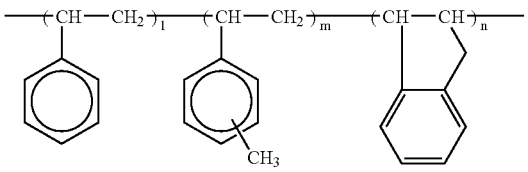
(1:m:n = 5:5:1)
P-21
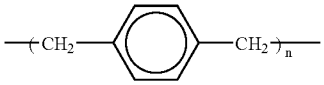
P-22
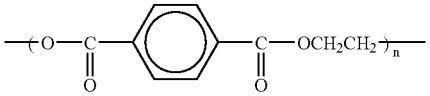
P-23
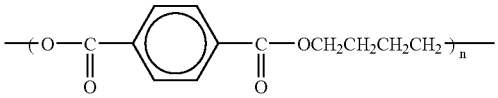
P-24
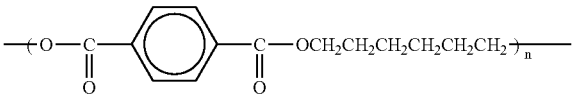
P-25
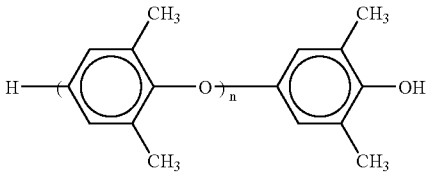
P-26
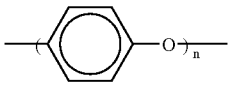
P-27
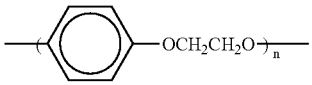
-continued
P-28
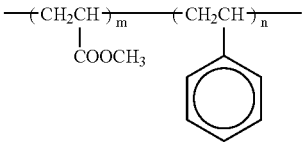
(m:n = 1:1)
P-29
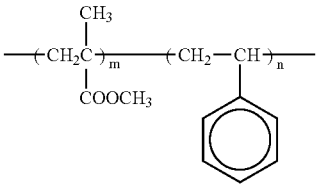
(m:n = 1:1)
P-30
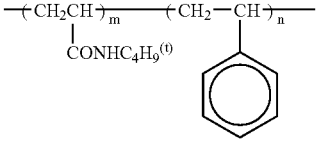
(m:n = 1:9)
P-31
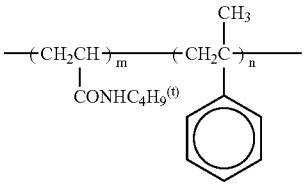
(m:n = 1:4)
P-32
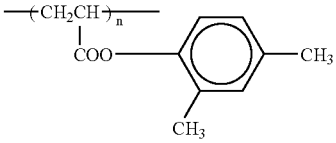
P-33
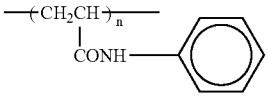
P-34
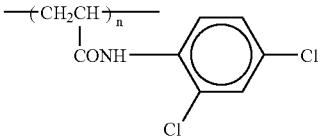
P-35
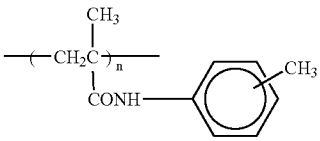
P-36
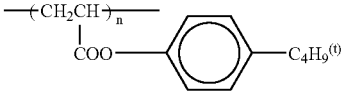

-continued

P-37

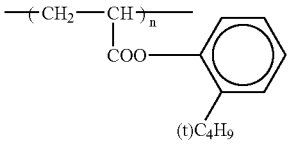

In the present invention, it is preferable that the polymer soluble in an organic solvent be used in an amount of 0.5 to 500 mass %, more preferably 5 to 100 mass %, based on the coupler that forms the dye slightly soluble in the organic solvent. Additionally, two or more polymers soluble in an organic solvent may be used in combination.

In the present invention, the polymer soluble in an organic solvent that can be used in the present invention is preferably used as a dispersion of lipophilic fine particles in which the polymer is present together with the coupler according to the present invention and forming the dye slightly soluble in the organic solvent. The dispersion can be prepared by dissolving the coupler forming the dye slightly soluble in the organic solvent and at least one polymer soluble in an organic solvent that can be used in the present invention in a high boiling organic solvent substantially insoluble in water, and emulsifying and dispersing the resulting solution in a hydrophilic protective colloid.

Then, the compounds represented by formulae (Ph-1) and (Ph-2) that can be preferably used in the present invention are described in detail.

$R_{b1}$ represents an aliphatic group, an aryl group, a carbamoyl group, an acylamino group, a carbonyl group or a sulfonyl group, and $R_{b6}$ represents an aliphatic group, an aryl group, an amino group or an acyl group. $R_{b7}$ to $R_{b9}$, $R_{b19}$ and $R_{b20}$ each independently represent a hydrogen atom, a halogen atom, a hydroxy group, an aliphatic group, an aryl group, a heterocyclic group, an alkyloxy group, an aryloxy group, a heterocyclicoxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group or an arylthio group. $R_{b17}$ and $R_{b18}$ each independently represent an aliphatic group or aryl group.

The groups recited above may have a substituent. The term "aliphatic group" as used above is a generic name for an alkyl group, an alkenyl group, an alkynyl group, a cycloalkyl group, a cycloalkenyl group and a cycloalkynyl group, with examples including methyl, ethyl, i-propyl, t-butyl, t-octyl and cyclohexyl. Examples of the aryl group include phenyl and naphthyl groups which each may have a substituent.

Examples of the groups that $R_{b1}$ can represent, namely the aliphatic group, the aryl group, the carbamoyl group, the acylamino group (referred to as amido group also), the carbonyl group (referred to as acyl group also) and the sulfonyl group, are as follows, and each of the corresponding groups can include the following groups as examples:

Examples thereof include an alkyl group (e.g., methyl, ethyl, propyl, isopropyl, t-butyl, pentyl, hexyl, octyl and dodecyl), an cycloalkyl group (e.g., cyclopentyl and cylcohexyl), an alkenyl group (e.g., vinyl and allyl), an alkynyl group (e.g., propargyl), an aryl group (e.g., phenyl and naphthyl), an acylamino group (e.g., methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), an acyl group (e.g., acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl), and a sulfonyl group (e.g., methylsulfonyl, ethylsulfonyl, butylsulfonyl, cyclohexylsulfonyl, 2-ethylhexylsulfonyl, dodecylsulfonyl, phenylsulfonyl, naphthylsulfonyl, 2-pyridylsulfonyl).

$R_{b6}$ represents an aliphatic group (e.g., 1-ethylpentyl, 1-hexylnonyl, undecyl, dodecyl, pentadecyl, heptadecyl), an aryl group, an amino group or an acyl group. $R_{b7}$ to $R_{b9}$, $R_{b19}$ and $R_{b20}$ each independently represent a hydrogen atom, a halogen atom, a hydroxy group, an aliphatic group, an aryl group, a heterocyclic group, an aliphatic oxy group (e.g., methoxy, octyloxy, cyclohexyloxy), an aryloxy group, a heterocyclic oxy group, an oxycarbonyl group (preferably an alkoxycarbonyl group or an aryloxycarbonyl group, such as methoxycarbonyl, hexadecyloxycarbonyl, phenoxycarbonyl, p-chlorophenoxycarbonyl), an acyl group, an acyloxy group, an oxycarbonyloxy group (preferably an alkoxycarbonyloxy group or an aryloxycarbonyloxy group, such as methoxycarbonyloxy, octyloxycarbonyloxy, phenoxycarbonyloxy), an aliphatic sulfonyl group (e.g., methanesulfonyl, butanesulfonyl), a carbamoyl group, an acylamino group, an acylamido group (e.g., heptylamido, undecylamido, pentadecylamido, 1-hexylnonylamido), a sulfonyl group, a sulfinyl group, a sulfamoyl group, an alkylthio group, or an arylthio group. $R_{b17}$ and $R_{b18}$ each independently represent an aliphatic group (e.g., 1-ethylhexyl, 1-hexyldecyl, dodecyl, tetradecyl, hexadecyl, octadecyl), or an aryl group.

In formula (Ph-1), $R_{b6}$ is preferably an aliphatic group, more preferably an unsubstituted aliphatic group, and particularly preferably a branched aliphatic group. The number of total carbon atoms in $R_{b6}$ is preferably from 8 to 25, particularly preferably from 12 to 20. $R_{b1}$ is preferably an aliphatic group, an aryl group, a carbamoyl group or an oxycarbonyl group; more preferably an aliphatic group; and particularly preferably a methyl group. Each of $R_{b7}$, $R_{b8}$ and $R_{b9}$ is preferably a hydrogen atom or an aliphatic group, particularly preferably a hydrogen atom.

In formula (Ph-2), each of $R_{b17}$ and $R_{b18}$ is preferably an aliphatic group. Each of $R_{17}$ and $R_{18}$ is preferably a hydrogen atom or an aliphatic group, particularly preferably a hydrogen atom. $R_{b1}$ is preferably a carbamoyl group, an oxycarbonyl group or an aliphatic group; and particularly preferably a carbamoyl group or an oxycarbonyl group.

Of the compounds represented by formulae (Ph-1) and (Ph-2), compounds represented by the following formula (Ph-3) are preferred over the others.

Formula Ph-3

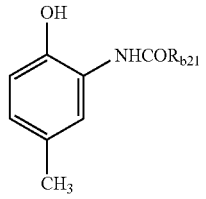

In the above formula, $R_{b21}$ represents a straight-chain, branched or cyclic, saturated or unsaturated, unsubstituted aliphatic group, or a branched or cyclic, saturated or unsaturated aliphatic group substituted with a halogen atom, a hydroxyl group, —SR', —CONR'R", —$CO_2$R' or —OC (═O)R'. R' and R" each independently represent a hydrogen atom or a straight-chain, branched or cyclic unsubstituted aliphatic group.

The compounds represented by formula (Ph-3) are explained in detail below.

In formula (Ph-3), $R_{b21}$ represents a straight-chain, branched or cyclic, saturated or unsaturated, unsubstituted aliphatic group, or a straight-chain, branched or cyclic, saturated or unsaturated aliphatic group substituted with a halogen atom, a hydroxyl group, —SR', —CONR'R", —$CO_2$R', or —OCOR'. R' and R" each independently represent a hydrogen atom, or a straight-chain, branched or cyclic, saturated or unsaturated, unsubstituted aliphatic group. Examples of the straight-chain unsubstituted aliphatic group include heptyl, nonyl, undecyl, dodecyl, pentadecyl, heptadecyl, octadecyl, icosyl, henicosyl, tricosyl, 8-heptadecel, 8,11-heptadecadienyl, and 8,11,14-heptadecatrienyl. Examples of the branched aliphatic group include t-butyl, t-pentyl, 1-propylbutyl, 1-ethylpentyl, and 1-hexylnonyl. Examples of the cyclic aliphatic group include cyclohexyl, cyclooctyl, dicyclohexylmethyl, (4-methyl)cyclohexylmethyl, adamantyl, norbornenyl, and 1-(3-methyl)hexyl-5-methylnonyl.

Examples of the halogen atom with which the aliphatic group of $R_{b21}$ may be substituted, include fluorine, chlorine, bromine and iodine atoms. Examples of the aliphatic group substituted with a halogen atom, include perfluorononyl, 8,9-dichloroheptadecyl, 1-chloro-1-hexylnonyl, 1-bromoheptyl, 1-bromopropadecyl, and 1-bromo-1-hexylnonyl. Examples of the aliphatic group substituted with a hydroxyl group, include 9-hydroxynonyl, 15-hydroxypentadecyl, and 11-hydroxyheptapentyl. Examples of the aliphatic group substituted with —SR', include 2-dodecylthioethyl, 1-hexyl-1-methylthiononyl, 1-t-octylthiopentyl, 1-methylthiopropadecyl, and 1-t-butylthio-1-hexylnonyl. Examples of the aliphatic group substituted with —CONR'R", include 1-(N,N-dibutyl) carbamoyl butyl, 3-(N,N-dibutyl)carbamoyl-1-methyl-propyl, 1-carbamoylmethyl heptadecyl, and 2-(N,N-dibutyl)carbamoylcyclohexyl. Examples of the aliphatic group substituted with —$CO_2$R' include 2-dodecyloxycarbonyl-1-methylethyl, and 1-dodecyl-2-methoxy carbonylethyl. Examples of the aliphatic group substituted with —OC(═O) R' include dodecylcarbonyloxyethyl and 2-acetyloxy-1-dodecylethyl. Double 2-acylamino-p-cresol mother skeletons may hold a single aliphatic group in common.

The total of carbon atoms in $R_{b21}$ is preferably in the range of 8 to 25, particularly preferably in the range of 12 to 20. If the total of carbon atoms is less than the range, an inhibitor tends to easily come out of an oil layer dispersed together with a coupler, so that the inhibitor becomes difficult to exert its effect. In contrast, if the total of carbon atoms is more than the range, when it is added in an equivalent molar amount, the resulting increase in volume makes it difficult to form a thin layer, and it tends to hardly dissolve into the above oil layer in which a coupler is co-dispersed.

Further, as the kind of preferable aliphatic groups, an unsubstituted aliphatic group is preferred from the viewpoint of an excellent fade-preventing capability. Of these aliphatic groups, a straight-chain, or branched aliphatic group is more preferable, and a branched aliphatic group is particularly preferred. Among the branched aliphatic groups, an aliphatic group branching at its α-position is particularly preferable.

Preferable specific examples of the compounds represented by formulae (Ph-1) to (Ph-3) that can be used in the present invention are shown below, but the present invention is not limited to these compounds.

(A-1)

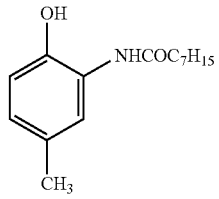

(A-2)

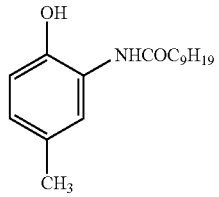

(A-3)

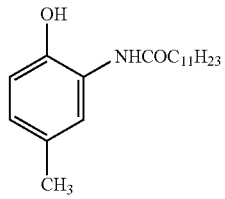

(A-4)

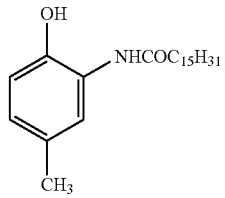

(A-5)

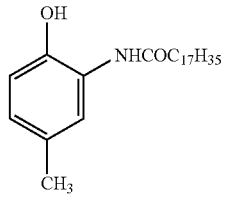

(A-6)

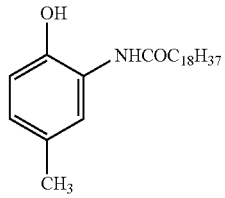

(A-7)

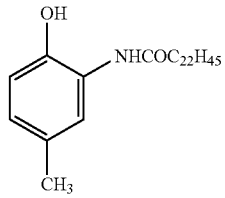

-continued
(A-8)
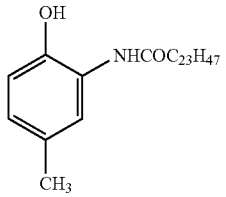
(A-9)
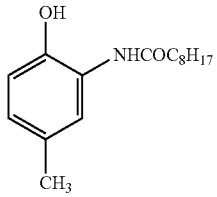
(A-10)
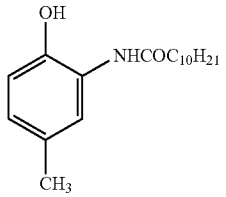
(A-11)
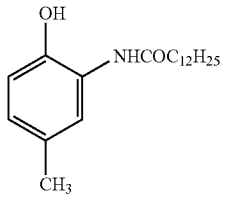
(A-12)
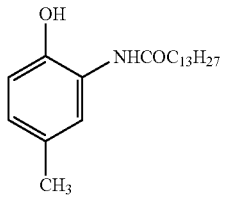
(A-13)
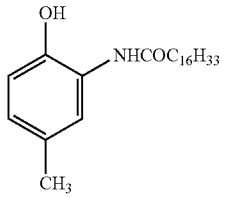
(A-14)
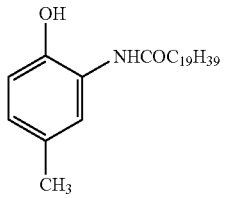
-continued
(A-15)
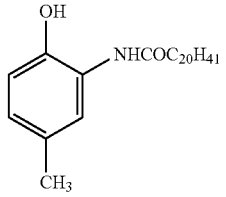
(A-16)
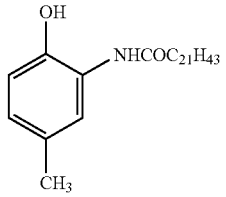
(A-17)
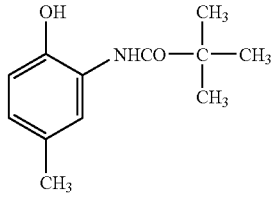
(A-18)
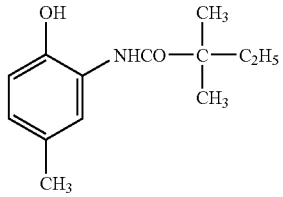
(A-19)
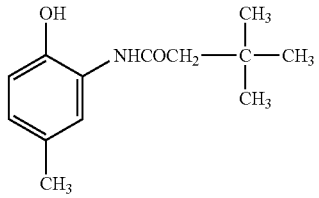
(A-20)
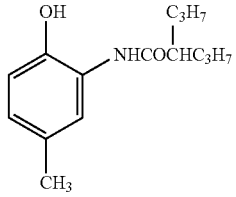
(A-21)
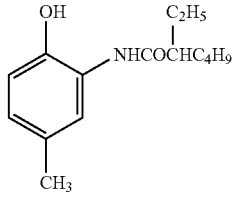

-continued
(A-22)
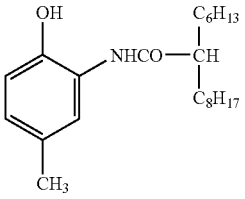
(A-23)
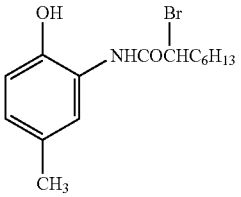
(A-24)
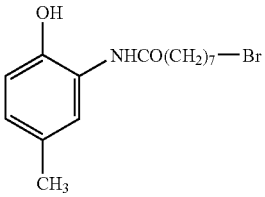
(A-25)
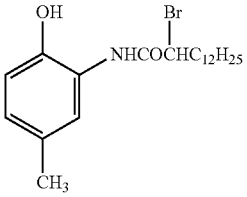
(A-26)
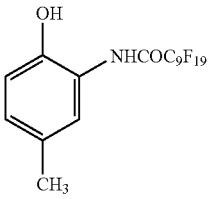
(A-27)
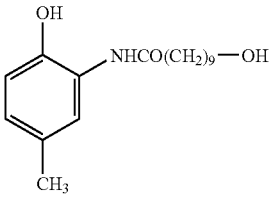
(A-28)
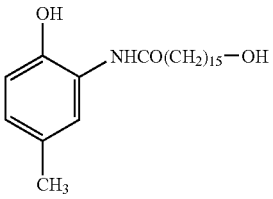
-continued
(A-29)
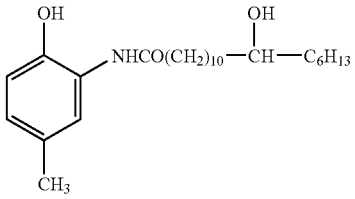
(A-30)
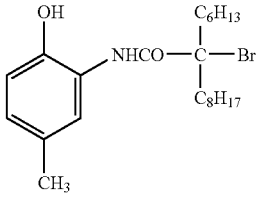
(A-31)
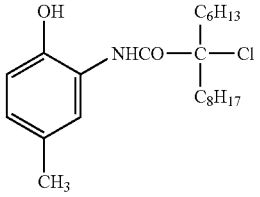
(A-32)
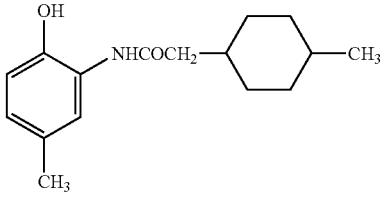
(A-33)
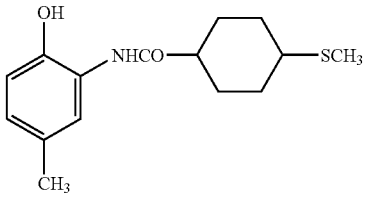
(A-34)
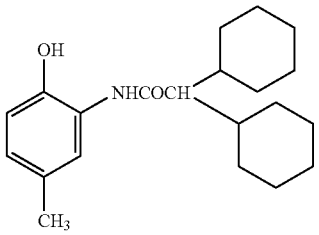
(A-35)
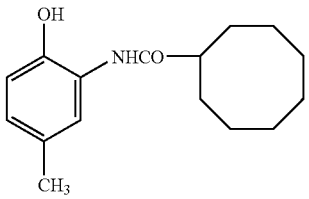

-continued
(A-36)
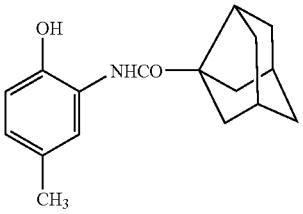
(A-37)
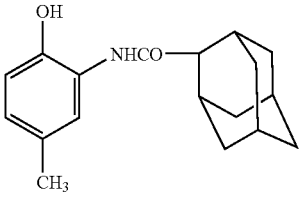
(A-38)
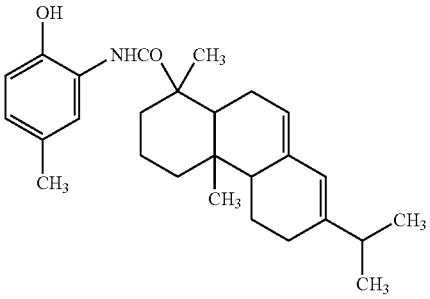
(A-39)
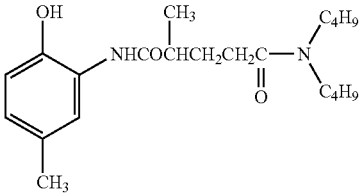
(A-40)
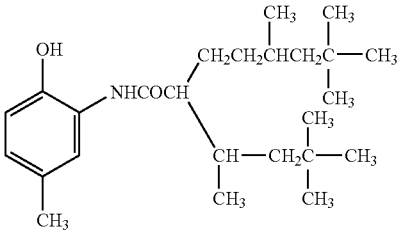
(A-41)
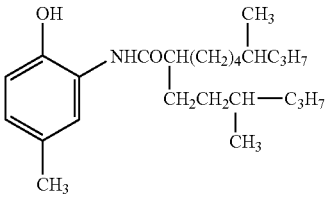
(A-42)
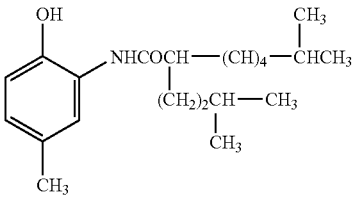
-continued
(A-43)
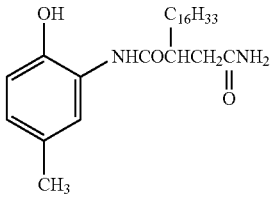
(A-44)
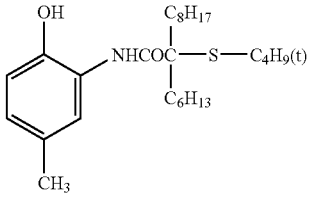
(A-45)
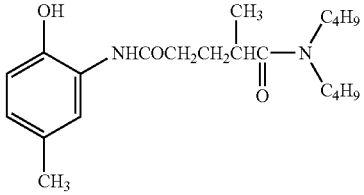
(A-46)
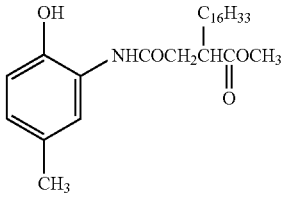
(A-47)
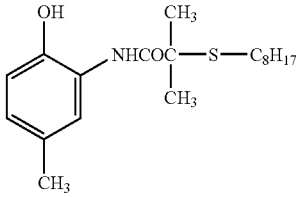
(A-48)
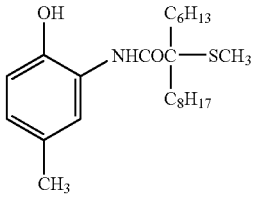
(A-49)
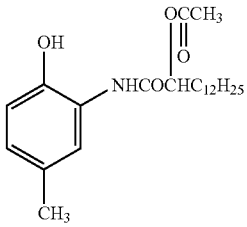

-continued
(A-50)
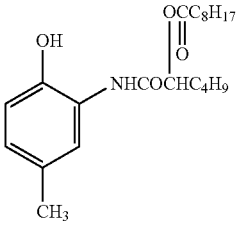
(A-51)
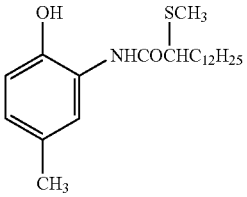
(A-52)
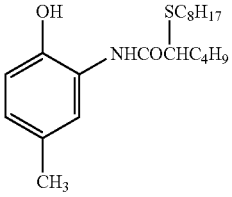
(A-53)
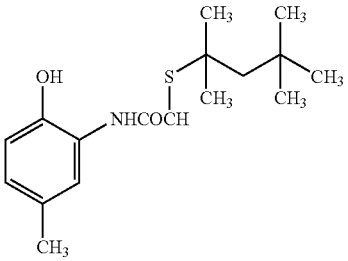
(A-54)
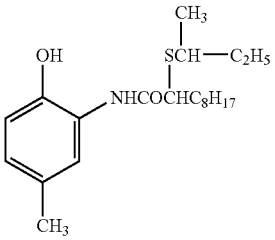
(A-55)
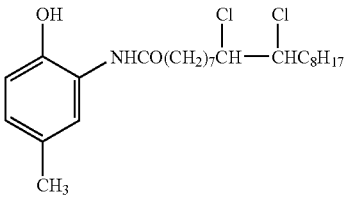
(A-56)
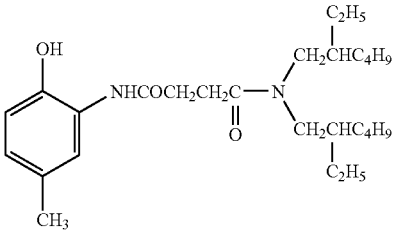
-continued
(A-57)
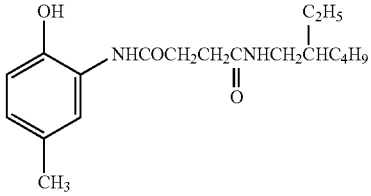
(A-58)
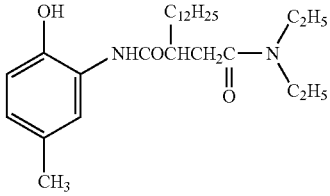
(A-59)
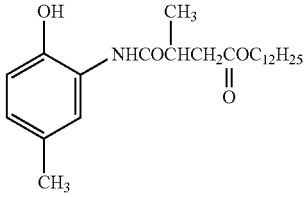
(A-60)
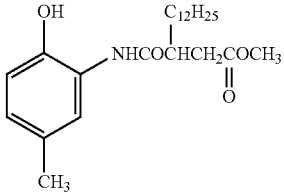
(A-61)
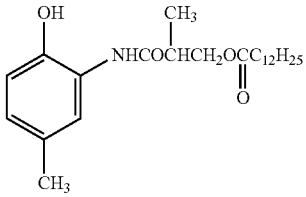
(A-62)
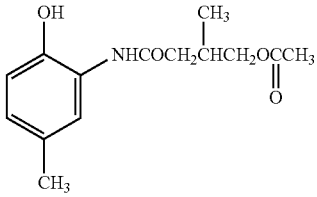
(A-63)
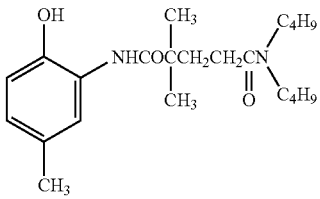

-continued
(A-64)
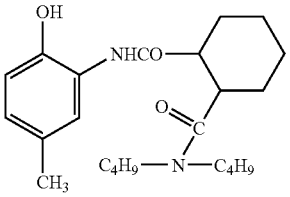
(A-65)
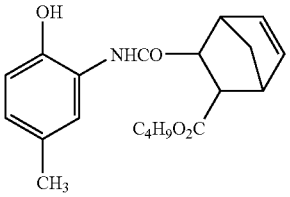
(A-66)
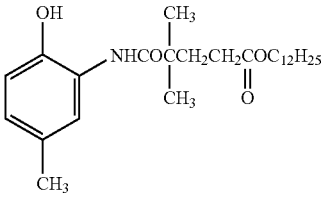
(A-67)
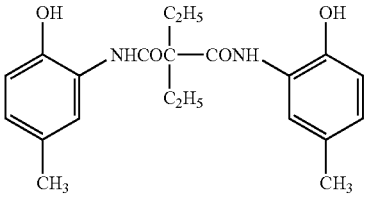
(A-68)
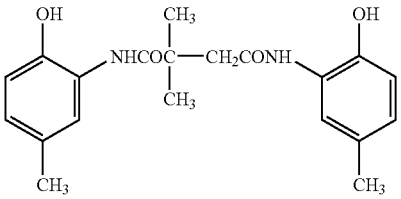
(A-69)
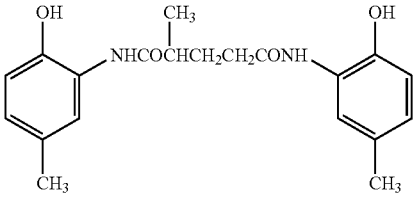
(A-70)
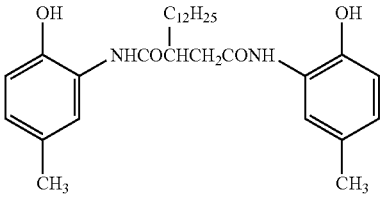
-continued
(A-71)
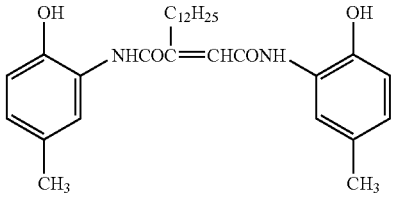
(A-72)
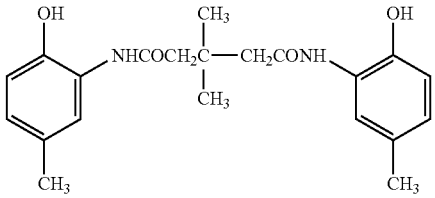
(A-73)
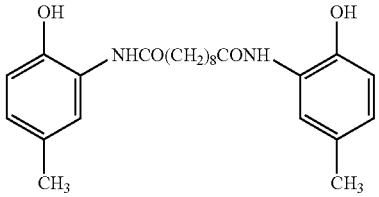
(A-74)
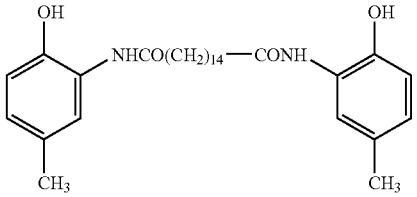
(A-75)
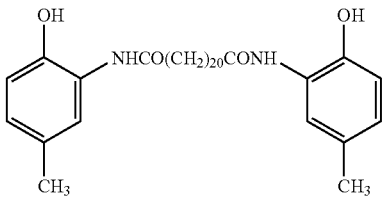
(A-76)
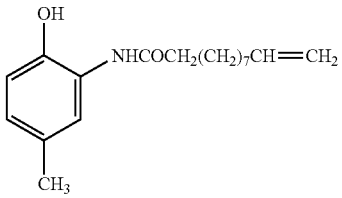
(A-77)
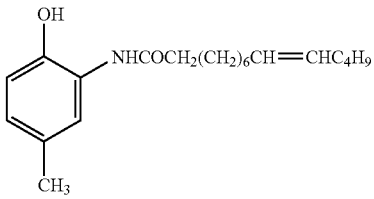

-continued
(A-78)
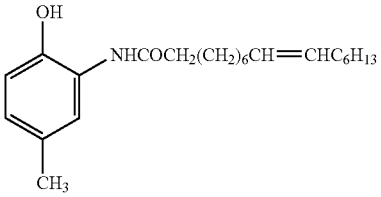
(A-79)
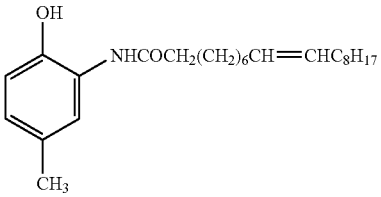
(A-80)
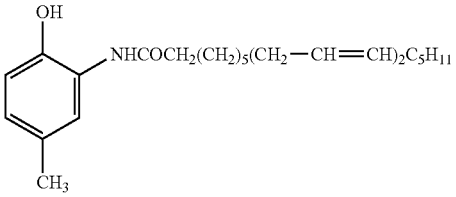
(A-81)
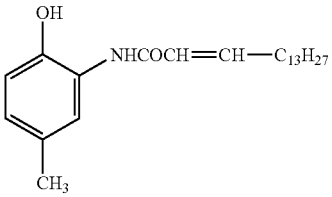
(A-82)
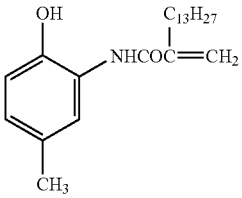
(A-83)
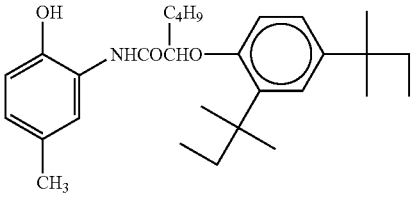
(A-84)
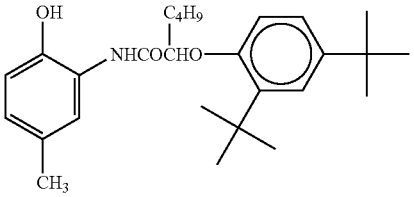
-continued
(A-85)
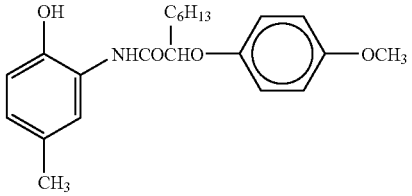
(A-86)
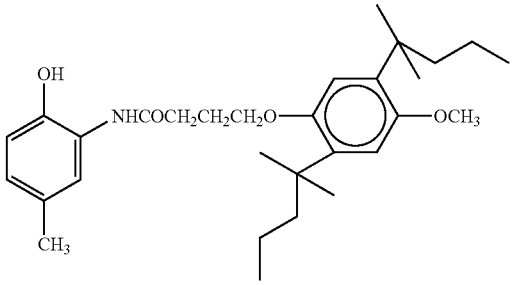
(A-87)
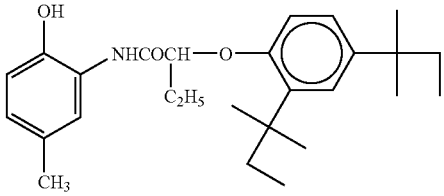
(A-88)
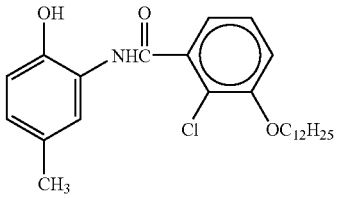
(A-89)
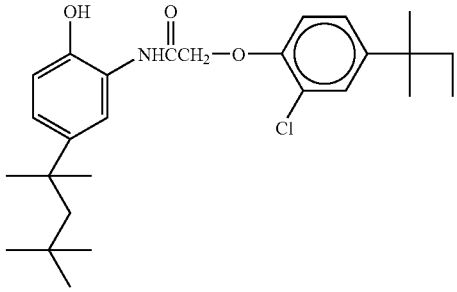
(A-90)
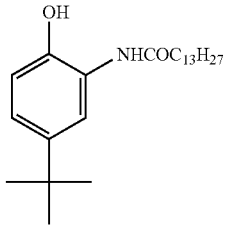

-continued
(A-91)
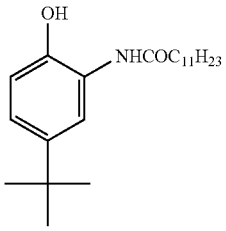
(A-92)
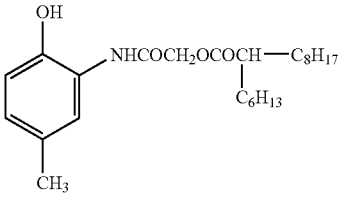
(A-93)
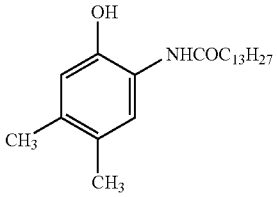
(A-94)
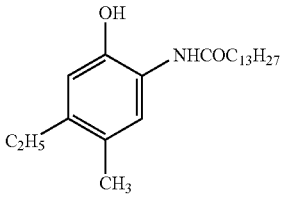
(A-95)
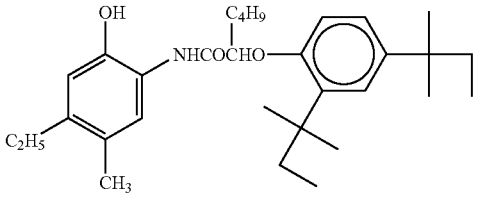
(A-96)
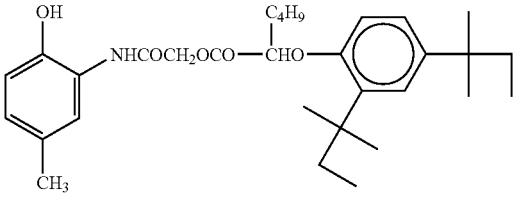
(A-97)
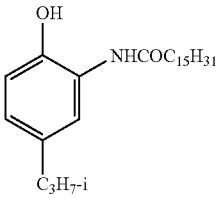
-continued
(A-98)
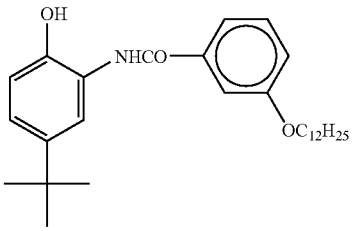
(A-99)
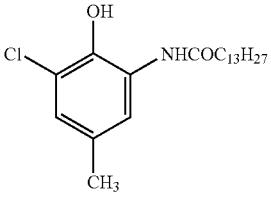
(A-100)
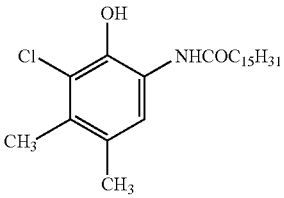
(A-101)
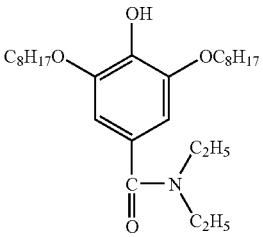
(A-102)
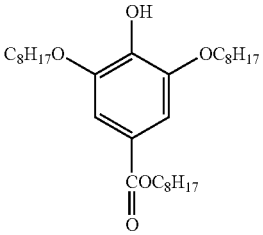
(A-103)
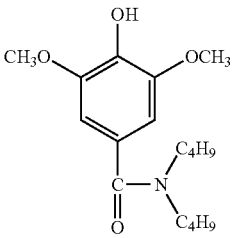
(A-104)
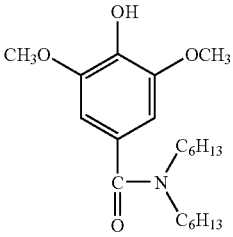

-continued (A-105)

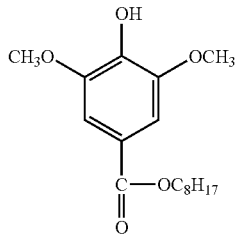

(A-106)

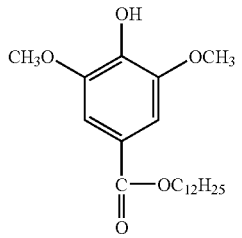

(A-107)

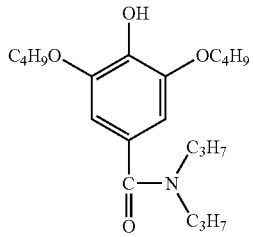

(A-108)

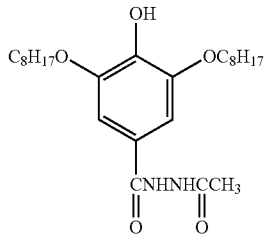

(A-109)

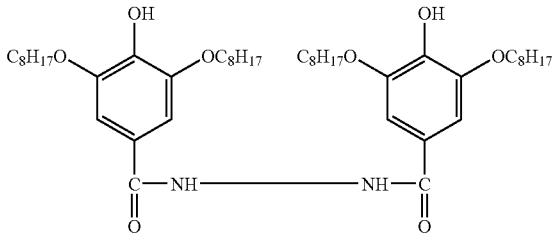

(A-110)

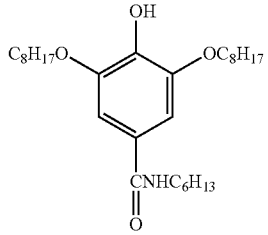

-continued (A-111)

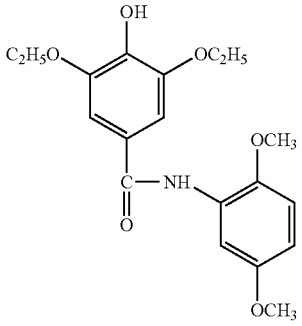

Next, a concrete synthesis method of the compounds represented by any one of formulae (Ph-1) to (Ph-3) is shown below.

Synthesis of (A-22)

To 28.7 g (0.233 mole) of 2-amino-p-cresol and 38.6 g (0.460 mole) of sodium bicarbonate, 126 ml of acetonitrile was added and 63.2 g (0.23 mole) of isopalmitoyl chloride was added dropwise over 30 minutes with heating and stirring. After additional heating and stirring for 1 hour, 100 ml of methanol was added thereto. The resulting insoluble residue was separated by filtration and washed with 100 ml of methanol. To the thus-obtained solution, 50 ml of water was added dropwise over 25 minutes with stirring at room temperature for crystallization. Further stirring was continued for 2 hours with water-cooling. The precipitated crystals were separated by filtration and washed with 250 ml of methanol/water=5/1, and further washed with 250 ml of water. The thus-obtained crystals were dried at 45° C. for 1 day by means of a blast drier, and 80.5 g of white crystals were obtained. Yield: 96.8%, Melting point: 82 to 84° C. Other compounds can also be synthesized in the similar manner as in the method set forth above.

The compounds represented by any one of formulae (E-1), (E-2), and (E-3) are explained in detail below.

In formulae (E-1), (E-2), and (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or —$Si(R_{47})(R_{48})(R_{49})$ in which $R_{47}$, $R_{48}$ and $R_{49}$ each independently represent an aliphatic group, an aryl group, an aliphatic oxy group, or an aryloxy group. $R_{42}$ to $R_{46}$ each independently represent a hydrogen atom, or a substituent. $R_{a1}$ to $R_{a4}$ each independently represent a hydrogen atom, or an aliphatic group (for example, methyl, ethyl). Preferable specific examples of the aliphatic group, the aryl group, the acyl group, the aliphatic sulfonyl group and the arylsulfonyl group are the same as those set forth in the explanation of formulae (Ph-1) and (Ph-2). Examples of each of the heterocyclic group, the aliphatic oxycarbonyl group and the aryloxycarbonyl group are as follows, and each of the corresponding groups can include the following groups as examples:

Example thereof include a heterocyclic group (this is also referred to as a hetero-ring group; for example, pyridyl, thiazolyl, oxazolyl, imidazolyl, furyl, pyrrolyl, pyrazinyl, pyrimidinyl, pyridazinyl, selenazolyl, sulforanyl, piperidinyl, pyrazolyl, tetrazolyl), an alkoxycarbonyl group (for example, methyloxycarbonyl, ethyloxycarbonyl, butyloxycarbonyl, octyloxycarbonyl, dodecyloxycarbonyl), a cycloalkoxycarbonyl group (for example, cyclopentyloxycarbonyl, cyclohexyloxycarbonyl), an aryloxycarbonyl group (for example, phenyloxycarbonyl, naphthyloxycarbonyl), and a heterocyclic oxycarbonyl group (for example, pyridyloxycarbonyl, furyloxycarbonyl, pyrazinyloxycarbonyl, pyrimidinyloxycarbonyl).

With respect to the compounds represented by any one of formulae (E-1) to (E-3), the groups that are preferred from the viewpoint of the effect obtained by the present invention, are explained below.

In formulae (E-1) to (E-3), it is preferred that $R_{41}$ represents an aliphatic group, an acyl group, an aliphatic oxycarbonyl group, an aryloxycarbonyl group, or a phosphoryl group, and $R_{42}$, $R_{43}$, $R_{45}$ and $R_{46}$ each independently represent a hydrogen atom, an aliphatic group, an aliphatic oxy group, or an acylamino group. It is more preferred that $R_{41}$ represents an aliphatic group, and $R_{42}$, $R_{43}$, $R_{45}$ and $R_{46}$ each independently represent a hydrogen atom, or an aliphatic group.

Preferable specific examples of the compounds represented by any one of formulae (E-1) to (E-3) that can be used in the present invention are shown below, but the present invention is not limited to these compounds.

B-1

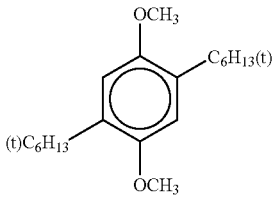

B-2

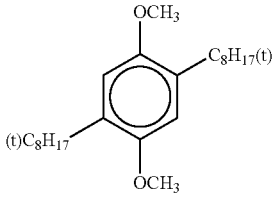

B-3

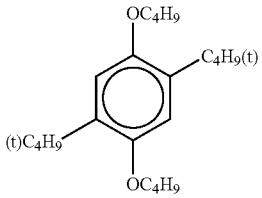

B-4

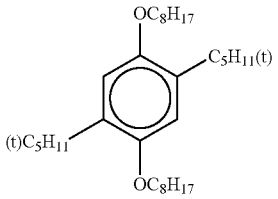

B-5

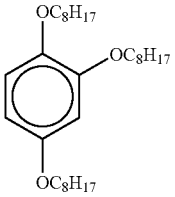

-continued

B-6

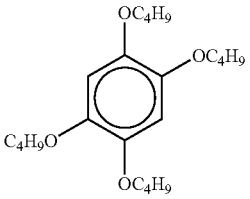

B-7

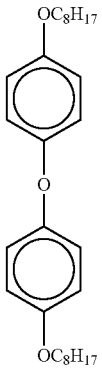

B-8

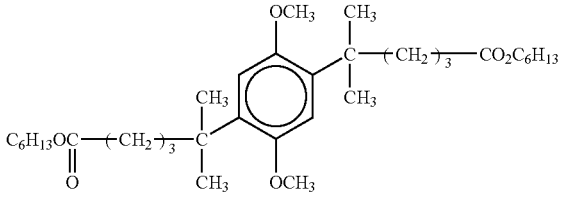

B-9

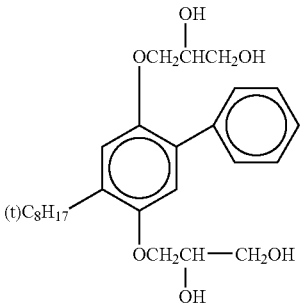

B-10

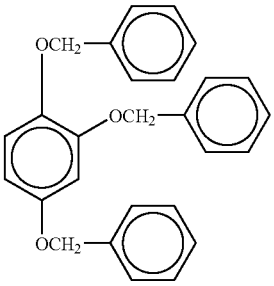

-continued

B-11

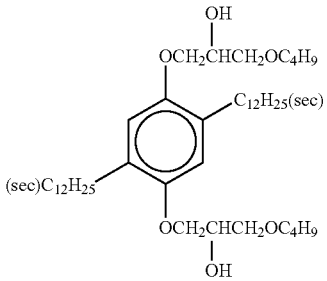

B-12

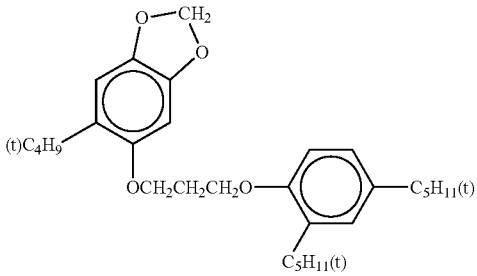

B-13

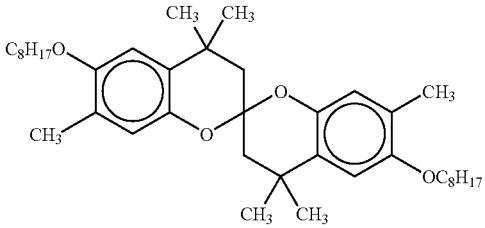

B-14

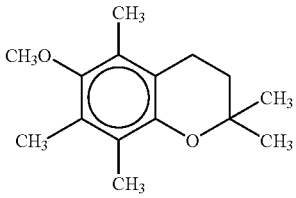

B-15

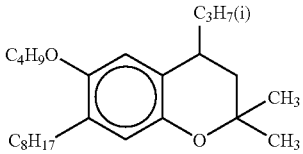

B-16

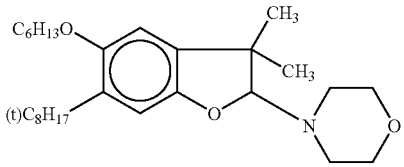

B-17

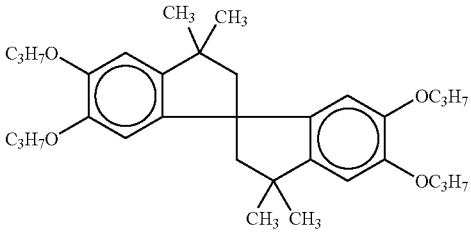

-continued

B-18

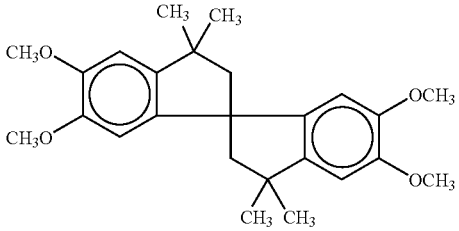

B-19

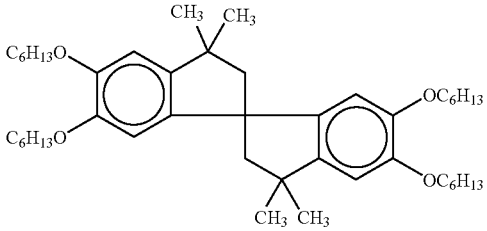

B-20

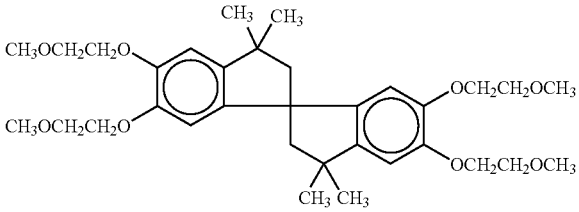

B-21

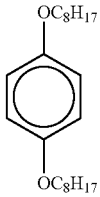

The addition amount of the compound represented by any one of formulae (E-1) to (E-3) that can be preferably used in the present invention, is preferably in the range of from 10 mole % to 100 mole %, more preferably in the range of from 20 mole % to 80 mole %, especially preferably in the range of from 30 mole % to 60 mole %, to the coupler.

The compounds represented by any one of formulae (E-1) to (E-3) can be synthesized by the methods described in JP-A-53-17729, JP-A-53-20327, JP-A-54-145530, JP-A-55-21004, and JP-A-56-159644, or according to these methods.

Next, a compound represented by any one of formulae (TS-I) to (TS-VII), a metal complex, and a ultraviolet ray absorbing agent, each of which can be preferably used in the present invention, are explained in detail below.

The compound represented by formula (TS-I) is described in more detail.

In formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group (e.g., diethyl phosphoryl, diphenyl phosphoryl, diphenoxy phosphoryl), or —$Si(R_{58})(R_{59})(R_{60})$.

$R_{58}$, $R_{59}$, and $R_{60}$ each independently represent an aliphatic group, an aryl group, an aliphatic oxy group, or an aryloxy group. $X_{51}$, represents —O— or —$N(R_{57})$—, in which $R_{57}$ has the same meaning as $R_{51}$. $X_{55}$ represents —N═ or —C($R_{52}$)═, $X_{56}$ represents —N═ or —C($R_{54}$)═, and $X_{57}$ represents —N═ or —C($R_{56}$)═. $R_{52}$, $R_{53}$, $R_{54}$, $R_{55}$, and $R_{56}$ each independently represent a hydrogen atom, or a substituent. As preferable substituents exemplified are an aliphatic group, an aryl group, an aliphatic oxycarbonyl group, an aryloxycarbonyl group, an aliphatic sulfonyl group, an aryl sulfonyl group, and —$X_{51}$—$R_{51}$. However, all of $R_{51}$ to $R_{57}$ cannot simultaneously represent hydrogen atoms, respectively, and the total number of carbon atoms in each of these groups is generally 10 or more (preferably 10 to 50), and more preferably 16 or more (preferably 16 to 40).

Further, the compound represented by formula (TS-I) is neither identical to the compound represented by formula (Ph-1) to (Ph-3), nor the compound represented by any one of formulae (E-1) to (E-3).

The compound represented by formula (TS-I) that can be used in the present invention includes those compounds represented by any of, for example, formula (I) of JP-B-63-50691, formula (IIIa), (IIIb), or (IIIc) of JP-B-2-37575, formula of JP-B-2-50457, formula of JP-B-5-67220, formula (IX) of JP-B-5-70809, formula of JP-B-6-19534, formula (I) of JP-A-62-227889, formula (I) or (II) of JP-A-62-244046, formula (I) or (II) of JP-A-2-66541, formula (II) or (III) of JP-A-2-139544, formula (I) of JP-A-2-194062, formula (B), (C), or (D) of JP-A-2-212836, formula (III) of JP-A-3-200758, formula (II) or (III) of JP-A-3-48845, formula (B), (C), or (D) of JP-A-3-266836, formula (I) of JP-A-3-969440, formula (I) of JP-A-4-330440, formula (I) of JP-A-5-297541, formula of JP-A-6-130602, formula (1), (2), or (3) of International Patent Application Publication WO 91/11749, formula (I) of German Patent Publication DE4,008,785A1, formula (II) of U.S. Pat. No. 4,931,382, formula (a) of European Patent No. 203,746B1, formula (I) of European Patent No. 264,730B1, and formula (III) of JP-A-62-89962. These compounds can be synthesized according to the methods described in these publications, or general methods described in Shin Jikken Kagaku Koza, Vol. 14 (Maruzen Co., Ltd.) (1977, 1978).

From the viewpoint of the effects of the present invention, the compound represented by formula (TS-I) is preferably a compound represented by any one of formulae (TS-ID), (TS-IE), (TS-IF), (TS-IG), and (TS-IH) shown below.

Formula (TS-ID)

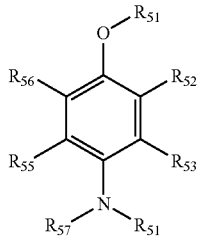

Formula (TS-IE)

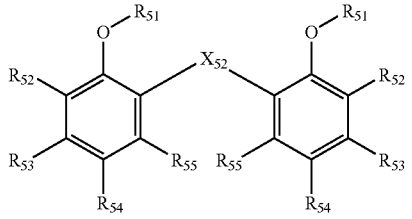

-continued

Formula (TS-IF)

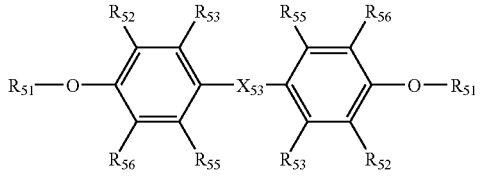

Formula (TS-IG)

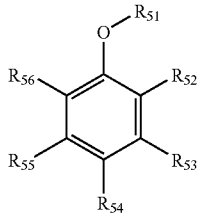

Formula (TS-IH)

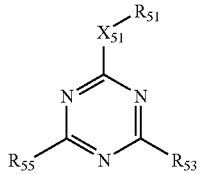

In formulae (TS-ID) to (TS-IH), $R_{51}$ to $R_{57}$ have the same meanings as those defined in formula (TS-I). $R_{a1}$ to $R_{a4}$ each independently represent a hydrogen atom, or an aliphatic group (for example, methyl, ethyl). $X_{52}$ and $X_{53}$ each independently represent a divalent linking group. Examples of the divalent linking group include an alkylene group, an oxy group, and a sulfonyl group. In the formulae, the same symbols in the same molecule may be the same or different from each other in meanings.

As to the compounds represented by any one of formulae (TS-ID) to (TS-IH), the groups thereon preferable in view of the effects of the present invention are described below.

In formula (TS-ID), preferable is the case where $R_{51}$ is a hydrogen atom, an aliphatic group, an acyl group, an aliphatic oxycarbonyl group, an aryl oxycarbonyl group, or a phosphoryl group, and $R_{52}$, $R_{53}$, $R_{55}$, and $R_{56}$ each independently are a hydrogen atom, an aliphatic group, an aliphatic oxy group, or an acyl amino group. More preferable is the case where $R_{51}$ is an aliphatic group, and $R_{52}$, $R_{53}$, $R_{55}$, and $R_{56}$ each independently are a hydrogen atom, or an aliphatic group. In formulae (TS-IE), (TS-IF), and (TS-IG), preferable is the case where $R_{51}$ is a hydrogen atom, an aliphatic group, an acyl group, an aliphatic oxycarbonyl group, an aryl oxycarbonyl group, or a phosphoryl group, and $R_{52}$, $R_{53}$, $R_{55}$, and $R_{56}$ each independently are a hydrogen atom, an aliphatic group, an aliphatic oxy group, or an acyl amino group, $R_{54}$ is an aliphatic group, a carbamoyl group, or an acyl amino group, and $X_{52}$ and $X_{53}$ each independently are an alkylene group or an oxy group. More preferable is the case where $R_{51}$ is a hydrogen atom, an aliphatic group, an acyl group, or a phosphoryl group, and $R_{52}$, $R_{53}$, $R_{55}$, and $R_{56}$ each independently are a hydrogen atom, an aliphatic group, an aliphatic oxy group, or an acyl amino group, $R_{54}$ is an aliphatic group, or a carbamoyl group, and $X_{52}$ and $X_{53}$ each independently are —$CHR_{58}$— ($R_{58}$ is an alkyl group). In formula (TS-IH), preferable is the case where $R_{51}$ is an aliphatic group, an aryl group, or a heterocyclic group, and $R_{53}$ and $R_{55}$ each independently are an aliphatic oxy group, an aryloxy group, or a heterocyclic oxy group. More preferable is the case where $R_{51}$ is an aryl group, or a heterocyclic group, and $R_{53}$ and $R_{55}$ each independently are an aryloxy group, or a heterocyclic oxy group.

From the point of the effects of the present invention, the compounds represented by formula (TS-I) are preferably the compounds represented by formula (TS-IE) or (TS-IG).

The compound represented by formula (TS-II) is described in detail below.

In formula (TS-II), $R_{61}$, $R_{62}$, $R_{63}$, and $R_{64}$ each independently are a hydrogen atom, or an aliphatic group (e.g., methyl, ethyl, preferably an alkyl group), $X_{61}$ represents a hydrogen atom, an aliphatic group, an aliphatic oxy group, an aliphatic oxycarbonyl group, an aryloxycarbonyl group, an acyl group, an acyloxy group, an aliphatic oxycarbonyloxy group, an aryloxycarbonyloxy group, an aliphatic sulfonyl group, an aryl sulfonyl group, an aliphatic sulfinyl group, an arylsulfinyl group, a sulfamoyl group, a carbamoyl group, a hydroxy group, or an oxy radical group. $X_{62}$ represents a group of non-metal atoms necessary to form a 5- to 7-membered ring (e.g., piperidine ring, piperazine ring). The total number of carbon atoms of the compound represented by formula (TS-II) is 8 or more (preferably 8 to 60).

The compound represented by formula (TS-II) that can be used in the present invention include those compounds represented by, for example, formula (I) of JP-B-2-32298, formula (I) of JP-B-3-39296, formula of JP-B-3-40373, formula (I) of JP-A-2-49762, formula (II) of JP-A-2-208653, formula (III) of JP-A-2-217845, formula (B) of U.S. Pat. No. 4,906,555, formula of European Patent Publication EP309,400A2, formula of European Patent Publication EP309,401A1, and formula of European Patent Publication EP309,402A1. These compounds can be synthesized according to the methods described in these publications or general methods described in Shin Jikken Kagaku Koza, Vol. 14 (Maruzen Co., Ltd.) (1977, 1978).

As to the compound represented by formula (TS-II), the groups thereon preferable from the point of the effects of the present invention are described below. From the point of the effects of the present invention, $R_{61}$, $R_{62}$, $R_{63}$ and $R_{64}$ each are preferably an aliphatic group, and more preferably a methyl group. From the point of the effects of the present invention, $X_{61}$ is preferably a hydrogen atom, an aliphatic group, an aliphatic oxy group, an acyl group, an acyloxy group, or an oxyradical group; more preferably a hydrogen atom, an aliphatic group, an aliphatic oxy group, an acyl group, or an oxyradical group; and most preferably an aliphatic group, or an aliphatic oxy group. From the point of the effects of the present invention, $X_{62}$ forms preferably a 6-membered ring, more preferably a piperidine ring. From the point of the effects of the present invention, the compound represented by formula (TS-II) is preferably in an embodiment where $R_{61}$, $R_{62}$, $R_{63}$, and $R_{64}$ each are a methyl group, $X_{61}$ is a hydrogen atom, an aliphatic group, an aliphatic oxy group, an acyl group, or an oxy radical group, and $X_{62}$ forms a 6-membered ring; and more preferably in an embodiment where $R_{61}$, $R_{62}$, $R_{63}$, and $R_{64}$ each are a methyl group, $X_{61}$ is an aliphatic group, or an aliphatic oxy group, and $X_{62}$ forms a piperidine ring.

The compound represented by formula (TS-III) is described in more detail below.

In formula (TS-III), $R_{65}$ and $R_{66}$ each independently represent a hydrogen atom, an aliphatic group, an aryl group, an acyl group, an aliphatic oxycarbonyl group, an aryloxycarbonyl group, a carbamoyl group, an aliphatic sulfonyl group, or an aryl sulfonyl group. $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryloxycarbonyloxy group, a substituted amino group (the substituent may be any one that is able to substitute for the hydrogen atom(s) on the amino group, e.g., amino groups substituted with a substituent such as an aliphatic group, an aryl group, an acyl group, an aliphatic sulfonyl group or an arylsulfonyl group), a heterocyclic group (e.g., a piperidine ring, a thiomorpholine ring), or a hydroxyl group. If possible, each combination of $R_{65}$ and $R_{66}$, $R_{66}$ and $R_{67}$, and $R_{65}$ and $R_{67}$ may combine together to form a 5- to 7-membered ring (e.g. a morpholine ring and a pyrazolidine ring), but they never form a 2,2,6,6-tetraalkylpiperidine ring. In addition, both $R_{65}$ and $R_{66}$ are not hydrogen atoms at the same time. Further, the total number of carbon atoms of the compound represented by formula (III) is generally 7 or more (preferably 7 to 50).

The compound represented by formula (TS-III) that can be used in the present invention include compounds represented by, for example, formula (I) of JP-B-6-97332, formula (I) of JP-B-6-97334, formula (I) of JP-A-2-148037, formula (I) of JP-A-2-150841, formula (I) of JP-A-2-181145, formula (I) of JP-A-3-266836, formula (IV) of JP-A-4-350854, and formula (I) of JP-A-5-61166. These compounds can be synthesized according to the methods described in these publications or general methods described in Shin Jikken Kagaku Koza, Vol. 14 (Maruzen Co., Ltd.) (1977, 1978).

From the point of the effects of the present invention, the compounds represented by formula (TS-III) are preferably a compound represented by any one of formulae (TS-IIIA), (TS-IIIB), (TS-IIIC), and (TS-IIID) shown below.

Formula (TS-IIIA)

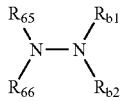

Formula (TS-IIIB)

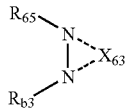

Formula (TS-IIIC)

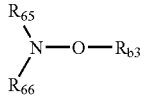

Formula (TS-IIID)

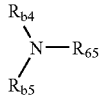

In formulae (TS-IIIA) to (TS-IIID), $R_{65}$ and $R_{66}$ each have the same meanings as those defined in formula (TS-III). $R_{b1}$, $R_{b2}$, and $R_{b3}$ each independently have the same meaning as $R_{65}$. $R_{b4}$ represents a hydrogen atom, an aliphatic group, or an aryl group. $X_{63}$ represents a group of non-metal atoms necessary to form a 5- to 7-membered ring (such as a pyrazolidine ring and a pyrazoline ring).

As to the compounds represented by any one of formulae (TS-IIIA) to (TS-IIID), the groups thereon preferable from the point of the effects of the present invention are described below. In formula (TS-IIIA), preferable is the case where $R_{65}$ and $R_{b1}$ each independently represent a hydrogen atom, an aliphatic group, or an aryl group, and $R_{66}$ and $R_{b2}$ each independently represent an aliphatic group, an aryl group, or an acyl group; and more preferable is the case where $R_{65}$ and $R_{b1}$ each independently represent an aliphatic group, and $R_{66}$ and $R_{b2}$ each independently represent an aliphatic group, an aryl group, or an acyl group. In formula (TS-IIIB), preferable is the case where $R_{65}$ represents a hydrogen atom, an aliphatic group, an aryl group, an acyl group, or an aliphatic oxycarbonyl group, $R_{b3}$ represents an aliphatic group, an aryl group, or an acyl group, and $X_{63}$ represents a group of non-metal atoms necessary to form a 5-membered ring; and more preferable is the case where $R_{65}$ represents a hydrogen atom, or an aliphatic group, and $R_{b3}$ represents an aliphatic group, or an aryl group, and $X_{63}$ represents a group of atoms that forms a pyrazolidine ring. In formula (TS-IIIC), preferable is the case where $R_{65}$ and $R_{66}$ each independently represent a hydrogen atom, an aliphatic group, an aryl group, an acyl group, an aliphatic oxycarbonyl group, or an aryl oxycarbonyl group, and $R_{b3}$ represents a hydrogen atom, an aliphatic group, or an acyl group; and more preferable is the case where $R_{65}$ and $R_{66}$ each independently represent an aliphatic group, an acyl group, or an aliphatic oxycarbonyl group, and $R_{b3}$ represents a hydrogen atom, an aliphatic group, or an acyl group. In formula (TS-IIID), preferable is the case where $R_{65}$ represents a hydrogen atom, an aliphatic group, an aryl group, an acyl group, or a carbamoyl group, $R_{b5}$ represents an aliphatic group, or an aryl group, and $R_{b4}$ represents an aliphatic group, or an aryl group; and more preferable is the case where $R_{65}$ represents an aliphatic group, an aryl group, an acyl group, or a carbamoyl group, $R_{b5}$ represents an aliphatic group, or an aryl group, and $R_{b4}$ represents an aliphatic group, or an aryl group.

From the point of the effects of the present invention, the compounds represented by formula (TS-III) are more preferably those compounds represented by any one of formulae (TS-IIIB), (TS-IIIC), and (TS-IIID), and most preferably those compounds represented by formula (TS-IIIB), or (TS-IIIC).

The compound represented by formula (TS-IV) is described in more detail below.

In formula (TS-IV), $R_{71}$ and $R_{72}$ each independently represent an aliphatic group, an aryl group, or a heterocyclic group (e.g., 2-pyridyl, 2-pyrimidyl). Further, $R_7$, also represents a hydrogen atom, Li, Na, or K. $R_{71}$ and $R_{72}$ may combine together to form a 5- to 7-membered ring, such as a tetrahydrothiophene ring and a thiomorpholine ring. q represents 0, 1, or 2. In the above, the total number of carbon atoms of each of $R_{71}$, and $R_{72}$ is generally 10 or more, preferably 10 to 60.

The compound represented by formula (TS-IV) that can be used in the present invention include compounds represented by, for example, formula (I) of JP-B-2-44052, formula (T) of JP-A-3-48242, formula (A) of JP-A-3-266836, formula (I), (II) or (III) of JP-A-5-323545, formula (I) of JP-A-6-148837, formula (I) of U.S. Pat. No. 4,933,271, and formula (I) of U.S. Pat. No. 4,770,987. These compounds can be synthesized according to the methods described in these publications or general methods described in Shin Jikken Kagaku Koza, Vol. 14 (Maruzen Co., Ltd.) (1977, 1978).

From the point of the effects of the present invention, in formula (TS-IV), q is preferably 0 or 2. When q is 0, it is preferable that $R_{71}$ and $R_{72}$ each independently represent an aliphatic group, or an aryl group, or that $R_{71}$ and $R_{72}$ combine together to form a 6-membered ring. When q is 2, it is preferable that $R_{71}$ represents a hydrogen atom, Na, K, an aliphatic group, or an aryl group, and $R_{72}$ represents an aliphatic group, or an aryl group; it is more preferable that $R_{71}$ represents a hydrogen atom, Na, or K, and $R_{72}$ represents an aryl group.

The compound represented by formula (TS-V) is described in more detail below.

In formula (TS-V), $R_{81}$, $R_{82}$, and $R_{83}$ each independently represent an aliphatic group, an aryl group, an aliphatic oxy group, an aryloxy group, an aliphatic amino group, or an arylamino group, and t represents 0 or 1. $R_{81}$ and $R_{82}$, and $R_{81}$ and/or $R_{83}$ may combine together to form a 5- to 8-membered ring. The number of total carbon atoms of each of $R_{81}$, $R_{82}$, and $R_{83}$ is 10 or more (preferably 10 to 50).

The compound represented by formula (TS-V) for use in the present invention include compounds represented by, for example, formula (I) of JP-A-3-25437, formula (I) of JP-A-3-142444, formula of U.S. Pat. No. 4,749,645, and formula of U.S. Pat. No. 4,980,275. These compounds can be synthesized according to the methods described in these publications or general methods described in Shin Jikken Kagaku Koza, Vol. 14 (Maruzen Co., Ltd.) (1977, 1978).

In formula (TS-V), from the point of the effects of the present invention, preferable is the case where t is 1 and $R_{81}$, $R_{82}$ and $R_{83}$ each independently represent an aliphatic group, an aryl group, an aliphatic oxy group, an aryloxy, or an arylamino group (more preferably at least one of $R_{81}$, $R_{82}$, and $R_{83}$ is an aliphatic group, an aryl group, an aliphatic oxy group, or an aryloxy group). Also preferable is the case where $R_{81}$ and $R_{82}$ combine together to form an 8-membered ring. More preferable is the case where t is 1, and $R_{81}$, $R_{82}$, and $R_{83}$ each independently represent an aryl group, an aliphatic oxy group, or an aryloxy group (more preferably at least one of $R_{81}$, $R_{82}$, and $R_{83}$ is an aryl group, or an aryloxy group).

The compound represented by formula (TS-VI) is described in more detail below.

In formula (TS-VI), $R_{85}$, $R_{86}$, $R_{87}$, and $R_{88}$ each independently represent a hydrogen atom or a substituent (e.g., an aliphatic group, an aryl group, an aliphatic oxycarbonyl group, an aryl oxycarbonyl group, a phosphoryl group, an acyl amino group, or a carbamoyl group). However, all of $R_{85}$, $R_{86}$, $R_{87}$, and $R_{88}$ cannot simultaneously represent hydrogen atoms, respectively. Any two of $R_{85}$, $R_{86}$, $R_{87}$, and $R_{88}$ may combine together to form a 5- to 7-membered ring (e.g., a cyclohexene ring, a cyclohexane ring), however the ring is not an aromatic ring consisting only of carbon atoms. The total number of carbon atoms of the compound represented by formula (TS-VI) is 10 or more (preferably 10 to 50).

The compound represented by formula (TS-VI) that can be used in the present invention include compounds represented by, for example, formula (I) of U.S. Pat. No. 4,713,317, formula (I) of JP-A-8-44017, formula (I) of JP-A-8-44018, formula (I) of JP-A-8-44019, formula (I) or (II) of JP-A-8-44020, formula (I) of JP-A-8-44021 and formula (I) or (II) of JP-A-8-44022. These compounds can be synthesized according to the methods described in these publications or general methods described in Shin Jikken Kagaku Koza, Vol. 14 (Maruzen Co., Ltd.) (1977, 1978).

From the point of the effects of the present invention, the compounds represented by formula (TS-VI) are preferably the compounds represented by any one of formulae (TS-VIA), (TS-VIB), and (TS-VIC).

Formula (TS-VIA)

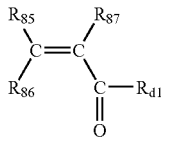

Formula (TS-VIB)

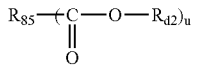

Formula (TS-VIC)

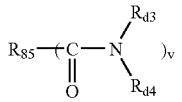

In formulae (TS-VIA), (TS-VIB) and (TS-VIC), $R_{85}$, $R_{86}$, and $R_{87}$ each have the same meanings as defined in formula (TS-VI). $R_{d1}$ represents an aliphatic group, an aliphatic oxy group, an aryloxy group, an aliphatic amino group, or an arylamino group. $R_{d2}$ and $R_{d3}$ each independently represent an alkenyl group. $R_{d4}$ represents a hydrogen atom, an aliphatic group, or an aryl group. u and v each independently represent 1, 2 or 3.

As to the compounds represented by any one of formulae (TS-VIA) to (TS-VIC), the groups thereon preferable from the point of the effects of the present invention are described below. In formula (TS-VIA), preferable is the case where $R_{85}$, $R_{86}$, and $R_{87}$ each independently represent a hydrogen atom, or an aliphatic group, and $R_{d1}$ is an aliphatic oxy group, an aliphatic amino group, or an arylamino group; and more preferable is the case where $R_{85}$, $R_{86}$ and $R_{87}$ each independently represent a hydrogen atom, or an aliphatic group, and $R_{d1}$ is an aliphatic oxy group, or an aliphatic amino group. In formula (TS-VIB), preferable is the case where $R_{85}$ is an aliphatic group or an aryl group, Rd2 is an alkenyl group, and u is 1, 2 or 3; and more preferable is the case where $R_{85}$ is an aliphatic group or an aryl group, $R_{d2}$ is an alkenyl group, and u is 2 or 3. In formula (TS-VIC), preferable is the case where $R_{85}$ is an aliphatic group or an aryl group, $R_{d3}$ is an alkenyl group, $R_{d4}$ is a hydrogen atom, or an aliphatic group, and u is 1, 2 or 3; and more preferable is the case where $R_{85}$ is an aliphatic group or an aryl group, $R_{d3}$ is an alkenyl group, $R_{d4}$ is a hydrogen atom, or an alkenyl group, and u is 2 or 3.

From the point of the effects of the present invention, the compounds represented by formula (TS-VI) are preferably the compounds represented by formula (TS-VIA) or (TS-VIB), and most preferably the compounds represented by formula (TS-VIA).

The compounds represented by formula (TS-VII) are explained below.

$R_{91}$ represents a hydrophobic group having the total number of carbon atoms of 10 or more (preferably from 10 to 50, more preferably from 10 to 32). Preferable examples thereof include an alkyl group having 1 to 32 carbon atoms, an alkenyl group having 2 to 32 carbon atoms, an alkynyl group having 2 to 32 carbon atoms, a cycloalkyl group having 3 to 32 carbon atoms and a cycloalkenyl group having 3 to 32 carbon atoms. The above alkyl group, alkenyl group and alkynyl group each may be straight-chain or branched. Further, each of these aliphatic groups may have a substituent(s).

Examples of the aromatic hydrophobic groups include an aryl group and an aromatic heterocyclic group (for example, pyridyl, furyl). Further, each of these aromatic groups may have a substituent.

$R_{91}$ is preferably an alkyl group or an aryl group.

As the substituent with which the aliphatic or aromatic group represented by $R_{91}$ may be substituted, there is no particular limitation, but as a preferable substituent, for example, there are illustrated an alkoxy group, an aryloxy group, an acyl group, an acyloxy group, an alkoxycarbonyl group, an aryloxycarbonyl group, a carbamoyl group, a sulfamoyl group, an acylamino group and an amino group. An aliphatic group is more preferred. $Y_{91}$ represents a monovalent organic group containing an alcoholic hydroxyl group. $Y_{91}$ is preferably a monovalent organic group represented by formula [AL] set forth below.

$$Y_{92}\text{-}(L_{92})\text{-}m_{92}\text{-} \qquad \text{Formula [AL]}$$

In the formula, $Y_{92}$ represents a group from a compound in which a hydrogen atom is removed from one of hydroxyl groups in a polyvalent alcohol. $L_{92}$ represents a divalent linking group. $m_{92}$ is 0 or 1.

The polyvalent alcohol from which a hydrogen atom is removed to form the group represented by $Y_{92}$, is preferably glycerol, polyglycerol, pentaerythritol, trimethylolpropane, neopentylglycol, sorbitan, sorbide, sorbitol, sugars, and the like. The divalent linking group represented by L is preferably —C(═O)— or —$SO_2$—.

Preferable compounds in another embodiment of the compounds represented by formula (TS-VII) are compounds in which $R_{91}$ represents an aliphatic group having carbon atoms of 12 or more (preferably alkyl or alkenyl groups having 12 to 32 carbon atoms) and $Y_{91}$ represents an OH group.

The metal complex that can be used in the present invention (herein, this complex is referred to as "the metal complex in the present invention") is explained below.

The metal complex in the present invention, is preferably those having Cu, Co, Ni, Pd, or Pt as a central metal, and more preferably those having Ni as a central metal. It is preferable that it is low in solubility to water. Specifically, the solubility at room temperature is preferably 50% or less, more preferably 25% or less, and furthermore preferably 10% or less. The category of a preferable compound can also be defined in terms of total number of carbon atoms of the whole compound. Specifically, the compound has carbon atoms preferably in the range of 15 to 65, more preferably in the range of 20 to 60, furthermore preferably in the range of 25 to 55, and most preferably in the range of 30 to 50, in total.

The metal complex in the present invention may have any kind of ligand. Dithiolate-series complexes and salicylaldoxime-series complexes are preferable, and salicylaldoxime-series metal complexes are more preferable.

As the metal complex in the present invention, there are many known metal complexes, including dithiolate-series nickel complexes and salicylaldoxime-series nickel complexes, which are effective. Preferable examples include compounds represented, for example, by, formula (I) of JP-B-61-13736, formula (I) of JP-B-61-13737, formula (I) of JP-B-61-13738, formula (I) of JP-B-61-13739, formula (I) of JP-B-61-13740, formula (I) of JP-B-61-13742, formula (I) of JP-B-61-13743, formula (I) of JP-B-61-13744, formula of JP-B-5-69212, formula (I) or (II) of JP-B-5-88809, formula of JP-A-63-199248, formula (I) or (II) of JP-A-64-75568, formula (I) or (II) of JP-A-3-182749, formula (II), (III), (IV) or (V) of U.S. Pat. No. 4,590,153, or formula (II), (III), or (IV) of U.S. Pat. No. 4,912,027.

As the metal complex, the compound represented by formula (TS-VIIIA) is preferable from the point of the effects of the present invention.

Formula (TS-VIIIA)

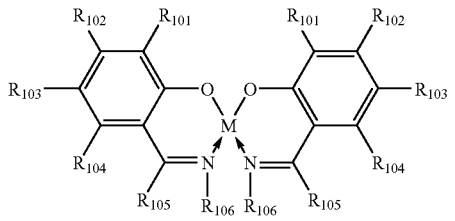

In formula (TS-VIIIA), $R_{101}$, $R_{102}$, $R_{103}$, and $R_{104}$ each independently represent a hydrogen atom or a substituent (e.g., an aliphatic group, an aliphatic oxy group, an aliphatic sulfonyl group, an aryl sulfonyl group, an acyl amino group). $R_{105}$ represents a hydrogen atom, an aliphatic group, or an aryl group. $R_{106}$ represents a hydrogen atom, an aliphatic group, an aryl group, or a hydroxyl group. M represents Cu, Co, Ni, Pd, or Pt. Two $R_{106}$s may combine together to form a 5- to 7-membered ring. $R_{101}$ and $R_{102}$, $R_{102}$ and $R_{103}$, $R_{103}$ and $R_{104}$, and/or $R_{104}$ and $R_{105}$, each two of which are adjacent to each other, may combine together to form a 5- to 6-membered ring.

In formula (TS-VIIIA), it is preferable from the point of the effects of the present invention that $R_{101}$, $R_{102}$, $R_{103}$, and $R_{104}$ each independently represent a hydrogen atom, an aliphatic group, or an aliphatic oxy group, $R_{105}$ is a hydrogen atom, $R_{106}$ is a hydrogen atom, an aliphatic group, or a hydroxy group, and M is Ni; and it is more preferable that $R_{101}$, $R_{102}$, $R_{103}$, and $R_{104}$ each independently represent a hydrogen atom, or an aliphatic oxy group, $R_{105}$ is a hydrogen atom, $R_{106}$ is a hydroxy group, and M is Ni.

An ultraviolet absorbing agent that can be used in the present invention is explained below.

The ultraviolet absorbing agent that can be used in the present invention is not particularly limited, so long as the compound has the maximum absorption wavelength (λmax) at 400 nm or less. The compounds represented by any of formulae (A), (B), (C), (D) and (E) are preferred.

Formula (A)

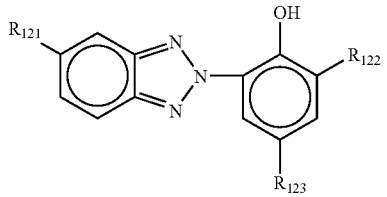

In the formula, $R_{121}$ represents a hydrogen atom, a halogen atom, an alkyl group, or an alkoxy group. $R_{122}$ and $R_{123}$ each independently represent a hydrogen atom, a substituted or unsubstituted alkyl group, or a substituted or unsubstituted aryl group.

Preferably, $R_{121}$ represents a hydrogen atom, a halogen atom, an alkyl group having 1 to 5 carbon atoms, or an alkoxy group having 1 to 4 carbon atoms; and $R_{122}$ and $R_{123}$ each independently represent a hydrogen atom, a substituted or unsubstituted alkyl group having 1 to 20 carbon atoms, or a substituted or unsubstituted aryl group having 6 to 12 carbon atoms.

Formula (B)

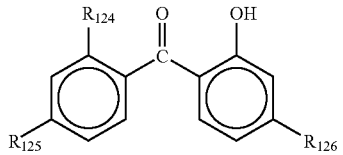

In the formula, $R_{124}$, $R_{125}$ and $R_{126}$ each independently represent a hydrogen atom, an alkoxy group having 1 to 12 carbon atoms, or a hydroxyl group.

Formula (C)

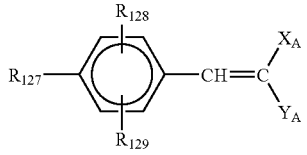

In the formula, $R_{127}$ represent a hydroxyl group, an alkoxy group, or an alkyl group. $R_{128}$ and $R_{129}$ each independently represent a hydrogen atom, a hydroxyl group, an alkoxy group, or an alkyl group. $R_{128}$ and $R_{127}$, or $R_{129}$ and $R_{127}$ may adjoin each other to form a 5- or 6-membered ring. $X_A$ and $Y_A$, which may be the same or different from each other, each represent CN, —$COR_{140}$, —$COOR_{140}$, —$SO_2R_{140}$, —CON($R_{140}$)($R_{141}$), or —COOH. $R_{140}$ and $R_{141}$ each independently represent an alkyl group or an aryl group. $R_{141}$ may be a hydrogen atom.

Preferably, $R_{127}$ represents a hydroxyl group, an alkoxy group having 1 to 6 carbon atoms, or an alkyl group having 1 to 6 carbon atoms; $R_{128}$ and $R_{129}$ each represent a hydrogen atom, a hydroxy group, an alkoxy group or an alkyl group, in which the alkoxy group and the alkyl group each have the same meanings as in $R_{127}$ or $R_{128}$ and $R_{127}$, or $R_{129}$ and $R_{127}$ may adjoin each other to form a 5- or 6-membered ring (for example, methylenedioxy ring); $X_A$ and $Y_A$ each independently represent —CN, —$COR_{140}$, —$COOR_{140}$, —$SO_2R_{140}$, —CON($R_{140}$) ($R_{141}$), or —COOH; $R_{140}$ and $R_{141}$ each represent a substituted or unsubstituted alkyl group having 1 to 16 carbon atoms or a substituted or unsubstituted aryl group having 6 to 12 carbon atoms; and $R_{141}$ may be a hydrogen atom.

Formula (D)

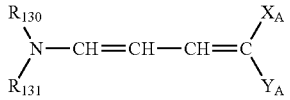

In the formula, $R_{130}$ and $R_{131}$ each independently represent a hydrogen atom, an alkyl group, an alkenyl group, or an aryl group. However, $R_{130}$ and $R_{131}$ cannot be a hydrogen atom at the same time. Further, a 5- or 6-membered ring may be formed by $R_{130}$ and $R_{131}$ together with the N. X and Y have the same meanings as defined in formula (C).

Preferably, $R_{130}$ and $R_{131}$, each represent a hydrogen atom, a substituted or unsubstituted alkyl group having 1 to 12 carbon atoms, or an alkenyl group having 3 to 6 carbon atoms. $R_{130}$ and $R_{131}$ may be the same or different from each other, but they cannot be a hydrogen atom at the same time. Further, a 5- or 6-membered ring (e.g. a piperidine ring or a morpholine ring) may be formed by $R_{130}$ and $R_{131}$ together with the N. $X_A$ and $Y_A$ have the same meanings as mentioned in formula (C).

Formula (E)

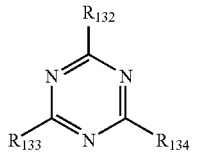

In the formula, $R_{132}$, $R_{133}$ and $R_{134}$ each independently represent a substituted or unsubstituted alkyl group, aryl group, alkoxyl group, aryloxy group, or heterocyclic group, in which at least one of the above $R_{132}$, $R_{133}$ and $R_{134}$ is represented by formula (F) set forth below.

Formula (F)

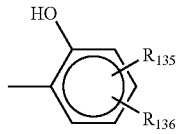

In the formula, $R_{135}$ and $R_{136}$ each independently represent a hydrogen atom, a halogen atom, or a substituted or unsubstituted alkyl group, cycloalkyl group, aryl group, alkoxyl group or aryloxy group.

Examples of specific compounds of the compound represented by any one of formulae (TS-I) to (TS-VII), the metal complex, and the ultraviolet absorbing agent are set forth below, but the present invention is not limited to these compounds.

(TI-1)
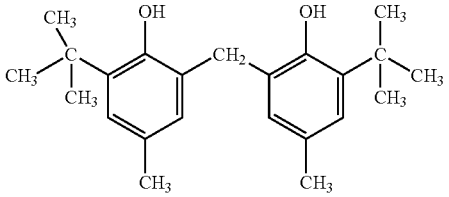
(TI-2)
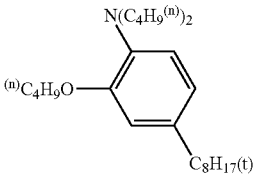
(TI-3)
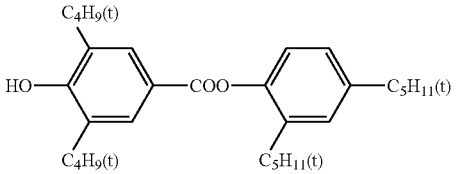
(TI-4)
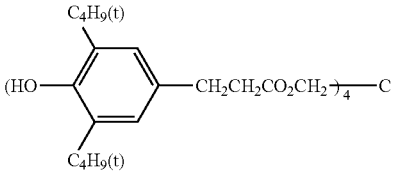
(TI-5)
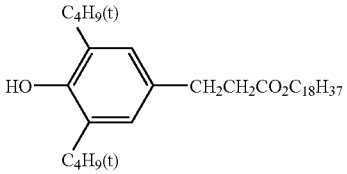
(TI-6)
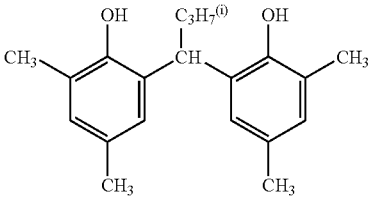
(TI-7)
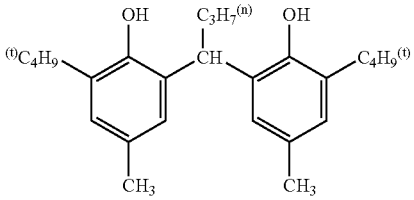
(TI-8)
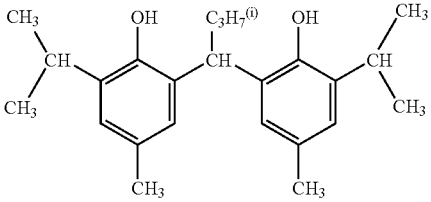
(TI-9)
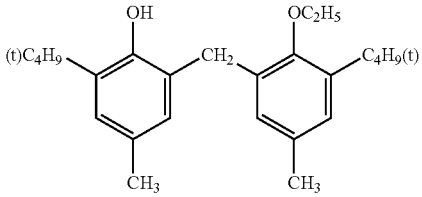
(TI-10)
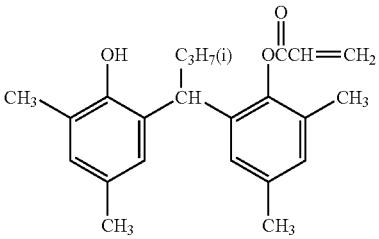
(TI-11)
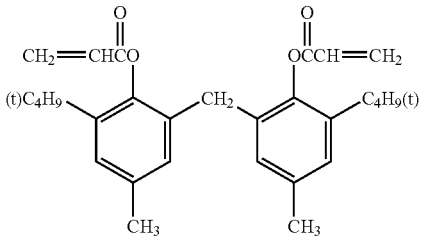
(TI-12)
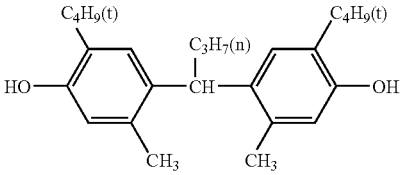
(TI-13)
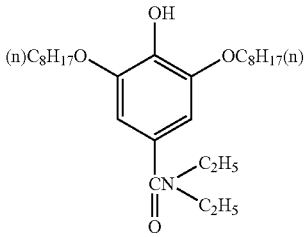
(TI-14)
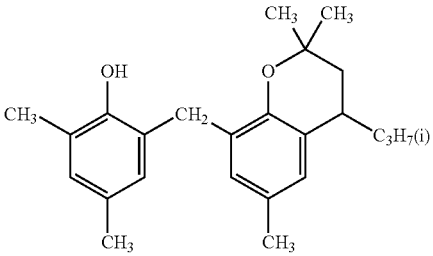

-continued
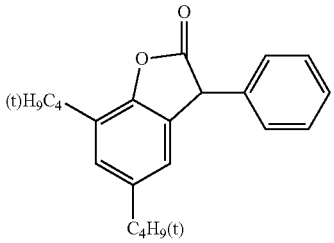
(TI-15)
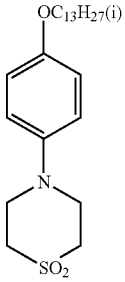
(TI-16)
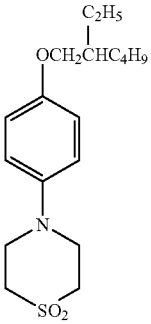
(TI-17)
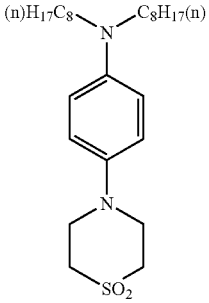
(TI-18)
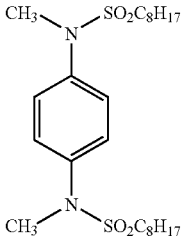
(TI-19)
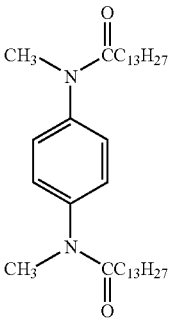
(TI-20)
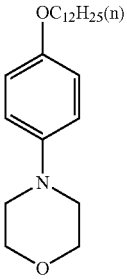
(TI-21)
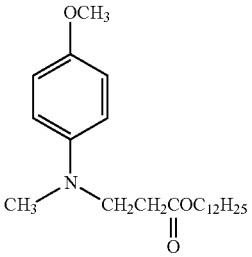
(TI-22)
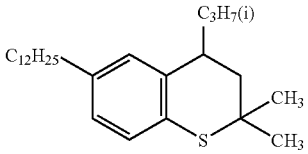
(TI-23)
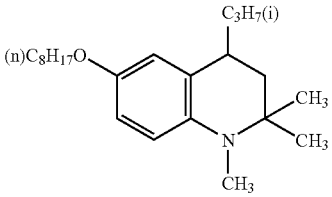
(TI-24)

-continued
(TI-25)
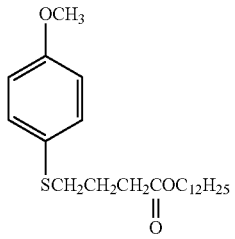
(TI-26)
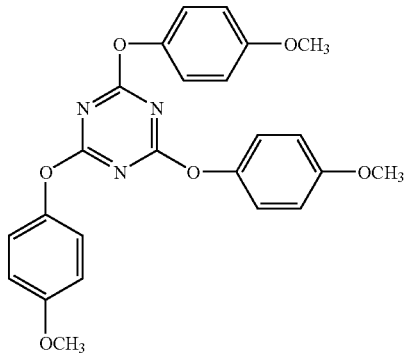
(TI-27)
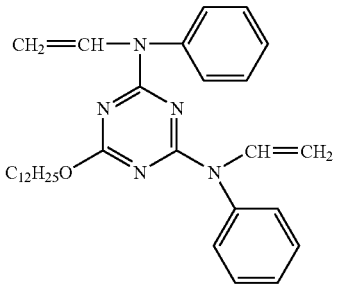
(TI-28)
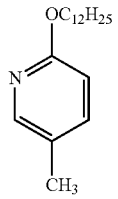
(TI-29)
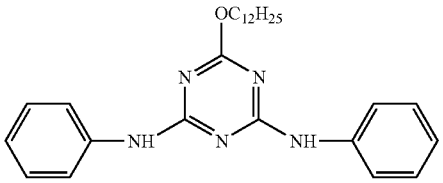
(TI-30)
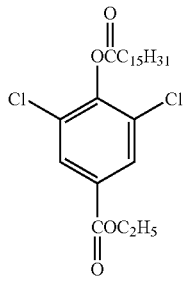
(TI-31)
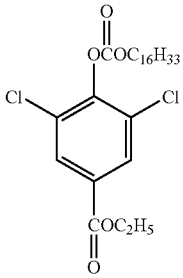
(TI-32)
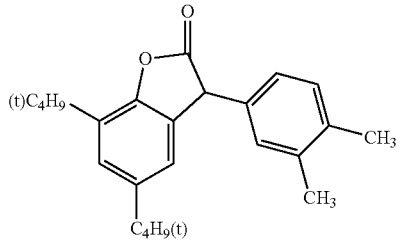
(TI-33)
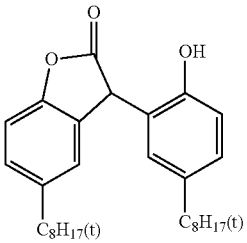
(TI-34)
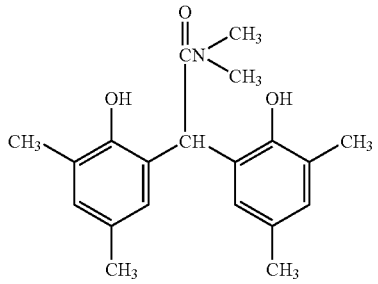

-continued
(TII-1)
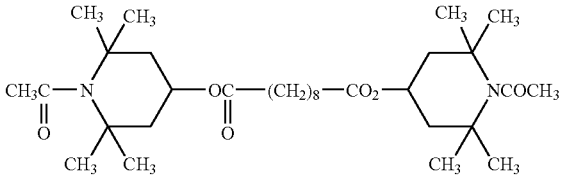
(TII-2)
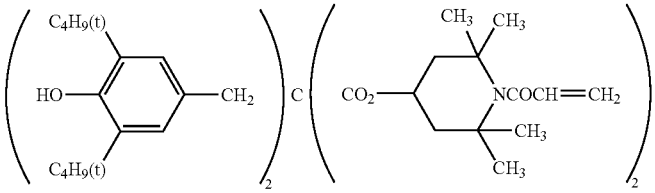
(TII-3)
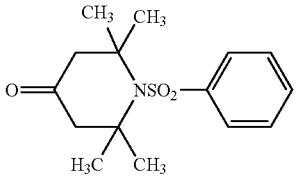
(TII-4)
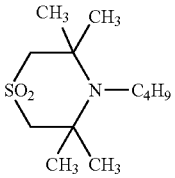
(TII-5)
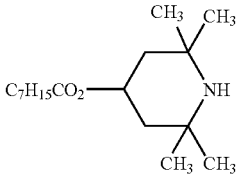
(TII-6)
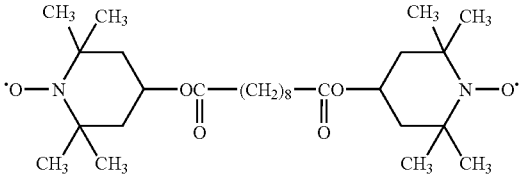
(TII-7)
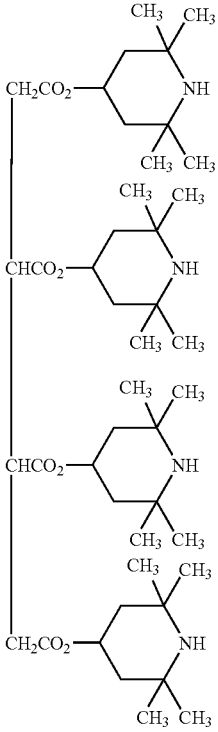
(TII-8)
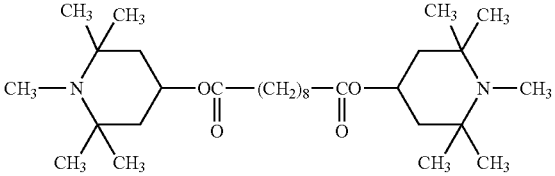

-continued
(TII-9)
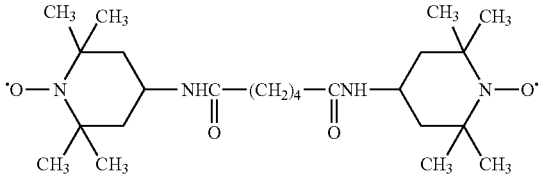
(TII-10)
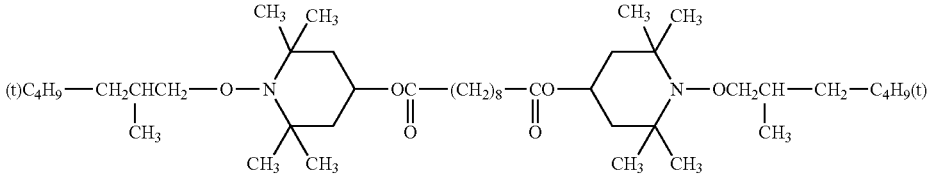
(TII-11)
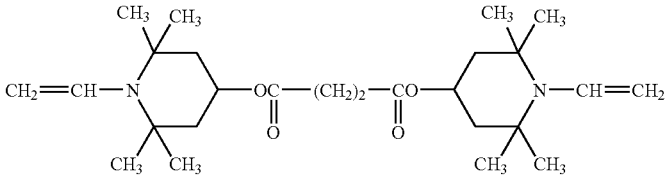
(TII-12)
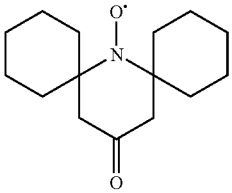
(TII-13)
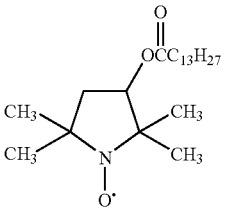
(TII-14)
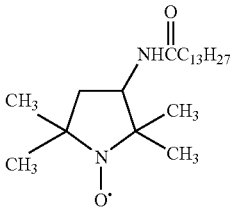
(TII-15)
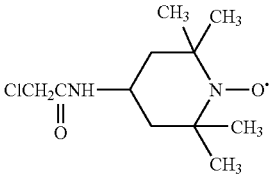
(TII-16)
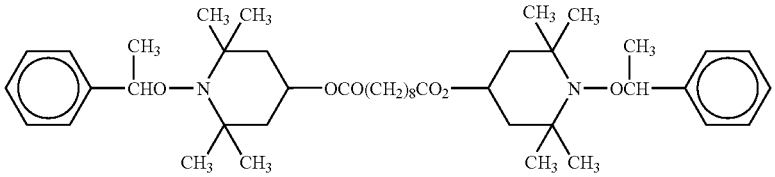
(TII-17)
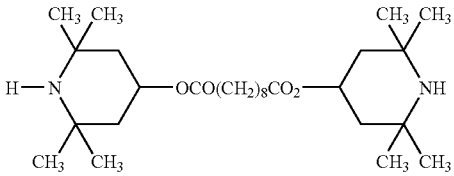
(TII-18)
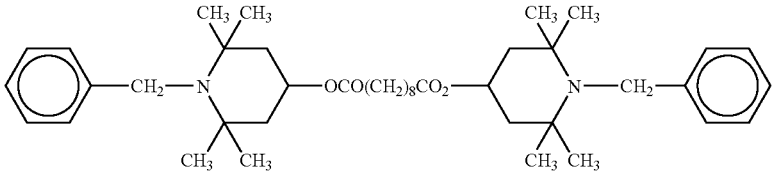

-continued
(TII-19)
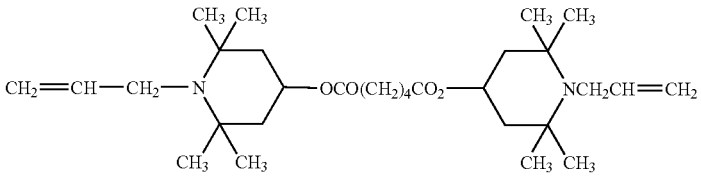
(TII-20)
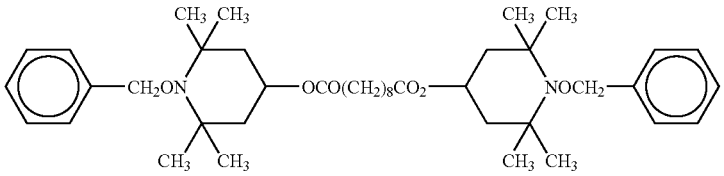
(TII-21)
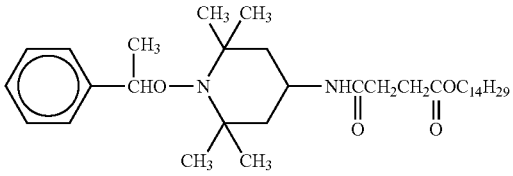
(TII-22)
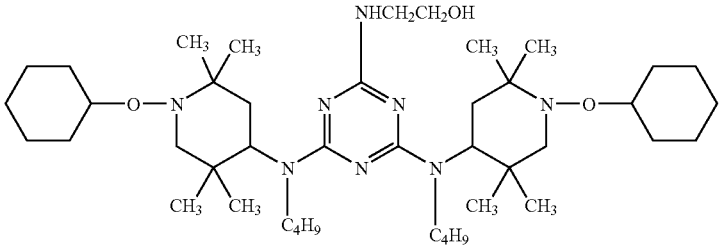
(TII-23)
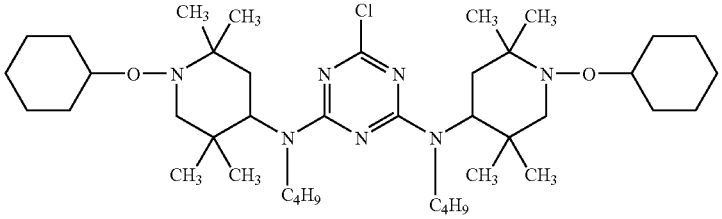
(TII-24)
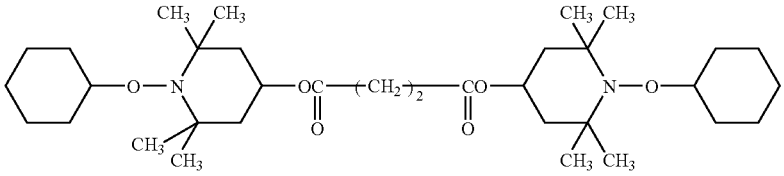
(TII-25)
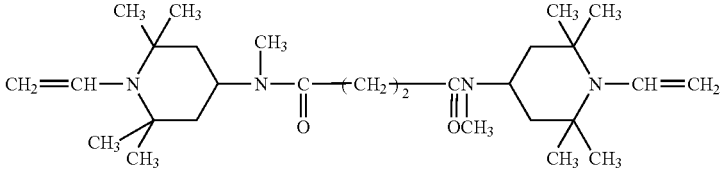
(TII-26)
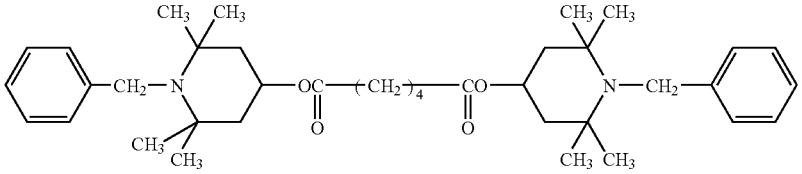

-continued
(TII-27)
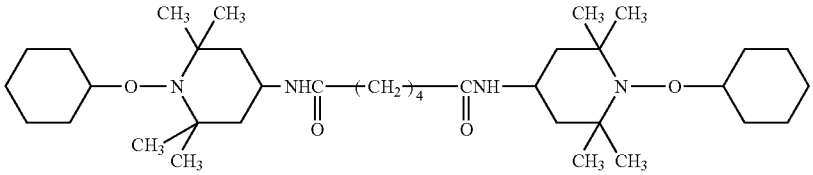
(TII-28)
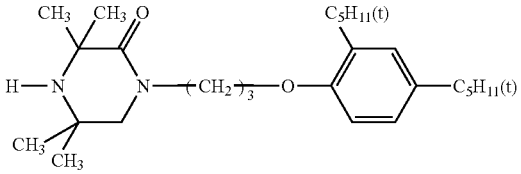
(TII-29)
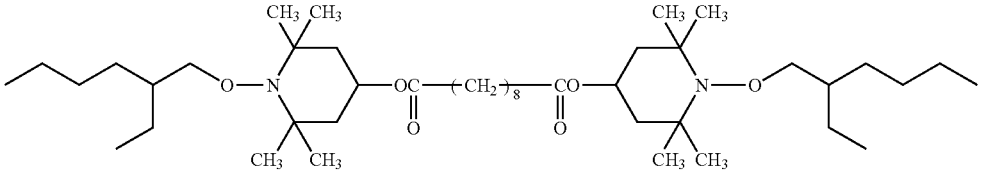
(TII-30)
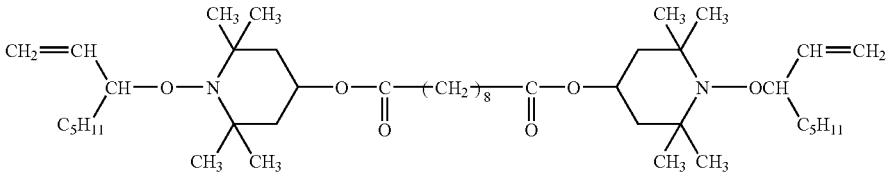
(TII-31)
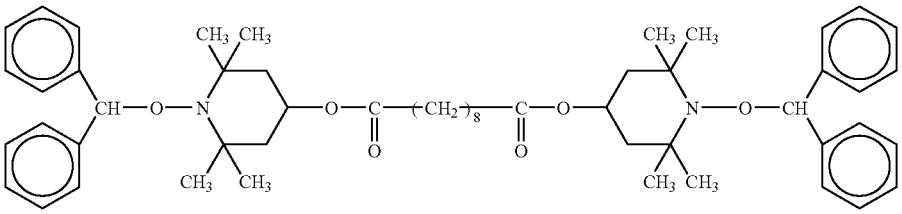
(TII-32)
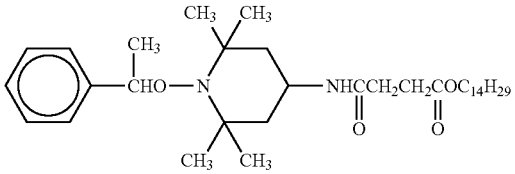
(TII-33)
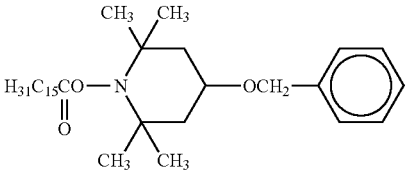
(TII-34)
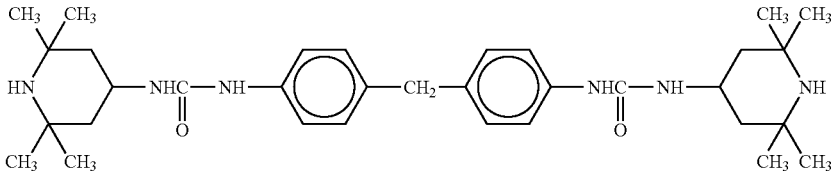
(TII-35)
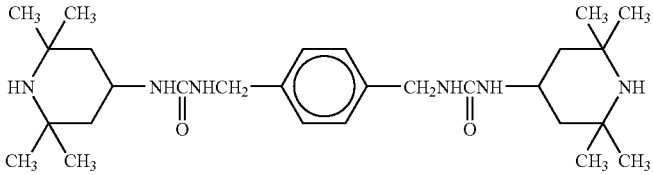

-continued
(TII-36)
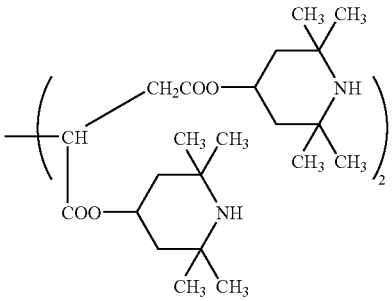
(TII-37)
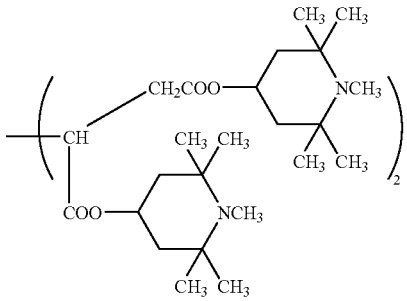
(TII-38)
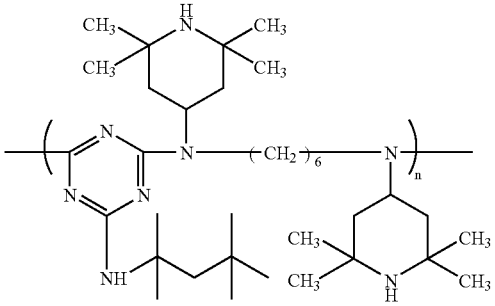
(TII-39)
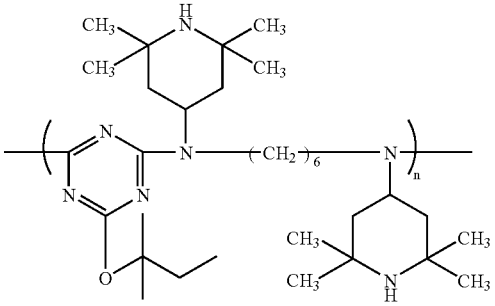
(TII-40)
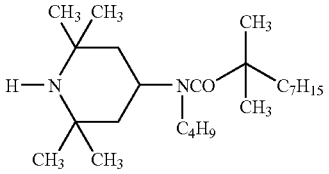
(TII-41)
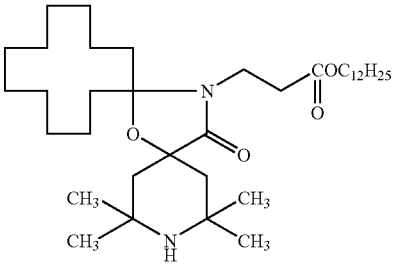
(TII-42)
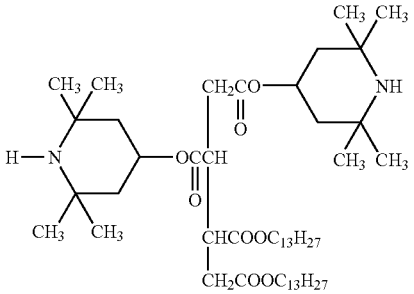
(TII-43)
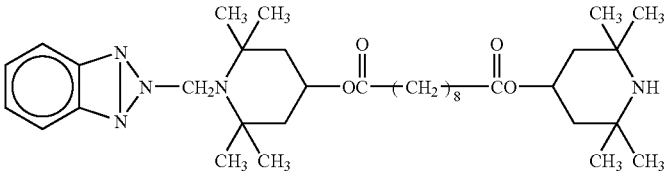
(TIII-1)
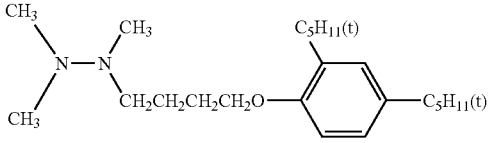
(TIII-2)
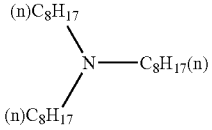

-continued
(TIII-3)
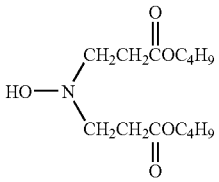
(TIII-4)
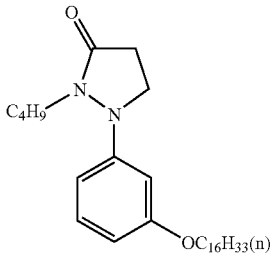
(TIII-5)
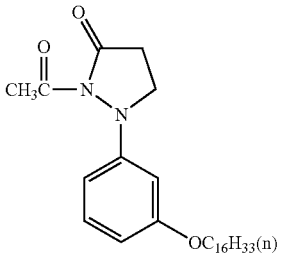
(TIII-6)
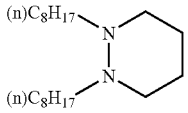
(TIII-7)
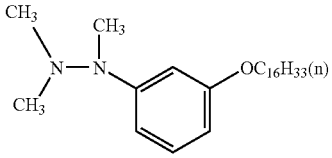
(TIII-8)
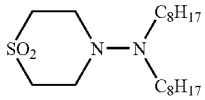
(TIII-9)
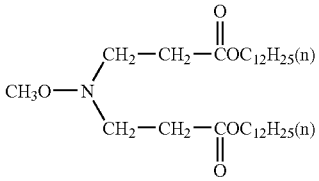
(TIII-10)
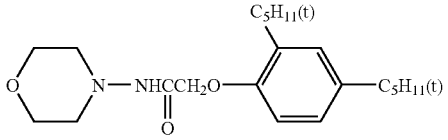
(TIII-11)
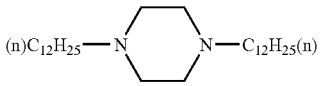
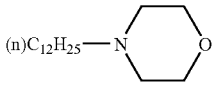
(TIII-12)
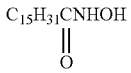
(TIII-13)
(TIII-14)
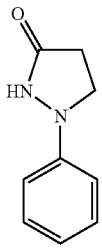
(TIII-15)
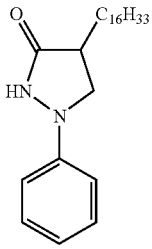
(TIII-16)
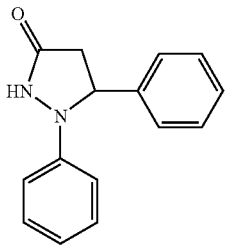

-continued
(TIII-17)
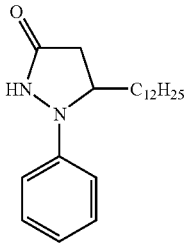
(TIII-18)
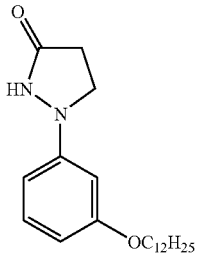
(TIII-19)
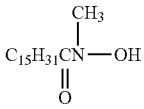
(TIII-20)
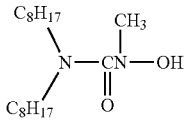
(TIII-21)
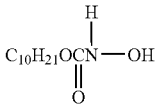
(TIV-1)
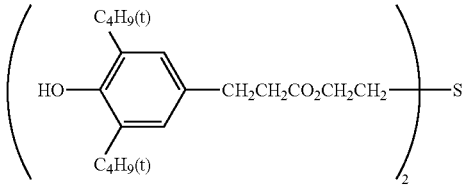
(TIV-2)
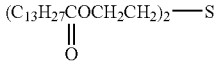
(TIV-3)
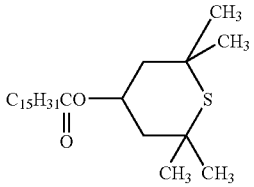
(TIV-4)
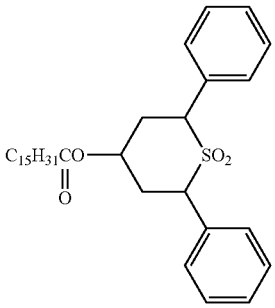
(TIV-5)
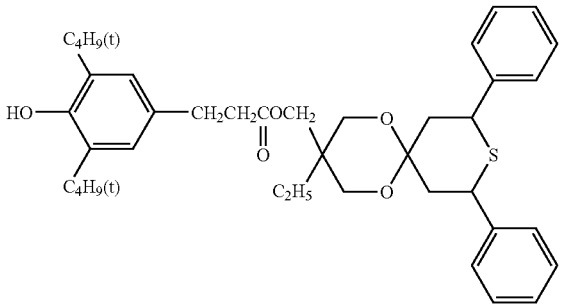
(TIV-6)
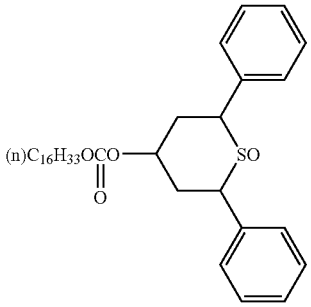
(TIV-7)
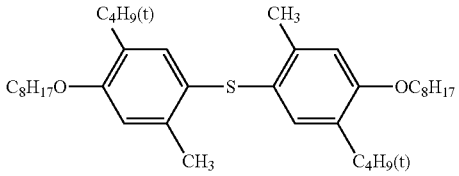
(TIV-8)
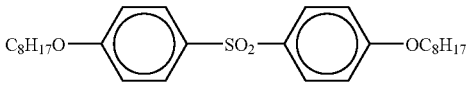
(TIV-9)
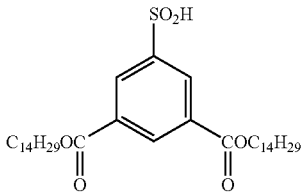

-continued
(TIV-10)
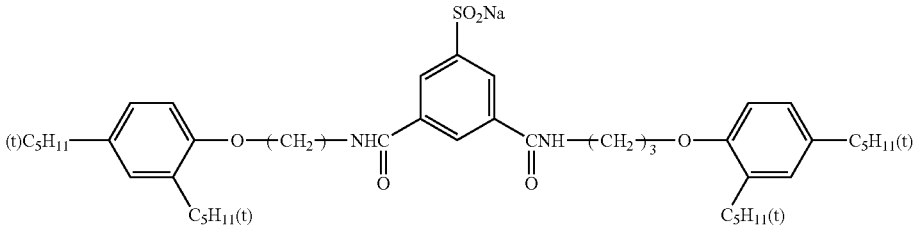
(TIV-11)
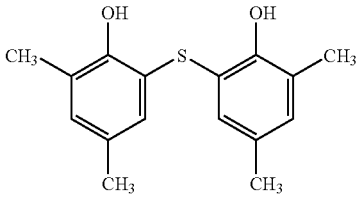
(TIV-12)
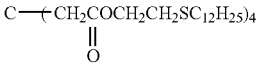
(TIV-13)
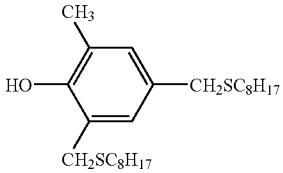
(TIV-14)
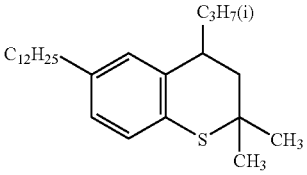
(TIV-15)
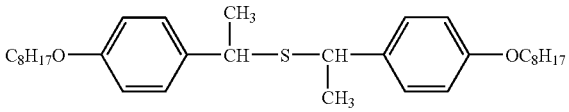
(TIV-16)
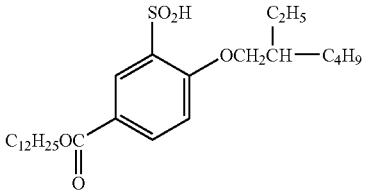
(TV-1)
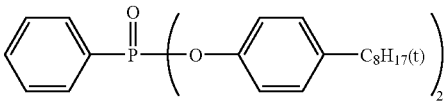
(TV-2)
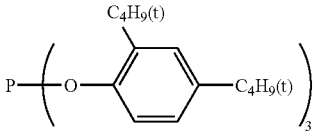
(TV-3)
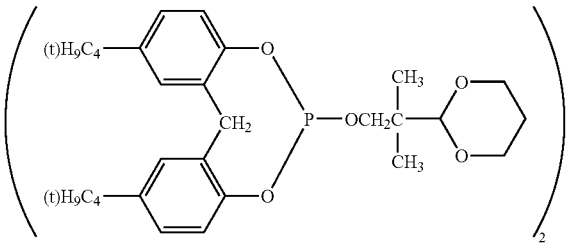

-continued
(TV-4)
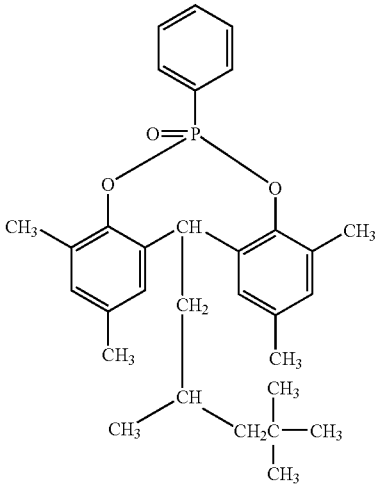
(TV-5)
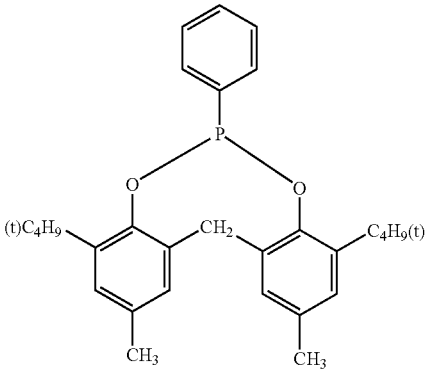
(TV-6)
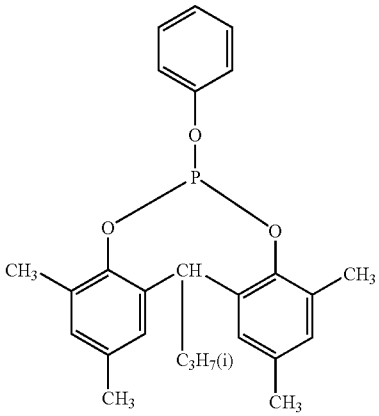
(TV-7)
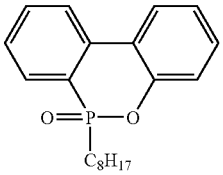
(TV-8)
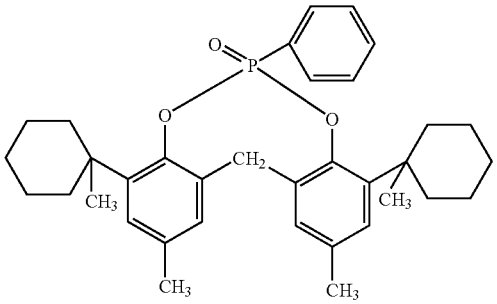
(TV-9)
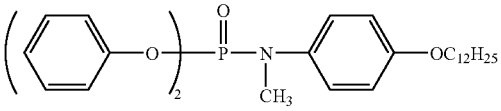
(TV-10)
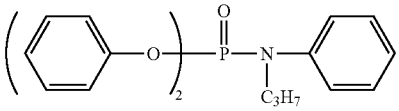
(TV-11)
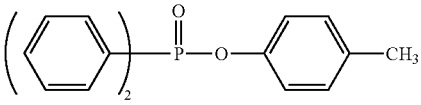
(TV-12)
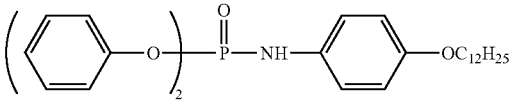
(TV-13)
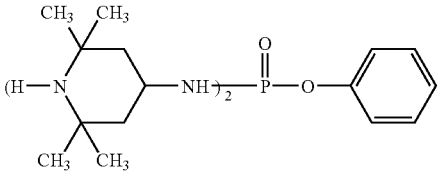

-continued
(TV-14)
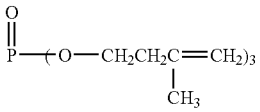
(TV-15)
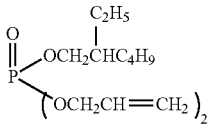
(TV-16)
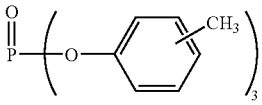
(TV-17)
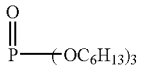
(TVI-1)
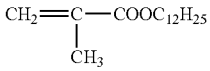
(TVI-2)
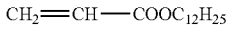
(TVI-3)
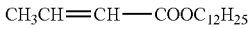
(TVI-4)
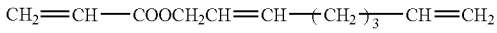
(TVI-5)
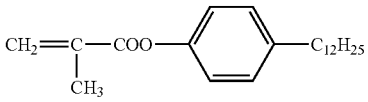
(TVI-6)
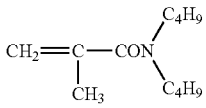
(TVI-7)
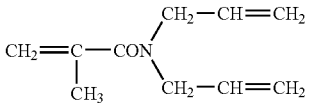
(TVI-8)
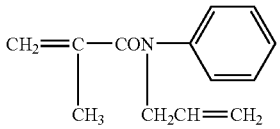
(TVI-9)
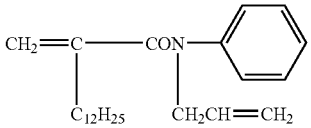
(TVI-10)
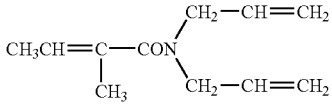
(TVI-11)
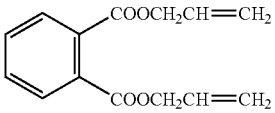
(TVI-12)
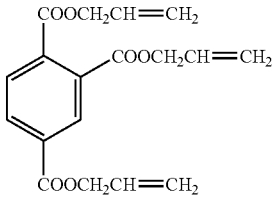
(TVI-13)
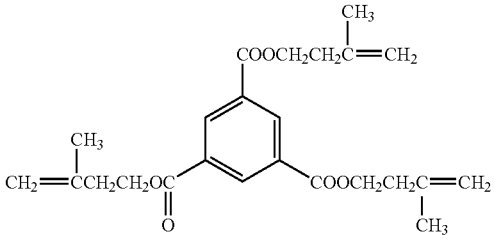
(TVI-14)
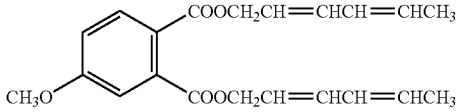
(TVI-15)
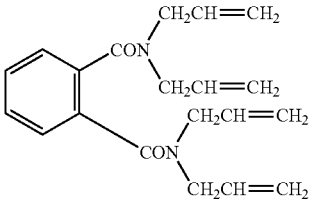
(TVI-16)
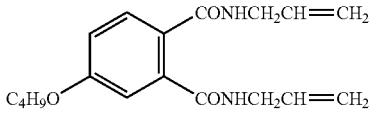

-continued
(TVI-17)
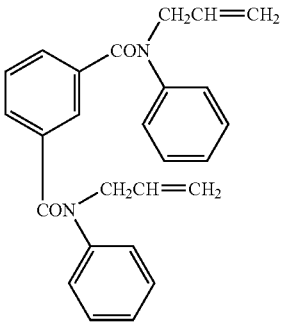
(TVI-18)
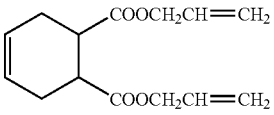
(TVI-19)
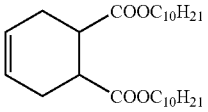
(TVI-20)
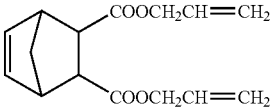
(TVI-21)
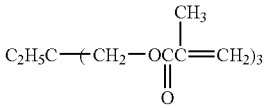
(TVI-22)
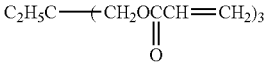
(TVI-23)
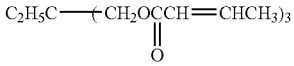
(TVI-24)
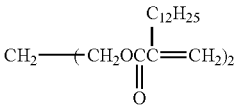
(TVI-25)
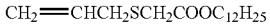
(TVI-26)
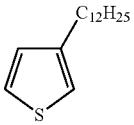
(TVI-27)
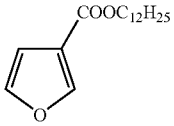
(TVI-28)
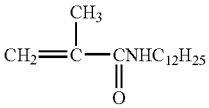
(TVI-29)
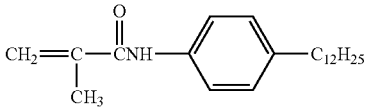
(TVI-30)
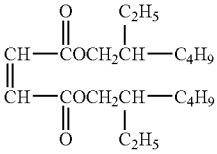
(TVI-31)
KAYARAD DPCA-30
(trade name, manufactured by Nippon Kayaku Co. Ltd.)
TVII-1
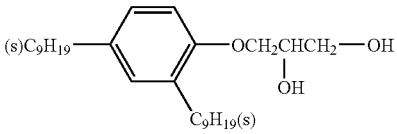
TVII-2
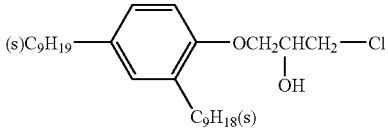
TVII-3
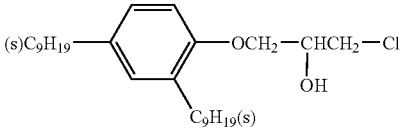
TVII-4
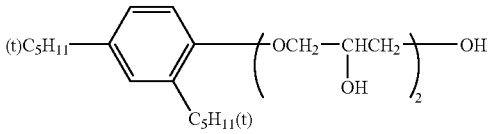
TVII-5
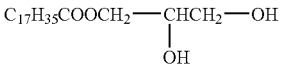

-continued

TVII-6

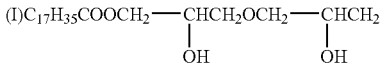

TVII-7

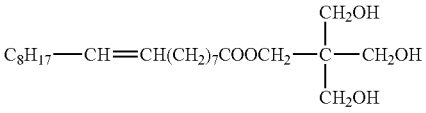

TVII-8

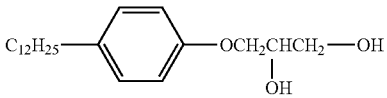

TVII-9

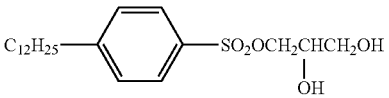

TVII-10

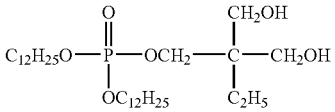

TVII-11

Diglyceryl diisostearate

TVII-12

Pentaerythritol dioleate

TVII-13

Tetraglyceryl tristearate

TVII-14

Decaglyceryl pentaoleate

TVII-15

Sorbitan monooleate

TVII-16

Sorbitan sesquioleate

TVII-17

Sorbitan trioleate

TVII-18

Sorbitan monostearate

TVII-19

$C_8H_{17}CH{=}CH(CH_2)_8OH$

TVII-20

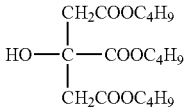

TVII-21

$C_{12}H_{25}OH$

TVII-22

$C_{14}H_{29}OH$

TVII-23

$C_{16}H_{33}OH$

TVII-24

$C_{18}H_{37}OH$

TVII-25

$C_{20}H_{41}OH$ (TVIII-1)

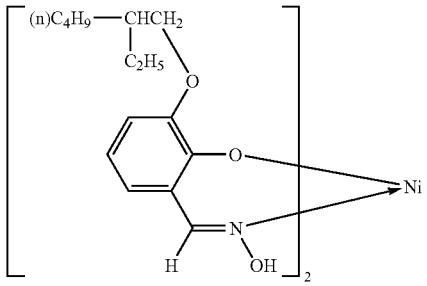

(TVIII-2)

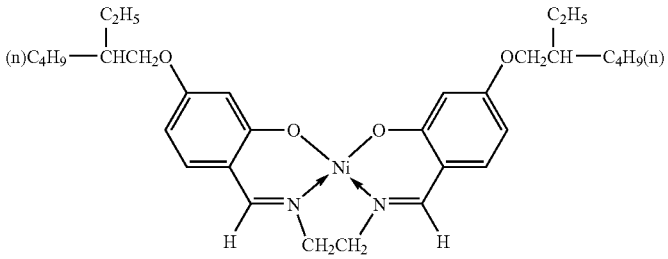

(TVIII-3)

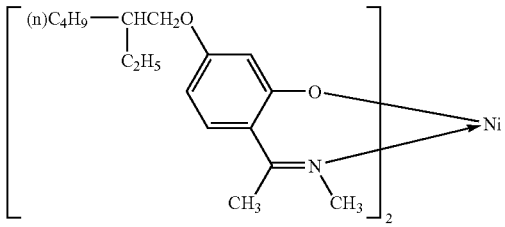

(TVIII-4)

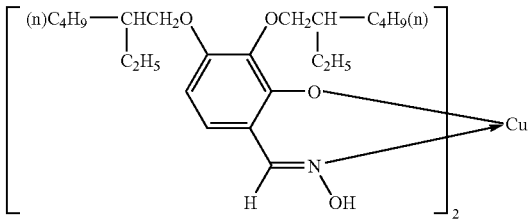

-continued
(TVIII-5)
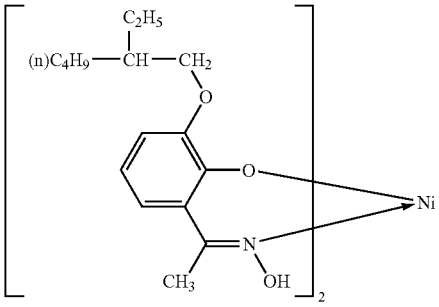
(TVIII-6)
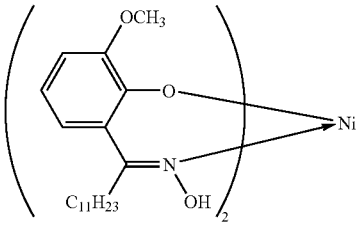
UA-1
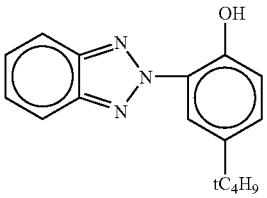
UA-2
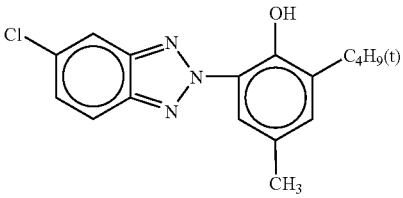
UA-3
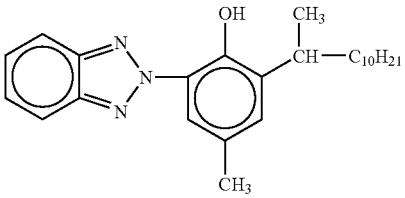
UA-4
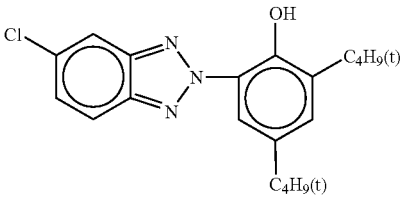
UA-5
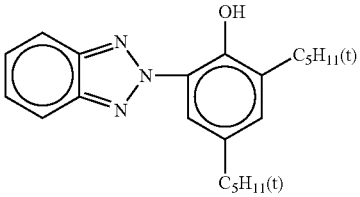
UA-6
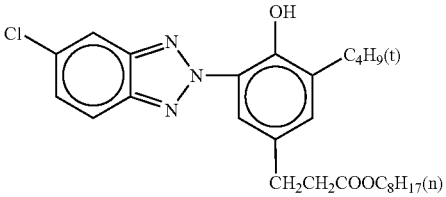
UA-7
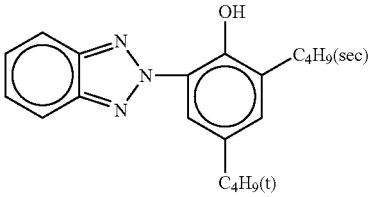
UA-8
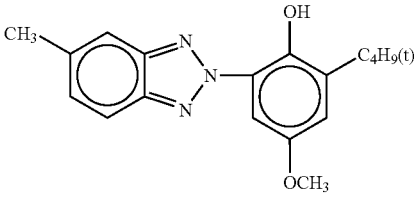
UA-9
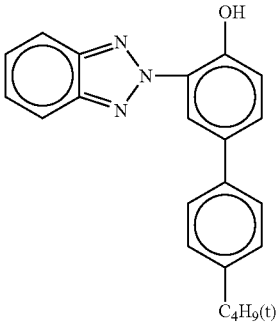
UA-10
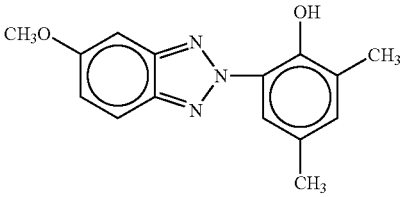
UB-1
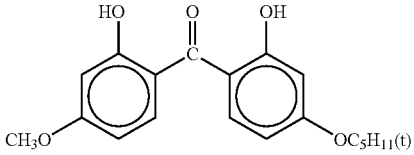
UB-2
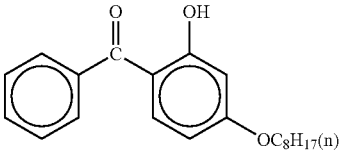

-continued
UB-3
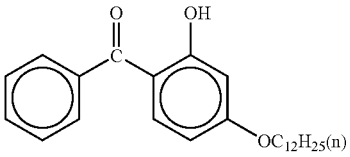
UB-4
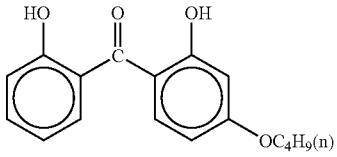
UB-5
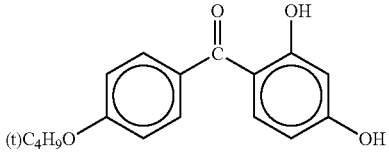
UB-6
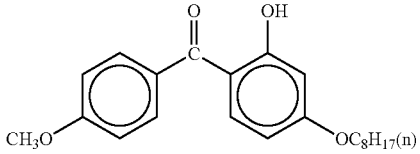
UB-7
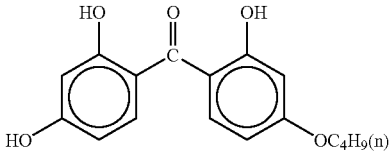
UC-1
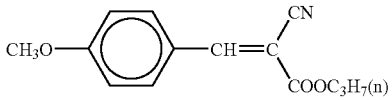
UC-2
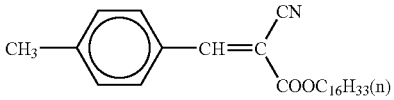
UC-3
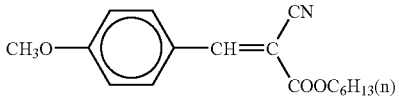
UC-4
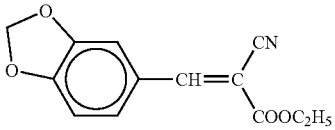
UC-5
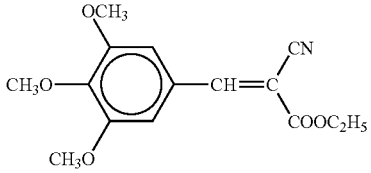
UC-6
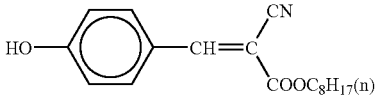
UC-7
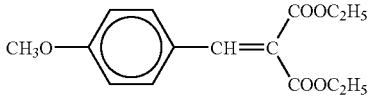
UC-8
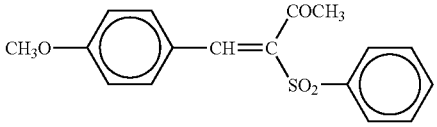
UC-9
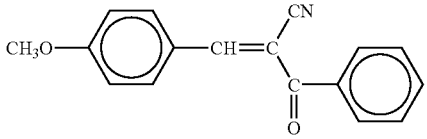
UC-10
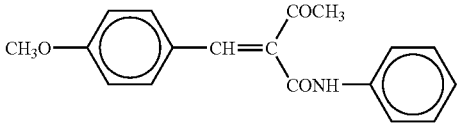
UC-11
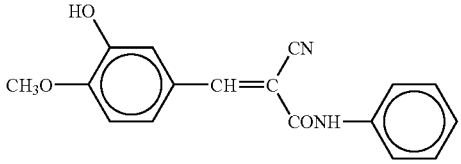
UC-12
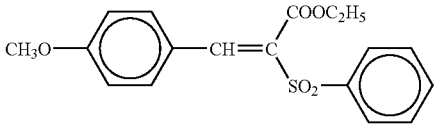
UD-1
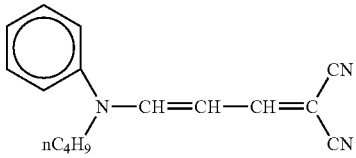
UD-2
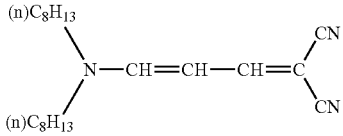
UD-3
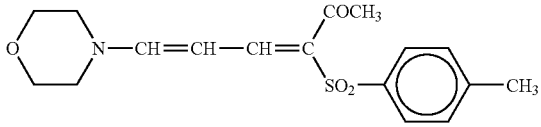

-continued
UD-4
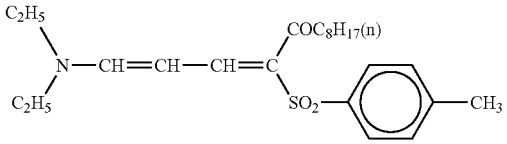
UD-5
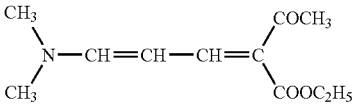
UD-6
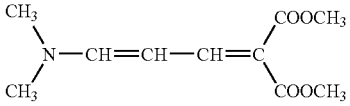
UD-7
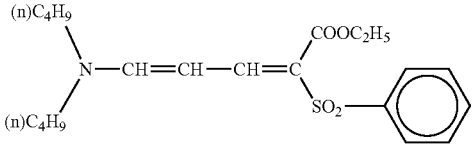
UD-8
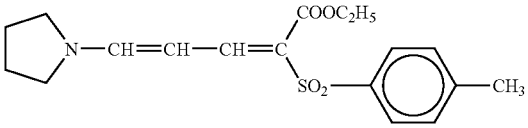
UD-9
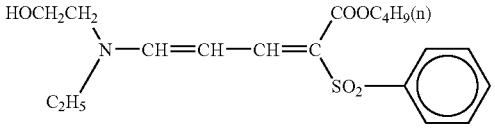
UE-1
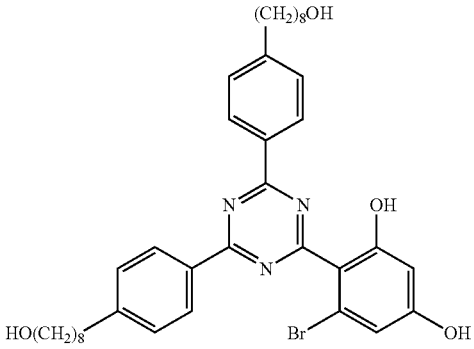
UE-2
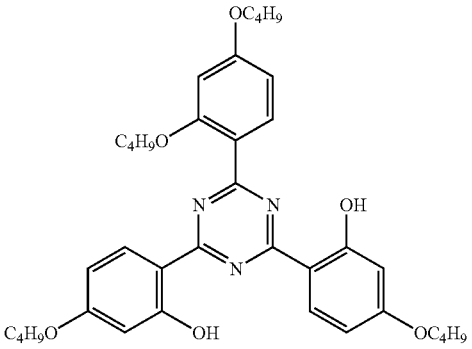
UE-3
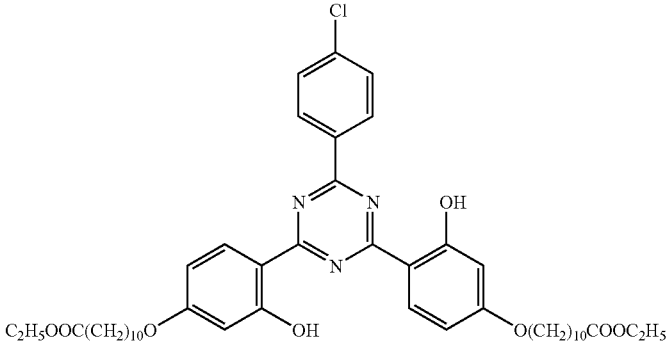
UE-4
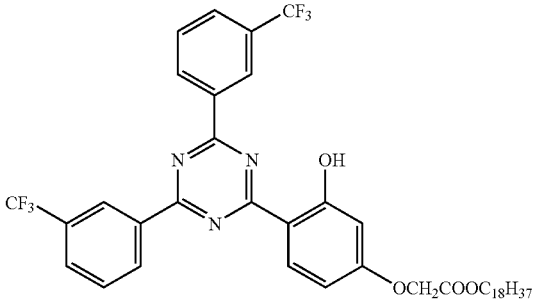

-continued
UE-5
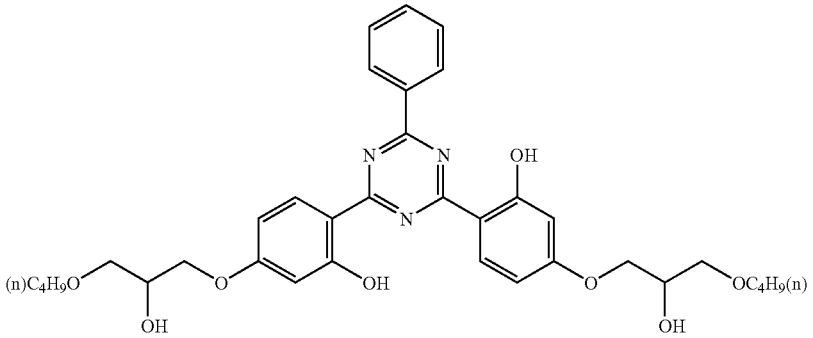
UE-6
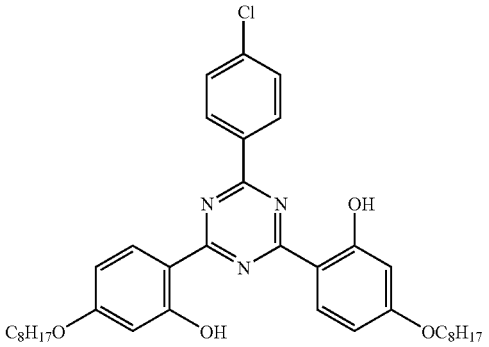
UE-7
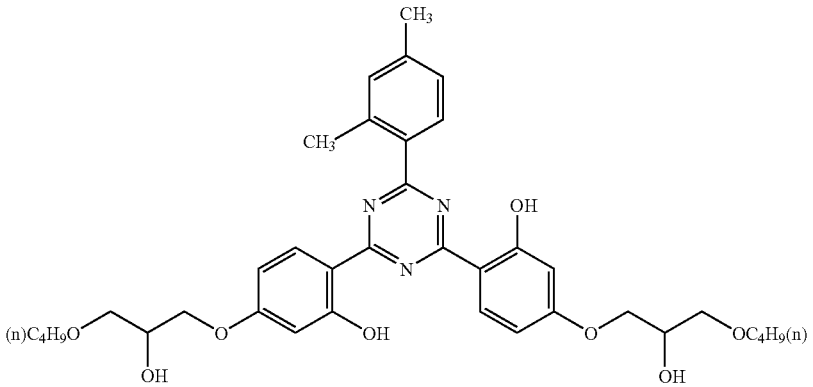
UE-8
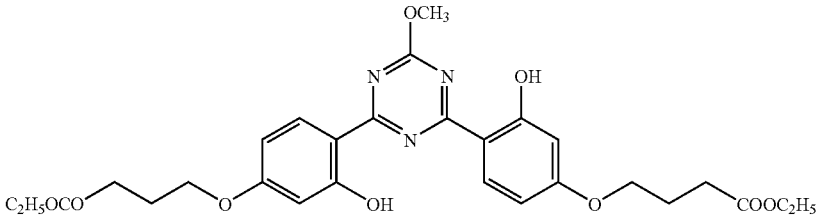

-continued
UE-9
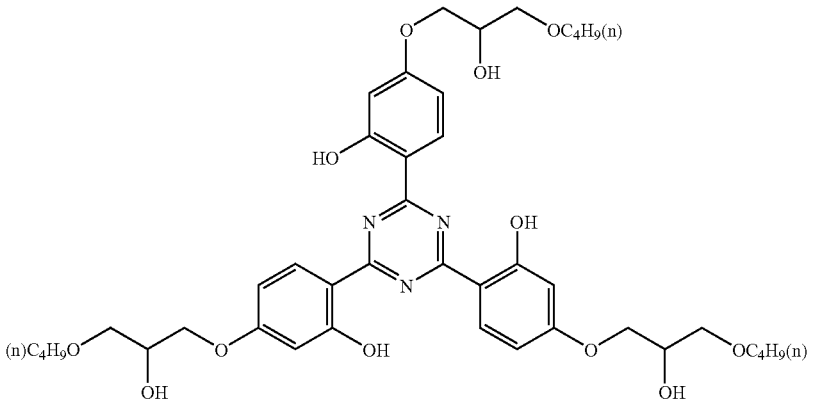
UE-10
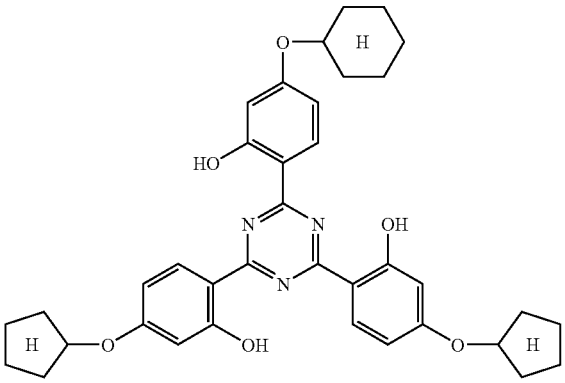
UE-11
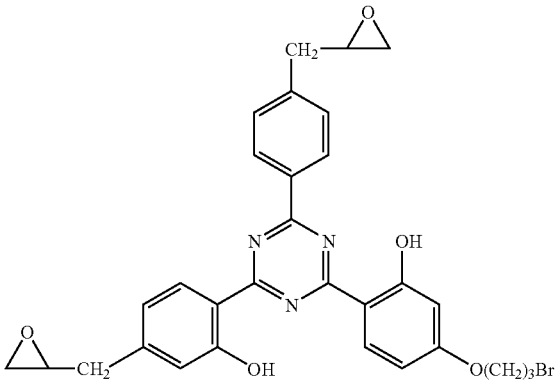
UE-12
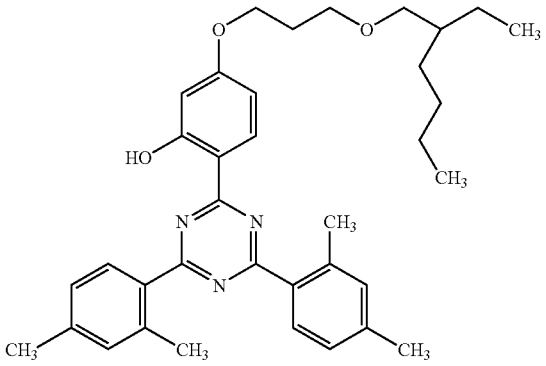

Of the compounds represented by any of formulae (TS-I) to (TS-VII), metal complexes and ultraviolet absorber, it is preferable that the compound represented by formula (TS-II) is used in combination with the compound represented by formula (TS-I), (TS-IV), (TS-V), (TS-VI) or (TS-VII) or the ultraviolet absorbent from the viewpoint of the effects of the present invention, and more preferable that the compound represented by formula (TS-II) is used in combination with the compound represented by formula (TS-I), (TS-V), (TS-VI) or (TS-VII), or the ultraviolet absorbent.

The addition amount of the compound represented by any of formulae (Ph-1) to (Ph-3) and/or the compound represented by any of formulae (E-1) to (E-3) which can be used in the present invention is preferably from 10 mole % to 200 mole %, more preferably from 20 mole % to 150 mole %, and particularly preferably from 40 mole % to 120 mole %, of the amount of couplers used.

The addition amount of the compound represented by any one of formulae (TS-I) to (TS-VII), the metal complex, or the ultraviolet absorbing agent, is preferably in the range of from 1 to 400 mass %, more preferably in the range of from 10 to 300 mass %, and most preferably in the range of from 15 to 200 mass %, to the dye-forming coupler used in the present invention.

All of the compounds represented by any of formulae (Ph-1) to (Ph-3), the compounds represented by any of formulae (E-1) to (E-3), the compounds represented by any of formulae (TS-I) to (TS-VII),the metal complexes and the ultraviolet absorbents that can be used in the present invention are image light-fastness improvers, and have effects of preventing radicals from generating upon light irradiation, capturing radicals and avoiding photo-oxidation.

The compound represented by any of formulae (Ph-1) to (Ph-3), the compound represented by any of formulae (E-1) to (E-3), the compound represented by any of formulae (TS-I) to (TS-VII), the metal complex and the ultraviolet absorbent that can be used in the present invention are preferably added to the layer containing the coupler that forms an azomethine dye having a solubility of $1\times10^{-8}$ to $5\times10^{-3}$ mol/L in ethyl acetate, but may further be added to another layer.

The compound represented by any one of formulae (Ph-1) to (Ph-3), the compound represented by any one of formulae (E-1) to (E-3), the compound represented by any one of formulae (TS-I) to (TS-VII), the metal complex, or the ultraviolet absorbing agent, each of which can be used in the present invention, each may be used singly or in combination with two or more kinds thereof.

Other compound(s) may be used additionally in combination with the compound represented by any one of formulae (Ph-1) to (Ph-3), the compound represented by any one of formulae (E-1) to (E-3), the compound represented by any one of formulae (TS-I) to (TS-VII), the metal complex, and the ultraviolet absorbing agent, each for use in the present invention.

Examples of the other compound that may be used in combination with the above compounds/additives, include boron compounds represented by formula (I) described in JP-A-4-174430, epoxy compounds represented by formula (II) described in U.S. Pat. No. 5,183,731 or formula (S1) described in JP-A-8-53431, disulfide-series compounds represented by formula described in European Patent Publication EP271,322 B1 or formula (I), (II), (III) or (IV) described in JP-A-4-19736, reactive compounds represented by formula (I), (II), (III) or (IV) described in U.S. Pat. No. 5,242,785, cyclic phosphorus compounds represented by formula (1) described in JP-A-8-283279, alcoholic compounds represented by formula (SO) described in JP-A-7-84350, formula (G) described in JP-A-9-114061, formula (II) described in JP-A-9-146242, formula (A) described in JP-A-9-329876, or formula (VII) described in JP-A-62-175748. If the above-mentioned publications include the exemplified compounds that are embraced in any of formulae (TS-I) to (TS-VI) that can be used in the present invention, these compounds are also included in the exemplified compounds that can be used in the present invention.

The compounds represented by formula (CMP) are described below in detail.

In formula (CMP), $R^{21}$ to $R^{29}$ each represent a hydrogen atom or a substituent, and examples of such a substituent include a halogen atom, an aliphatic group, an aryl group, a heterocyclic group, a cyano group, a hydroxy group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, a sulfonyloxy group, an aryloxycarbonylamino group, an imido group, a heterocyclylthio group, a sulfinyl group, a phosphonyl group, an aryloxycarbonyl group and an acyl group. Each of these groups may further be substituted with any of the substituents as recited as examples of $R^{21}$. However, at least one of $R^{21}$ to $R^{29}$ is required to be a substituent.

In formula (CMP), specific examples of $R^{21}$ to $R^{29}$ include, a hydrogen atom, a halogen atom (e.g., a chlorine atom, and a bromine atom), an aliphatic group (e.g., a straight-chain or branched-chain alkyl group, an aralkyl group, an alkenyl group, an alkynyl group, a cycloalkyl group, and a cycloalkenyl group, each having 1 to 32 carbon atoms, and specifically, for example, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecaneamido}phenyl}propyl, 2-ethoxytridecyl, trifluoromethyl, cyclopentyl, and 3-(2,4-di-t-amylphenoxy) propyl), an aryl group (e.g., phenyl, 4-t-butylphenyl, 2,4-di-t-amylphenyl, 4-tetradecaneamidophenyl), a heterocyclic group (e.g., imidazolyl, pyrazolyl, triazolyl, 2-furyl, 2-thienyl, 2-pyrimidinyl, and 2-benzothiazolyl), a cyano group, a hydroxyl group, a nitro group, a carboxy group, an amino group, an alkoxy group (e.g., methoxy, ethoxy, 2-methoxyethoxy, 2-dodecyloxyethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, and 2-{4-(4-hydroxyphenylsulfonyl) phenoxy}decaneamido), an alkylamino group (e.g., methylamino, butylamino, dodecylamino, diethylamino, and methylbutylamino), an anilino group (e.g., phenylamino, 2-chloroanilino, 2-chloro-5-tetradecaneaminoanilino, 2-chloro-5-dodecyloxycarbonylanilino, N-acetylanilino, and 2-chloro-5-{2-(3-t-butyl-4-hydroxyphenoxy) dodecaneamido}anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (e.g., N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazole-5-oxy and 2-tetrahydropyranyloxy), an azo group (e.g., phenylazo, 4-methoxyphenylazo, 4-pivaroylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), a sulfonyloxy group (e.g., methanesulfonyloxy, octanesulfonyloxy, and benzenesulfonyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-di-phenoxy-1,3,5-tirazole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), and an acyl group (e.g., acetyl, 3-phenylpropanoyl, benzoyl, and 4-dodecyloxybenzoyl).

In formula (CMP), each of $R^{21}$ to $R^{29}$ is preferably a hydrogen atom, an alkyl group, an aryl group, a heterocyclic group, a cyano group, a hydroxyl group, an alkoxy group, an aryloxy group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an acyloxy group, a carbamoyloxy group, a sulfonyloxy group, an aryloxycarbonylamino group, a phosphonyl group or an aryloxycarbonyl group. The more preferred as each of $R^{21}$ to $R^{29}$ is a hydrogen atom, an alkyl group, an aryl group, a hydroxyl group, an alkoxy group, an aryloxy group, an acylamino group, an acyloxy group, a sulfonyloxy group, an alkoxycarbonyl group or a hydroxyl group. And the most preferred as each of $R^{21}$ to $R^{29}$ is a hydrogen atom, an alkyl group, an alkoxy group, an acyloxy group or a hydroxyl group.

In formula (CMP), $R^{22}$ is particularly preferably a hydrogen atom or an alkyl group, more preferably a hydrogen atom or an alkyl group containing at most 8 carbon atoms, and most preferably a hydrogen atom or an alkyl group containing at most 4 carbon atoms. It is preferable that the compound represented by formula (CMP) contains, in a molecule, an oil-soluble group, easily dissolves in a high boiling-point organic solvent and is non-diffusible in a hydrophilic colloid layer. In this respect, the number of total carbon atoms in the compound represented by formula (CMP) is preferably from 16 to 60, more preferably from 18 to 50.

The compound represented by formula (CMP) may be a compound in which any of $R^{21}$ to $R^{29}$ is a compound residue represented by formula (CMP) to form a dimer or a polymer of a higher order, or a compound in which any of $R^{21}$ to $R^{29}$ contains a polymer chain to form a homopolymer or copolymer. Typical examples of such a homo- or co-polymer having a polymer chain are homo- or co-polymers of an addition polymerizable ethylenic unsaturated compound having a residue of the compound represented by formula (CMP). Herein, one or more kinds of repeating units having a residue of the compound represented by formula (CMP) may be contained in those polymers, and the copolymers may be copolymers which contain, as their respective copolymerizing components, one or more kinds of non-color-generating ethylenic monomers causing no coupling with an oxidation product of an aromatic primary amine developer, such as acrylic acid esters, methacrylic acid esters and maleic acid esters.

Examples of the compound represented by formula (CMP) (Exemplified Compounds (I-1) to (I-34)) are illustrated below, but these examples should not be construed as limiting the scope of the present invention in any way.

(I-1)

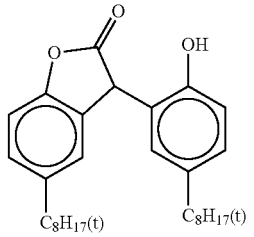

(I-2)

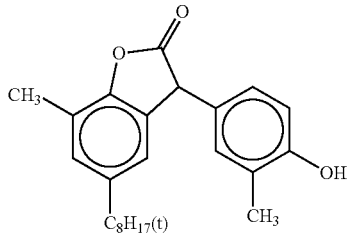

(I-3)

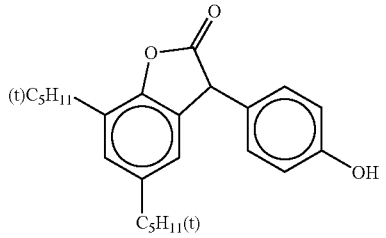

(I-4)

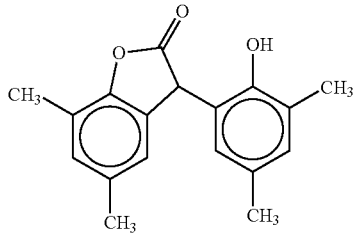

(I-5)

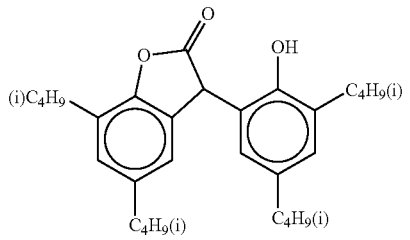

-continued
(I-6)
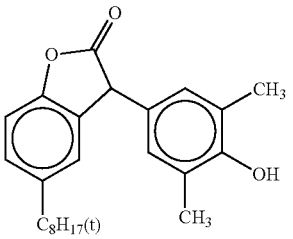
(I-7)
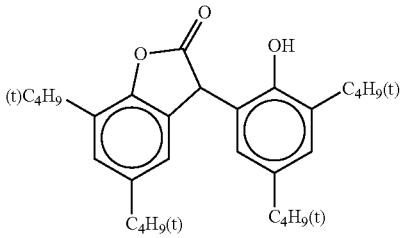
(I-8)
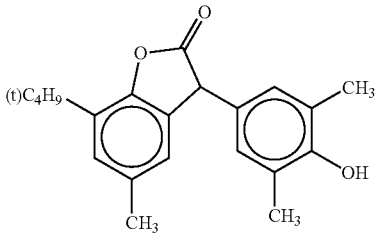
(I-9)
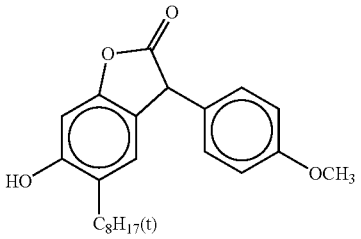
(I-10)
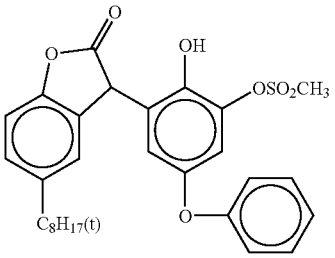
(I-11)
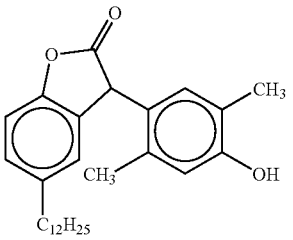
-continued
(I-12)
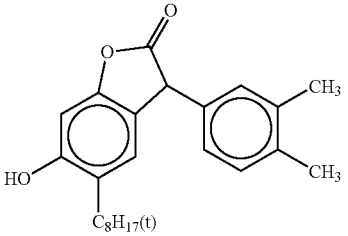
(I-13)
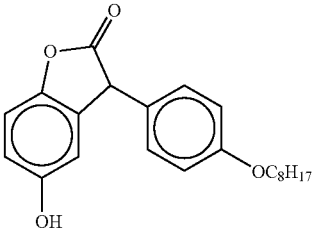
(I-14)
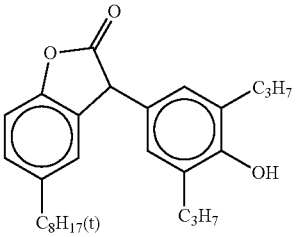
(I-15)
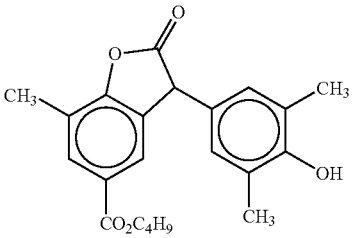
(I-16)
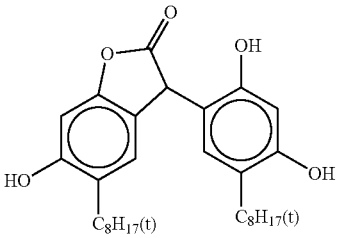
(I-17)
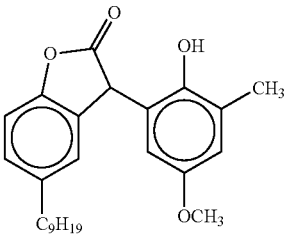

-continued
(I-18)
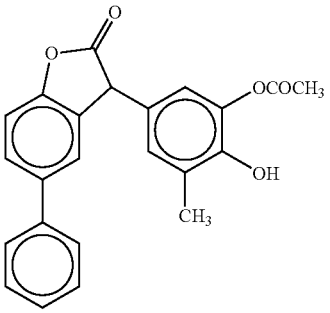
(I-19)
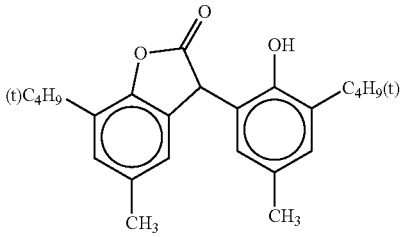
(I-20)
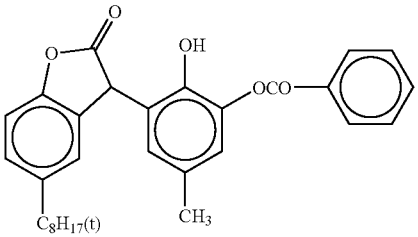
(I-21)
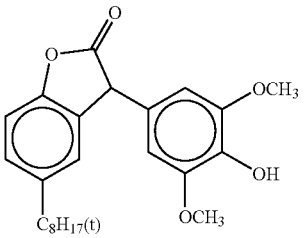
(I-22)
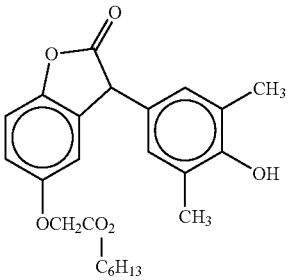
(I-23)
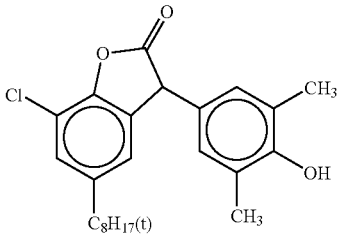
-continued
(I-24)
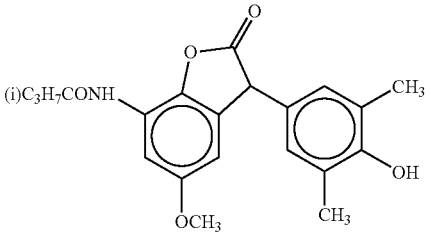
(I-25)
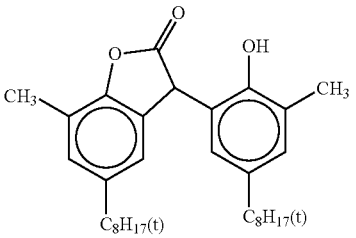
(I-26)
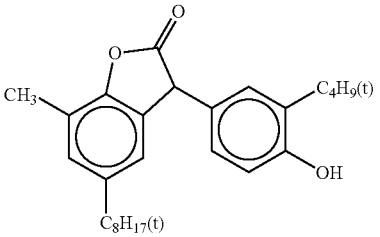
(I-27)
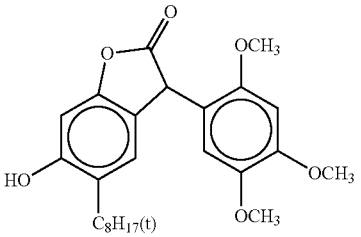
(I-28)
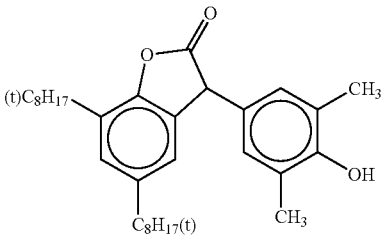
(I-29)
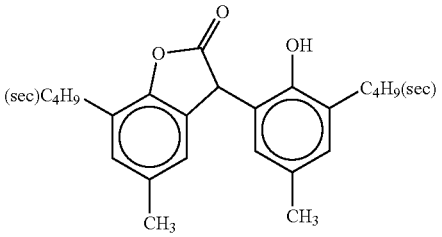

-continued (I-30)

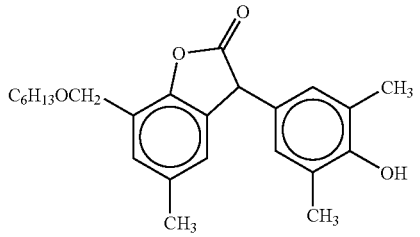

(I-31)

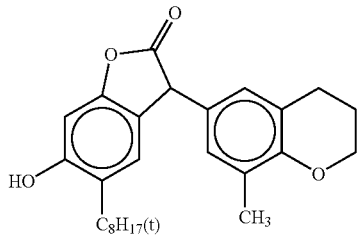

(I-32)

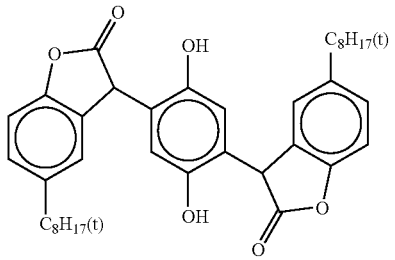

(I-33)

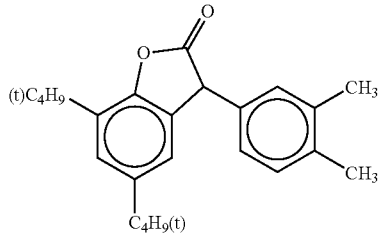

(I-34)

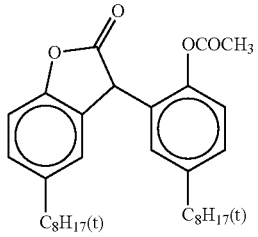

The compounds represented by formula (CMP) can be synthesized using known methods, such as the methods described in WO-A1-0023849 and JP-A-2000-122243 or methods conforming thereto.

The compound represented by formula (CMP) is used in combination with the dye-forming coupler according to the present invention, which forms an azomethine dye having its solubility in the range of $1\times10^{-8}$ mol/L to $5\times10^{-3}$ mol/L in ethyl acetate, and may be added to any of the light-insensitive hydrophilic colloid layers. However, it is preferable that the compound is added to any of light-insensitive hydrophilic colloid layers other than the uppermost layer, and it is especially preferable from the viewpoint of effects of the present invention that the compound is added to a light-insensitive hydrophilic colloid layer adjacent to the layer containing the coupler forming an azomethine dye having its solubility in the range of $1\times10^{-8}$ mol/L to $5\times10^{-3}$ mol/L in ethyl acetate according to the present invention.

The compound represented by formula (CMP) is added in an amount of preferably 10 to 400 mass %, more preferably 20 to 300 mass %, most preferably 50 to 200 mass %, based on the dye-forming coupler forming the dye slightly soluble in the organic solvent according to the present invention.

The compound represented by formula (CMP) may be used alone, or as combinations of two or more thereof, or in combination with other anti-color-mixing agent, such as hydroquinones.

For the purpose of further improving the storage characteristics of dye images, the silver halide color photographic light sensitive material of the present invention may additionally contain various kinds of organic-series or metal-complex-series anti-fading agents. Examples of the organic anti-fading agent include hydroquinones, alkoxyphenols, dialkoxyphenols, phenols, anilines, amines, indanes, chromans, alkoxyanilines and heterocycles, and examples of the metal complex include nickel complexes and zinc complexes. More specifically, the compounds enumerated in *Research Disclosure*, No. 17643, Items VII-I to VII-J, ibid., No. 15162, ibid., No. 18716, p. 650, left column, ibid., No. 36544, p. 527, ibid., No. 307105, p. 872, and ibid., No. 15612 can be used.

As the organic anti-fading agents, the compounds disclosed in the following patent documents are preferably used. The aromatic compound includes those compounds represented by, for example, formula (I) of JP-B-63-50691, formula (IIIa), (IIIb), or (IIIc) of JP-B-2-37575, formula of JP-B-2-50457, formula of JP-B-5-67220, formula (IX) of JP-B-5-70809, formula of JP-B-6-19534, formula (I) of JP-A-62-227889, formula (I) or (II) of JP-A-62-244046, formula (I) or (II) of JP-A-2-66541, formula (II) or (III) of JP-A-2-139544, formula (I) of JP-A-2-194062, formula (B), (C), or (D) of JP-A-2-212836, formula (III) of JP-A-3-200758, formula (II) or (III) of JP-A-3-48845, formula (B), (C), or (D) of JP-A-3-266836, formula (I) of JP-A-3-969440, formula (I) of JP-A-4-330440, formula (I) of JP-A-5-297541, formula of JP-A-6-130602, formula (1), (2), or (3) of International Patent Application Publication WO 91/11749, formula (I) of German Patent Publication DE4,008,785A1, formula (II) of U.S. Pat. No. 4,931,382, formula (a) of European Patent No. 203,746B1, and formula (I) of European Patent No. 264,730B1.

The cyclic amine-series compound includes those compounds represented by, for example, formula (I) of JP-B-2-32298, formula (I) of JP-B-3-39296, formula of JP-B-3-40373, formula (I) of JP-A-2-49762, formula (II) of JP-A-2-208653, formula (III) of JP-A-2-217845, formula (B) of U.S. Pat. No. 4,906,555, formula of European Patent Publication EP309,400A2, formula of European Patent Publication EP309,401A1, and (formula of European Patent Publication) EP309,402A1.

The amine-series compound includes compounds represented by, for example, formula (I) of JP-B-6-97332, formula (I) of JP-B-6-97334, formula (I) of JP-A-2-148037, formula (I) of JP-A-2-150841, formula (I) of JP-A-2-181145, formula (I) of JP-A-3-266836, formula (IV) of JP-A-4-350854, and formula (I) of JP-A-5-61166. The thioether-series compound include compounds represented by, for example, formula (I) of JP-B-2-44052, formula (T) of JP-A-3-48242, formula (A) of JP-A-3-266836, formula (I), (II) or (III) of JP-A-5-323545, formula (I) of JP-A-6-148837, formula (I) of U.S. Pat. No. 4,933,271, and formula (I) of U.S. Pat. No. 4,770,987. The phosphorus-series compound includes compounds represented by, for example, formula (I) of JP-A-3-25437, formula (I) of JP-A-3-142444, formula of U.S. Pat. No. 4,749,645, and formula of U.S. Pat. No. 4,980,275.

In addition to these compounds, may be effective compounds represented by, for example, alkene compounds represented by formula (I) described in U.S. Pat. No. 4,713,317, boron compounds represented by formula (I) described in JP-A-4-174430, epoxy compounds represented by formula (II) described in U.S. Pat. No. 5,183,731 or formula (S1) described in JP-A-8-53431, disulfide-series compounds represented by formula described in European Patent Publication EP271,322 B1 or formula (I), (II), (III) or (IV) described in JP-A-4-19736, sulfin-series compounds represented by formula (1) described in U.S. Pat. No. 4,770,987, reactive compounds represented by formula (I), (II), (III) or (IV) described in U.S. Pat. No. 5,242,785, cyclic phosphorus compounds represented by formula (1) described in JP-A-8-283279.

In addition, a metal complex is effective. As the metal complex, there are many known metal complexes, including dithiolate-series nickel complexes and salicylaldoxime-series nickel complexes, which are effective. Effective examples include compounds represented, for example, by, formula (I) of JP-B-61-13736, formula (I) of JP-B-61-13737, formula (I) of JP-B-61-13738, formula (I) of JP-B-61-13739, formula (I) of JP-B-61-13740, formula (I) of JP-B-61-13742, formula (I) of JP-B-61-13743, formula (I) of JP-B-61-13744, formula of JP-B-5-69212, formula (I) or (II) of JP-B-5-88809, formula of JP-A-63-199248, formula (I) or (II) of JP-A-64-75568, formula (I) or (II) of JP-A-3-182749, formula (II), (III), (IV) or (V) of U.S. Pat. No. 4,590,153, or formula (II), (III), or (IV) of U.S. Pat. No. 4,912,027.

The silver halide color light-sensitive material (hereinafter referred to as light-sensitive material too) applied in the image forming methods of the present invention are described below.

The light-sensitive materials of the present invention has, on a support, photographic constituent layers including at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer, and at least one light-insensitive hydrophilic colloid layer. The yellow-dye-forming-coupler-containing silver-halide emulsion layer functions as an yellow-color-forming layer (Y), the magenta-dye-forming-coupler-containing silver-halide emulsion layer functions as a magenta-color-forming layer (M), and the cyan-dye-forming-coupler-containing silver-halide emulsion layer functions as a cyan-color-forming layer (C).

The silver halide emulsions contained in the Y-, M- and C-color-forming layers preferably have sensitivities to light of three different wavelengths, respectively (e.g., respectively to blue light, green light and red light in the order of Y, M and C).

From the viewpoint of the usage in digital exposure mode using semiconductor lasers or LEDs as light sources, it is possible to arbitrarily choose the foregoing three different spectral sensitivities. Herein, it is preferable from the viewpoint of color separation that the closest distance between spectral sensitivity maxima is at least 30 nm. As to the corresponding relationship between the at least three light-sensitive layers having different spectral-sensitivity maxima ($\lambda 1$, $\lambda 2$, $\lambda 3$) and the color-generating couplers (Y, M, C) incorporated therein, any combinations may be chosen. Further, wavelength regions other than those of blue light, green light and red light may be adopted, and it is also preferable that the light-sensitive layers has infrared spectral sensitivity and can respond to infrared laser exposure.

In addition to the yellow-color-forming layer, the magenta-color-forming layer and the cyan-color-forming layer, the light-sensitive material of the present invention can have, as a light-insensitive hydrophilic colloid layer, an anti-halation layer, an interlayer and a colored layer, as needed.

The arranging order of those silver halide emulsion layers in the silver halide reflective photosensitive material, from nearest to farthest from the support, is generally a yellow-color-generating silver halide emulsion layer, a magenta-color-generating silver halide emulsion layer and a cyan-color-generating silver halide emulsion layer.

The present invention has no restriction as to the arranging order of individual silver halide emulsion layers, but it is preferable that any of the at least three dye-forming-coupler-containing light-sensitive silver halide emulsion layers, other than the light-sensitive silver halide emulsion layer situated in the position farthest from the support among those light-sensitive emulsion layers, contains the dye-forming coupler forming the azomethine dye.

The molar extinction coefficients of dyes formed from generally known yellow couplers are lower than those of dyes formed from magenta couplers and cyan couplers, so there is a tendency of the coating amount of a blue-sensitive emulsion layer to increase with an increase in coating amount of yellow couplers. Therefore, on consideration of resistance to pressure from the photosensitive material surface, such as scratch, the yellow-color-forming blue-sensitive silver halide emulsion layer has a disadvantage in comparison with other layers, and it is preferably arranged in a position nearer the support.

The dye-forming coupler of the present invention that forms a dye hardly soluble in an organic solvent is preferably a cyan-dye-forming coupler that forms a dye having its absorption maximum wavelengths in a range of 570 nm to 700 nm at the time of image formation as described hereinbefore, and the preferable arranging order is a yellow-color-generating silver halide emulsion layer, a cyan-color-generating silver halide emulsion layer and a magenta-color-generating silver halide emulsion layer in order of increasing distant from the support.

Each of the yellow-, magenta- and cyan-color-forming layers may include two or three layers.

It is preferable that a light-insensitive, dye-forming-coupler-containing layer which can be used in the present invention is adjacent to at least one silver halide emulsion layer. When the silver halide emulsion layer is adjacent to the support, it is preferable that the light-insensitive, dye-forming-coupler-containing layer adjacent to the emulsion layer is a single layer, and that it is provided on the side farther from the support. When the silver halide emulsion layer is not adjacent to the support, at least one light-insensitive dye-forming-coupler-containing layer adjoins the emulsion layer and two layers may be adjacent to both sides of the emulsion layer.

The dye-forming coupler may be incorporated in both of the emulsion layer and the light-insensitive dye-forming-coupler-containing layer. For instance, the red-sensitive silver halide emulsion layer may contain a cyan-dye-forming coupler and the light-insensitive dye-forming-coupler-containing layer adjacent thereto may contain also a cyan-dye-forming coupler. The cyan-dye-forming couplers contained in the emulsion layer and the light-insensitive dye-forming-coupler-containing layer may be the same or different in kind, but it is preferable that the same dye-forming coupler is incorporated therein. Likewise, the green-sensitive silver halide emulsion layer and the light-insensitive dye-forming-coupler-containing layer adjacent thereto contain a magenta-dye-forming coupler, and a blue-sensitive silver halide emulsion layer and a light-insensitive dye-forming-coupler-containing layer contain an yellow-dye-forming coupler.

It is preferable that at least 10% by mole, preferably at least 20% by mole, of the total coupler content in both the emulsion layer and the light-insensitive dye-forming-coupler-containing layer is a coupler content in the light-insensitive dye-forming-coupler-containing layer.

The state in which the emulsion layer and the light-insensitive dye-forming-coupler-containing layer are adjacent to each other may be brought about by coating them as clearly separate layers, or by applying one and the same mixed solution but causing separation after application to result in concentration of emulsion grains.

The silver-coating amount of the emulsion layer to which the light-insensitive dye-forming-coupler-containing layer is adjacent is preferably 0.2 g/m$^2$ or below (preferably from 0.01 g/m$^2$ to 0.2 g/m$^2$), more preferably 0.15 g/m$^2$ or below (preferably from 0.01 g/m$^2$ to 0.15 g/m$^2$), further preferably 0.1 g/m$^2$ or below (preferably from 0.01 g/m$^2$ to 0.1 g/m$^2$). The ratio by mass of the silver content to the hydrophilic binder content in the emulsion layer is preferably 0.1 or above, more preferably 0.15 or above (preferably from 0.15 to 1), further preferably 0.2 or above (preferably from 0.2 to 1). The hydrophilic-binder-coating amount in the emulsion layer is preferably 0.6 g/m$^2$ or below (preferably from 0.05 g/m$^2$ to 0.6 g/m$^2$), more preferably 0.4 g/m$^2$ or below (preferably from 0.05 g/m$^2$ to 0.4 g/m$^2$), further preferably 0.3 g/m$^2$ or below (preferably from 0.05 g/m$^2$ to 0.3 g/m$^2$). The ratio of the hydrophilic-binder-coating amount in the light-insensitive dye-forming-coupler-containing layer to that in the emulsion layer is preferably 1.0 or above (preferably from 1.0 to 5.0), more preferably 1.4 or above (preferably from 1.4 to 5.0), further preferably 1.8 or above (preferably from 1.8 to 5.0). Herein, when two light-insensitive dye-forming-coupler-containing layers are present in one color-generating unit, the total of their hydrophilic-binder-coating amounts is used.

The substantially-light-insensitive dye-forming layers that can be used in the present invention don't contain any silver halide emulsion at all, or when they contain silver halide emulsions, the content thereof is 0.1 mole or below, preferably 0.01 mole or below, per mole of couplers.

A non-color-generating and light-insensitive hydrophilic colloid layer (a non-color-generating interlayer) is generally made up of four layers, namely a protective layer, an ultraviolet-absorbing layer and two color-mixing preventive layers.

A unit, in which the non-color-forming intermediate layer containing a color-mixing inhibitor (hereinafter symbolized by MCS) and the non-color-forming intermediate layer substantially free of color-mixing inhibitor (hereinafter symbolized by MCN) in an adjacent state, may be placed between two silver halide emulsion layers so that the MCN is arranged at a position closer to the silver halide emulsion layers. It is preferred that this non-color-forming intermediate layer unit having MCN and MCS, has a triple-layer structure made up of two MCNs and one MCS, and the MCS is positioned adjacent to both upper and lower MCNs. It is much preferred that the non-color-forming intermediate layer having at least two constituent layers is present in each of two spaces formed by three emulsion layers generally included in a color photographic light-sensitive material.

In the present invention, known color-mixing inhibitors can be used. Among them, the compounds disclosed in the following patent documents are preferably used. For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615, and German Patent No. 19629142 A1, may be used. Also, in order to accelerate developing speed by increasing the pH of a developing solution, redox compounds described in, for example, German Patent No. 19,618,786 A1, European Patent Nos. 839,623 A1 and 842,975 A1, German Patent No. 19,806,846 A1 and French Patent No. 2,760,460 A1, are also preferably used.

The expression "substantially free of color-mixing inhibitor" in the MCN that can be used in the present invention means that the per-layer coating amount of a color-mixing inhibitor is not greater than $1\times10^{-5}$ mole/m$^2$.

The content of color-mixing inhibitor in the light-sensitive material of the present invention is preferably at least $5\times10^{-5}$ mole/m$^2$ (more preferably from $5\times10^{-5}$ mole/m$^2$ to $5\times10^{-3}$ mole/m$^2$), more preferably from $1\times10^{-4}$ mole/m$^2$ to $5\times10^{-3}$ mole/m$^2$.

The per-layer coating amount of hydrophilic binder in the non-color-forming intermediate layer MCS or MCN in the present invention is preferably at most 0.7 g/m$^2$ (from 0.05 g/m$^2$ or more to 0.7 g/m$^2$ or less), more preferably at most 0.5 g/m$^2$ (from 0.05 g/m$^2$ or more to 0.5 g/m$^2$ or less), further preferably from at most 0.4 g/m$^2$ (from 0.05 g/m$^2$ or more to 0.4 g/m$^2$ or less).

The total coating amount of hydrophilic binder for the non-color-forming intermediate layer having two or more constituent layers in the present invention is preferably at most 1.5 g/m$^2$ (preferably from 0.2 g/m$^2$ to 1.5 g/m$^2$), more preferably at most 1.2 g/m$^2$ (preferably 0.2 g/m$^2$ to 1.2 g/m$^2$). With respect to the total coating amount of hydrophilic binder, when three layers are coated in two places each, for instance, the total coating amount of hydrophilic binder is a sum of the coating amounts of hydrophilic binders in the six layers. The coating amount of hydrophilic binder for the non-color-forming intermediate layer MCN is preferably at least 0.05 g/m$^2$ (preferably 0.05 g/m$^2$ to 0.5 g/m$^2$), more preferably from 0.1 g/m$^2$ to 0.4 g/m$^2$, further preferably from 0.2 g/m$^2$ to 0.3 g/m$^2$.

In the present invention, the total amount of hydrophilic binder contained in the photosensitive silver halide emulsion layer and the non-photosensitive hydrophilic colloid layer from the support to the hydrophilic colloid layer remotest from the support (on the side where the silver halide emulsion layer(s) is provided) is preferably 6.0 g/m$^2$ or less (preferably 2.0 g/m$^2$ to 6.0 g/m$^2$), more preferably 5.5 g/m$^2$ or less (preferably 3.0 g/m$^2$ to 5.5 g/m$^2$), and further more preferably from 4.0 g/m$^2$ or more to 5.0 g/m$^2$ or less.

When the amount of hydrophilic binder is greater than the foregoing range, there are cases where the effects of the present invention are lessened because rapidity of color-development processing is impaired, blix discoloration is aggravated and rapid processing suitability in a rinsing process (washing and/or stabilizing process) is lost. On the other hand, use of the hydrophilic binder in an amount smaller than the foregoing range is also undesirable because it tends to cause detrimental effects associated with lack of film strength, such as pressure fog streaks.

In the light-sensitive material of the present invention, gelatin is generally used as the hydrophilic binder, but hydrophilic colloids, for example, other gelatin, gelatin derivatives, graft polymers between gelatin and other polymers, proteins other than gelatin, sugar derivatives, cellulose derivatives, and synthetic hydrophilic polymeric materials such as homopolymers or copolymers, can also be used in combination with gelatin, if necessary.

Gelatin to be used in the light-sensitive material of the present invention may be either lime-treated or acid-treated gelatin, or may be gelatin produced from any of cow bone, cowhide, pig skin, or the like, as the raw material, preferably lime-treated gelatin produced from cow bone or pig skin as the raw material.

It is preferable for the gelatin that the content of heavy metals, such as Fe, Cu, Zn and Mn, contained as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

The silver coating amount in the light-sensitive material of the present invention is preferably 0.45 g/m$^2$ or less (preferably 0.1 g/m$^2$ to 0.45 g/m$^2$), more preferably 0.4 g/m$^2$ or less (preferably 0.1 g/m$^2$ to 0.4 g/m$^2$), and further more preferably 0.35 g/m$^2$ or less (preferably 0.2 g/m$^2$ to 0.35 g/m$^2$ or less).

In the following, examples of the layer constitution of the light-sensitive material of the present invention are shown, but the present invention is not limited to these.

1) Support/BL/YL/MCS/RL/MCS/GL/UV/PC
2) Support/BL/YL/MCS/RL/MCS/GL/PC
3) Support/BL/YL/MCS/CL/RL/CL/MCS/GL/PC
4) Support/BL/MCN/MCS/MCN/RL/MCN/MCS/MCN/GL/PC
5) Support/BL/YL/MCN/MCS/MCN/CL/RL/CL/MCN/MCS/MCN/ML/GL/UV/PC
6) Support/BL/MCN/MCS/MCN/CL/RL/CL/MCN/MCS/MCN/GL/UV/PC
7) Support/BL/YL/MCN/MCS/CL/RL/CL/MCS/MCN/GL/PC
8) Support/BL/YL/MCS/GL/MCS/RL/UV/PC
9) Support/BL/YL/MCS/ML/GL/ML/MCS/RL/UV/PC
10) Support/BL/YL/MCN/MCS/MCN/ML/GL/ML/MCN/MCS/MCN/CL/RL/UV/PC
11) Support/BL/YL/MCN/MCS/MCN/ML/GL/ML/MCN/MCS/MCN/CL/RL/PC
12) Support/RL/CL/MCS/BL/MCS/GL/UV/PC
13) Support/CL/MCS/BL/MCS/GL/PC
14) Support/RL/CL/MCS/YL/BL/YL/MCS/GL/PC
15) Support/RL/CL/MCN/MCS/MCN/YL/BL/YL/MCN/MCS/MCN/GL/PC In the above, each layer has the following meaning.

BL: Blue-sensitive emulsion layer
GL: Green-sensitive emulsion layer
RL: Red-sensitive emulsion layer
YL: Light-insensitive layer containing a yellow-dye-forming coupler
ML: Light-insensitive layer containing a magenta-dye-forming coupler
CL: Light-insensitive layer containing a cyan-dye-forming coupler
MCS: Non-color-forming intermediate layer containing a color-mixing inhibitor
MCN: Non-color-forming intermediate layer free of color-mixing inhibitor
UV: Ultraviolet absorbing layer
PC: Protective layer The silver halide emulsion that is preferably used in the present invention is described below.

The shape of the silver halide grains contained in the silver halide emulsion is not particularly limited. The shape is preferably such that the grains are composed of cubic or tetradecahedron crystal particles substantially having a {100} plane (these crystal particles may have a round particle top and high-order planes), octahedron crystal particles, or tabular particles having a {100} or {111} plane as a major plane and an aspect ratio of 2 or more. The aspect ratio is a value obtained by dividing the diameter of a circle having an area equivalent to the projected area of an individual grain by the thickness of the particle.

In the present invention, cubic or tetradecahedron crystal particles are further preferable.

A silver halide emulsion generally contains a silver chloride, and the silver chloride content is preferably 90 mol % or more, more preferably 93 mol % or more in view of rapid processing performance, and still more preferably 95 mol % or more.

A silver halide emulsion preferably contains a silver bromide and/or a silver iodide. The silver bromide content is preferably from 0.1 to 7 mol %, and more preferably from 0.5 to 5 mol %, in view of high contrast and excellent latent image stability. The silver iodide content is preferably from 0.02 to 1 mol %, more preferably from 0.05 to 0.50 mol %, and most preferably from 0.07 to 0.40 mol %, in view of high sensitivity and high contrast under high illumination intensity exposure.

The silver halide emulsion is preferably silver chloroiodobromide emulsion, and more preferably silver chloroiodobromide emulsion having the above-described halogen composition.

The silver halide emulsion preferably has a silver bromide-containing phase and/or a silver iodide-containing phase. Herein, a region where the content of silver bromide is higher than that in other regions will be referred to as a silver bromide-containing phase, and likewise, a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The localized silver bromide content in the silver bromide-containing phase is preferably 5 mol % or more, more preferably from 10 to 80 mol %, and most preferably from 15 to 50 mol %. The localized silver iodide content in the silver iodide-containing phase is preferably 0.3 mol % or more, more preferably from 0.5 to 8 mol %, and most preferably from 1 to 5 mol %. Such silver bromide- or silver iodide-containing phase may be present in plural numbers in layer form, within the grain. In this case, the phases may have different silver bromide or silver iodide contents from each other. The silver halide grain has at least one of the silver bromide-containing phase and silver iodide-containing phase. Preferably, it contains both at least one silver bromide-containing phase and at least one silver iodide-containing phase.

The silver bromide-containing phase or silver iodide-containing phase formed in the silver halide emulsion is preferably formed in a layer form so as to surround the grain. One preferred embodiment is that the silver bromide-containing phase or the silver iodide-containing phase formed in the layer form so as to surround the grain has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or an edge of the grain can be different from that of a main plane of the grain. Further, aside from the silver bromide-containing phase and silver iodide-containing phase formed in the layer form so as to surround the grain, another silver bromide-containing phase or silver iodide-containing phase not surrounding the grain may exist in isolation at a specific portion of the surface of the grain.

In a case where the silver halide emulsion contains a silver bromide-containing phase, it is preferable that said silver bromide-containing phase is formed in a layer form so as to have a concentration maximum of silver bromide inside of the grain. Likewise, in a case where the silver halide emulsion for use of the present invention contains a silver iodide-containing phase, it is preferable that said silver iodide-containing phase is formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide emulsion preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide content and/or a silver iodide content of a silver halide emulsion increase with the silver bromide-containing phase and/or the silver iodide-containing phase being formed in more inside of the grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

In order to introduce bromide ions or iodide ions for introduction of the silver bromide or silver iodide into the silver halide emulsion, a bromide salt or iodide salt solution may be added alone, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high chloride emulsion may be limited. The deeper in the emulsion grain the iodide ion is introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side, of the volume of the grain.

The variation coefficient of sphere-equivalent diameter of the all grains in the silver halide emulsion is preferably 20% or less, more preferably 15% or less, and still more preferably 10% or less. The variation coefficient of sphere-equivalent diameter is expressed as a percentage of standard deviation of sphere-equivalent diameter of each grain, to an average of sphere-equivalent diameter. In this connection, for the purpose of obtaining broad latitude, it is also preferred that the above-mentioned monodisperse emulsions be used as blended in the same layer, or coated by a multilayer coating method. In the present specification, the sphere-equivalent diameter is indicated by a diameter of a sphere having the same volume as that of individual grain. Preferably, the silver halide emulsion comprises grains having a monodisperse-grain size-distribution.

The sphere-equivalent diameter of the grain in the silver halide emulsion is preferably 0.6 μm or below, further preferably 0.5 μm or below, and most preferably 0.4 μm or below. The lower limit of the sphere-equivalent diameter of the silver halide grains is preferably 0.05 μm, and more preferably 0.1 μm. The grain having a sphere-equivalent diameter of 0.6 μm corresponds to a cubic grain having a side length of approximately 0.48 μm, the grain having a sphere-equivalent diameter of 0.5 μm corresponds to a cubic grain having a side length of approximately 0.4 μm, and the grain having a sphere-equivalent diameter of 0.4 μm corresponds to a cubic grain having a side length of approximately 0.32 μm, respectively.

The silver halide emulsion preferably contains iridium. Iridium preferably forms an iridium complex. A six-coordination complex having 6 ligands and containing iridium as a central metal is preferable, for uniformly incorporating iridium in a silver halide crystal. As one preferable embodiment of iridium compound for use in the present invention, a six-coordination complex having Cl, Br or I as a ligand and containing iridium as a central metal is preferable. A more preferable example is a six-coordination complex in which all six ligands are Cl, Br, or I and which has iridium as a central metal. In this case, Cl, Br and I may coexist in the six-coordination complex. It is especially preferable that a six-coordination complex having Cl, Br or I as a ligand and containing iridium as a central metal is contained in a silver bromide-containing phase, in order to obtain a hard gradation in a high illumination intensity exposure.

Specific examples of the six-coordination complex in which all of 6 ligands are made of Cl, Br or I and which has iridium as a central metal include $[IrCl_6]^{2-}$, $[IrCl_6]^{3-}$, $[IrBr_6]^{2-}$, $[IrBr_6]^{3-}$, and $[IrI_6]^{3-}$. However, Iridium in the present invention is not limited to these complexes.

As another preferable embodiment of iridium compound, a six-coordination complex having at least one ligand other than a halogen or ligand other than a cyan and containing iridium as a central metal is preferable. A six-coordination complex having $H_2O$, OH, O, OCN, thiazole, a substituted thiazole, thiadiazole or a substituted thiadiazole, as a ligand, and containing iridium as a central metal is preferable. A six-coordination complex in which at least one ligand is $H_2O$, OH, O, OCN, thiazole or a substituted thiazole and the remaining ligands are Cl, Br or I, and iridium is a central metal, is more preferable. A six-coordination complex in which one or two ligands are 5-methylthiazole, 2-chloro-5-fluorothiadiazole or 2-bromo-5-fluorothiadiazole and the remaining ligands are Cl, Br or I, and iridium is a central metal, is most preferable.

Examples of the six-coordinate complex containing Ir as the central metal, $H_2O$, OH, O, OCN, thiazole or a substituted thiazole as at least one ligand, and Cl, Br or I as the remaining ligands include $[Ir(H_2O)Cl_5]^{2-}$, $[Ir(OH)Br_5]^{3-}$, $[Ir(OCN)Cl_5]^{3-}$, $[Ir(thiazole)Cl_5]^{2-}$, $[Ir(5\text{-methylthiazole})Cl_5]^{2-}$, $[Ir(2\text{-chloro-5-fluorothiadiazole})Cl_5]^{2-}$ and $[Ir(2\text{-bromo-5-fluorothiadiazole})Cl_5]^{2-}$, but they are not limited to these complexes.

In addition to the above iridium complexes, it is preferred for a silver halide emulsion to contain six-coordinate complexes having CN as the ligands with Fe, Ru, Re or Os as the central metal, e.g., $[Fe(CN)_6]^{4-}$, $[Fe(CN)_6]^{3-}$, $[Ru(CN)_6]^{4-}$, $[Re(CN)_6]^{4-}$ and $[Os(CN)_6]^{4-}$. It is further preferred for a silver halide emulsion for use in the invention to contain pentachloronitrosyl complex or pentachlorothionitrosyl complex with Ru, Re or Os as the central metal, and six-coordinate complex having Cl, Br or I as the ligands with Rh as the central metal. These ligand may be subjected to partial aquation.

The foregoing metal complexes are anions. When these are formed into salts with cations, counter cations are preferably those easily soluble in water. Specifically, alkali metal ions, such as sodium ion, potassium ion, rubidium ion, cesium ion and lithium ion, an ammonium ion, and an alkylammonium ion are preferable. These metal complexes can be used by being dissolved in water or a mixed solvent of water and an appropriate water-miscible organic solvent (such as alcohols, ethers, glycols, ketones, esters and amides). These metal complexes are preferably added during grain formation in an amount of $1\times10^{-10}$ mol to $1\times10^{-3}$ mol, most preferably $1\times10^{-9}$ mol to $1\times10^{-5}$ mol, per mol of silver, although the optimum amount may vary depending on the kind thereof.

It is preferable that the above-mentioned metal complex is incorporated into the silver halide grains, by directly adding the same to a reaction solution for the formation of the silver halide grains, or to an aqueous solution of the halide for the formation of the silver halide grains, or to another solution and then to the reaction solution for the grain formation. It is also preferable that a metal complex is incorporated into the silver halide grains by physical ripening with fine grains having metal complex previously incorporated therein. Further, the metal complex can be also contained into the silver halide grains by a combination of these methods.

In case where the metal complex is doped (incorporated) into the silver halide grains, the metal complex may be uniformly distributed in the inside of the grains. On the other hand, as disclosed in JP-A-4-208936, JP-A-2-125245 and JP-A-3-188437, the metal complex is also preferably distributed only in the grain surface layer. Alternatively, the metal complex is also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having the metal complex incorporated therein, to modify the grain surface phase. Further, these methods may be used in combination. Plural kinds of complexes may be incorporated in the inside of an individual silver halide grain. The halogen composition at the position (portion) where the complexes are incorporated, is not particularly limited, but the six-coordination complex whose central metal is Ir and whose all six-ligands are Cl, Br, or I is preferably incorporated in a silver bromide concentration maximum portion.

The silver halide emulsion is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272, page 18, right lower column to page 22, right upper column are preferably used. Of these chemical sensitization, gold-sensitized silver halide emulsion is particularly preferred, since a fluctuation in photographic properties which occurs when scanning exposure with laser beams or the like is conducted, can be further reduced by gold sensitization.

In order to conduct gold sensitization to the silver halide emulsion, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), can be used.

As the gold (I) compounds each having an organic ligand (an organic compound), use can be made of bis-gold (I) mesoionic heterocycles described in JP-A-4-267249, e.g. bis (1,4,5-trimethyl-1,2,4-triazolium-3-thiolato) aurate (I) tetrafluoroborate; organic mercapto gold (I) complexes described in JP-A-11-218870, e.g. potassium bis(1-[3-(2-sulfonatobenzamido)phenyl]-5-mercaptotetrazole potassium salt) aurate (I) pentahydrate; and gold (I) compound with a nitrogen compound anion coordinated therewith, as described in JP-A-4-268550, e.g. bis (1-methylhydantoinato) gold (I) sodium salt tetrahydrate. As these gold (I) compounds having organic ligands, use can be made of those which are synthesized in advance and isolated, as well as those which are generated by mixing an organic ligand and an Au compound (e.g., chlroauric acid or its salt), to add to an emulsion without isolating the Au compound. Moreover, an organic ligand and an Au compound (e.g., chlroauric acid or its salt) may be separately added to the emulsion, to generate the gold (I) compound having the organic ligand, in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used. The amount of the above compound to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

Further, in the present invention, colloidal gold sulfide can also be used. A method of producing the colloidal gold sulfide is described in, for example, Research Disclosure, No. 37154; Solid State Ionics, Vol. 79, pp. 60 to 66 (1995); and Compt. Rend. Hebt. Seances Acad. Sci. Sect. B, Vol. 263, p. 1328 (1966). The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

Chalcogen sensitization and gold sensitization can be conducted by using the same molecule such as a molecule capable of releasing $AuCh^-$, in which Au represents Au (I), and Ch represents a sulfur atom, a selenium atom or a tellurium atom. Examples of the molecule capable of releasing $AuCh^-$ include gold compounds represented by AuCh-L, in which L represents a group of atoms bonding to AuCh to form the molecule. Further, one or more ligands may coordinate to Au together with Ch-L. Examples of more specific compounds include Au(I) salts of thiosugar (for example, gold thioglucose (such as α-gold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar.

Herein, the terms "thiosugar", "selenosugar" and "tellurosugar" each mean the compound in which a hydroxy group in the anomer position of the sugar is substituted with a SH group, a SeH group or a TeH group. An addition amount of these compounds can vary over a wide range according to the occasions, and the amount is generally in the range of $5\times10^{-7}$ to $5\times10^{-3}$ mol, preferably in the range of $3\times10^{-6}$ to $3\times10^{-4}$ mol, per mol of silver halide.

In the silver halide emulsion, the above-mentioned gold sensitization may be combined with other sensitization, such as sulfur sensitization, selenium sensitization, tellurium sensitization, reduction sensitization, and noble metal sensitization using noble metals other than gold compounds. In particular, the gold sensitization is preferably combined with sulfur sensitization and/or selenium sensitization.

Various compounds or precursors thereof can be included in the silver halide emulsion to prevent fogging from occurring or to stabilize photographic performance during manufacture, storage or photographic processing of the photographic material. Specific examples of these compounds are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance fastness of the silver halide emulsion, it is also preferred to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

Spectral sensitizing dyes can be contained in the silver halide emulsion for the purpose of imparting spectral sensitivity in a desired light wavelength region. Examples of spectral sensitizing dyes, for spectral sensitization of blue, green, and red light regions, include, for example, those disclosed by F. M. Harmer, in "Heterocyclic Compounds—Cyanine Dyes and Related Compounds", John Wiley & Sons, New York, London (1964). Specific examples of compounds and spectral sensitization processes include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like.

In use of a digital exposure system also, the spectral sensitization is carried out for the purpose of conferring appropriate spectral sensitivities corresponding to wavelength regions of light sources, and it is also preferable to provide infrared spectral sensitization, if required. As a spectral sensitization method intended for digital exposure, the method described in JP-A-5-142712 is also preferable and the compounds disclosed therein are preferably used as infrared spectral sensitizing dyes.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{3}$ mole, per mole of silver halide.

In the following, the light-sensitive materials of the present invention will be explained in detail.

In the light-sensitive material according to the present invention, gelatin can be used as the hydrophilic binder, but hydrophilic colloids of other gelatin derivatives, graft polymers between gelatin and other polymers, proteins other than gelatin, sugar derivatives, cellulose derivatives and synthetic hydrophilic polymeric materials such as homopolymers or copolymers can also be used in combination with gelatin, if necessary. Gelatin to be used in the silver halide color photographic light-sensitive material according to the present invention may be either lime-treated or acid-treated gelatin or may be gelatin produced from any of cow bone, cowhide, pig skin, or the like, as the raw material, preferably lime-treated gelatin produced from cow bone or pig skin as the raw material.

It is preferred for the gelatin that the content of heavy metals, such as Fe, Cu, Zn, and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

The total coating amount of gelatin in photographic constituent layers of the photosensitive material, namely the total amount of hydrophilic binders contained in the light-sensitive silver halide emulsion layers and light-insensitive hydrophilic colloid layers which are provided in a range extending from the support to the hydrophilic colloid layer most distant from the support on the silver halide emulsion-coated side, is preferably from 4.0 g/m$^2$ to 7.0 g/m$^2$, far preferably from 4.0 g/m$^2$ to 6.5 g/m$^2$, particularly preferably from 4.0 g/m$^2$ to 6.0 g/m$^2$. When the amount of total hydrophilic binders exceeds the foregoing range, effects of the present invention is lowered in some cases because the rapidity of color-development processing is lost, blix discoloration is worsened, or the rapid processing suitability of the rinsing process (washing and/or stabilizing process) is impaired. On the other hand, the amount of total hydrophilic binders falling short of the foregoing range is undesirable because it tends to yield detrimental effects, such as pressure-induced fog streaks, caused by insufficient film strength.

The light-sensitive material of the present invention preferably contains, in the hydrophilic colloid layer, a dye (particularly oxonole dyes and cyanine dyes) that can be discolored by processing, as described in European Patent Application Publication No. 0337490A2, pages 27 to 76, in order to prevent irradiation or halation or enhance safelight safety, and the like. Further, a dye described in European Patent Publication No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the light-sensitive material of the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (closer to a support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source of the scanning exposure in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine particles of dye and of using colloidal silver.

It is preferable that the light-sensitive material of the present invention has at least one yellow-color-forming silver halide emulsion layer, at least one magenta-color-forming silver halide emulsion layer and at least one cyan-color-forming silver halide emulsion layer. In general, the arranging order of these silver halide emulsion layers, from nearest the support to farthest from the support, is a yellow-color-forming silver halide emulsion layer, a magenta-color-forming silver halide emulsion layer and a cyan-color-forming silver halide emulsion layer.

However, other layer arrangements which are different from the above, may be adopted.

In the light-sensitive material of the present invention, the silver halide emulsion contained in the blue-sensitive silver halide emulsion layer preferably has a relatively high sensitivity as compared with the green-sensitive silver halide emulsion and red-sensitive silver halide emulsion, in consideration of yellow mask of a negative or spectroscopic characteristics of halogen that is the source at the time of exposure. For this purpose, the side length of the grains in the blue-sensitive emulsion is greater than that of the grains in other layers. Further, the generally known molar extinction coefficient of the coloring dye formed by a yellow coupler is low as compared with those of the coloring dyes formed by the magenta coupler and the cyan coupler, so that increasing yellow coupler coating amount is accompanied by an increasing coating amount of the blue-sensitive emulsion. The yellow color-forming blue-sensitive silver halide emulsion layer is disadvantageous as compared with other layers when taking into consideration the resistance to pressure applied from the surface of the light-sensitive material, such as scratching, and it is preferably positioned on a side closer to the support.

That is, the yellow coupler-containing silver halide emulsion layer may be provided at any position on a support. In the case where silver halide tabular grains are contained in the silver halide emulsion layer, it is preferable that the yellow-coupler-containing layer be positioned more apart from a support than at least one of the magenta-coupler-containing silver halide emulsion layer and the cyan-coupler-containing silver halide emulsion layer. Further, it is preferable that the yellow-coupler-containing blue-sensitive silver halide emulsion layer be positioned most apart from a support than other silver halide emulsion layers, from the viewpoint of color-development acceleration, desilvering acceleration, and reducing residual color due to a sensitizing dye. Further, it is preferable that the cyan-coupler-containing silver halide emulsion layer be disposed in the lowest layer or the middle of the other silver halide emulsion layers, from the viewpoint of reducing light fading. Further, each of the yellow-color-forming layer, the magenta-color-forming layer, and the cyan-color-forming layer may be composed of two or three layers.

Preferred examples of silver halide emulsions that can be additionally used in combination with the light sensitive material of the present invention, and other materials (additives or the like) applicable to the present invention, photographic constitutional layers (arrangement of the layers or the sensitive material, those described in the patent publications as shown in the following table are particularly preferably used in the present invention.

TABLE 1

| Element | JP-A-7-104448 | JP-A-7-77775 | JP-A-7-301895 |
|---|---|---|---|
| Reflective type supports | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | — | — |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | — | — |
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | — | — |

like), and processing methods for processing the photographic materials and additives for processing, include those disclosed in JP-A-62-215272, JP-A-2-33144, and European Patent Application Publication No. 0,355,660A2. In particular, those disclosed in European Patent Application Publication No. 0,355,660A2 can be preferably used. Further, it is also preferred to use silver halide color photographic light-sensitive materials and processing methods thereof described, for example, in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Application Publication No. 0520457A2.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and discoloration inhibitors), the dyes (coloring layers), the kinds of gelatin, the layer structure of the light-sensitive material, and the film pH of the light- In the photosensitive material of the present invention, the dye-forming coupler is preferably added to a photographically useful substance or a high-boiling organic solvent, emulsified and dispersed together with the substance or solvent, and incorporated into a photosensitive material as a resulting dispersion. This solution (dispersion) is emulsified and dispersed in fine grain form, into a hydrophilic colloid, preferably into an aqueous gelatin solution, together with a dispersant which is, for example, a surfactant, by use of a known apparatus such as an ultrasonic device, a colloid mill, a homogenizer, a Manton-Gaulin, or a high-speed dissolver, to obtain a dispersion. The average particle size of the thus obtained dispersion is preferably from 0.04 to 0.50 μm, further preferably from 0.05 to 0.20 μm, and most preferably from 0.05 to 0.1 μm (100 nm). The average particle size can be measured according to dynamic light scattering. When gelatin is used as the protective colloid of the dispersion, the gelatin adsorbed to particles is removed in the following manner, and the size can be determined.

1. Preparation of Solution for Enzyme Treatment:

The surfactant used in a target aqueous dispersion, in an amount of 0.25 g and a commercially available proteolytic enzyme (e.g., Actinase E, manufactured by Wako Pure Chemical Industries, Ltd.) in an amount of 0.020 g were dissolved in 200 mL of water at room temperature. By passing the thus obtained aqueous solution through a commercially available 0.2-μm aqueous-system filter, a solution for enzyme treatment was prepared.

2. Preparation of Solution for Size Measurement:

The aqueous dispersion was weighed in an amount of 0.25 g, and dissolved in 2.5 mL of water kept at a temperature of 40 to 45° C. This dilute solution and the foregoing solution for enzyme treatment were admixed in a proportion of 1 mL to 10 mL, and kept at 40° C. for 5 minutes. The solution thus obtained was then cooled to room temperature.

3. Measurement:

The thus-prepared solution for size measurement was subjected to particle-size measurement with a particle size analyzer LB500 made by Horiba Ltd.

It is preferred that the aqueous dispersion, be emulsified under pressure of 200 MPa or above, preferably 240 MPa or above, with a high-pressure homogenizer.

An example of a high-pressure homogenizer usable for emulsification is Ultimaizer System HJP-25005 made by Sugino Machine Limited. This system can accelerate a dispersion by feeding the dispersion at ultrahigh pressure by means of a hydraulic pump and by passing it through 0.1 mmϕ diamond-made chamber nozzles. The thus-accelerated dispersion flows can be caused oppose to and collide with each other. In addition, it is possible to apply back pressure to the dispersion outlet. Alternatively, the dispersing machine shown in FIGS. 1 to 3 of JP-A-2001-27795 or a DeBEE 2000 made by BEE INTERNATIONAL can be preferably used.

It is preferred that the aqueous dispersion in the present invention be rendered fine in a jet stream, with using a high-pressure homogenizer. The jet stream in the present invention refers to a fluid flow, and the initial velocity of jet stream is preferably at least 300 m/sec, more preferably at least 400 m/sec, far preferably at least 600 m/sec.

The high-boiling organic solvent is not particularly limited, and an ordinary one may be used. Examples thereof include those described in U.S. Pat. No. 2,322,027 and JP-A-7-152129.

Further, an auxiliary solvent may be used together with the high-boiling point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, s-ethoxyethyl acetate, methyl cellosolve acetate, methyl carbitol acetate, and cyclohexanone.

Further, if necessary, an organic solvent that completely admix with water, such as methyl alcohol, ethyl alcohol, acetone, tetrahydrofuran, and dimethylformamide, can be additionally used as a part of the auxiliary solvent. These organic solvents can be used in combination with two or more.

For the purpose of, for example, improving stability with the lapse of time at storage in the state of an emulsified dispersion, and improving stability with the lapse of time and inhibiting the fluctuation of photographic property of the final-composition for coating that is mixed with an emulsion, if necessary, from the thus-prepared emulsified dispersion, the auxiliary solvent may be removed in its entirety or part of it, for example, by distillation under reduced pressure, noodle washing, or ultrafiltration.

Preferably, the average particle size of the lipophilic fine-particle dispersion obtained in this way is 0.04 to 0.50 μm, more preferably 0.05 to 0.30 μm, and most preferably 0.06 to 0.20 μm. The average particle size can be measured by using Coulter Submicron Particle Analyzer Model N4 (trade name, manufactured by Coulter Electronics Co.) or the like.

Also, a pigment for coloration may be co-emulsified into the emulsion used in the present invention in order to adjust coloration of the white background, or it may coexist in an organic solvent that dissolves the photographically useful compound, such as the coupler, used in the photosensitive material of the present invention to be co-emulsified, thereby preparing an emulsion.

As cyan, magenta, and yellow couplers which can be used in the photosensitive material, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add a compound represented by formula (II) or (III) in WO 98/33760 or a compound represented by formula (D) described in JP-A-10-221825.

It is preferred that couplers usable in the photosensitive material, are pregnated into a loadable latex polymer (as described, for example, in U.S. Pat. No. 4,203,716) in the presence (or absence) of the high-boiling-point organic solvent described in the foregoing Table 1, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic-solvent-soluble polymer which can be preferably used, include the homopolymers and co-polymers as disclosed in U.S. Pat. No. 4,857,449, from column 7 to column 15, and WO 88/00723, from page 12 to page 30. The use of methacrylate-series or acrylamide-series polymers, especially acrylamide-series polymers are more preferable, in view of color-image stabilization and the like.

In the photosensitive material of the present invention, known color mixing-inhibitors may be used. Among these compounds, those described in the following patent publications are preferred.

For example, high-molecular weight redox compounds described in JP-A-5-333501; phenidone- or hydrazine-series compounds as described in WO 98/33760 pamphlet and U.S. Pat. No. 4,923,787 and the like; and white couplers as described in JP-A-5-249637, JP-A-10-282615, German Patent Application Publication No. 19629142 A1 and the like, may be used. In addition, in order to accelerate developing speed by increasing the pH of a developing solution, redox compounds described in German Patent Application Publication No. 19618786A1, European Patent Application Publication Nos. 839623A1 and 842975A1, German Patent Application Publication No. 19806846A1, French Patent Application Publication No. 2760460A1, and the like, are also preferably used.

In the photosensitive material of the present invention, as an ultraviolet ray absorbent, it is preferred to use a compound having a triazine skeleton high in a molar extinction coefficient. For example, those described in the following patent publications can be used. These compounds can be preferably used in the light-sensitive layer or/and the light-insensitive layer. For example, use can be made of the compound described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 711804A, JP-T-8-501291 ("JP-T" means published searched patent publication), and the like.

It is preferred to add an antibacterial (fungi-preventing) agent or antimold agent, as described in JP-A-63-271247, to the light-sensitive material of the present invention, in order to destroy various kinds of molds and bacteria which propagate in a hydrophilic colloid layer and deteriorate the image. Further, the pH of the coating film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, there are anionic, cationic, betaine-series or nonionic surfactants. Examples thereof include those described in JP-A-5-333492. As the surface-active agent for use in the present invention, a fluorine-containing surface-active agent is preferred. In particular, a fluorine-containing surface-active agent is preferably used. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention can be used for various materials, such as color negative films, color positive films, color reversal films, color reversal papers, and color papers, and color papers are more preferable.

As a photographic support (usable in the light-sensitive material of the present invention, a transmissive type support or a reflective type support may be used. As the transmissive type support, it is preferred to use a transparent support, such as a cellulose triacetate film, and a transparent film of polyethylene terephthalate, or a polyester of 2,6-naphthalenedicarboxylic acid (NDCA) and ethylene glycol (EG), or a polyester of NDCA, terephthalic acid and EG, provided thereon with an information-recording layer such as a magnetic layer. In the present invention, it is preferable to use the reflective type support. As the reflective type support, it is especially preferable to use a reflective support having a substrate laminated thereon with a plurality of polyethylene layers or polyester layers, at least one of the water-proof resin layers (laminate layers) contains a white pigment such as titanium oxide.

Further, it is preferred that the above-described water-proof resin layer contains a fluorescent whitening agent. Further, the fluorescent whitening agent may be dispersed in the hydrophilic colloid layer of the light-sensitive material. Preferred fluorescent whitening agents which can be used, include benzoxazole-series, coumarin-series, and pyrazoline-series compounds. Further, fluorescent whitening agents of benzoxazolylnaphthalene-series and benzoxazolylstilbene-series are more preferably used. Specific examples of the fluorescent whitening agent that is contained in the water-resistant resin layer, include, for example, 4,4'-bis(benzoxazolyl)stilbene, 4,4'-bis(5-methylbenzoxazolyl)stilbene, and mixture thereof. The amount of the fluorescent whitening agent to be used is not particularly limited, and preferably in the range of 1 to 100 mg/m$^2$. When the fluorescent whitening agent is mixed with the water-proof resin, a mixing ratio of the fluorescent whitening agent to the resin is preferably in the range of 0.0005 to 3% by mass, and more preferably in the range of 0.001 to 0.5% by mass.

Further, a transmissive type support or the foregoing reflective type support each having coated thereon a hydrophilic colloid layer containing a white pigment may be used as the reflective type support. Furthermore, a support having a mirror plate reflective metal surface or a secondary diffusion reflective metal surface may be employed as the reflective type support.

A more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.7 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface is polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer provided on the paper substrate include those described in JP-A-10-333277, JP-A-10-333278, JP-A-11-52513, JP-A-11-65024, European Patent Nos. 0880065 and 0880066.

The light-sensitive material of the present invention can be preferably used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red. The exposure time in such a scanning exposure is defined as the time necessary to expose the size of the picture element with the density of the picture element being 400 dpi, and preferred exposure time is $1\times10^{-4}$ sec or less, and further preferably $1\times10^{-6}$ sec or less.

The silver halide color photographic light sensitive material according to the present invention can be preferably used in combination with the exposure and development systems described in the following known publications. These development systems include the automatic printing and the developing system disclosed in JP-A-10-333253, the transporting apparatus of a light-sensitive material disclosed in JP-A-2000-10206, the recording system including an image reader disclosed in JP-A-11-215312, the exposure systems comprising a color image-recording system disclosed in JP-A-11-88619 and JP-A-10-202950, the digital photo print system including a remote diagnostic system disclosed in JP-A-10-210206, and the photo print system including an image-recording apparatus disclosed in JP-A-2000-310822.

The preferred scanning exposure methods which can be applied to the present invention are described in detail in the publications listed in the table 1 shown above.

It is preferred to use a band stop filter, as described in U.S. Pat. No. 4,880,726, when the light-sensitive material of the present invention is subjected to exposure with a printer. Color mixing of light can be excluded and color reproducibility is remarkably improved by the above means.

In the present invention, a yellow microdot pattern may be previously pre-exposed before giving an image information, to thereby perform a copy restraint, as described in European Patent Nos. 0789270A1 and 0789480A1.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be applied. Further, as the preservative for use in the developing solution, compounds described in the patent publications listed in the aforementioned Table can be preferably used.

The present invention can be preferably applied to a light-sensitive material having rapid processing suitability. In the case of conducting rapid processing, the color-developing time is preferably 60 sec or less, more preferably from 50 sec to 6 sec, further preferably from 30 sec to 6 sec, and most preferably from 20 sec to 6 sec. Likewise, the blix time is preferably 60 sec or less, more preferably from 50 sec to 6 sec, further preferably from 30 sec to 6 sec, and most preferably from 20 sec to 6 sec. Further, the washing or stabilizing time is preferably 150 sec or less, and more preferably from 130 sec to 6 sec.

Herein, the term "color-developing time" as used herein means a period of time required from the beginning of dipping a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color-developing solution (so-called "time in the solution") and a time in which the light-sensitive material has left the color-developing solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

EXAMPLES

The present invention will be described in more detail based on the following examples, but the invention is not intended to be limited thereto.

Example 1

To a mixture of 4.1 g of Exemplified Compound CP-(1), 3.53 g of 4-amino-3-methyl-N-ethyl-N-(β-methanesulfonamidoethyl)aniline and 2.8 g of anhydrous sodium carbonate, 20 ml of ethyl acetate, 20 ml of ethanol and 10 ml of water were added in succession, and stirred at room temperature. To the resulting mixture, a solution of 3.62 g of ammonium persulfate in 20 ml of water was added dropwise. After the dropwise addition, the stirring was continued for 2 hours at room temperature. Crystals thus precipitated out were filtered off, and washed with water first and then with ethanol. After drying the crystals, recrystallization from methanol was carried out, and 3.45 g of the intended (Dye 1) was obtained as violet crystals (in a 70% yield). The structure of the compound obtained was confirmed by $^1$HNMR and a mass spectrum.

$^1$HNMR (300 MHz, DMSO-$d_6$) δ0.90 (18H, s), 1.09 (3H, d), 1.25 (3H, t), 1.28 (9H, s), 1.3-1.8 (7H, m), 2.98 (3H, s), 3.25 (2H, m), 3.36 (3H, s), 3.72 (4H, m), 3.96 (3H, s), 6.00 (1H, s), 7.00 (2H, m), 7.20 (1H, d), 7.30 (1H, t), 7.95 (1H, d), 8.54 (1H, s), 8.70 (1H, s), 9.16 (1HY, br. s)

MS m/z 856 (M+)

Melting point 276-279° C.

λmax in ethyl acetate=634 nm $\epsilon max=5.9\times10^4$ $cm^{-1}M^{-1}$ (Dye 1)

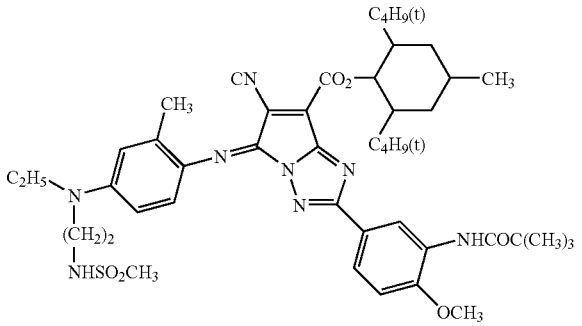

The (Dye 1) in an amount of 50 mg was added to 20 ml of ethyl acetate and dissolved by ultrasonic stirring to prepare a supersaturated dispersion at 25° C. Absorption spectrum measurement (1-mm quartz glass cell) was made on the dye-saturated solution obtained from a filtrate of the supersaturated dispersion. Calculating from the measured value of absorbance at the maximum absorption wavelength, the solubility of the (Dye 1) was $5.5\times10^{-4}$ mol/L.

In the same manner as described above, (Dye 2), (Dye 3) and (Dye 4) were synthesized using Exemplified Compound CP-(2), Exemplified Compound CP-(5) and a coupler (ExC-1) illustrated in Example 2 described hereinafter, respectively, and the solubility of each Dye was determined. The results obtained are shown in Table 2.

TABLE 2
(Dye 2)
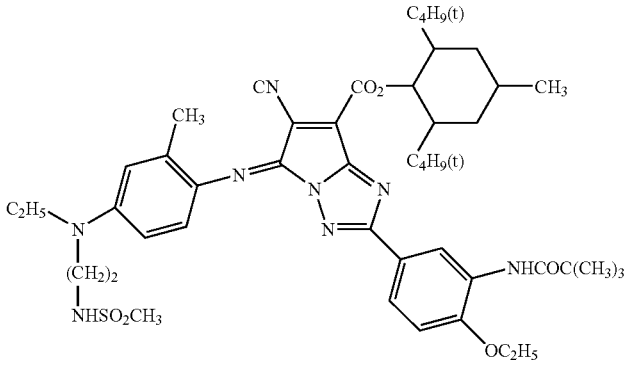
(Dye 3)
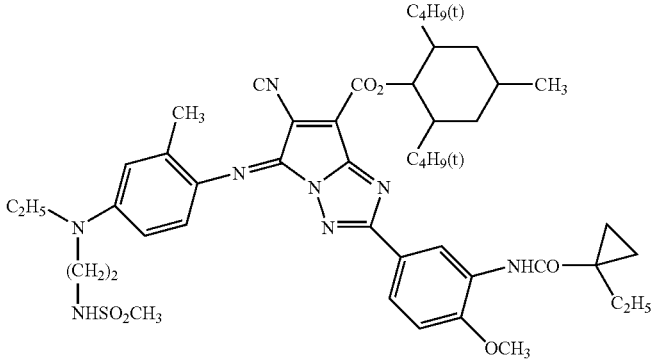
(Dye 4)
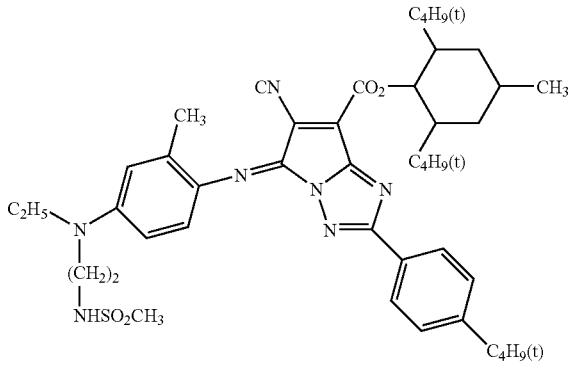
| | λmax (ethyl acetate) | Molecular weight | ε | Solubility (mole/L) (ethyl acetate) | Remarks |
|---|---|---|---|---|---|
| Dye 1 | 634 nm | 857.2 | $5.9 \times 10^4$ | $5.5 \times 10^{-4}$ | This invention |
| Dye 2 | 633 nm | 871.2 | $5.8 \times 10^4$ | $6.7 \times 10^{-4}$ | ditto |
| Dye 3 | 635 nm | 883.2 | $5.8 \times 10^4$ | $1.6 \times 10^{-4}$ | ditto |
| Dye 4 | 631 nm | 784.1 | $5.9 \times 10^4$ | $1.5 \times 10^{-2}$ | For comparison |

As can be seen from the results shown in Table 2, the azomethine dyes formed from the cyan couplers represented by formula (CP-I) according to the present invention (Dyes 1 to 3) had their ethyl-acetate solubility in the range of $1\times10^{-8}$ mol/L to $5\times10^{-3}$ mol/L.

Example 2

(Preparation of Blue-Sensitive Layer Emulsion BH-1)

Using a method of simultaneously adding a silver nitrate solution and, sodium chloride solution mixed into stirring deionized distilled water containing deionized gelatin, high silver chloride cubic grains were prepared. In this preparation, at the step of from 10% to 20% addition of the entire silver nitrate amount, $Cs_2[OsCl_5(NO)]$ was added. At the step of from 70% to 85% addition of the entire silver nitrate amount, potassium bromide (3.0 mol % per mol of the finished silver halide) and $K_4[Fe(CN)_6]$ were added. $K_2[IrCl_6]$ was added at the step of from 75% to 80% addition of the entire silver nitrate amount. Further, $K_2[IrCl_5(H_2O)]$ and $K[IrCl_4(H_2O)_2]$ were added at the step of from 88% to 98% addition of the entire silver nitrate amount. Potassium iodide (0.3 mol % per mol of the finished silver halide) was added, with vigorous stirring, at the step of completion of 93% addition of the entire silver nitrate amount. The thus-obtained emulsion grains were monodisperse cubic silver iodobromochloride grains having a side length of 0.25 μm and a variation coefficient of 9.5%. After being subjected to a sedimentation desalting treatment, the following were added to the resulting emulsion: gelatin, Compounds (Ab-1), (Ab-2), and (Ab-3), and calcium nitrate, and the emulsion was re-dispersed.

The re-dispersed emulsion was dissolved at 40° C., and sodium benzenethiosulfate, p-glutaramidophenyldisulfide, SE-1 as a selenium sensitizer, and (bis(1,4,5-trimethyl-1,2,4-triazolium-3-thiolate)aurate (I) tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, a mixture whose major components were compounds represented by Compound-3 in which the repeating unit (n) is 2 or 3 (both ends $X_1$ and $X_2$ are each a hydroxyl group); Compound-4, and potassium bromide were added. Further, in a midway of the emulsion preparation step, Sensitizing dye S-1, Sensitizing dye S-2, and Sensitizing dye S-3 were added as sensitizing dyes, to conduct spectral sensitization. The thus-obtained emulsion was referred to as Emulsion BH-1.

(Ab-1) Antiseptic

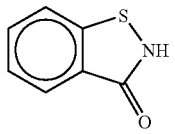

(Ab-2) Antiseptic

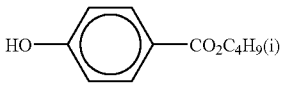

(Ab-3) Antiseptic

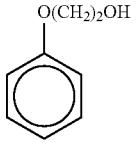

-continued (Ab-4) Antiseptic

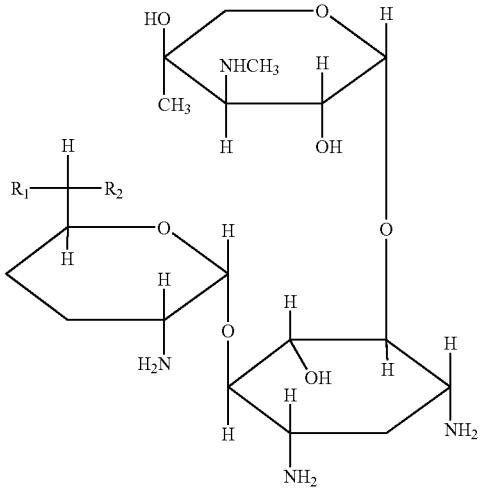

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d

Sensitizing dye S-1

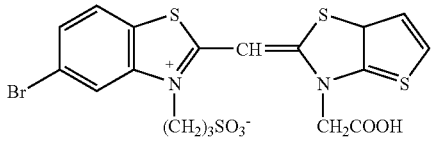

Sensitizing dye S-2

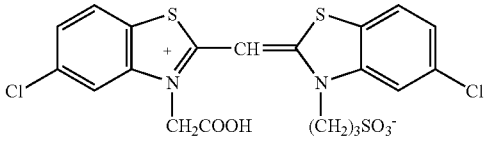

Sensitizing dye S-3

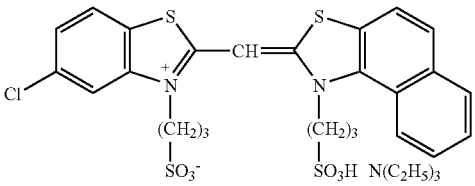

Compound-1

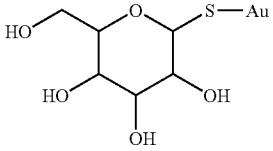

-continued

Compound-2

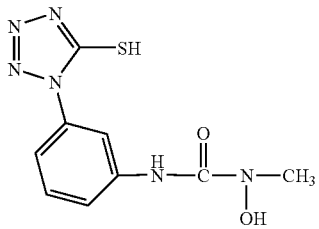

Compound-3

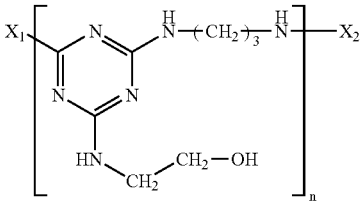

Compound-4

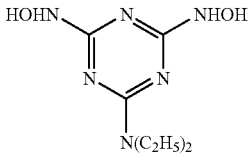

SE-1

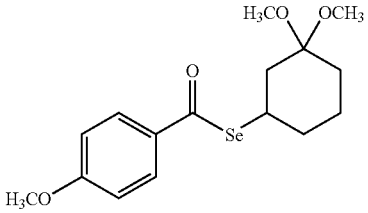

(Preparation of Blue-Sensitive Layer Emulsion BL-1)

Emulsion grains were prepared in the same manner as in the preparation of Emulsion BH-1, except that the amounts of respective metal complexes that were to be added during the addition of the silver nitrate and sodium chloride were changed. The thus-obtained emulsion grains were monodisperse cubic silver iodobromochloride grains having a side length of 0.25 μm and a variation coefficient of 9.5%. After re-dispersion of this emulsion, Emulsion BL-1 was prepared in the same manner as Emulsion BH-1, except that the amounts of compounds to be added in the preparation of BH-1 were changed, to give a desired sensitivity.

(Preparation of Green-Sensitive Layer Emulsion GH-1)

Using a method of simultaneously adding silver nitrate and sodium chloride mixed into stirring deionized distilled water containing a deionized gelatin, high silver chloride cubic grains were prepared. In this preparation, at the step of from 70% to 85% addition of the entire silver nitrate amount, $K_4[Ru(CN)_6]$ was added. At the step of from 70% to 85% addition of the entire silver nitrate amount, potassium bromide (1 mol % per mol of the finished silver halide) was added. Further, $K_2[IrCl_6]$ and $K_2[RhBr_5(H_2O)]$ were added at the step of from 70% to 85% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 87% to 98% addition of the entire silver nitrate amount. The thus-obtained emulsion grains were monodisperse cubic silver iodobromochloride grains having a side length of 0.25 μm and a variation coefficient of 9.5%. The resulting emulsion was subjected to a sedimentation desalting treatment and re-dispersing treatment in the same manner as described in the above.

The re-dispersed emulsion was dissolved at 40° C., and sodium benzenethiosulfate, p-glutaramidophenyldisulfide, SE-1 as a selenium sensitizer, and (bis(1,4,5-trimethyl-1,2,4-triazolium-3-thiolate)aurate (I) tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, Sensitizing dye S-4, Sensitizing dye S-5, Sensitizing dye S-6, and Sensitizing dye S-7 were added as sensitizing dyes, to conduct spectral sensitization. The thus-obtained emulsion was referred to as Emulsion GH-1.

Sensitizing dye S-4

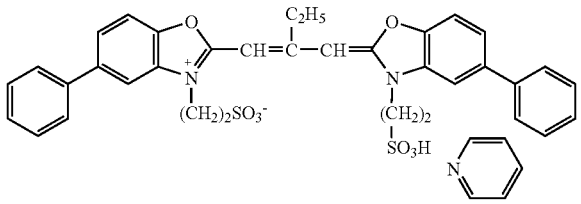

Sensitizing dye S-5

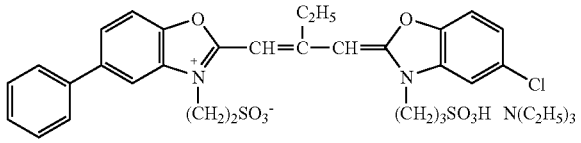

Sensitizing dye S-6

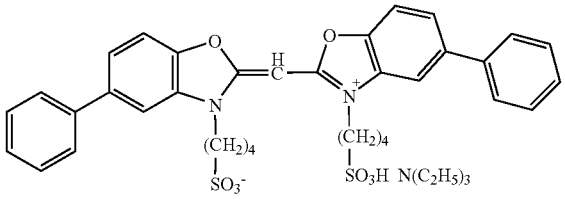

Sensitizing dye S-7

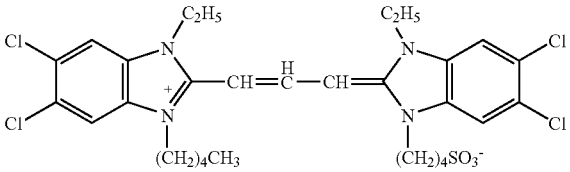

(Preparation of Green-Sensitive Layer Emulsion GL-1)

Emulsion grains were prepared in the same manner as in the preparation of Emulsion GH-1, except that the amounts of respective metal complexes that were to be added during the addition of the silver nitrate and sodium chloride were changed. The thus-obtained emulsion grains were monodisperse cubic silver iodobromochloride grains having a side length of 0.25 μm and a variation coefficient of 9.5%. After re-dispersion of this emulsion, Emulsion GL-1 was prepared in the same manner as Emulsion GH-1, except that the amounts of compounds to be added in the preparation of GH-1 were changed, to give a desired sensitivity.

(Preparation of Red-Sensitive Layer Emulsion RH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 93% to 98% addition of the entire silver nitrate amount, $K_4[Ru(CN)_6]$ was added. At the step of from 85% to 100% addition of the entire silver nitrate amount, potassium bromide (3 mol % per mol of the finished silver halide) was added. Further, $K_2[IrCl_5(5\text{-methylthiazole})]$ was added at the step of from 88% to 93% addition of the entire silver nitrate amount. Potassium iodide (0.1 mol % per mol of the finished silver halide) was added, with vigorous stirring, at the step of completion of 93% addition of the entire silver nitrate amount. Further, $K_2[IrCl_5(H_2O)]$ and $K[IrCl_4(H_2O)_2]$ were added at the step of from 93% to 98% addition of the entire silver nitrate amount. The thus-obtained emulsion grains were monodisperse cubic silver iodobromochloride grains having a side length of 0.25 μm and a variation coefficient of 9.5%. The resulting emulsion was subjected to a sedimentation desalting treatment and re-dispersing treatment in the same manner as described in the above.

The re-dispersed emulsion was dissolved at 40° C., and Sensitizing dye S-8, Compound-5, sodium benzenethiosulfate, p-glutaramidophenyldisulfide, Compound-1 as a gold-sulfur sensitizer, SE-1 as a selenium sensitizer, and (bis(1,4,5-trimethyl-1,2,4-triazolium-3-thiolate)aurate (1) tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1.

Sensitizing dye S-8

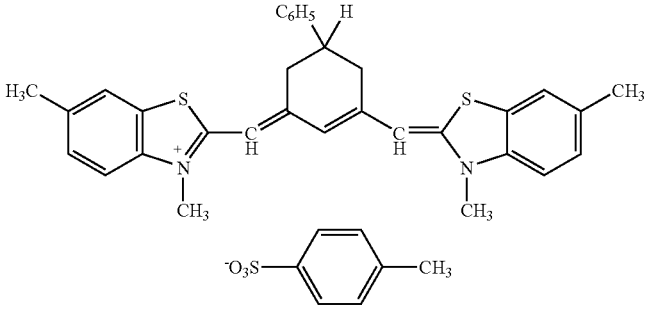

Compound -5

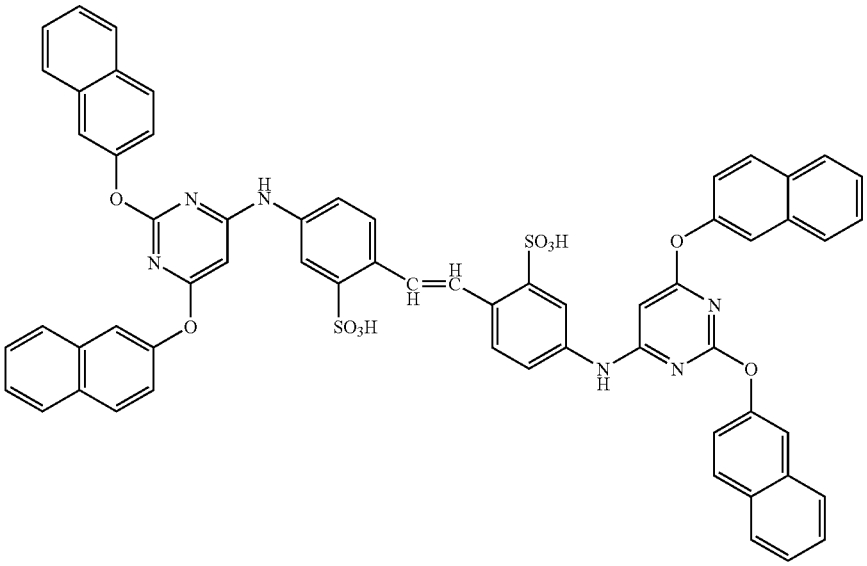

(H-1) Hardener

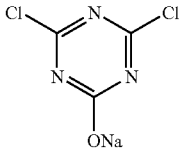

(H-2) Hardener

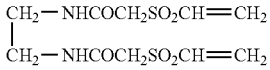

(H-3) Hardener

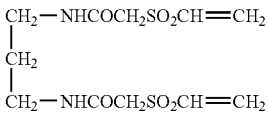

(Preparation of Red-Sensitive Layer Emulsion RL-1)

Emulsion grains were prepared in the same manner as in the preparation of Emulsion RH-1, except that the amounts of respective metal complexes that were to be added during the addition of silver nitrate and sodium chloride were changed. The thus-obtained emulsion grains were monodisperse cubic silver iodobromochloride grains having a side length of 0.25 μm and a variation coefficient of 9.5%. After re-dispersion of this emulsion, Emulsion RL-1 was prepared in the same manner as Emulsion RH-1, except that the amounts of compounds in the preparation of RH-1 were changed, to give a desired sensitivity.

Preparation of a Coating Solution for the First Layer

Into 17 g of a solvent (Solv-4), 3 g of a solvent (Solv-6), 17 g of a solvent (Solv-9) and 45 ml of ethyl acetate were dissolved 24 g of a yellow coupler (Ex-Y), 6 g of a color-image stabilizer (Cpd-8), 1 g of a color-image stabilizer (Cpd-16), 1 g of a color-image stabilizer (Cpd-17), 11 g of a color-image stabilizer (Cpd-18), 1 g of a color-image stabilizer (Cpd-19), 11 g of a color-image stabilizer (Cpd-21), and 1 g of a color-image stabilizer (UV-A). This solution was emulsified and dispersed in 205 g of a 20 mass % aqueous gelatin solution containing 3 g of sodium dodecylbenzenesulfonate with a high-speed stirring emulsifier (dissolver). Water was added thereto, to prepare 700 g of Emulsified dispersion A.

On the other hand, the above emulsified dispersion A and the prescribed emulsions BH-1 and BL-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added (Ab-1), (Ab-2), (Ab-3), and (Ab-4), so that the total amounts would be 10.0 mg/m$^2$, 43.0 mg/m$^2$, 3.5 mg/m$^2$, and 7.0 mg/m$^2$, respectively.

Further, to the third layer, the fifth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respect Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the third layer, the fifth layer, and the sixth layer so that coating amounts would be 6 mg/m$^2$, 6 mg/m$^2$, and 18 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added.

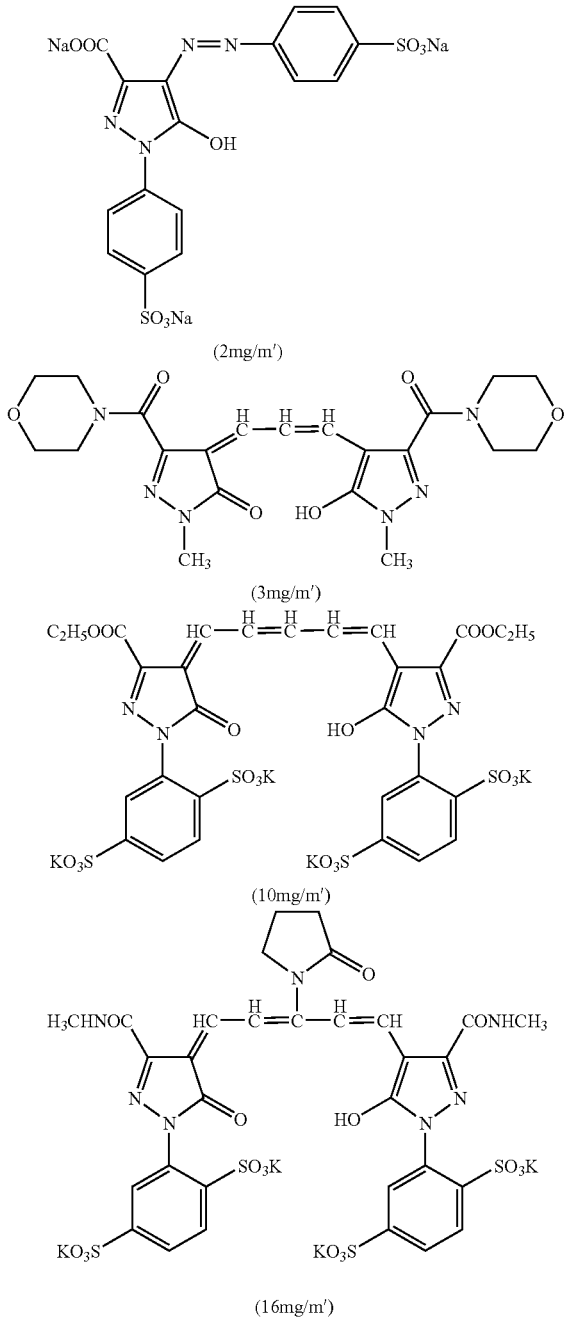

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| First layer (Blue-sensitive emulsion layer) | |
|---|---|
| Emulsion (a 5:5 mixture of BH-1 and BL-1 (mol ratio of silver))) | 0.13 |
| Gelatin | 1.00 |
| Yellow coupler (Ex-Y) | 0.24 |
| Color-image stabilizer (Cpd-8) | 0.06 |
| Color-image stabilizer (Cpd-16) | 0.01 |
| Color-image stabilizer (Cpd-17) | 0.01 |
| Color-image stabilizer (Cpd-18) | 0.11 |
| Color-image stabilizer (Cpd-19) | 0.01 |
| Color-image stabilizer (Cpd-21) | 0.11 |
| Color-image stabilizer (UV-A) | 0.01 |
| Solvent (Solv-4) | 0.17 |
| Solvent (Solv-6) | 0.03 |
| Solvent (Solv-9) | 0.17 |
| **Second layer (Intermediate color-forming layer)** | |
| Gelatin | 0.33 |
| Yellow coupler (Ex-Y) | 0.08 |
| Color-image stabilizer (Cpd-8) | 0.02 |
| Color-image stabilizer (Cpd-16) | 0.01 |
| Color-image stabilizer (Cpd-17) | 0.01 |
| Color-image stabilizer (Cpd-18) | 0.03 |
| Color-image stabilizer (Cpd-19) | 0.01 |
| Color-image stabilizer (Cpd-21) | 0.03 |
| Color-image stabilizer (UV-A) | 0.01 |
| Solvent (Solv-4) | 0.05 |
| Solvent (Solv-6) | 0.01 |
| Solvent (Solv-9) | 0.05 |
| **Third layer (Color-mixing-inhibiting layer)** | |
| Gelatin | 0.31 |
| Color-mixing inhibitor (Cpd-4) | 0.020 |
| Color-mixing inhibitor (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |
| Solvent (Solv-5) | 0.028 |
| Solvent (Solv-8) | 0.028 |
| **Fourth layer (Red-sensitive emulsion layer)** | |
| Emulsion (a 4:6 mixture of RH-1 and RL-1 (mol ratio of silver)) | 0.09 |
| Gelatin | 0.77 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.07 |
| Color-image stabilizer (Cpd-16) | 0.08 |
| Color-image stabilizer (Cpd-17) | 0.07 |
| Color-image stabilizer (UV-5) | 0.04 |
| Solvent (Solv-5) | 0.15 |
| **Fifth layer (Color-mixing-inhibiting layer)** | |
| Gelatin | 0.39 |
| Color-mixing inhibitor (Cpd-4) | 0.025 |
| Color-mixing inhibitor (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (Cpd-7) | 0.002 |
| Solvent (Solv-l) | 0.030 |
| Solvent (Solv-2) | 0.030 |
| Solvent (Solv-5) | 0.035 |
| Solvent (Solv-8) | 0.035 |
| **Sixth layer (Green-sensitive emulsion layer)** | |
| Emulsion (a 1:3 mixture of GH-1 and GL-1 (mol ratio of silver)) | 0.09 |

-continued

| | |
|---|---|
| Gelatin | 1.10 |
| Magenta coupler (Ex-M) | 0.12 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |
| Ultraviolet absorber (UV-B) | 0.26 |
| Solvent (Solv-3) | 0.04 |
| Solvent (Solv-4) | 0.08 |
| Solvent (Solv-6) | 0.05 |
| Solvent (Solv-9) | 0.12 |
| Solvent (Solv-7) | 0.11 |
| Compound (S1-4) | 0.0015 |
| **Seventh layer (Protective layer)** | |
| Gelatin | 0.44 |
| Additive (Cpd-20) | 0.015 |
| Liquid paraffin | 0.01 |
| Surfactant (Cpd-13) | 0.01 |

(Ex-Y) Yellow coupler

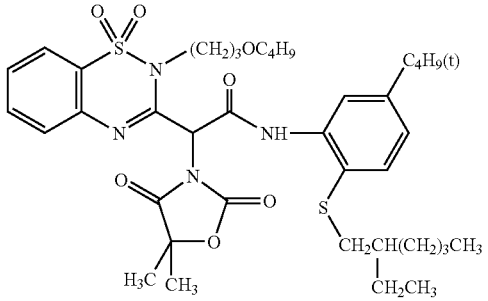

(Ex-M) Magenta coupler

A mixture in 40:40:20 (mol ratio) of

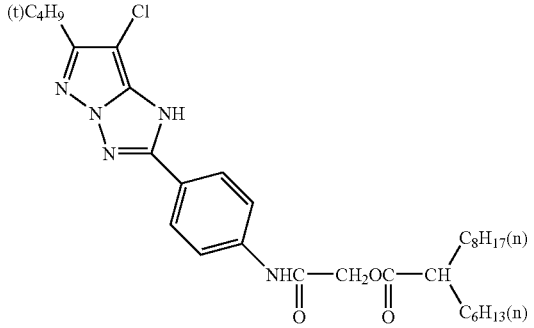

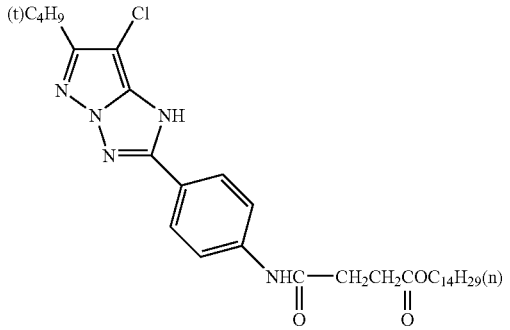

and

-continued

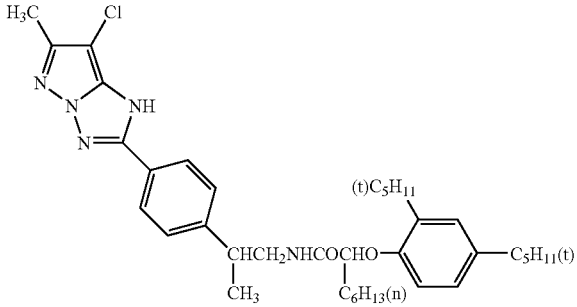

(ExC-1) Cyan coupler

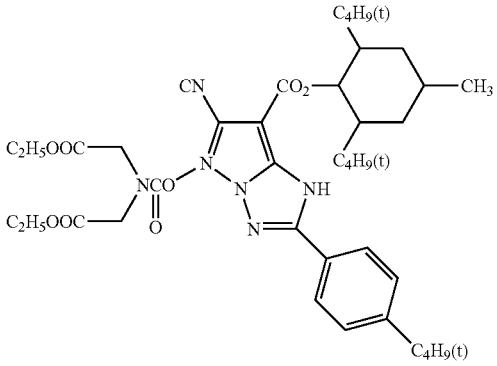

(ExC-2) Cyan coupler

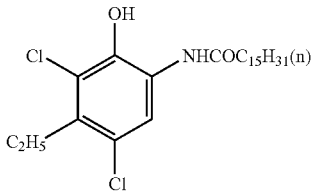

(Cpd-1) Color-image stabilizer

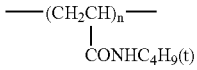

Number-average molecular weight 60,000

(Cpd-2) Color-image stabilizer

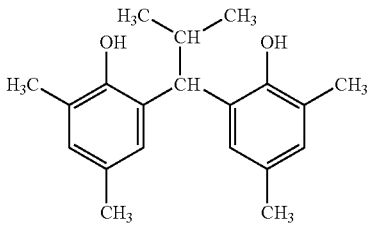

-continued (Cpd-3) Color-image stabilizer

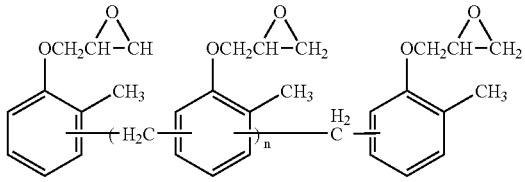

n = 7~8 (Average value)

(Cpd-4) Color-image stabilizer

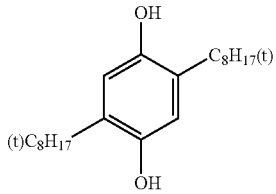

(Cpd-5) Color-image stabilizer

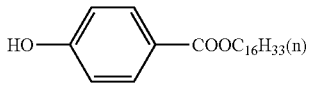

(Cpd-6) Color-image stabilizer

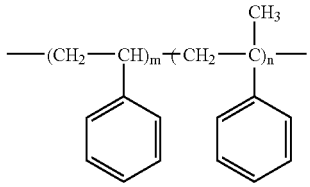

Number-average molecular weight 600, m/n = 10/90

(Cpd-7) Color-image stabilizer

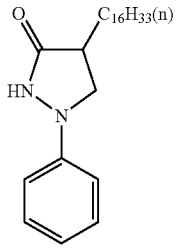

(Cpd-8) Color-image stabilizer

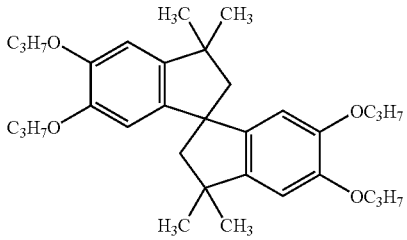

-continued
(Cpd-9) Color-image stabilizer
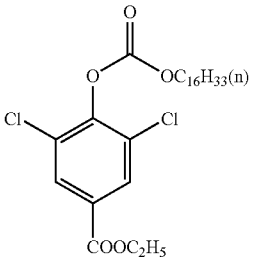
(Cpd-10) Color-image stabilizer
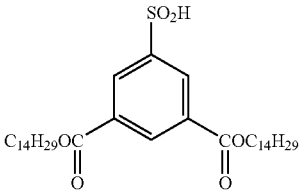
(Cpd-11)
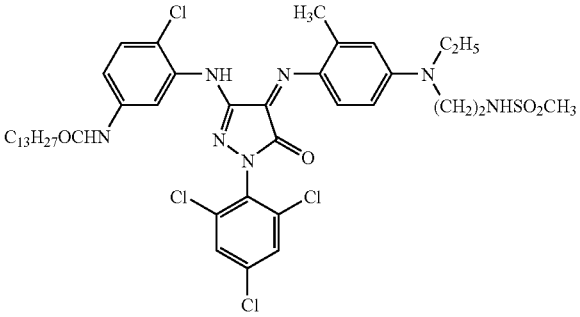
(Cpd-12)
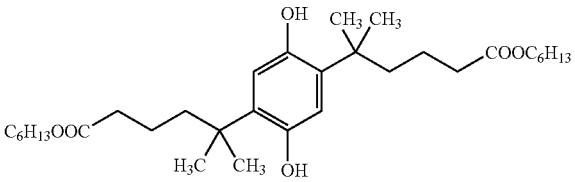
(Cpd-13)
A mixture of 6:2:2 (molar ratio) of (a)/(b)/(c)
(a)
(a)
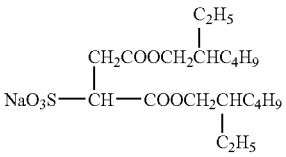
(b)
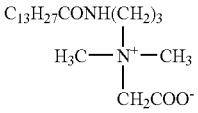
(c)
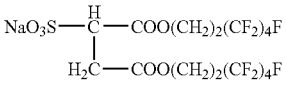
-continued
(Cpd-14)
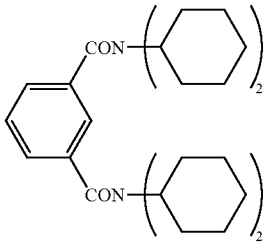
(Cpd-15)
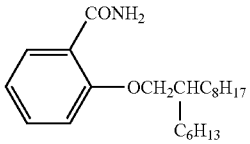
(Cpd-16)
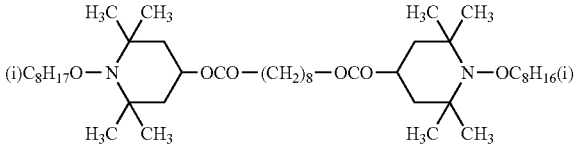
(Cpd-17)
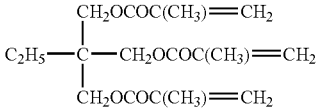
(Cpd-18)
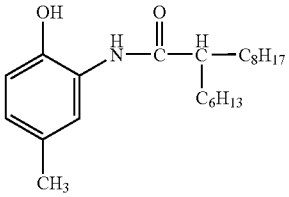
(Cpd-19)
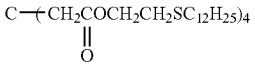
(Cpd-20)
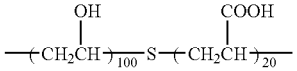
(Mass ratio)
(Cpd-21)
KAYARAD DPCA-30
(manufactured by Nippon Kayaku Co. Ltd.)
(Solv-1)
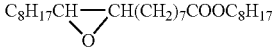

-continued (Solv-2)

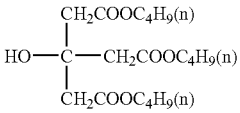

(Solv-3)

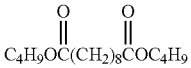

(Solv-4)

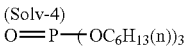

(Solv-5)

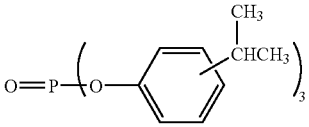

(Solv-6)

(Solv-7)

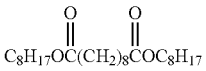

(Solv-8)

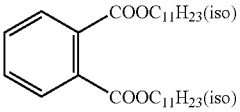

(Solv-9)

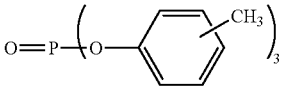

(S1-4)

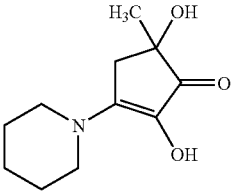

UV-A:

A mixture of (UV-1)/(UV-4)/(UV-5) = 1/7/2 (Mass ratio)

UV-B:

A mixture of (UV-1)/(UV-2)/(UV-3)/(UV-4)/(UV-5) = 1/1/2/3/3 (Mass ratio)

(UV-1)

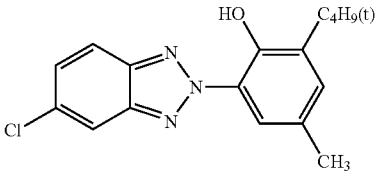

-continued (UV-2)

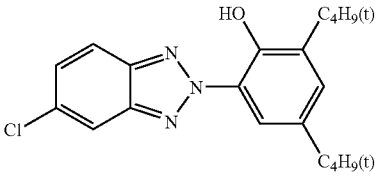

(UV-3)

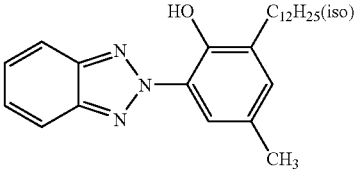

(UV-4)

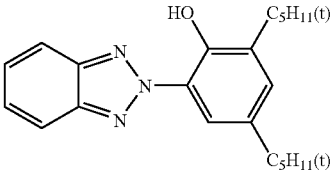

(UV-5)

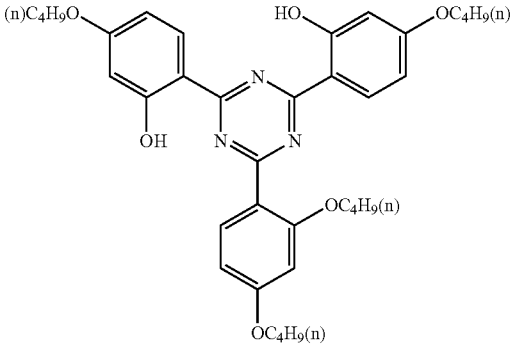

The thus-prepared sample is referred to as Sample 001.

In the red-sensitive layer of Sample 001, the amount of solvent (Solv-5) was increased as shown below, and the amount of gelatin was increased in proportion to the total amount of increased lipophilic components. Sample 002 and Sample 003 were prepared in the same manner as Sample 001, except that the amount of solvent (Solv-5) and the amount of gelatin were changed as described above.

| Fourth layer (Red-sensitive emulsion layer of Sample 002) | |
|---|---|
| Emulsion (a 4:6 mixture of RH-1 and RL-1 (mol ratio of silver)) | 0.09 |
| Gelatin | 1.00 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |

-continued

| | |
|---|---|
| Color-image stabilizer (Cpd-10) | 0.001 |
| Color-image stabilizer (Cpd-14) | 0.001 |
| Color-image stabilizer (Cpd-15) | 0.07 |
| Color-image stabilizer (Cpd-16) | 0.08 |
| Color-image stabilizer (Cpd-17) | 0.07 |
| Color-image stabilizer (UV-5) | 0.04 |
| Solvent (Solv-5) | 0.30 |
| Fourth layer (Red-sensitive emulsion layer of Sample 003) | |
| Emulsion (a 4:6 mixture of RH-1 and RL-1 (mol ratio of silver)) | 0.09 |
| Gelatin | 1.26 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.07 |
| Color-image stabilizer (Cpd-16) | 0.08 |
| Color-image stabilizer (Cpd-17) | 0.07 |
| Color-image stabilizer (UV-5) | 0.04 |
| Solvent (Solv-5) | 0.50 |

Sample 101, Sample 102 and Sample 103 were prepared so as to have the same composition as Sample 001, except that the coupler (ExC-1) in the red-sensitive emulsion layer was replaced with equimolecular quantities of Exemplified Compounds CP-(1), CP-(1) and CP-(5), respectively.

Sample 104, Sample 105 and Sample 106 were prepared so as to have the same composition as Sample 002, except that the coupler (ExC-1) in the red-sensitive emulsion layer was replaced with equimolecular quantities of Exemplified Compounds CP-(1) and CP-(5), respectively.

Sample 106 was prepared so as to have the same composition as Sample 003, except that the coupler (ExC-1) in the red-sensitive emulsion layer was replaced with equimolecular quantities of Exemplified Compounds CP-(1).

The color development described below was given to the Samples, to give cyan images. As results of qualitative analyses of structures of the dyes extracted from the cyan images, respectively, by high-performance liquid chromatography, the dyes formed respectively from the couplers used have proved to be those shown in Table 3.

The coupler content in lipophilic components of the red-sensitive emulsion layer of each Sample is also shown in Table 3.

Additionally, the ethyl-acetate solubility of the azomethine dye obtained from the coupler (ExC-2) was 0.5 mol/L or more.

Processing A

The aforementioned Sample 001 was made into a roll with a width of 127 mm; the resultant sample was exposed to light with a standard photographic image, using Digital Minilab Frontier 350 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. A processing with this running processing solutions was named processing A.

| Processing step | Temperature | Time | Replenishment rate |
|---|---|---|---|
| Color development | 38.5° C. | 45 sec | 45 mL |
| Bleach-fixing | 38.0° C. | 45 sec | Replenisher A 17.5 mL<br>Replenisher B 17.5 mL |
| Rinse 1 | 38.0° C. | 20 sec | — |
| Rinse 2 | 38.0° C. | 20 sec | — |
| Rinse 3 | 38.0° C. | 20 sec | — |
| Rinse 4 | 38.0° C. | 20 sec | 121 mL |
| Drying | 80° C. | | |

(Note)

* Replenishment rate per $m^2$ of the photosensitive material to be processed

** A rinse cleaning system RC50D, manufactured by Fuji Photo Film Co., Ltd., was installed in the rinse 3, and the rinse solution was taken out from the rinse 3 and sent to a reverse osmosis membrane module (RC50D) by using a pump. The permeated water obtained in that tank was supplied to the rinse 4,and the concentrated liquid was returned to the rinse 3. Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from 1 to 4.

The compositions of each processing solution were as follows.

TABLE 3

| Sample No. | Composition of Red-sensitive Layer: Coupler Used (changed one) | Content (mass %) of Coupler Given in Left Column (in lipophilic components of coupler-containing layer) | Dye Formed after Development |
|---|---|---|---|
| 001 | ExC-1 | 25.1 | Dye 4 |
| 002 | ExC-1 | 20.3 | Dye 4 |
| 003 | ExC-1 | 16.2 | Dye 4 |
| 101 | Exemplified Compound CP-(1) | 26.9 | Dye 1 |
| 102 | Exemplified Compound CP-(2) | 27.2 | Dye 2 |
| 103 | Exemplified Compound CP-(5) | 27.5 | Dye 3 |
| 104 | Exemplified Compound CP-(1) | 21.9 | Dye 1 |
| 105 | Exemplified Compound CP-(5) | 22.4 | Dye 3 |
| 106 | Exemplified Compound CP-(1) | 17.5 | Dye 1 |
| 107 | Exemplified Compounds CP-(1) and CP-(5)*) | 22.2 | Dyes 1 and 3 |

*)Mixture of Exemplified Compounds CP-(1) and CP-(5) in a mol ratio of 1:1

| (Color developer) | (Tank solution) | (Replenisher) |
|---|---|---|
| Water | 800 mL | 800 mL |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)aniline•3/2 sulfate•monohydrate | 4.8 g | 14.0 g |
| Potassium carbonate | 26.3 g | 26.3 g |
| Water to make | 1000 mL | 1000 mL |
| pH (25° C., adjusted using sulfuric acid and KOH) | 10.15 | 12.40 |

| (Bleach-fixing solution) | (Tank solution) | (Replenisher A) | (Replenisher B) |
|---|---|---|---|
| Water | 800 mL | 500 mL | 300 mL |
| Ammonium thiosulfate (750 g/L) | 107 mL | — | 386 mL |
| Ammonium bisulfite (65%) | 30.0 g | — | 190 g |
| Ammonium iron (III) ethylenediamine tetraacetate | 47.0 g | 133 g | — |
| Ethylenediaminetetraacetic acid | 1.4 g | 5 g | 6 g |
| Nitric acid (67%) | 16.5 g | 66.0 g | — |
| Imidazole | 14.6 g | 50.0 g | — |
| m-Carboxybenzene sulfinic acid | 8.3 g | 33.0 g | — |
| Water to make | 1000 mL | 1000 mL | 1000 mL |
| pH (25° C., adjusted using nitric acid and aqueous ammonia) | 6.5 | 6.0 | 6.0 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 mL | 1000 mL |
| pH (25° C.) | 6.5 | 6.5 |

Processing B

The aforementioned Sample 001 was made into a roll with a width of 127 mm; the resultant sample was exposed to light with a standard photographic image, using Digital Minilab Frontier 340 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. Additionally, in order to attain the following processing times in the processor, changes to the transport speed were made by modifications to processing racks. A processing with this running processing solutions was named processing B.

| Processing step | Temperature | Time | Replenisher amount |
|---|---|---|---|
| Color development | 45.0° C. | 12 sec | 35 mL |
| Bleach-fixing | 40.0° C. | 12 sec | Replenisher A 15 mL<br>Replenisher B 15 mL |
| Rinse 1 | 45.0° C. | 4 sec | — |
| Rinse 2 | 45.0° C. | 2 sec | — |
| Rinse 3 | 45.0° C. | 2 sec | — |
| Rinse 4 | 45.0° C. | 3 sec | 175 mL |
| Drying | 80° C. | 15 sec | |

(Note)
* Replenisher amount per $m^2$ of the light-sensitive material to be processed.

The composition of each processing solution was as follows.

| (Color developer) | (Tank solution) | (Replenisher) |
|---|---|---|
| Water | 800 mL | 800 mL |
| Fluorescent whitening agent (FL-3) | 4.0 g | 10.0 g |
| Residual color reducing agent (SR-1) | 3.0 g | 3.0 g |
| m-Carboxybenzene sulfinic acid | 2.0 g | 4.0 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.0 g |
| 4-Amino-3-methyl-N-ethyl-N-(β-methanesulfonamidoethyl) aniline · 3/2 sulfate · monohydrate | 7.0 g | 19.0 g |

-continued

| | | |
|---|---|---|
| Potassium carbonate | 26.3 g | 26.3 g |
| Water to make | 1000 mL | 1000 mL |
| pH (25° C./adjusted using sulfuric acid and KOH) | 10.25 | 12.8 |

| (Bleach-fixing solution) | (Tank solution) | (Replenisher A) | (Replenisher B) |
|---|---|---|---|
| Water | 700 mL | 300 mL | 300 mL |
| Ammonium thiosulfate (750 g/l) | 107 mL | — | 400 mL |
| Ammonium sulfite | 30.0 g | — | — |
| Ammonium iron (III) ethylenediaminetetraacetate | 47.0 g | 200 g | — |
| Ethylenediamine tetraacetic acid | 1.4 g | 0.5 g | 10.0 g |
| Nitric acid (67%) | 7.0 g | 30.0 g | — |
| m-Carboxybenzene sulfinic acid | 3.0 g | 13.0 g | — |
| Ammonium bisulfite (65%) | — | — | 200 g |
| Succinic acid | 7.0 g | 30.0 g | — |
| Water to make | 1000 mL | 1000 mL | 1000 mL |
| pH (25° C./adjusted using nitric acid and aqua ammonia) | 6.0 | 2.0 | 5.6 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 mL | 1000 mL |
| pH (25° C.) | 6.5 | 6.5 |

FL-1

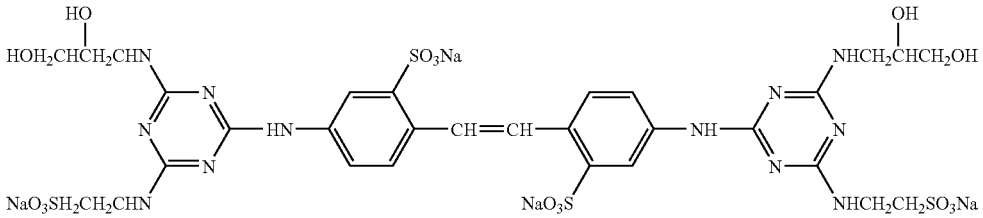

FL-2

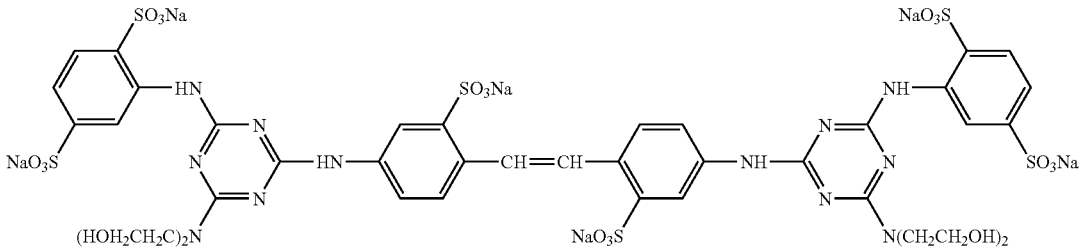

FL-3

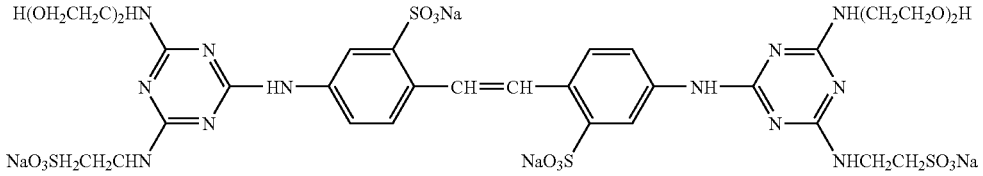

SR-1

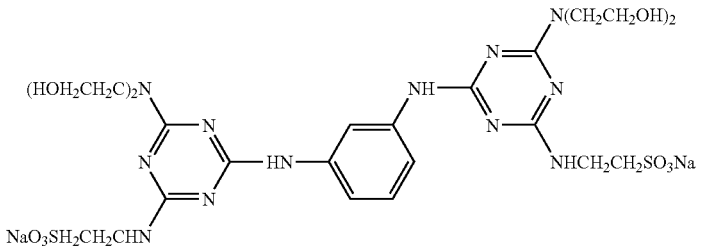

On the Samples 001 to 003 and 101 to 107, the following evaluations were made after the photosensitive materials prepared by coating were stored for 14 days under a 25° C.-55% RH condition.

Each sample was subjected to gradation exposure to impart gray in the above color-development processing B, with the following exposure apparatus; and then, at five seconds after the exposure was finished, the sample was subjected to color-development processing by the processing A and the processing B. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG (trade name), manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity fluctuations associated with a temperature change. The laser beam had an effective diameter of 80 μm and a scanning pitch of 42.3 μm (600 dpi), and an average exposure time per pixel was $1.7\times10^{-7}$ seconds. From each Sample, gray images having their maximum density in the range of 2.3 to 2.5 were obtained.

Next, R (red) light exposure was given gradation-wise to each Sample in accordance with the foregoing exposure method, and the Sample thus exposed was subjected to each of Processing A and Processing B to produce each individual cyan gradation image. In each processing, every Sample of the present invention provided a cyan image having a maximum developed-color density of 2.0 to 2.4.

(Evaluation of Color Reproducibility)

Cyan gradation images were produced by giving gradation-wise R exposure to each Sample in accordance with the foregoing exposure method and subjecting the exposed Sample to each of Processing A and Processing B. Based on the result of reflection spectrum measurement at the portion having the density of 1.0 in the cyan-color-forming area, color reproducibility was rated as "○" (for a particularly sample, "◎") when undesired absorptions corresponding to magenta and yellow in the wavelength range of 550 nm to 400 nm were regarded as small and the result of sensory evaluation was excellent; "Δ" when they were somewhat inferior; and "×" when undesired absorption corresponding to magenta or yellow in the wavelength range of 550 nm to 400 nm was great and it was apparently inferior.

(Evaluation of Light Fastness)

The image samples were exposed for 14 days to a xenon light (100,000 lx of xenon light irradiator) via an UV cut filter with a light transmittance of 50% at 370 nm and a heat wave cut filter. The light fastness was evaluated by relative residual rate (%) after the exposure at the portion having the cyan initial density of 2.0.

(Evaluation of White-Background Preservability)

Rapid processing suitability of each Sample was evaluated based on white-background preservability with the lapse of time of the image obtained through Processing B. The white-background preservability was estimated as follows: Each sample after processing was stored for 21 days at 60° C. and 70% RH, and examined for an increment of cyan density between before and after the storage. This increment was denoted by ΔD. And ΔD values smaller than 0.05 were judged as being within the preferable range of sensory evaluation.

Results thus obtained are shown in Table 4.

Please note that the results shown as color reproducibility and light fastness are results of evaluations made on the Samples having undergone the R exposure and Processing B, and the results shown as white-background preservability are results of evaluation made on the Samples having undergone the R exposure.

TABLE 4

| Sample No. | Color Reproducibility | Light fastness residual rate %) | White-background preservability (ΔD) |
|---|---|---|---|
| 001 | X | 73 | 0.02 |
| 002 | Δ | 77 | 0.04 |
| 003 | ○ | 82 | 0.09 |
| 101 | ◎ | 88 | 0.02 |
| 102 | ◎ | 86 | 0.02 |
| 103 | ◎ | 91 | 0.02 |
| 104 | ◎ | 86 | 0.03 |
| 105 | ◎ | 90 | 0.04 |
| 106 | ◎ | 84 | 0.08 |
| 107 | ◎ | 90 | 0.03 |

As can be seen from Table 4, the photosensitive materials of the present invention could give color prints superior in color reproducibility, light fastness and white-background preservability when ultra-rapid processing was carried out. More specifically, Samples 101 to 105 and 107 each having the red-sensitive layer wherein the dye hardly soluble in an organic solvent as defined by the present invention was contained and the coupler content in lipophilic components was not lower than 18 mass % were superior in all of the foregoing properties.

By contrast, comparative Samples 001 to 003 each having the dye hardly soluble in an organic solvent whose ethyl-acetate solubility was outside the definition in the present invention were all inferior in light fastness. In addition, Samples 001 and 002 wherein the coupler contents in lipophilic components were 25.1 mass % and 20.3 mass %, respectively, were superior in white-background preservability, but inferior in color reproducibility, while Sample 003 wherein the coupler content in lipophilic components was 16.2 mass % was superior in color reproducibility but inferior in white-background preservability. In other words, the comparative samples couldn't meet requirements for color reproducibility, light fastness and white-background preservability at the same time. On the other hand, the comparative Sample 106 having the red-sensitive layer wherein, though the dye hardly soluble in an organic solvent as defined by the present invention was contained, the high boiling organic solvent was contained in an amount (coupler content: 17.5 mass %) was inferior in white-background preservability.

As mentioned above, it is understandable that in the present invention, color prints having excellent color reproducibility, light fastness and white-background preservability can be provided by using a high boiling organic solvent in a relatively small amount, and the coupler capable of forming the preferable dye according to the definition by the present invention in a high coupler-containing ratio.

Example 3

Sample 201, Sample 202 and Sample 203 were prepared so as to have the same composition as Sample 101 in Example 2, except that Exemplified Compound CP-(1) was replaced with equimolecular quantities of the following couplers (ExC-3), (ExC-4) and (ExC-5), respectively. All of these couplers fall in the category of the compound represented by formula (CP-I), and more specifically, Exemplified Compound CP-(1) falls in the category of the compound represented by formula (CP-III) and the couplers (ExC-3), (ExC-4) and (ExC-5) falls in the category of the compound represented by formula (CP-II). Color prints were produced by subjecting each Sample to Processing A or Processing B after the same exposure as in Example 2.

The same evaluations as in Example 2 were performed on Samples 201, 202 and 203 each, and it was found that the effects of the present invention were achieved by Samples 201, 202 and 203 also. Further, results of maximum cyan-density (Dmax) evaluations of these Samples are shown in Table 5.

TABLE 5

| | Cyan-forming density (Dmax) | |
|---|---|---|
| Sample No. | Color prints produced by Processing A | Color prints produced by Processing B |
| 101 | 2.34 | 2.33 |
| 102 | 2.34 | 2.33 |
| 103 | 2.32 | 2.32 |
| 201 | 2.20 | 2.16 |
| 202 | 2.15 | 2.09 |
| 203 | 2.20 | 2.13 |

Samples 101 to 103 using Exemplified Compound CP-(1) provided sufficient color-forming densities in both Processing A and Processing B. On the other hand, Samples 201 to 203 using the couplers (ExC-3) to (ExC-5), though they all had maximum color-forming densities not lower than 2.0, were lower in Dmax than Samples 101 to 103 in the case of Processing A, and had much lower Dmax in the case of Processing B. In other words, Samples 201 to 203 were inferior in the color-forming density to Samples 101 to 103.

From these results, it is noted that the structure represented by in formula (CP-III) is preferable as the splitting-off group of the pyrrolotriazole-type coupler for use in this example, from the viewpoint of the excellent color-forming properties in a rapid processing.

(ExC-3) Cyan coupler

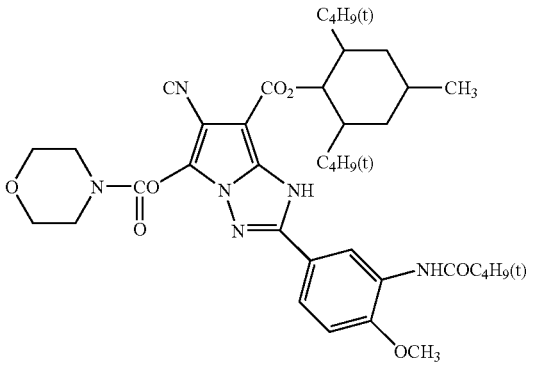

-continued (ExC-4) Cyan coupler

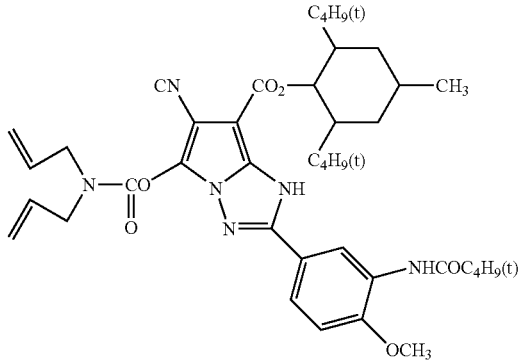

(ExC-5) Cyan coupler

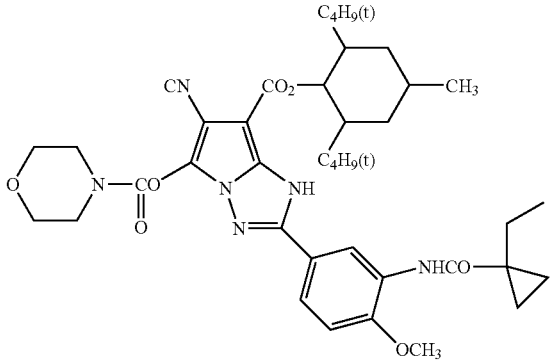

Example 4

Photosensitive material 301 was prepared in the same manner as in Example 2, except that the layer structures were changed to the following. The numbers show coating amounts (g/m$^2$). In the case of the silver halide emulsion, the coating amount is in terms of silver.

| | |
|---|---|
| First layer (Blue-sensitive emulsion layer) | |
| Emulsion (a 5:5 mixture of BH-1 and BL-1 (mol ratio of silver)) | 0.13 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-16) | 0.01 |
| Color-image stabilizer (Cpd-17) | 0.02 |
| Color-image stabilizer (Cpd-18) | 0.15 |
| Color-image stabilizer (Cpd-19) | 0.01 |
| Color-image stabilizer (Cpd-21) | 0.15 |
| Color-image stabilizer (UV-A) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (Cpd-7) | 0.006 |

-continued

| | |
|---|---|
| Solvent (Solv-1) | 0.03 |
| Solvent (Solv-2) | 0.03 |
| Solvent (Solv-5) | 0.04 |
| Third layer (Green-sensitive emulsion layer) | |
| Emulsion (a 1:3 mixture of GH-1 and GL-1 (mol ratio of silver)) | 0.11 |
| Gelatin | 0.70 |
| Magenta coupler (ExM) | 0.12 |
| Ultraviolet absorber (UV-A) | 0.03 |
| Color-image stabilizer (Cpd-2) | 0.01 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-18) | 0.01 |
| Solvent (Solv-3) | 0.03 |
| Solvent (Solv-4) | 0.06 |
| Solvent (Solv-6) | 0.03 |
| Solvent (Solv-9) | 0.08 |
| Fourth layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (Cpd-7) | 0.006 |
| Solvent (Solv-1) | 0.03 |
| Solvent (Solv-2) | 0.03 |
| Solvent (Solv-5) | 0.04 |
| Fifth layer (Red-sensitive emulsion layer) | |
| Emulsion (a 4:6 mixture of RH-1 and RL-1 (mol ratio of silver)) | 0.09 |
| Gelatin | 1.04 |
| Cyan coupler (ExC-1) | 0.11 |
| Cyan coupler (ExC-2) | 0.05 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.20 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.44 |
| Additive (Cpd-20) | 0.015 |
| Liquid paraffin | 0.01 |
| Surfactant (Cpd-13) | 0.01 |

Then, photosensitive materials 302 and 303 were prepared in the same manner as photosensitive material 301, except that the cyan coupler (ExC-1) in the fifth layer was changed to Exemplified Compound CP-(1) and Exemplified Compound CP-(5), respectively. The coupler contents in lipophilic components of the fifth layer in Samples 301, 302 and 303 were 17.1%, 18.5% and 19.0%, respectively.

Color print Samples 301, 302 and 303 were obtained from the photosensitive materials of this Example through the same exposure and each of Processing A and Processing B as in Example 2. As results of the same evaluations as in Example 2, as shown in Table 6, it was found that the photosensitive materials 302 and 303 according to the present invention were superior in color reproducibility, light fastness and white-background preservability.

TABLE 6

| Sample No. | Color Reproducibility | Light fastness (residual rate %) | White-background preservability (ΔD) |
|---|---|---|---|
| 301 | Δ | 74 | 0.03 |
| 302 | ◎ | 85 | 0.03 |
| 303 | ◎ | 86 | 0.03 |

Example 5

Samples were prepared by coating each of Samples 101 to 104 obtained in Example 2 on a 175 μm-thick barium-sulfate-kneaded PET reflective support, and thereon the evaluations in accordance with those in Example 2 were performed. As a result, these samples also received almost the same results.

Example 6

For silver halide emulsions used in the light-sensitive layers, silver halide emulsions prepared in the same manners as in Example 2 were used.

Preparation of Coating Solution for First Layer

An emulsified dispersion A was prepared in the same manner as the coating composition for the first layer in Example 2, except that an additive (ExC-2) was further added in an amount of 0.1 g, and by use of this dispersion, was prepared the coating composition for the first layer.

In addition to the additives as used in Example 2, 1.5 mg/m$^2$ of Compound (S1-4) was further added to each layer.

(Layer Constitution)

The composition of each layer is shown below.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

The following samples shared a support with one another.

The constitutions of Samples 1101 to 1104 are shown in Table 7.

TABLE 7

| | Sample No. | | | |
|---|---|---|---|---|
| | 1101 | 1102 | 1103 | 1104 |
| Layer constitution | A | B | C | D |
| 1st layer | BL-1 | BL-1 | BL-2 | BL-1 |
| 2nd layer | MCS1-1 | MCS1-1 | YL-1 | MCN1-1 |
| 3rd layer | GL-1 | RL-2 | MCS1-2 | MCS1-3 |
| 4th layer | MCS2-1 | MCS2-1 | RL-2 | MCN1-1 |
| 5th layer | RL-1 | GL-2 | MCS2-2 | RL-2 |
| 6th layer | UV-1 | UV-1 | ML-1 | MCN2-1 |
| 7th layer | PC-1 | PC-1 | GL-3 | MCS2-3 |
| 8th layer | — | — | UV-1 | MCN2-1 |
| 9th layer | — | — | PC-1 | GL-2 |
| 10th layer | — | — | — | UV-1 |
| 11th layer | — | — | — | PC-1 |

The compositions of the layers in each of Samples 1101 to 1104 are described below. The numbers show coating amounts (g/m$^2$). In the case of the silver halide emulsion, the coating amount is in terms of silver.

| | |
|---|---|
| Blue-sensitive emulsion layer: BL-1 | |
| Emulsion (a 5:5 mixture of BH-1 and BL-1 (mol ratio of silver)) | 0.13 |
| Gelatin | 1.33 |
| Yellow coupler (Ex-Y) | 0.32 |
| Color-image stabilizer (Cpd-8) | 0.08 |
| Color-image stabilizer (Cpd-16) | 0.02 |
| Color-image stabilizer (Cpd-17) | 0.02 |
| Color-image stabilizer (Cpd-18) | 0.14 |
| Color-image stabilizer (Cpd-19) | 0.02 |
| Color-image stabilizer (Cpd-21) | 0.14 |
| Additive (ExC-2) | 0.002 |
| Color-image stabilizer (UV-A) | 0.02 |
| Solvent (Solv-4) | 0.22 |
| Solvent (Solv-6) | 0.04 |
| Solvent (Solv-9) | 0.22 |
| Blue-sensitive emulsion layer: BL-2 | |
| Emulsion (a 5:5 mixture of BH-1 and BL-1 (mol ratio of silver)) | 0.13 |
| Gelatin | 1.00 |
| Yellow coupler (Ex-Y) | 0.24 |
| Color-image stabilizer (Cpd-8) | 0.06 |
| Color-image stabilizer (Cpd-16) | 0.01 |
| Color-image stabilizer (Cpd-17) | 0.01 |
| Color-image stabilizer (Cpd-18) | 0.11 |
| Color-image stabilizer (Cpd-19) | 0.01 |
| Color-image stabilizer (Cpd-21) | 0.11 |
| Additive (ExC-2) | 0.001 |
| Color-image stabilizer (UV-A) | 0.01 |
| Solvent (Solv-4) | 0.17 |
| Solvent (Solv-6) | 0.03 |
| Solvent (Solv-9) | 0.17 |
| Light-insensitive coupler-containing color-forming layer: YL-1 | |
| Gelatin | 0.33 |
| Yellow coupler (Ex-Y) | 0.08 |
| Color-image stabilizer (Cpd-8) | 0.02 |
| Color-image stabilizer (Cpd-16) | 0.01 |
| Color-image stabilizer (Cpd-17) | 0.01 |
| Color-image stabilizer (Cpd-18) | 0.03 |
| Color-image stabilizer (Cpd-19) | 0.01 |
| Color-image stabilizer (Cpd-21) | 0.03 |
| Additive (ExC-2) | 0.001 |
| Color-image stabilizer (UV-A) | 0.01 |
| Solvent (Solv-4) | 0.05 |
| Solvent (Solv-6) | 0.01 |
| Solvent (Solv-9) | 0.05 |
| Color-mixing-inhibiting layer: MCS1-1 | |
| Gelatin | 0.39 |
| Color-mixing inhibitor (Cpd-4) | 0.025 |
| Color-mixing inhibitor (Cpd-12) | 0.005 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |
| Solvent (Solv-5) | 0.028 |
| Solvent (Solv-8) | 0.028 |
| Color-mixing-inhibiting layer: MCS1-2 | |
| Gelatin | 0.31 |
| Color-mixing inhibitor (Cpd-4) | 0.020 |
| Color-mixing inhibitor (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |

-continued

| | |
|---|---|
| Solvent (Solv-5) | 0.028 |
| Solvent (Solv-8) | 0.028 |
| Color-mixing-inhibiting layer: MCS1-3 | |
| Gelatin | 0.15 |
| Color-mixing inhibitor (Cpd-4) | 0.017 |
| Color-mixing inhibitor (Cpd-12) | 0.003 |
| Color-image stabilizer (Cpd-3) | 0.004 |
| Color-image stabilizer (Cpd-5) | 0.004 |
| Color-image stabilizer (Cpd-6) | 0.010 |
| Color-image stabilizer (UV-A) | 0.010 |
| Color-image stabilizer (Cpd-7) | 0.002 |
| Solvent (Solv-1) | 0.012 |
| Solvent (Solv-2) | 0.012 |
| Solvent (Solv-5) | 0.014 |
| Solvent (Solv-8) | 0.014 |
| Intermediate non-color-forming layer: MCN1-1 | |
| Gelatin | 0.075 |
| Color-image stabilizer (Cpd-6) | 0.005 |
| Color-image stabilizer (UV-A) | 0.005 |
| Solvent (Solv-1) | 0.006 |
| Solvent (Solv-2) | 0.006 |
| Solvent (Solv-5) | 0.007 |
| Solvent (Solv-8) | 0.007 |
| Red-sensitive emulsion layer: RL-1 | |
| Emulsion (a 4:6 mixture of RH-1 and RL-1 (mol ratio of silver)) | 0.07 |
| Gelatin | 0.77 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.15 |
| Red-sensitive emulsion layer: RL-2 | |
| Emulsion (a 4:6 mixture of RH-1 and RL-1 (mol ratio of silver)) | 0.09 |
| Gelatin | 0.77 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.15 |
| Color-mixing-inhibiting layer: MCS2-1 | |
| Gelatin | 0.47 |
| Color-mixing inhibitor (Cpd-4) | 0.030 |
| Color-mixing inhibitor (Cpd-12) | 0.006 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (Cpd-7) | 0.002 |
| Solvent (Solv-1) | 0.030 |
| Solvent (Solv-2) | 0.030 |
| Solvent (Solv-5) | 0.035 |
| Solvent (Solv-8) | 0.035 |
| Color-mixing-inhibiting layer: MCS2-2 | |
| Gelatin | 0.39 |
| Color-mixing inhibitor (Cpd-4) | 0.025 |
| Color-mixing inhibitor (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.025 |

-continued

| | |
|---|---|
| Color-image stabilizer (UV-A) | 0.025 |
| Color-image stabilizer (Cpd-7) | 0.002 |
| Solvent (Solv-1) | 0.030 |
| Solvent (Solv-2) | 0.030 |
| Solvent (Solv-5) | 0.035 |
| Solvent (Solv-8) | 0.035 |
| Color-mixing-inhibiting layer: MCS2-3 | |
| Gelatin | 0.19 |
| Color-mixing inhibitor (Cpd-4) | 0.022 |
| Color-mixing inhibitor (Cpd-12) | 0.004 |
| Color-image stabilizer (Cpd-3) | 0.005 |
| Color-image stabilizer (Cpd-5) | 0.005 |
| Color-image stabilizer (Cpd-6) | 0.013 |
| Color-image stabilizer (UV-A) | 0.013 |
| Color-image stabilizer (Cpd-7) | 0.002 |
| Solvent (Solv-1) | 0.016 |
| Solvent (Solv-2) | 0.016 |
| Solvent (Solv-5) | 0.019 |
| Solvent (Solv-8) | 0.019 |
| Intermediate non-color-forming layer: MCN2-1 | |
| Gelatin | 0.09 |
| Color-image stabilizer (Cpd-3) | 0.005 |
| Color-image stabilizer (Cpd-5) | 0.005 |
| Color-image stabilizer (Cpd-6) | 0.013 |
| Color-image stabilizer (UV-A) | 0.013 |
| Color-image stabilizer (Cpd-7) | 0.002 |
| Solvent (Solv-1) | 0.007 |
| Solvent (Solv-2) | 0.007 |
| Solvent (Solv-5) | 0.008 |
| Solvent (Solv-8) | 0.008 |
| Green-sensitive emulsion layer: GL-1 | |
| Emulsion (a 1:3 mixture of GH-1 and GL-1 (mol ratio of silver)) | 0.11 |
| Gelatin | 0.75 |
| Magenta coupler (ExM) | 0.12 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |
| Ultraviolet absorber (UV-B) | 0.02 |
| Solvent (Solv-3) | 0.04 |
| Solvent (Solv-4) | 0.08 |
| Solvent (Solv-6) | 0.05 |
| Solvent (Solv-9) | 0.12 |
| Green-sensitive emulsion layer: GL-2 | |
| Emulsion (a 1:3 mixture of GH-1 and GL-1 (mol ratio of silver)) | 0.09 |
| Gelatin | 0.75 |
| Magenta coupler (ExM) | 0.12 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |
| Ultraviolet absorber (UV-B) | 0.02 |
| Solvent (Solv-3) | 0.04 |
| Solvent (Solv-4) | 0.08 |
| Solvent (Solv-6) | 0.05 |
| Solvent (Solv-9) | 0.12 |
| Green-sensitive emulsion layer: GL-3 | |
| Emulsion (a 1:3 mixture of GH-1 and GL-1 (mol ratio of silver)) | 0.09 |
| Gelatin | 0.56 |
| Magenta coupler (ExM) | 0.09 |
| Color-image stabilizer (Cpd-2) | 0.0075 |
| Color-image stabilizer (Cpd-8) | 0.0075 |
| Color-image stabilizer (Cpd-9) | 0.004 |
| Color-image stabilizer (Cpd-10) | 0.004 |
| Color-image stabilizer (Cpd-11) | 0.000075 |
| Color-image stabilizer (Cpd-18) | 0.0075 |
| Ultraviolet absorber (UV-B) | 0.01 |

-continued

| | |
|---|---|
| Solvent (Solv-3) | 0.03 |
| Solvent (Solv-4) | 0.06 |
| Solvent (Solv-6) | 0.04 |
| Solvent (Solv-9) | 0.09 |
| Light-insensitive coupler-containing color-forming layer: ML-1 | |
| Gelatin | 0.19 |
| Magenta coupler (ExM) | 0.03 |
| Color-image stabilizer (Cpd-2) | 0.0025 |
| Color-image stabilizer (Cpd-8) | 0.0025 |
| Color-image stabilizer (Cpd-9) | 0.001 |
| Color-image stabilizer (Cpd-10) | 0.001 |
| Color-image stabilizer (Cpd-11) | 0.000025 |
| Color-image stabilizer (Cpd-18) | 0.0025 |
| Ultraviolet absorber (UV-B) | 0.01 |
| Solvent (Solv-3) | 0.01 |
| Solvent (Solv-4) | 0.02 |
| Solvent (Solv-6) | 0.01 |
| Solvent (Solv-9) | 0.03 |
| Ultraviolet absorbing layer: UV-1 | |
| Gelatin | 0.34 |
| Ultraviolet absorber (UV-B) | 0.24 |
| Solvent (Solv-7) | 0.11 |
| Protective layer: PC-1 | |
| Gelatin | 0.44 |
| Additive (Cpd-20) | 0.015 |
| Liquid paraffin | 0.01 |

Surfactant (Cpd-13) 0.01

Samples 1105 to 1108 were prepared so as to have the same composition as the above Samples 1101 to 1104, except that the coupler (ExC-1) in the red-sensitive emulsion layer was replaced with equimolecular quantities of Exemplified Compounds CP-(1).

Processing A and B

Processing A and B were conducted so as to have the same manner as Processing A and B in Example 2, except that the above Sample 1101 was used.

On the Samples 1101 to 1108, the following evaluations were made after the photosensitive materials prepared by coating were stored for 14 days under a 25° C.-55% RH condition.

Each sample was subjected to gradation exposure to impart gray in the above color-development processing B, with the following exposure apparatus; and then, at five seconds after the exposure was finished, the sample was subject to color-development processing by the processing A and B. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG (trade name), manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity fluctuation associated with temperature changes. The laser beam had an effective diameter of 80 μm and a scanning pitch of 42.3 μm (600 dpi), and an average exposure time per pixel was $1.7\times10^{-7}$ seconds.

(Evaluation of Color-Forming Density)

Gradation exposure providing gray was given to each Sample in accordance with the foregoing exposure method, and then Processing B was performed to produce gradation images. And reflection densities in maximum color-forming areas of cyan and magenta images were measured.

(Evaluation of Light Fastness)

Cyan gradation images were produced by giving gradation-wise red light to each Sample in accordance with the foregoing exposure method and subjecting the exposed Sample to Processing B. The image samples were exposed for 15 days to a xenon light (100,000 lx of xenon light irradiator) via an UV cut filter with a light transmittance of 50% at 370 nm and a heat wave cut filter. The light fastness was evaluated by relative residual rate (%) after the exposure at the cyan initial density of 1.0. All Samples according to the present invention had maximum color-forming densities not lower than 2.0.

Results thus obtained are shown in Table 8.

TABLE 8

| Sample No. | Layer constitution | Cyan coupler | Color-forming density (gray exposure) Cyan | Color-forming density (gray exposure) Magenta | Light fastness (residual rate %) |
|---|---|---|---|---|---|
| 1101 | A | ExC-1 | 2.40 | 2.46 | 72 |
| 1102 | B | ExC-1 | 2.40 | 2.48 | 70 |
| 1103 | C | ExC-1 | 2.40 | 2.48 | 73 |
| 1104 | D | ExC-1 | 2.40 | 2.48 | 73 |
| 1105 | A | CP-(1) | 2.40 | 2.33 | 84 |
| 1106 | B | CP-(1) | 2.40 | 2.50 | 81 |
| 1107 | C | CP-(1) | 2.40 | 2.50 | 89 |
| 1108 | D | CP-(1) | 2.40 | 2.50 | 91 |

Please note that the ethyl-acetate solubility of the azomethine dye obtained from the coupler (ExC-2) was 0.5 mol/L or above.

As can be seen from Table 8, the light fastness of each of Samples 1105 to 1108 using Coupler CP-(1) was better than the light fastness of each of Samples 1101 to 1104 using Coupler (ExC-1). However, it was found that the layer constitution A containing the azomethine dye-forming coupler in the silver halide emulsion layer located farthest from the support caused a great drop in the maximum magenta density under gray exposure. By contrast, the density drop in magenta image was small in the layer constitution B containing Coupler CP-(1) in the layer located near the support, and deep black was obtained. Therefore, the photosensitive materials 1106 to 1108 of the present invention were superior in not only color-forming density but also light fastness. In addition, the photosensitive materials 1107 and 1108 having the layer constitution C or D of the present invention were found to be more superior in light fastness.

Example 7

Samples 1115 to 1118 were prepared in the same manner as Samples 1105 to 1108, except that the coating amount of gelatin in each layer was increased by 45%.

Samples 1125 to 1128 were prepared in the same manner as Samples 1105 to 1108, except that the coating amount of silver in each light-sensitive emulsion layer was increased by 52%.

(Processing Unevenness Caused by Processing After Storage)

Each sample was stored at a temperature of 25° C. and a relative humidity of 55% for 7 days after coating, and further stored at a temperature of 30° C. and a relative humidity of 55% for 28 days. The thus stored samples were each subjected to the aforementioned exposure using a digital information recorded with a digital camera. In addition, each Sample was subjected to color-development processing by the processing A and B. Under each of the conditions, 10 sheets of color print were produced, and a visual observation of unevenness of each print was made and evaluated according to the following criterion.

◎: Uneven density was hardly observed, so the print quality was rated as excellent.

○: Uneven density was observed to a slight extent on 1 to 3 of 10 sheets.

Δ: Uneven density was observed clearly on 1 to 3 of 10 sheets, so the print quality was rated as poor.

x: Uneven density was observed clearly on almost all of 10 sheets, so the print quality was rated as unacceptable.

(Silver Removal Characteristics)

After uniform exposure under a condition to develop gray color, each sample was subjected to the above processing B, with adjusting the time in the bleach-fixing bath to be 10 seconds. In order to remove organic dyes and colored matter from the processed samples, the samples were allowed to stand in an 85:15 mixture of dimethylformamide and water for 12 hours at room temperature. Then, stain derived from silver remaining in each sample was observed, and a sensory evaluation was made by grading the extent of stain in accordance with the criterion described below:

○: Practically no residual silver stain was observed

Δ: Slight stain was observed x: Stain observed was noticeable, so unacceptable

TABLE 9

| Sample No. | Kind of layer constitution | Total amount of gelatin coated ($g/m^2$) | Total amount of silver coated ($g/m^2$) | Unevenness after storage Processing A | Unevenness after storage Proceccing B | Silver Removal Characteristics |
|---|---|---|---|---|---|---|
| 1101 | A | 4.49 | 0.31 | ○ | X | ○ |
| 1102 | B | 4.49 | 0.31 | ○ | X | ○ |
| 1103 | C | 4.33 | 0.31 | ○ | ◎ | ○ |
| 1104 | D | 4.33 | 0.31 | ○ | ◎ | ○ |
| 1105 | A | 4.49 | 0.31 | ○ | X | ○ |
| 1106 | B | 4.49 | 0.31 | ○ | X | ○ |
| 1107 | C | 4.33 | 0.31 | ○ | ◎ | ○ |
| 1108 | D | 4.33 | 0.31 | ○ | ◎ | ○ |
| 1115 | A | 6.51 | 0.31 | ◎ | ○ | X |
| 1116 | B | 6.51 | 0.31 | ◎ | ○ | X |
| 1117 | C | 6.27 | 0.31 | ◎ | ○ | X |
| 1118 | D | 6.27 | 0.31 | ◎ | ○ | X |
| 1125 | A | 4.49 | 0.47 | ◎ | X | X |

TABLE 9-continued

| Sample No. | Kind of layer constitution | Total amount of gelatin coated (g/m$^2$) | Total amount of silver coated (g/m$^2$) | Unevenness after storage Processing A | Unevenness after storage Proceccing B | Silver Removal Characteristics |
|---|---|---|---|---|---|---|
| 1126 | B | 4.49 | 0.47 | ◎ | X | X |
| 1127 | C | 4.33 | 0.47 | ◎ | X | X |
| 1128 | D | 4.33 | 0.47 | ◎ | X | X |

When a sample reduced in an coating amount of gelatin is processed in accordance with Processing B as ultra-rapid processing, processing unevenness is conspicuously caused after storage.

As can be seen from the results shown in Table 9, the layer constitution C or D in which the light-insensitive color-forming generation layer and the interlayer containing no color-mixing inhibitor were provided, made it possible to reduce the addition amount of the color-mixing inhibitor without aggravating muddiness of colors even in ultra-rapid processing. The reduction in color-mixing inhibitor led effectively to improvement in processing unevenness after storage.

However, since the total gelatin coating amount greater than 6.0 g/m$^2$ or the total silver coating amount greater than 0.45 g/m$^2$ went out of tolerance for the desilvering in the ultra-rapid Processing B, it run counter to improvement in processing unevenness.

Based also on the effects mentioned in Example 6, the constitutions of Sample 1107 and Sample 1108 could therefore give images superior in not only color-forming densities and light fastness but also ultra-rapid processing suitability.

Example 8

The layer constitutions of Samples 1201 to 1204 are described below.

TABLE 10

| Layer constitution | Sample No. 1201 E | 1202 F | 1203 G | 1204 H |
|---|---|---|---|---|
| 1st layer | BL-2 | BL-1 | BL-1 | BL-2 |
| 2nd layer | YL-1 | MCS1-2 | MCS1-2 | YL-1 |
| 3rd layer | MCS1-4 | CL-1 | CL-1 | MCS1-2 |
| 4th layer | CL-1 | RL-4 | RL-4 | RL-3 |
| 5th layer | RL-4 | CL-1 | CL-1 | MCS2-2 |
| 6th layer | CL-1 | MCS2-2 | MCS2-2 | GL-4 |
| 7th layer | MCS2-4 | ML-1 | GL-4 | PC-1 |
| 8th layer | ML-1 | GL-3 | PC-1 | — |
| 9th layer | GL-3 | UV-1 | — | — |
| 10th layer | UV-1 | PC-1 | — | — |
| 11th layer | PC-1 | — | — | — |
| Total amount of gelatin coated (g/m$^2$) | 4.33 | 4.33 | 4.34 | 4.34 |
| Total amount of silver coated (g/m$^2$) | 0.31 | 0.31 | 0.31 | 0.31 |

The composition of a new layer not described in Example 6 is shown below.

| Color-mixing-inhibiting layer: MCS1-4 | |
|---|---|
| Gelatin | 0.31 |
| Color-mixing inhibitor (Cpd-4) | 0.018 |

-continued

| | |
|---|---|
| Color-mixing inhibitor (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |
| Solvent (Solv-5) | 0.028 |
| Solvent (Solv-8) | 0.028 |
| Color-mixing-inhibiting layer: MCS2-4 | |
| Gelatin | 0.39 |
| Color-mixing inhibitor (Cpd-4) | 0.022 |
| Color-mixing inhibitor (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (Cpd-7) | 0.002 |
| Solvent (Solv-1) | 0.030 |
| Solvent (Solv-2) | 0.030 |
| Solvent (Solv-5) | 0.035 |
| Solvent (Solv-8) | 0.035 |
| Red-sensitive emulsion layer: RL-3 | |
| Emulsion (a 4:6 mixture of RH-1 and RL-1 (mol ratio of silver)) | 0.09 |
| Gelatin | 0.77 |
| Cyan coupler (Exemplified Compound CP-(1)) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.15 |
| Red-sensitive emulsion layer: RL-4 | |
| Emulsion (a 4:6 mixture of RH-1 and RL-1 (mol ratio of silver)) | 0.09 |
| Gelatin | 0.26 |
| Cyan coupler (Exemplified Compound CP-(1)) | 0.054 |
| Cyan coupler (ExC-2) | 0.005 |
| Color-image stabilizer (Cpd-1) | 0.004 |
| Color-image stabilizer (Cpd-7) | 0.004 |
| Color-image stabilizer (Cpd-9) | 0.01 |
| Color-image stabilizer (Cpd-10) | 0.001 |
| Color-image stabilizer (Cpd-14) | 0.001 |
| Color-image stabilizer (Cpd-15) | 0.01 |
| Color-image stabilizer (Cpd-16) | 0.03 |
| Color-image stabilizer (Cpd-17) | 0.03 |
| Solvent (Solv-5) | 0.05 |
| Light-insensitive coupler-containing color-forming layer: CL-1 | |
| Gelatin | 0.255 |
| Cyan coupler (Exemplified Compound CP-(1)) | 0.053 |
| Cyan coupler (ExC-2) | 0.005 |
| Color-image stabilizer (Cpd-1) | 0.003 |
| Color-image stabilizer (Cpd-7) | 0.003 |
| Color-image stabilizer (Cpd-9) | 0.01 |

-continued

| | |
|---|---|
| Color-image stabilizer (Cpd-10) | 0.001 |
| Color-image stabilizer (Cpd-14) | 0.001 |
| Color-image stabilizer (Cpd-15) | 0.01 |
| Color-image stabilizer (Cpd-16) | 0.02 |
| Color-image stabilizer (Cpd-17) | 0.02 |
| Solvent (Solv-5) | 0.05 |
| Green-sensitive emulsion layer: GL-4 | |
| Emulsion (a 1:3 mixture of GH-1 and GL-1 (mol ratio of silver)) | 0.09 |
| Gelatin | 1.10 |
| Magenta coupler (ExM) | 0.12 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |
| Ultraviolet absorber (UV-B) | 0.26 |
| Solvent (Solv-3) | 0.04 |
| Solvent (Solv-4) | 0.08 |
| Solvent (Solv-6) | 0.05 |
| Solvent (Solv-9) | 0.12 |
| Solvent (Solv-7) | 0.11 |
| Compound (S1-4) | 0.0015 |

Evaluations of color-forming densities under gray exposure, light fastness of cyan images, processing unevenness after storage and desilvering performance were conducted on Samples 1201 to 1204 in the same way as in Examples 6 and 7, and these Samples were rated as good on every criterion.

Example 9

Sample 1205 and Sample 1206 were prepared so as to have the same composition as Sample 1204, except that the Exemplified Compounds CP-(1) (cyan coupler) in the $4^{th}$ layer was replaced with equimolecular quantities of Exemplified Compounds CP-(2) and CP-(5), respectively.

Evaluations of color-forming densities under gray exposure, light fastness of cyan images, processing unevenness after storage and desilvering performance were conducted on Samples 1205 and 1206 in the same way as in Examples 6 and 7, and these Samples were rated as good on every criterion.

Example 10

Various samples were prepared in the same manners as Samples 001, 002 and 003 prepared in Example 2, except that the changes as mentioned below were made.

Samples 2101 to 2117 were prepared in the same manner as Sample 001, except that the coupler (ExC-1) and the high boiling organic solvent (Solv-5) were changed to those shown in Table 11. The cyan coupler (ExC-1) listed in Table 11 was changed in the equimolecular quantity, and the high boiling organic solvent (Solv-5) listed in Table 11 was changed in the same amount by mass. Additionally, when the high boiling organic solvent was changed to a mixture of two or more solvents, the mixing ratio by mass was shown. Except for the changes as shown in Table 11, Samples 2201 to 2207 were prepared in the same manner as Sample 002, and Samples 2301 to 2303 were prepared in the same manner as Sample 003.

TABLE 11

| | Red-sensitive layer | | | |
|---|---|---|---|---|
| Sample No. | Coupler | Mass %* | High boiling point organic solvent | Mass %* |
| 001 | ExC-1 | 25.1 | Solv-5 | 23.5 |
| 002 | " | 20.3 | Solv-5 | 38.1 |
| 003 | " | 16.2 | Solv-5 | 50.7 |
| 2101 | CP-(1) | 26.9 | Solvent for comparison 1 | 23.0 |
| 2102 | " | " | Solvent for comparison 2 | " |
| 2103 | " | " | Solv-5 | " |
| 2104 | " | " | S-I-6 | " |
| 2105 | " | " | S-I-18 | " |
| 2106 | " | " | S-I-20 | " |
| 2107 | " | " | S-I-22 | " |
| 2108 | " | " | Solv-5/S-II-4*1) | " |
| 2109 | " | " | S-II-6 | " |
| 2110 | " | " | S-III-2 | " |
| 2111 | " | " | S-IV-7 | " |
| 2112 | " | " | S-V-4 | " |
| 2113 | CP-(2) | 27.2 | S-V-5 | 22.9 |
| 2114 | " | " | S-I-20 | " |
| 2115 | CP-(5) | 27.5 | S-I-18 | 22.8 |
| 2116 | " | " | S-I-20 | " |
| 2117 | " | " | S-V-4 | " |
| 2201 | CP-(1) | 21.9 | S-I-20 | 37.4 |
| 2202 | " | " | S-IV-7/ST-I-27*2) | " |
| 2203 | " | " | Solv-5/ST-II-1*3) | " |
| 2204 | " | " | S-I-20/ST-III-1*4) | " |
| 2205 | " | " | Solv-5/ST-IV-6*5) | " |
| 2206 | " | " | S-V-5/ST-V-19*6) | " |
| 2207 | " | " | Solv-5/S-V-5*7) | " |
| 2301 | " | 17.5 | S-I-18 | 50.0 |
| 2302 | " | " | S-IV-7 | " |
| 2303 | " | " | S-V-4 | " |

*mass % represents a content in lipophilic components.
*1)Mixture (mass ratio: 1:1),
*2)Mixture (mass ratio: 3:1),
*3)Mixture (mass ratio: 3:1),
*4)Mixture (mass ratio: 2:1),
*5)Mixture (mass ratio: 4:1),
*6)Mixture (mass ratio: 3:1),
*7)Mixture (mass ratio: 1:1)

Solvent for comparison 1

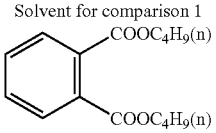

Solvent for comparison 2

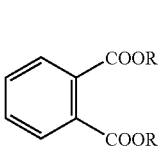

R:

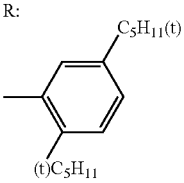

Each Sample underwent the color development described below to produce a cyan image. The structure of the dye extracted from the cyan image of each of Samples 001, 002, 003, and 2101 to 2303 was examined by high-performance liquid chromatography and mass analysis, and thereby the dyes formed from the couplers used, namely (ExC-1), Exemplified Compound CP-(1), Exemplified Compound CP-(2) and Exemplified Compound CP-(5), were identified as (Dye 4), (Dye 1), (Dye 2) and (Dye 3), respectively.

On the Samples shown in Table 11, the following evaluations were made after the photosensitive materials prepared by coating were stored for 14 days under a 25° C.-55% RH condition.

Gradation exposure providing gray by the same Processing B as in Example 2 was given to each Sample by use of the same exposure device as used in Example 2, and after a 5-second lapse from the end of the exposure the color development was carried out according to each of the same Processing A and Processing B as in Example 2.

(Evaluation of Maximum Density)

In each of Samples shown in Table 11, yellow, magenta, cyan and gray images were formed by undergoing the foregoing exposure and Processing A or Processing B, and maximum densities thereof were measured. The Samples of the present invention achieved sufficient color generation providing a maximum cyan density of 2.3 or above in both cases of Processing A and Processing B.

(Evaluation of Color Reproducibility)

Cyan gradation images were produced by giving gradation-wise R exposure to each Sample in accordance with the foregoing exposure method and subjecting the exposed Sample to each of Processing A and Processing B. Based on the result of reflection spectrum measurement at the portion having the density of 1.0 in the cyan-color-forming area, color reproducibility was rated as "○" (for a particularly sample, "◎") when undesired absorptions corresponding to magenta and yellow in the wavelength range of 550 nm to 400 nm were regarded as small and the result of sensory evaluation was excellent; "Δ" when they were somewhat inferior; and "x" when undesired absorption corresponding to magenta or yellow in the wavelength range of 550 nm to 400 nm was great and it was apparently inferior. The results obtained are shown in Table 12. All Samples according to the present invention had maximum color-forming densities not lower than 2.0.

(Evaluation of Light Fastness)

The image samples were exposed for 14 days to a xenon light (100,000 lx of xenon light irradiator) via an UV cut filter with a light transmittance of 50% at 370 nm and a heat wave cut filter. The light fastness was evaluated by relative residual rate (%) after the exposure at the portion having the cyan initial density of 2.0. The results obtained are shown in Table 12.

(Evaluation of White-Background Preservability)

Rapid processing suitability of each Sample was evaluated by white-background preservability of the image obtained through Processing B. The white-background preservability was estimated as follows: Each sample after processing was stored for 21 days at 60° C. and 70% RH, and examined for an increment of cyan density between before and after the storage. This increment was denoted by ΔD. And ΔD values smaller than 0.05 were judged as being within the preferable range of sensory evaluation. The results obtained are shown in Table 12.

Please note that the results shown as color reproducibility and light fastness are results of evaluations made on the Samples having undergone the development process by Processing B.

TABLE 12

| Sampl No. | Color Reproducibility | Light fastness (residual rate %) | White-Background Preservability (ΔD) |
|---|---|---|---|
| 001 | X | 73 | 0.02 |
| 002 | Δ | 77 | 0.04 |
| 003 | ○ | 82 | 0.09 |
| 2101 | ○ | 76 | 0.05 |
| 2102 | ○ | 77 | 0.04 |
| 2103 | ◎ | 88 | 0.02 |
| 2104 | ◎ | 86 | 0.02 |
| 2105 | ◎ | 85 | 0.02 |
| 2106 | ◎ | 85 | 0.02 |
| 2107 | ◎ | 86 | 0.02 |
| 2108 | ◎ | 88 | 0.02 |
| 2109 | ◎ | 86 | 0.02 |
| 2110 | ◎ | 86 | 0.02 |
| 2111 | ◎ | 86 | 0.02 |
| 2112 | ◎ | 86 | 0.02 |

TABLE 12-continued

| Sampl No. | Color Reproducibility | Light fastness (residual rate %) | White-Background Preservability (ΔD) |
|---|---|---|---|
| 2113 | ◎ | 86 | 0.02 |
| 2114 | ◎ | 84 | 0.02 |
| 2115 | ◎ | 89 | 0.02 |
| 2116 | ◎ | 90 | 0.02 |
| 2117 | ◎ | 89 | 0.02 |
| 2201 | ◎ | 87 | 0.03 |
| 2202 | ◎ | 85 | 0.03 |
| 2203 | ◎ | 86 | 0.03 |
| 2204 | ◎ | 86 | 0.04 |
| 2205 | ◎ | 86 | 0.03 |
| 2206 | ◎ | 85 | 0.04 |
| 2207 | ◎ | 85 | 0.03 |
| 2301 | ◎ | 84 | 0.08 |
| 2302 | ○ | 83 | 0.08 |
| 2303 | ○ | 83 | 0.09 |

Please note that the ethyl-acetate solubility of the azomethine dye obtained from a coupler (ExC-2) was 0.5 mol/L or above.

As can be seen from Table 12, the constitutions according to the present invention can yield color prints superior in color reproducibility, light fastness and white-background preservability even in ultra-rapid processing. More specifically, Samples 2103 to 2117 and Samples 2201 to 2207 which each had the dye hardly soluble in an organic solvent as defined by the present invention in the red-sensitive layer, contained the coupler for forming such a dye in an amount of at least 18 mass % based on the lipophilic components and further contained, in the same layer, the high boiling organic solvent, which is preferably used in the present invention, were superior in all of the foregoing properties.

Tables 11 and 12 further reveal that, in a still more preferable embodiment of the present invention, the high boiling organic solvent according to the invention is used in an amount of no greater than 50 mass % based on the total lipophilic components, and besides, the coupler for forming the dye hardly soluble in an organic solvent is contained in the oily component in an amount of 24 mass % or above.

On the other hand, Samples 2101 and 2102 using the high boiling organic solvent outside the scope of the present invention were inferior in light fastness. In addition, Samples 003 and 2301 to 2303 having a coupler content lower than 18 mass % were inferior in white-background preservability.

Example 11

Photosensitive material 2400 was prepared in the same manner as in Example 10, except that the layer constitution as shown below. The numbers show coating amounts (g/m$^2$). In the case of the silver halide emulsion, the coating amount is in terms of silver.

| First layer (Blue-sensitive emulsion layer) | |
|---|---|
| Emulsion (a 5:5 mixture of BH-1 and BL-1 (mol ratio of silver)) | 0.13 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-16) | 0.01 |
| Color-image stabilizer (Cpd-17) | 0.02 |
| Color-image stabilizer (Cpd-18) | 0.15 |
| Color-image stabilizer (Cpd-19) | 0.01 |

-continued

| | |
|---|---|
| Color-image stabilizer (Cpd-20) | 0.15 |
| Additive (ExC-1) | 0.001 |
| Color-image stabilizer (UV-A) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (Cpd-7) | 0.006 |
| Solvent (Solv-1) | 0.03 |
| Solvent (Solv-2) | 0.03 |
| Solvent (Solv-5) | 0.04 |
| Third layer (Green-sensitive emulsion layer) | |
| Emulsion (a 1:3 mixture of GH-1 and GL-1 (mol ratio of silver)) | 0.11 |
| Gelatin | 0.70 |
| Magenta coupler (Ex-M) | 0.12 |
| Ultraviolet absorber (UV-A) | 0.03 |
| Color-image stabilizer (Cpd-2) | 0.01 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-18) | 0.01 |
| Solvent (Solv-3) | 0.03 |
| Solvent (Solv-4) | 0.06 |
| Solvent (Solv-6) | 0.03 |
| Solvent (Solv-9) | 0.08 |
| Fourth layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (Cpd-7) | 0.006 |
| Solvent (Solv-1) | 0.03 |
| Solvent (Solv-2) | 0.03 |
| Solvent (Solv-5) | 0.04 |
| Fifth layer (Red-sensitive emulsion layer) | |
| Emulsion (a 4:6 mixture of RH-1 and RL-1 (mol ratio of silver)) | 0.09 |
| Gelatin | 1.04 |
| Cyan coupler (ExC-1) | 0.11 |
| Cyan coupler (ExC-2) | 0.05 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.07 |
| Color-image stabilizer (Cpd-17) | 0.08 |
| Solvent (Solv-5) | 0.20 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.44 |
| Additive (Cpd-20) | 0.015 |
| Liquid paraffin | 0.01 |
| Surfactant (Cpd-13) | 0.01 |

Samples 2401 to 2410 were prepared in the same manner as Sample 2400, except that the coupler (ExC-1) and the high boiling organic solvent (Solv-5) were changed to those shown in Table 13. In Table 13, (ExC-1) was replaced with each of the cyan couplers in the equimolecular quantity, and (Solv-5) was replaced with each of the high boiling organic solvents in the same amount by mass. Additionally, when the high boiling organic solvent was changed to a mixture of two or more solvents, the mixing ratio by mass was shown. Color print samples were prepared from the light sensitive materials of this Example by performing the exposure and each of Processing A and Processing B as described in Example 10, and evaluated. As a result, it was ascertained that the effects of the present invention can be obtained by the constitution of this Example also.

TABLE 13

| | Red-sensitive layer | | | |
|---|---|---|---|---|
| Sample No. | Coupler | Mass %* | High boiling organic solvent | Mass %* |
| 2401 | CP-(1) | 18.5 | S-I-18 | 30.6 |
| 2402 | CP-(2) | 18.8 | S-I-20 | 30.5 |
| 2403 | " | " | S-I-22 | " |
| 2404 | CP-(5) | 19.0 | Solv-5/S-II-4*1) | 30.5 |
| 2405 | " | " | S-II-6 | " |
| 2406 | " | " | S-III-2 | " |
| 2407 | CP-(1) | 18.5 | S-IV-7 | 30.6 |
| 2408 | " | " | S-V-4 | " |
| 2409 | " | " | S-V-5 | " |
| 2410 | " | " | S-V-5/ST-V-19*2) | " |

*mass % represents a content in lipophilic components.
*1)Mixture (mass ratio: 1:1),
*2)Mixture (mass ratio: 3:1)

Example 12

For silver halide emulsions in the light-sensitive layers, the silver halide emulsions prepared in the same manners as in Example 2.

(Layer Constitution)

A sample was prepared in the same manner as Sample 001 in Example 2, except that the compositions of the third, fourth and fifth layers were changed as described below.

| | |
|---|---|
| Third layer (Color-mixing-inhibiting layer) | |
| Gelatin | 0.31 |
| Color-mixing inhibitor (Cpd-4) | 0.020 |
| Color-mixing inhibitor (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Color-image stabilizer (UV-5) | 0.056 |
| Solvent (Solv-1) | 0.024 |
| Solvent (Solv-2) | 0.024 |
| Solvent (Solv-5) | 0.028 |
| Solvent (Solv-8) | 0.028 |
| Fourth layer (Red-sensitive emulsion layer) | |
| Emulsion (a 4:6 mixture of RH-1 and RL-1 (mol ratio of silver)) | 0.09 |
| Gelatin | 0.77 |
| Cyan coupler (ExC-1) | 0.16 |
| Cyan coupler (ExC-2) | 0.015 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |

-continued

| | |
|---|---|
| Color-image stabilizer (Cpd-16) | 0.08 |
| Color-image stabilizer (Cpd-17) | 0.07 |
| Solvent (Solv-5) | 0.19 |
| Fifth layer (Color-mixing-inhibiting layer) | |
| Gelatin | 0.39 |
| Color-mixing inhibitor (Cpd-4) | 0.025 |
| Color-mixing inhibitor (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (Cpd-7) | 0.002 |
| Color-image stabilizer (UV-5) | 0.070 |
| Solvent (Solv-1) | 0.030 |
| Solvent (Solv-2) | 0.030 |
| Solvent (Solv-5) | 0.035 |
| Solvent (Solv-8) | 0.035 |

The thus-prepared sample was referred to as Sample 3001.

Then, Sample 3002 was prepared in the same manner as Sample 3001, except that the organic-solvent-soluble polymer (P-10) was added to the red-sensitive layer and the solvent (Solv-5) was reduced in content as mentioned below.

| Fourth layer (Red-sensitive emulsion layer of Sample 3002) | |
|---|---|
| Emulsion (a 4:6 mixture of RH-1 and RL-1 (mol ratio of silver)) | 0.09 |
| Gelatin | 0.77 |
| Cyan coupler (ExC-1) | 0.160 |
| Cyan coupler (ExC-2) | 0.015 |

-continued

| Fourth layer (Red-sensitive emulsion layer of Sample 3002) | |
|---|---|
| Organic-solvent-soluble polymer (P-10) | 0.04 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.15 |

Samples 3003 to 3019 were each prepared in the same manner as Sample 3001, except that the coupler (ExC-1) in the red-sensitive emulsion layer was replaced with Exemplified Compound CP-(1), CP-(2) or CP-(5) in an equimolecular quantity, the kinds and amounts of the organic-solvent-soluble polymer compound according to the present invention and the solvent (Solv-5), and the amount of gelatin used were changed as shown in Table 14.

The coupler used in the red sensitive emulsion layer, the organic-solvent-soluble polymer used and the coupler content in lipophilic components in each Sample are shown in Table 14.

The color development described below was given to Samples each, and cyan images were obtained. As results of qualitative analyses of structures of the dyes extracted from the cyan images, respectively, by high-performance liquid chromatography, the dyes formed respectively from the couplers used have proved to be those shown in Table 14.

TABLE 14

| | Composition of Red-sensitive Layer (Coupler Used, Organic-solvent-soluble polymer, and Solvent with the used amount (g/m$^2$)) shown in the bottom | | | | | | |
|---|---|---|---|---|---|---|---|
| Sample No. | Coupler Used | Organic-solvent-soluble polymer | Amount to be used of solvent (Solv-5) | Coupler content in lipophilic components | | Gel amount | Coloring dye tormed after deveropment |
| | | | | | Ratio of the polymer of the invention to the coupler used | | |
| 3001 | ExC-1 0.160 g/m$^2$ | — | 0.19 g/m$^2$ | 26.3 mass % | — | 0.77 g/m$^2$ | Dye 4 |
| 3002 | ExC-1 0.160 | (PC-10) 0.04 g/m$^2$ | 0.19 | 26.3 | 25 mass % | 0.77 | Dye 4 |
| 3003 | CP-(1) 0.176 | — | 0.19 | 28.2 | — | 0.77 | Dye 1 |
| 3004 | CP-(1) 0.176 | (PC-10) 0.04 | 0.15 | 28.2 | 22.7 | 0.77 | Dye 1 |
| 3005 | CP-(1) 0.176 | (PC-10) 0.005 | 0.185 | 28.2 | 2.84 | 0.77 | Dye 1 |
| 3006 | CP-(1) 0.176 | — | 0.60 | 17.1 | — | 1.26 | Dye 1 |
| 3007 | CP-(1) 0.176 | (PC-10) 0.04 | 0.56 | 17.1 | 22.7 | 1.26 | Dye 1 |
| 3008 | CP-(1) 0.176 | (PC-2) 0.04 | 0.15 | 28.2 | 22.7 | 0.77 | Dye 1 |
| 3009 | CP-(1) 0.176 | (PC-34) 0.04 | 0.15 | 28.2 | 22.7 | 0.77 | Dye 1 |
| | | | | | Ratio of the polymer of the organic-solvent-soluble polymer to the coupler used | | |
| 3010 | CP-(1) 0.176 | (PC-57) 0.04 | 0.15 | 28.2 | 22.7 | 0.77 | Dye 1 |
| 3011 | CP-(1) 0.176 | (PC-70) 0.04 | 0.15 | 28.2 | 22.7 | 0.77 | Dye 1 |

TABLE 14-continued

| Sample No. | Coupler Used | Organic-solvent-soluble polymer | Amount to be used of solvent (Solv-5) | Coupler content in lipophilic components | | Gel amount | Coloring dye tormed after deveropment |
|---|---|---|---|---|---|---|---|
| | Composition of Red-sensitive Layer (Coupler Used, Organic-solvent-soluble polymer, and Solvent with the used amount (g/m$^2$)) shown in the bottom | | | | | | |
| 3012 | CP-(1) 0.176 | (P-10) 0.04 | 0.15 | 28.2 | 22.7 | 0.77 | Dye 1 |
| 3013 | CP-(1) 0.176 | (P-30) 0.04 | 0.15 | 28.2 | 22.7 | 0.77 | Dye 1 |
| 3014 | CP-(1) 0.176 | (PC-2) 0.02 (PC-10) 0.02 | 0 15 | 28.2 | 22.7 | 0.77 | Dye 1 |
| 3015 | CP-(1) 0.176 | (PC-10) 0.02 (P-30) 0.02 | 0.15 | 28.2 | 22.7 | 0.77 | Dye 1 |
| 3016 | CP-(2) 0.179 | — | 0.19 | 28.6 | — | 0.77 | Dye 2 |
| 3017 | CP-(2) 0.179 | (PC-10) 0.04 | 0.15 | 28.6 | 22.3 | 0.77 | Dye 2 |
| 3018 | CP-(5) 0.181 | — | 0.19 | 28.8 | — | 0.77 | Dye 3 |
| 3019 | CP-(5) 0.181 | (PC-10) 0.04 | 0.15 | 28.8 | 22.1 | 0.77 | Dye 3 |

Processings A and B

Processings A and B were conducted in the same manner as the Processings A and B in Example 2, except that the above Sample 3001 was used.

On the Samples 3001 to 3019, the following evaluations were made after the light-sensitive materials prepared by coating were stored for 14 days under a 25° C.-55% RH condition.

Gradation exposure providing gray by the same Processing B as in Example 2 was given to each Sample by use of the same exposure device as used in Example 2, and after a 5-second lapse from the end of the exposure the color development of each Sample was carried out according to the above-mentioned Processing A or Processing B.

(Evaluation of Color Reproducibility)

Cyan gradation images were produced by giving gradation-wise R exposure to each Sample in accordance with the foregoing exposure method and subjecting the exposed Sample to either the Processing A or the Processing B. From the results of reflection spectrum measurement at the density of 1.0 in the cyan-color formed area, color reproducibility was rated as particularly excellent "○" or being somewhat but still excellent "Δ" by sensory evaluation of when undesired absorption corresponding to magenta or yellow in the wavelength range of 550 nm to 400 nm was regarded as small, while it was rated as being apparently poor (F) when undesired absorption corresponding to magenta or yellow in the wavelength range of 550 nm to 400 nm was large. All Samples according to the present invention had the maximum developed-color densities not lower than 2.0.

(Evaluation of Light Fastness)

The image samples were exposed for 10 days to a xenon light ($10^5$ lux of xenon light irradiator) via an UV protection filter with a light transmittance of 50% at 370 nm and a heat wave protection filter. The light fastness was evaluated by a relative residual rate (%) after the exposure at the cyan initial density of 1.5.

(Evaluation of Wet/Heat Fastness)

The foregoing image-bearing samples were stored for 21 days at 80-70% RH, and their wet-heat fastness was evaluated by a relative remaining rate (%) at the density of 2.0.

(Evaluation of White-Background Preservability)

Rapid processing suitability of each Sample was evaluated by white-background preservability (keeping property of it with the lapse of time) of the image obtained through the Processing B. The white-background preservability was estimated as follows: Each sample after processing was stored for 21 days at 60° C. and 70% RH, and examined for an increment of cyan density between before and after the storage. This increment was denoted by ΔD. When ΔD values were smaller than 0.05, it was judged as being within the desirable range of sensory evaluation.

Results thus obtained are shown in Table 15.

Additionally, the results shown as color reproducibility, light fastness, and wet-heat fastness are results of evaluations made on the Samples having undergone the development process by the Processing B.

TABLE 15

| Sample No. | Color reproducibility | Light fastness (residual rate %) | Wet/heat fastness (residual rate %) | White-background preservability (ΔD) |
|---|---|---|---|---|
| 3001 | Δ | 81 | 92 | 0.04 |
| 3002 | Δ | 82 | 92 | 0.04 |
| 3003 | ◎ | 93 | 85 | 0.03 |
| 3004 | ◎ | 93 | 97 | 0.03 |
| 3005 | ◎ | 92 | 95 | 0.03 |
| 3006 | ○ | 82 | 90 | 0.08 |
| 3007 | ○ | 82 | 90 | 0.09 |
| 3008 | ◎ | 93 | 96 | 0.03 |

TABLE 15-continued

| Sample No. | Color reproducibility | Light fastness (residual rate %) | Wet/heat fastness (residual rate %) | White-background preservability (ΔD) |
|---|---|---|---|---|
| 3009 | ◎ | 92 | 96 | 0.03 |
| 3010 | ◎ | 92 | 97 | 0.03 |
| 3011 | ◎ | 92 | 97 | 0.03 |
| 3012 | ◎ | 92 | 95 | 0.03 |
| 3013 | ◎ | 93 | 95 | 0.03 |
| 3014 | ◎ | 93 | 97 | 0.03 |
| 3015 | ◎ | 93 | 97 | 0.03 |
| 3016 | ◎ | 94 | 88 | 0.03 |
| 3017 | ◎ | 94 | 97 | 0.03 |
| 3018 | ◎ | 92 | 85 | 0.03 |
| 3019 | ◎ | 92 | 96 | 0.03 |

Additionally, the solubility to ethyl-acetate of the azomethine dye obtained from a coupler (ExC-2) was 0.5 mol/L or above.

As can be seen from Table 15, according to the structure of the present invention, color prints can be obtained which are excellent in color reproducibility, light fastness and white-background preservability even upon ultra-rapid processing. Specifically, the light-sensitive materials having the red-sensitive layer as specified in the present invention were excellent in all of the foregoing properties. On the other hand, the samples for comparison not meeting either the use of the coupler according to the present invention, or the coupler content or incorporation of the organic-solvent-soluble polymer as specified by the present invention, at least failed to achieve satisfactory color reproducibility, light fastness, wet-heat fastness and white-background preservability at the same time.

Example 13

Light-sensitive material 3101 was prepared in the same manner as in Example 12, except that the layer structure was changed to the following. The numbers show coating amounts (g/m$^2$). In the case of the silver halide emulsion, the coating amount is in terms of silver.

| | |
|---|---|
| First layer (Blue-sensitive emulsion layer) | |
| Emulsion (a 5:5 mixture of BH-1 and BL-1 (mol ratio of silver)) | 0.13 |
| Gelatin | 1.32 |
| Yellow coupler (Ex-Y) | 0.34 |
| Color-image stabilizer (Cpd-2) | 0.01 |
| Color-image stabilizer (Cpd-8) | 0.08 |
| Color-image stabilizer (Cpd-16) | 0.01 |
| Color-image stabilizer (Cpd-17) | 0.02 |
| Color-image stabilizer (Cpd-18) | 0.15 |
| Color-image stabilizer (Cpd-19) | 0.01 |
| Color-image stabilizer (Cpd-21) | 0.15 |
| Color-image stabilizer (UV-A) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (Cpd-7) | 0.006 |
| Solvent (Solv-1) | 0.03 |

-continued

| | |
|---|---|
| Solvent (Solv-2) | 0.03 |
| Solvent (Solv-5) | 0.04 |
| Third layer (Green-sensitive emulsion layer) | |
| Emulsion (a 1:3 mixture of GH-1 and GL-1 (mol ratio of silver)) | 0.11 |
| Gelatin | 0.70 |
| Magenta coupler (ExM) | 0.12 |
| Ultraviolet absorber (UV-A) | 0.03 |
| Color-image stabilizer (Cpd-2) | 0.01 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-18) | 0.01 |
| Solvent (Solv-3) | 0.03 |
| Solvent (Solv-4) | 0.06 |
| Solvent (Solv-6) | 0.03 |
| Solvent (Solv-9) | 0.08 |
| Fourth layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (Cpd-7) | 0.006 |
| Solvent (Solv-1) | 0.03 |
| Solvent (Solv-2) | 0.03 |
| Solvent (Solv-5) | 0.04 |
| Fifth layer (Red-sensitive emulsion layer) | |
| Emulsion (a 4:6 mixture of RH-1 and RL-1 (mol ratio of silver)) | 0.09 |
| Gelatin | 1.04 |
| Cyan coupler (ExC-1) | 0.11 |
| Cyan coupler (ExC-2) | 0.05 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.07 |
| Color-image stabilizer (Cpd-17) | 0.08 |
| Solvent (Solv-5) | 0.14 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.44 |
| Additive (Cpd-21) | 0.015 |
| Liquid paraffin | 0.01 |
| Surfactant (Cpd-14) | 0.01 |

Photosensitive materials 3102 to 3105 were prepared in the same manner as the light-sensitive material 3101, except that changes as shown in Table 16 were made.

Color print Samples were obtained from the light-sensitive materials 3101 to 3105 of this Example through the same exposure and the Processing A or Processing B as described in Example 12. As a result of conducting the same evaluations as in Example 12, it was ascertained that the effects of the present invention were attained as shown in Table 17.

TABLE 16

| Sample No. | Constitution of Red-sensitive layer: Coupler used | Amount to be used of solvent (Solv-5) | Organic-solvent-soluble polymer | Coupler content in lipophilic components |
|---|---|---|---|---|
| 3101 | EXC-1 0.11 g/m$^2$ | 0.140 g/m$^2$ | — | 19.9 mass % |
| 3102 | CP-(1) 0.121 | 0.140 | — | 21.5 |
| 3103 | CP-(1) 0.121 | 0.137 | PC-10 0.03 g/m$^2$ | 21.5 |
| 3104 | CP-(1) 0.121 | 0.137 | PC-34 0.03 | 21.5 |
| 3105 | CP-(1) 0.121 | 0.137 | P-30 0.03 | 21.5 |

TABLE 17

| Sample No. | Color reproducibility | Light fastness (residual rate %) | Wet-heat fastness (residual rate %) | White-background preservability (ΔD) |
|---|---|---|---|---|
| 3101 | Δ | 83 | 90 | 0.04 |
| 3102 | ◎ | 93 | 86 | 0.03 |
| 3103 | ◎ | 94 | 97 | 0.03 |
| 3104 | ◎ | 94 | 96 | 0.03 |
| 3105 | ◎ | 92 | 95 | 0.03 |

Example 14

Samples were prepared by coating any of Samples 3001 to 3019 obtained in Example 12 on a 175 μm-thick barium-sulfate-kneaded PET reflective support, and thereon the evaluations in accordance with those in Example 12 were performed. As a result, these samples also received almost the same ratings.

Example 15

The silver halide emulsions and the coating solutions prepared in the same manners as in Example 2 were used for light-sensitive layers in this example.

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| | |
|---|---|
| First layer (Blue-sensitive emulsion layer) | |
| Emulsion (a 5:5 mixture of BH-1 and BL-1 (mol ratio of silver)) | 0.13 |
| Gelatin | 1.00 |
| Yellow coupler (Ex-Y) | 0.24 |
| Color-image stabilizer (B-17) | 0.06 |

-continued

| | |
|---|---|
| Color-image stabilizer (TII-29) | 0.01 |
| Color-image stabilizer (TVI-21) | 0.01 |
| Color-image stabilizer (A-22) | 0.11 |
| Color-image stabilizer (Cpd-19) | 0.01 |
| Color-image stabilizer (TI-31) | 0.11 |
| Color-image stabilizer (UV-A) | 0.01 |
| Solvent (Solv-4) | 0.17 |
| Solvent (Solv-6) | 0.03 |
| Solvent (Solv-9) | 0.17 |
| Second layer (Intermediate color-forming layer) | |
| Gelatin | 0.33 |
| Yellow coupler (Ex-Y) | 0.08 |
| Color-image stabilizer (B-17) | 0.02 |
| Color-image stabilizer (TII-29) | 0.01 |
| Color-image stabilizer (TVI-21) | 0.01 |
| Color-image stabilizer (A-22) | 0.03 |
| Color-image stabilizer (Cpd-19) | 0.01 |
| Color-image stabilizer (TI-31) | 0.03 |
| Color-image stabilizer (UV-A) | 0.01 |
| Solvent (Solv-4) | 0.05 |
| Solvent (Solv-6) | 0.01 |
| Solvent (Solv-9) | 0.05 |
| Third layer (Color-mixing-inhibiting layer) | |
| Gelatin | 0.31 |
| Color-mixing inhibitor (Cpd-4) | 0.020 |
| Color-mixing inhibitor (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (TIII-15) | 0.002 |
| Solvent (Solv-1) | 0.024 |
| Solvent (Solv-2) | 0.024 |
| Solvent (Solv-5) | 0.028 |
| Solvent (Solv-8) | 0.028 |
| Fourth layer (Red-sensitive emulsion layer) | |
| Emulsion (a 4:6 mixture of RH-1 and RL-1 (mol ratio of silver)) | 0.09 |
| Gelatin | 0.77 |
| Cyan coupler (ExC-1) | 0.16 |
| Cyan coupler (ExC-2) | 0.015 |
| Color-image stabilizer (Cpd-1) | 0.01 |
| Color-image stabilizer (TIII-15) | 0.01 |
| Color-image stabilizer (TI-31) | 0.03 |
| Color-image stabilizer (TIV-9) | 0.001 |

-continued

| | |
|---|---|
| Color-image stabilizer (Cpd-14) | 0.001 |
| Color-image stabilizer (Cpd-15) | 0.05 |
| Color-image stabilizer (TVI-21) | 0.07 |
| Solvent (Solv-5) | 0.15 |
| Fifth layer (Color-mixing-inhibiting layer) | |
| Gelatin | 0.39 |
| Color-mixing inhibitor (Cpd-4) | 0.025 |
| Color-mixing inhibitor (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (TIII-15) | 0.002 |
| Solvent (Solv-1) | 0.030 |
| Solvent (Solv-2) | 0.030 |
| Solvent (Solv-5) | 0.035 |
| Solvent (Solv-8) | 0.035 |
| Sixth layer (Green-sensitive emulsion layer) | |
| Emulsion (a 1:3 mixture of GH-1 and GL-1 (mol ratio of silver)) | 0.09 |
| Gelatin | 1.10 |
| Magenta coupler (Ex-M) | 0.12 |
| Color-image stabilizer (TI-6) | 0.01 |
| Color-image stabilizer (B-17) | 0.01 |
| Color-image stabilizer (TI-31) | 0.005 |
| Color-image stabilizer (TIV-9) | 0.005 |
| Color-image stabilizer (Cpd-11) | 0.0001 |
| Color-image stabilizer (A-22) | 0.01 |
| Ultraviolet absorber (UV-B) | 0.26 |
| Solvent (Solv-3) | 0.04 |
| Solvent (Solv-4) | 0.08 |
| Solvent (Solv-6) | 0.05 |
| Solvent (Solv-9) | 0.12 |
| Solvent (Solv-7) | 0.11 |
| Compound (S1-4) | 0.0015 |
| Seventh layer (Protective layer) | |
| Gelatin | 0.44 |
| Additive (Cpd-20) | 0.015 |
| Liquid paraffin | 0.01 |
| Surfactant (Cpd-13) | 0.01 |

The thus-prepared sample is referred to as Sample 4001.

Next, in the red-sensitive layer of Sample 4001, the amount of solvent (Solv-5) was increased as shown below, and the amount of gelatin was increased in proportion to the total amount of increased lipophilic components. Thus, Sample 4002 and Sample 4003 were prepared in the same manner as Sample 4001, except for the above difference in amounts of solvent (Solv-5) and gelatin in the red-sensitive layer.

| | |
|---|---|
| Fourth layer (Red-sensitive emulsion layer of Sample 4002.) | |
| Emulsion (a 4:6 mixture of RH-1 and RL-1 (mol ratio of silver)) | 0.09 |
| Gelatin | 1.00 |
| Cyan coupler (ExC-1) | 0.16 |
| Cyan coupler (ExC-2) | 0.015 |
| Color-image stabilizer (Cpd-1) | 0.01 |

-continued

| | |
|---|---|
| Color-image stabilizer (TIII-15) | 0.01 |
| Color-image stabilizer (TI-31) | 0.03 |
| Color-image stabilizer (TIV-9) | 0.001 |
| Color-image stabilizer (Cpd-14) | 0.001 |
| Color-image stabilizer (Cpd-15) | 0.05 |
| Color-image stabilizer (TVI-21) | 0.07 |
| Solvent (Solv-5) | 0.35 |
| Fourth layer (Red-sensitive emulsion layer of Sample 4003.) | |
| Emulsion (a 4:6 mixture of RH-1 and RL-1 (mol ratio of silver)) | 0.09 |
| Gelatin | 1.26 |
| Cyan coupler (ExC-1) | 0.16 |
| Cyan coupler (ExC-2) | 0.015 |
| Color-image stabilizer (Cpd-1) | 0.01 |
| Color-image stabilizer (TIII-15) | 0.01 |
| Color-image stabilizer (TI-31) | 0.03 |
| Color-image stabilizer (TIV-9) | 0.001 |
| Color-image stabilizer (Cpd-14) | 0.001 |
| Color-image stabilizer (Cpd-15) | 0.05 |
| Color-image stabilizer (TVI-21) | 0.07 |
| Solvent (Solv-5) | 0.60 |

Sample 4101, Sample 4102 and Sample 4103 were prepared so as to have the same composition as Sample 4001, except that the coupler (ExC-1) in the red-sensitive emulsion layer was replaced with an equimolecular quantity of Exemplified Compound CP-(1), CP-(2) or CP-(5), respectively.

Sample 4104 and Sample 4105 were prepared so as to have the same composition as Sample 4002, except that the coupler (ExC-1) in the red-sensitive emulsion layer was replaced with an equimolecular quantity of Exemplified Compound CP-(1) or CP-(5), respectively.

Sample 4106 and Sample 4107 were prepared so as to have the same composition as Sample 4003, except that the coupler (ExC-1) in the red-sensitive emulsion layer was replaced with an equimolecular quantity of Exemplified Compound CP-(1) or CP-(5), respectively.

Further, Samples 4108 to 4124 were prepared in the same manner as Sample 4001, except that the fourth layer structure was changed to ones as shown in the following Table 18, respectively.

The color development processing described below was given to Samples each, and cyan images were obtained. As results of qualitative analyses of structures of the dyes extracted from the cyan images, respectively, by high-performance liquid chromatography, the dyes formed respectively from the couplers used have proved to be those shown in Table 18.

The coupler content and the compound represented by any of formula (Ph-1), (Ph-2), (E-1) to (E-3) or (TS-I) to (TS-VII), the metal complex or/and the water-insoluble polymer included in the lipophilic components in the red-sensitive emulsion layer of each Sample are shown in Table 18.

The proportion of the coupler to the total oil-soluble components in each Sample was adjusted to the coupler content shown in Table 18 by increasing or decreasing the addition amount of solvent (Solv-5).

TABLE 18

| | | | Fourth layer structure | | | | |
|---|---|---|---|---|---|---|---|
| | | | Content of coupler | Compound of any of the formulae (Ph-1), (Ph-2), (E-1) to(E-3), and (TS-I) to (TS-VII), Matal complex, and Ultraviolet absorber | | | |
| Sample No. | Coupler used | Dye colored after processing | in the left column mass % | Structure | Addition amount g/m$^2$ | Structure | Addition amount g/m$^2$ |
| 4001 | ExC-1 | Dye 4 | 32.2 | (TIII-15)<br>(TI-31) | 0.01<br>0.03 | (TIV-9)<br>(TVI21) | 0.001<br>0.07 |

TABLE 18-continued

| | | | Fourth layer structure | | | | |
|---|---|---|---|---|---|---|---|
| | | | Content of coupler | Compound of any of the formulae (Ph-1), (Ph-2), (E-1) to(E-3), and (TS-I) to (TS-VII), Matal complex, and Ultraviolet absorber | | | |
| Sample No. | Coupler used | Dye colored after processing | in the left column mass % | Structure | Addition amount g/m$^2$ | Structure | Addition amount g/m$^2$ |
| 4002 | " | " | 23.0 | (TIII-15) | 0.01 | (TIV-9) | 0.001 |
| | | | | (TI-31) | 0.03 | (TVI21) | 0.07 |
| 4003 | " | " | 16.9 | (TIII-15) | 0.01 | (TIV-9) | 0.001 |
| | | | | (TI-31) | 0.03 | (TVI21) | 0.07 |
| 4101 | CP-(1) | Dye 1 | 32.2 | (TIII-15) | 0.01 | (TIV-9) | 0.001 |
| | | | | (TI-31) | 0.03 | (TVI21) | 0.07 |
| 4102 | CP-(2) | Dye 2 | 32.2 | (TIII-15) | 0.01 | (TIV-9) | 0.001 |
| | | | | (TI-31) | 0.03 | (TVI21) | 0.07 |
| 4103 | CP-(5) | Dye 3 | 32.2 | (TIII-15) | 0.01 | (TIV-9) | 0.001 |
| | | | | (TI-31) | 0.03 | (TVI21) | 0.07 |
| 4104 | CP-(1) | Dye 1 | 23.0 | (TIII-15) | 0.01 | (TIV-9) | 0.001 |
| | | | | (TI-31) | 0.03 | (TVI21) | 0.07 |
| 4105 | CP-(5) | Dye 3 | 23.0 | (TIII-15) | 0.01 | (TIV-9) | 0.001 |
| | | | | (TI-31) | 0.03 | (TVI21) | 0.07 |
| 4106 | CP-(1) | Dye 1 | 16.9 | (TIII-15) | 0.01 | (TIV-9) | 0.001 |
| | | | | (TI-31) | 0.03 | (TVI21) | 0.07 |
| 4107 | CP-(5) | Dye 3 | 16.9 | (TIII-15) | 0.01 | (TIV-9) | 0.001 |
| | | | | (TI-31) | 0.03 | (TVI21) | 0.07 |
| 4108 | CP-(1) | Dye 1 | 32.2 | none | — | none | — |
| 4109 | CP-(5) | Dye 3 | 32.2 | none | — | none | — |
| 4110 | CP-(1) | Dye 1 | 32.2 | (TII-29) | 0.08 | (TIV-9) | 0.001 |
| | | | | (TIII-15) | 0.01 | (TVI-21) | 0.07 |
| | | | | (TI-31) | 0.03 | | |
| 4111 | " | " | " | (TII-30) | 0.08 | (TIV-9) | 0.001 |
| | | | | (TI-31) | 0.03 | (TVI-21) | 0.07 |
| 4112 | " | " | " | (TII-16) | 0.08 | (TIV-9) | 0.001 |
| | | | | (TI-31) | 0.03 | (TVI-21) | 0.07 |
| 4113 | " | " | " | (TII-29) | 0.20 | — | — |
| 4114 | " | " | " | (A-22) | 0.25 | — | — |
| 4115 | " | " | " | (A-102) | 0.25 | — | — |
| 4116 | " | " | " | (TVI-2) | 0.20 | — | — |
| 4117 | " | " | " | (B-17) | 0.20 | — | — |
| 4118 | " | " | " | (TII-29) | 0.08 | (TIV-9) | 0.001 |
| | | | | (TIII-15) | 0.01 | (TVI-21) | 0.07 |
| | | | | (TI-31) | 0.03 | (A-22) | 0.04 |
| 4119 | " | " | " | (TII-29) | 0.08 | (TIV-9) | 0.001 |
| | | | | (TIII-15) | 0.01 | (TVI-21) | 0.07 |
| | | | | (TI-31) | 0.03 | (A-22) | 0.04 |
| 4120 | " | " | " | (TII-29) | 0.08 | (TIV-9) | 0.001 |
| | | | | (TIII-15) | 0.01 | (TVI-21) | 0.07 |
| | | | | (TI-31) | 0.03 | (A-102) | 0.04 |
| 4121 | " | " | " | (TII-29) | 0.08 | (TIV-9) | 0.001 |
| | | | | (TIII-15) | 0.01 | (TVI-21) | 0.07 |
| | | | | (TI-31) | 0.03 | (TVI-2) | 0.04 |
| 4122 | " | " | " | (TII-29) | 0.08 | (TIV-9) | 0.001 |
| | | | | (TIII-15) | 0.01 | (TVI-21) | 0.07 |
| | | | | (TI-31) | 0.03 | (B-17) | 0.04 |
| 4123 | " | " | " | (TII-29) | 0.08 | (TIV-9) | 0.001 |
| | | | | (TIII-15) | 0.01 | (TVI-21) | 0.07 |
| | | | | (TI-31) | 0.03 | (UV-B) | 0.05 |
| 4124 | " | " | " | (TII-29) | 0.08 | (TIV-9) | 0.001 |
| | | | | (TIII-15) | 0.01 | (TVI-21) | 0.07 |
| | | | | (TI-31) | 0.03 | (TVIII-3) | 0.03 |

Processings A and B

Processings A and B were conducted in the same manner as Processings A and B in Example 2, respectively, except that the above Sample 4001 was used.

On the Samples 4001 to 4003 and 4101 to 4124, the following evaluations were made after the light-sensitive materials prepared by coating were stored for 14 days under a 25° C.-55% RH condition.

Gradation exposure providing gray by the same Processing B as in Example 2 was given to each Sample by use of the same exposure device as used in Example 2, and after a 5-second lapse from the end of the exposure the color development processing of each Sample was carried out according to any of the Processing A or Processing B described above.

(Evaluation of Color Reproducibility)

Cyan gradation images were produced by giving gradation-wise R exposure to each Sample in accordance with the foregoing exposure method and subjecting the exposed Sample to either the Processing A or the Processing B. From the results of reflection spectrum measurement at the density of 1.0 in the cyan-color formed area, color reproducibility was rated as excellent "○" (particularly excellent: "◎") or being somewhat inferior but still excellent "Δ" by sensory evaluation when undesired absorption corresponding to magenta or yellow in the wavelength range of 550 nm to 400 nm was regarded as small, while it was rated as being apparently poor "x" when undesired absorption corresponding to magenta or yellow in the wavelength range of 550 nm to 400 nm was large. All Samples according to the present invention had the maximum developed-color densities not lower than 2.0.

(Evaluation of Light Fastness)

The image samples were exposed for 14 days to a xenon light ($10^5$ lux of xenon light irradiator) via an UV protection filter with a light transmittance of 50% at 370 nm and a heat wave protection filter. The light fastness was evaluated by a relative residual rate (%) after the exposure at the cyan initial density of 1.0.

(Evaluation of White-Background Preservability)

Rapid processing suitability of each Sample was evaluated by white-background preservability of the image obtained through the Processing B. The white-background preservability was estimated as follows: Each sample after processing was stored for 21 days at 60° C. and 70% RH, and examined for an increment of cyan density between before and after the storage. This increment was denoted by ΔD. When ΔD values were smaller than 0.05, it was judged as being within the desirable range of sensory evaluation.

Results thus obtained are shown in Table 19.

Additionally, the results of color reproducibility and light fastness are those of evaluations made on the Samples having undergone the development processing by the Processing B.

TABLE 19

| Sample No. | Color reproducibility | Light fastness (residual rate %) | White-background preservability (ΔD) |
|---|---|---|---|
| 4001 | X | 69 | 0.02 |
| 4002 | Δ | 71 | 0.04 |
| 4003 | ○ | 74 | 0.09 |
| 4101 | ◎ | 81 | 0.02 |
| 4102 | ◎ | 80 | 0.02 |
| 4103 | ◎ | 84 | 0.02 |
| 4104 | ◎ | 80 | 0.03 |
| 4105 | ◎ | 82 | 0.04 |
| 4106 | ◎ | 77 | 0.08 |
| 4107 | ◎ | 78 | 0.07 |
| 4108 | ◎ | 46 | 0.13 |
| 4109 | ◎ | 52 | 0.10 |
| 4110 | ◎ | 86 | 0.02 |
| 4111 | ◎ | 87 | 0.02 |
| 4112 | ◎ | 87 | 0.02 |
| 4113 | ◎ | 84 | 0.04 |
| 4114 | ◎ | 87 | 0.04 |
| 4115 | ◎ | 83 | 0.04 |
| 4116 | ◎ | 86 | 0.04 |
| 4117 | ◎ | 84 | 0.02 |
| 4118 | ◎ | 90 | 0.02 |
| 4119 | ◎ | 91 | 0.02 |
| 4120 | ◎ | 90 | 0.02 |
| 4121 | ◎ | 90 | 0.02 |
| 4122 | ◎ | 91 | 0.02 |
| 4123 | ◎ | 89 | 0.02 |
| 4124 | ◎ | 91 | 0.02 |

Additionally, the solubility to ethyl acetate of the azomethine dye obtained from a coupler (ExC-2) was 0.5 mol/L or above.

As can be seen from Table 19, according to the structure of the present invention, color prints can be obtained which are excellent in color reproducibility, light fastness and white-background preservability even upon ultra-rapid processing. More specifically, Samples 4101 to 4105 and 4110 to 4124 each having the red-sensitive layer wherein the coupler forming the azomethine dye as defined in the present invention was contained and the coupler content in lipophilic components was 18 mass % or above, were excellent in all of the foregoing properties. By contrast, Samples 4001 to 4003 using couplers for comparison were low in the remaining rate of color image after xenon exposure, and failed to satisfy both color reproducibility and white-background preservability at the same time. On the other hand, Samples in which the coupler content in the total oil-soluble components was lower than 18 mass % though the coupler forming the azomethine dye as defined in the present invention was used (Samples 4106 and 4107), and Samples each using none of the compound selected from the group consisting of the compounds represented by any of formulae (Ph-1), (Ph-2), (E-1) to (E-3) and (TS-I) to (TS-VII) according to the present invention, metal complexes, and ultraviolet absorbents, in the same layer as the coupler for forming the azomethine dye as defined in the present invention was contained (Samples 4108 and 4109), each failed to satisfy both light fastness and white-background preservability.

Example 16

Light-sensitive material 4301 was prepared in the same manner as in Example 15, except that the layer structure was changed to the following. The numbers show coating amounts ($g/m^2$). In the case of the silver halide emulsion, the coating amount is in terms of silver.

| | |
|---|---|
| First layer (Blue-sensitive emulsion layer) | |
| Emulsion (a 5:5 mixture of BH-1 and BL-1 (mol ratio of silver)) | 0.13 |
| Gelatin | 1.32 |
| Yellow coupler (Ex-Y) | 0.34 |
| Color-image stabilizer (Cpd-1) | 0.01 |
| Color-image stabilizer (TI-6) | 0.01 |
| Color-image stabilizer (B-17) | 0.08 |
| Color-image stabilizer (TII-29) | 0.01 |
| Color-image stabilizer (TVI-21) | 0.02 |
| Color-image stabilizer (A-22) | 0.15 |
| Color-image stabilizer (Cpd-19) | 0.01 |
| Color-image stabilizer (TI-31) | 0.15 |
| Additive (ExC-1) | 0.001 |
| Color-image stabilizer (UV-A) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (TIII-15) | 0.006 |
| Solvent (Solv-1) | 0.03 |
| Solvent (Solv-2) | 0.03 |
| Solvent (Solv-5) | 0.04 |
| Third layer (Green-sensitive emulsion layer) | |
| Emulsion (a 1:3 mixture of GH-1 and GL-1 (mol ratio of silver)) | 0.11 |
| Gelatin | 0.70 |
| Magenta coupler (Ex-M) | 0.12 |
| Ultraviolet absorber (UV-A) | 0.03 |
| Color-image stabilizer (TI-6) | 0.01 |
| Color-image stabilizer (TIII-15) | 0.005 |
| Color-image stabilizer (B-17) | 0.01 |
| Color-image stabilizer (TI-31) | 0.01 |
| Color-image stabilizer (TIV-9) | 0.005 |

-continued

| | |
|---|---|
| Color-image stabilizer (Cpd-11) | 0.0001 |
| Color-image stabilizer (A-22) | 0.01 |
| Solvent (Solv-3) | 0.03 |
| Solvent (Solv-4) | 0.06 |
| Solvent (Solv-6) | 0.03 |
| Solvent (Solv-9) | 0.08 |
| Fourth layer (Color-mixing-inhibiting layer) | |
| Gelatin | 0.39 |
| Color-mixing inhibitor (Cpd-4) | 0.03 |
| Color-mixing inhibitor (Cpd-12) | 0.01 |
| Color-image stabilizer (Cpd-3) | 0.01 |
| Color-image stabilizer (Cpd-5) | 0.006 |
| Color-image stabilizer (Cpd-6) | 0.05 |
| Color-image stabilizer (UV-A) | 0.03 |
| Color-image stabilizer (TIII-15) | 0.006 |
| Solvent (Solv-1) | 0.03 |
| Solvent (Solv-2) | 0.03 |
| Solvent (Solv-5) | 0.04 |
| Fifth layer (Red-sensitive emulsion layer) | |
| Emulsion (a 4:6 mixture of RH-1 and RL-1 (mol ratio of silver)) | 0.09 |
| Gelatin | 1.04 |
| Cyan coupler (ExC-1) | 0.11 |
| Cyan coupler (ExC-2) | 0.05 |
| Color-image stabilizer (Cpd-1) | 0.03 |
| Color-image stabilizer (TIII-15) | 0.01 |
| Color-image stabilizer (TI-31) | 0.04 |
| Color-image stabilizer (TIV-9) | 0.001 |
| Color-image stabilizer (Cpd-14) | 0.001 |
| Color-image stabilizer (Cpd-15) | 0.05 |
| Solvent (Solv-5) | 0.20 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.44 |
| Additive (Cpd-20) | 0.015 |
| Liquid paraffin | 0.01 |
| Surfactant (Cpd-13) | 0.01 |

Light-sensitive materials were prepared in the same manner as described above, except that the cyan coupler (ExC-1) in the fifth layer of the light-sensitive material 4301 was replaced with Exemplified Compound CP-(1) or CP-(5), and that the same additives as added to Samples 4101, 4103 and 4108 to 4124 were used, and the same evaluations as in Example 15 were performed on the materials thus prepared. As a result, it was ascertained that these materials exhibited the effects of the present invention similar to the case of Example 15.

Example 17

The silver halide emulsions and the coating solutions prepared in the same manners as in Example 2 were used for light-sensitive layers.

(Layer Constitution)

A sample was prepared so as to have the same layer structure as Sample 001 of Example 2, except that the third layer, the fourth layer and the fifth layer were changed as mentioned below.

| | |
|---|---|
| Third layer (Color-mixing-inhibiting layer) | |
| Gelatin | 0.31 |
| Color-mixing inhibitor (Cpd-4) | 0.024 |

-continued

| | |
|---|---|
| Color-image stabilizer (Cpd-5) | 0.004 |
| Color-image stabilizer (Cpd-6) | 0.020 |
| Solvent (Solv-5) | 0.028 |
| Fourth layer (Red-sensitive emulsion layer) | |
| Emulsion (a 4:6 mixture of RH-1 and RL-1 (mol ratio of silver)) | 0.09 |
| Gelatin | 0.77 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.15 |
| Fifth layer (Color-mixing-inhibiting layer) | |
| Gelatin | 0.39 |
| Color-mixing inhibitor (Cpd-4) | 0.030 |
| Color-image stabilizer (Cpd-5) | 0.005 |
| Color-image stabilizer (Cpd-6) | 0.025 |
| Solvent (Solv-5) | 0.035 |

The thus-prepared sample is referred to as Sample 5001.

Next, with respect to the red-sensitive layer of Sample 5001, the amount of solvent (Solv-5) was increased as shown below, and the amount of gelatin was increased in proportion to the total amount of increased lipophilic components. Sample 5002 and Sample 5003 were prepared in the same manner as Sample 5001, except for the above differences in the amount of solvent (Solv-5) and the amount of gelatin in the red-sensitive layer.

| | |
|---|---|
| Fourth layer (Red-sensitive emulsion layer of Sample 5002) | |
| Emulsion (a 4:6 mixture of RH-1 and RL-1 (mol ratio of silver)) | 0.09 |
| Gelatin | 1.00 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.30 |
| Fourth layer (Red-sensitive emulsion layer of Sample 5003) | |
| Emulsion (a 4:6 mixture of RH-1 and RL-1 (mol ratio of silver)) | 0.09 |
| Gelatin | 1.26 |
| Cyan coupler (ExC-1) | 0.16 |
| Cyan coupler (ExC-2) | 0.015 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.05 |
| Color-image stabilizer (Cpd-16) | 0.08 |
| Color-image stabilizer (Cpd-17) | 0.07 |
| Solvent (Solv-5) | 0.50 |

Samples 5101 to 5104, Samples 5109 to 5112 and Samples 5114 to 5120 were prepared so as to have the same structure as Sample 5001, except that the coupler (ExC-1) in the red-sensitive emulsion layer was replaced with an equimolecular amount of Exemplified Compound CP-(1), CP-(2) or CP-(5), respectively, and the color-mixing inhibitor (Cpd-4) in the third layer and the fifth layer was replaced with an equimolecular amount of compound represented by formula (CMP) according to the present invention as shown in Table 20.

In addition, Samples 5105, 5106 and 5113 were prepared by making the same changes as mentioned above to Sample 5002; and Samples 5107 and 5108 were prepared by making the same changes as mentioned above to Sample 5003.

Additionally, the proportion of the coupler to the total oil-soluble components was adjusted to the coupler content shown in Table 20 by increasing or decreasing the addition amount of solvent (Solv-5).

The color development described below was given to the thus-prepared Samples 5001 to 5003 and 5101 to 5120, and cyan images were obtained. As results of qualitative analyses of structures of the dyes extracted from the cyan images, respectively, by high-performance liquid chromatography, the dyes formed respectively from the couplers used have proved to be those shown in Table 20.

TABLE 20

| | Fourth layer structure | | | |
|---|---|---|---|---|
| Sample No. | Coupler used | Colored dye after processing | Content of coupler in the left column (mass %) | Compound in the third and fifth layers |
| 5001 | ExC-1 | Dye 4 | 32.2 | (Cpd-4) |
| 5002 | " | " | 23.0 | " |
| 5003 | " | " | 16.9 | " |
| 5101 | CP-(1) | Dye 1 | 32.2 | " |
| 5102 | CP-(1) | Dye 1 | 32.2 | (I-1) |
| 5103 | CP-(2) | Dye 2 | 32.2 | " |
| 5104 | CP-(5) | Dye 3 | 32.2 | " |
| 5105 | CP-(1) | Dye 1 | 23.0 | " |
| 5106 | CP-(5) | Dye 3 | 23.0 | " |
| 5107 | CP-(1) | Dye 1 | 16.9 | " |
| 5108 | CP-(5) | Dye 3 | 16.9 | " |
| 5109 | CP-(1) | Dye 1 | 32.2 | (I-29) |
| 5110 | " | " | " | (I-10) |
| 5111 | " | " | " | (I-33) |
| 5112 | " | " | " | (I-34) |
| 5113 | " | " | 23.0 | " |
| 5114 | CP-(5) | Dye 3 | 32.2 | (I-1) |
| 5115 | " | " | " | (I-10) |
| 5116 | " | " | " | (I-33) |
| 5117 | " | " | " | (I-34) |
| 5118 | " | " | " | A mixture in equimoler of (I-1) and (I-34) |
| 5119 | " | " | " | A mixture in equimoler of (I-33) and (I-34) |
| 5120 | " | " | " | A mixture in equimoler of (Cpd-4) and (I-34) |

Processings A and B

Processings A and B were conducted in the same manner as Processings A and B in Example 2, respectively, except that the above Sample 5001 was used.

On the Samples 5001 to 5003 and 5101 to 5120, the following evaluations were made after the light-sensitive materials prepared by coating were stored for 14 days under a 25° C.-55% RH condition.

Gradation exposure providing gray by the Processing B as in Example 2 was given to each Sample by use of the same exposure device as used in Example 2, and after a 5-second lapse from the end of the exposure the color development processing of each Sample was carried out according to the Processing A or the Processing B.

(Evaluation of Color Reproducibility)

Cyan gradation images were produced by giving gradation-wise R exposure to each Sample in accordance with the foregoing exposure method and subjecting the exposed Sample to the Processing A or Processing B. From the results of reflection spectrum measurement at the density of 1.0 in the cyan-color formed area, color reproducibility was rated as excellent "○" (particularly excellent: "◎") or being somewhat inferior but still excellent "Δ" by sensory evaluation when undesired absorption corresponding to magenta or yellow in the wavelength range of 550 nm to 400 nm was regarded as small, while it was rated as being apparently poor "x" when undesired absorption corresponding to magenta or yellow in the wavelength range of 550 nm to 400 nm was large. All Samples according to the present invention had the maximum developed-color densities not lower than 2.0.

(Evaluation of Light Fastness)

The image samples were exposed for 14 days to a xenon light ($10^5$ lux of xenon light irradiator) via an UV protection filter with a light transmittance of 50% at 370 nm and a heat wave protection filter. The light fastness was evaluated by a relative residual rate (%) after the exposure at the cyan initial density of 1.0.

(Evaluation of White-Background Preservability)

Rapid processing suitability of each Sample was evaluated by white-background preservability of the image obtained through the Processing B. The white-background preservability was estimated as follows: Each sample after processing was stored for 21 days at 60° C. and 70% RH, and examined for an increment of cyan density between before and after the storage. This increment was denoted by ΔD. When ΔD values were smaller than 0.05, it was judged as being within the desirable range of sensory evaluation.

Additionally, the results of color reproducibility and light fastness are those of evaluations made on the Samples having undergone the Processing B.

Results thus obtained are shown in Table 21.

TABLE 21

| Sample No. | Color reproducibility | Light fastness (residual rate %) | White-background preservability (ΔD) |
|---|---|---|---|
| 5001 | X | 64 | 0.02 |
| 5002 | Δ | 66 | 0.04 |
| 5003 | ○ | 69 | 0.09 |
| 5101 | ◎ | 75 | 0.02 |
| 5102 | ◎ | 87 | 0.02 |
| 5103 | ◎ | 85 | 0.02 |
| 5104 | ◎ | 90 | 0.02 |
| 5105 | ◎ | 85 | 0.03 |
| 5106 | ◎ | 89 | 0.03 |
| 5107 | ◎ | 74 | 0.08 |
| 5108 | ◎ | 76 | 0.07 |
| 5109 | ◎ | 87 | 0.03 |
| 5110 | ◎ | 88 | 0.03 |
| 5111 | ◎ | 91 | 0.03 |
| 5112 | ◎ | 93 | 0.02 |
| 5113 | ◎ | 89 | 0.02 |
| 5114 | ◎ | 90 | 0.03 |
| 5115 | ◎ | 92 | 0.03 |
| 5116 | ◎ | 93 | 0.02 |
| 5117 | ◎ | 93 | 0.02 |
| 5118 | ◎ | 92 | 0.02 |
| 5119 | ◎ | 92 | 0.02 |
| 5120 | ◎ | 90 | 0.03 |

Additionally, the solubility to ethyl acetate of the azomethine dye obtained from a coupler (ExC-2) was 0.5 mol/L or above.

As can be seen from Table 21, according to the structure of the present invention, color prints can be obtained which are excellent in color reproducibility, light fastness and white-background preservability even upon ultra-rapid processing. More specifically, Samples 5102 to 5106 and 5109 to 5120 each having the red-sensitive layer wherein the coupler according to the present invention for forming the azomethine dye having solubility to ethyl acetate in the range of $1\times10^{-8}$ mol/L to $5\times10^{-3}$ mol/L was contained and the coupler content in lipophilic components was 18 mass % or more, each were excellent in all of the foregoing properties. By contrast, Samples 5001 to 5003 using couplers for comparison were low in the remaining rate of color image after xenon exposure, and failed to satisfy both color reproducibility and white-background preservability at the same time. On the other hand, though the coupler for forming the azomethine dye having solubility to ethyl acetate in the range of $1\times10^{-8}$ mol/L to $5\times10^{-3}$ mol/L as specified in the present invention was used, Samples in which the coupler content in the total oil-soluble components was lower than 18 mass % (Samples 5107 and 5108), and Sample not using any of compound represented by formula (CMP) (Sample 5101), each failed to satisfy both light fastness and white-background preservability.

INDUSTRIAL APPLICABILITY

The silver halide color photographic light-sensitive material and image-forming method, each according to the present invention, are preferable as a photosensitive material and an image-forming method, each of which is capable of producing photographs, especially color prints, which are excellent in color reproducibility and image preservability against light and heat even in the case of rapid processing.

Further, the silver halide color photographic light-sensitive material and image-forming method, each according to the present invention, are preferable as a photosensitive material and an image-forming method, each of which is capable of providing images with high developed color densities and excellent image preservability even in the case of ultra-rapid processing.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2004-244296 filed in Japan on Aug. 24, 2004, Patent Application No. 2004-286333 filed in Japan on Sep. 30, 2004, Patent Application No. 2004-286402 filed in Japan on Sep. 30, 2004, Patent Application No. 2004-286447 filed in Japan on Sep. 30, 2004, Patent Application No. 2004-286477 filed in Japan on Sep. 30, 2004, Patent Application No. 2004-286554 filed in Japan on Sep. 30, 2004, and Patent Application No. 2004-286581 filed in Japan on Sep. 30, 2004, each of which is entirely herein incorporated by reference.

The invention claimed is:

1. A silver halide color photographic light-sensitive material having, on a support, at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer, and at least one light-insensitive hydrophilic colloid layer, characterized in that:

at least one of the dye-forming couplers is a dye-forming coupler represented by formula (CP-III) that forms an azomethine dye having a solubility of $1\times10^{-8}$ mol/L to $5\times10^{-3}$ mol/L in ethyl acetate by reaction with an oxidized aromatic primary amine compound:

Formula (C P-III)

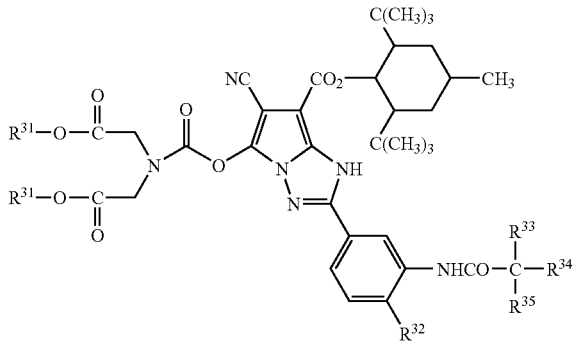

wherein $R^{31}$ represents an alkyl group; $R^{32}$ represents an alkoxy group; $R^{33}$, $R^{34}$ and $R^{35}$ each represent a hydrogen atom or an alkyl group; when $R^{33}$ an $R^{34}$ are each an alkyl group, they may combine with each other to form a 3- to 6-membered ring.

2. The silver halide color photographic light-sensitive material according to claim 1, characterized by containing the dye-forming coupler in an amount of 18 mass % to 100 mass % based on the total lipophilic components in a layer containing the dye-forming coupler.

3. The silver halide color photographic light-sensitive material according to claim 1, which satisfies at least one of the following conditions a) and b):

a) any emulsion layer, other than the light-sensitive silver halide emulsion layer present in the position most distant from the support, of at least the three dye-forming-coupler-containing light-sensitive silver halide emulsion layers, contains the dye-forming coupler that forms the azomethine dye; and b) at least one of the light-insensitive hydrophilic colloid layers is a dye-forming-coupler-containing light-insensitive color-forming layer and the light-insensitive color-forming layer is adjacent to at least one dye-forming-coupler-containing light-sensitive silver halide emulsion layer.

4. The silver halide color photographic light-sensitive material according to claim 1, characterized in that the support is a reflective support, the dye-forming coupler that forms the azomethine dye is contained in an amount of 18 mass % or more but less than 100 mass % based on the total lipophilic components in a layer containing the dye-forming coupler, and as the lipophilic component, at least one compound represented by any of formulae [S-I], [S-II], [S-III], [S-IV] and [S-V] is contained;

Formula [S-I]

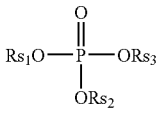

wherein $Rs_1$, $Rs_2$ and $Rs_3$ each independently represent an alkyl group, a cycloalkyl group, an alkenyl group or an aryl group, and each of these groups may be substituted; and the total number of carbon atoms contained in groups represented by $Rs_1$, $Rs_2$ and $Rs_3$ is from 12 to 60; at least one of $Rs_1$, $Rs_2$ and $Rs_3$ represents a linking group, to form a dimmer or a polymer whose order is higher than said dimer:

$Rs_4$-(COO$Rs_5$)sm Formula [S II]

wherein $Rs_4$ represents a linking group having no aromatic group; $Rs_5$ represents an alkyl, cycloalkyl, alkenyl or alkynyl group having 20 or less carbon atoms; sm represents an integer from 2 or more and 5 or less; and when sm is 2 or more, plural —COO$Rs_5$s may be the same or different from each other;

$Rs_6$-(OCO$Rs_7$)sn Formula [S-III]

wherein $Rs_6$ represents a linking group; $Rs_7$ represents an alkyl, cycloalkyl, alkenyl or alkynyl group having 20 or less carbon atoms; sn represents an integer from 2 or more and 5 or less; and when sn is 2 or more, plural —OCO$Rs_7$s may be the same or different from each other;

Formula [S-IV]

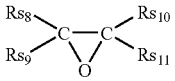

wherein $Rs_8$, $Rs_9$, $Rs_{10}$ and $Rs_{11}$ each independently represent a hydrogen atom, an aliphatic group, an aliphatic oxycarbonyl group, an aromatic oxycarbonyl group or a carbamoyl group, in which the total number of carbon atoms contained in $Rs_8$, $Rs_9$, $Rs_{10}$ and $Rs_{11}$ is 8 to 60;

and $Rs_8$ and $Rs_9$, $Rs_8$ and $Rs_{10}$, or $Rs_{10}$ and $Rs_{11}$ may bond with each other, to form a five- to seven-membered ring, respectively; with the proviso that all of $Rs_8$, $Rs_9$, $Rs_{10}$ and $Rs_{11}$ simultaneously do not represent a hydrogen atom;

$RS_{12}$-(COO$Rs_{13}$)sp Formula [S-V]

wherein $Rs_{12}$ represents an aromatic linking group; $Rs_{13}$ represents an alkyl, cycloalkyl, alkenyl or alkynyl group having 20 or less carbon atoms; sp represents an integer from 3 or more and 5 or less; and when sp is 2 or more, plural —COO$Rs_{13}$s may be the same or different from each other.

5. The silver halide color photographic light-sensitive material according to claim 1, characterized in that the support is a reflective support, the dye-forming coupler that forms the azomethine dye is contained in an amount of 18 mass % or more but less than 100 mass % based on the total lipophilic components in a layer containing the dye-forming coupler, and as the lipophilic component, at least one compound represented by any of formulae [ST-I], [ST-II], [ST-III], [ST-IV] and [ST-V] is contained;

Formula [ST-I]

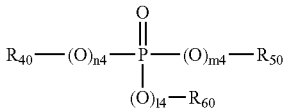

wherein $R_{40}$, $R_{50}$ and $R_{60}$ each independently represent an aliphatic group or an aromatic group; and l4, m4 and n4 each independently represent 0 or 1, with the proviso that l4, m4 and n4 simultaneously are not 1;

$R_A$—NH—$SO_2$—$R_8$ Formula [ST-II]

wherein $R_A$ and $R_B$ each independently represent a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic oxy group, or —N($R_C$)($R_D$), in which $R_c$ and $R_D$ each independently represent a hydrogen atom, an alkyl group or an aryl group; and $R_A$ and $R_B$ each may be the same or different from each other;

HO-(J')COOY Formula [ST-III]

wherein J' represents a divalent organic group; and Y represents an alkyl group, a cycloalkyl group, an aryl group, an alkenyl group, an alkynyl group, a cycloalkenyl group or a heterocyclic group;

$R_{51}$—O-($CH_2$-$J_5$-$CH_2O$)$_{15}$$R_{52}$ Formula [ST-IV]

wherein $R_{51}$ and $R_{52}$ each independently represent an aliphatic group or —$COR_{53}$, in which $R_{53}$ represents an aliphatic group; $J_5$ represents a divalent organic group or simply a connecting bond; and 15 represents an integer from 0 to 6; and $R_{54}$—$Y_{54}$ Formula [ST-V]

wherein $R_{54}$ represents a hydrophobic group having the total number of carbon atoms of 10 or more; and $Y_{54}$ represents a monovalent organic group containing an alcoholic hydroxyl group.

6. The silver halide color photographic light-sensitive material according to claim 1, characterized in that the support is a reflective support, the dye-forming coupler that forms the azomethine dye is contained in an amount of 18 mass % or more but less than 100 mass % based on the total lipophilic components in a layer containing the dye-forming coupler, and as the lipophilic component, at least one polymer soluble in an organic solvent is contained.

7. The silver halide color photographic light-sensitive material according to claim 1, characterized in that the dye-forming coupler that forms the azomethine dye and at least one compound selected from a group consisting of compounds represented by any of formulae (Ph-1), (Ph-2), (E-1) to (E-3) and (TS-I) to (TS-VII), metal complexes, and ultraviolet absorbents are contained in at least one light-sensitive silver halide emulsion layer containing the dye-forming coupler, and a proportion of the dye-forming coupler to the total lipophilic components in the emulsion layer containing the dye-forming coupler is from ±8 mass % to 99 mass %;

Formula Ph-1

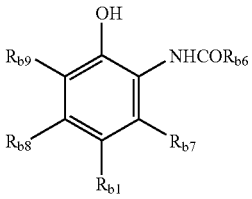

Formula Ph-2

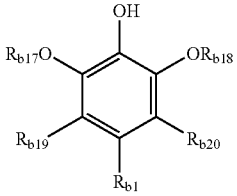

wherein, in formula [Ph-1] and [Ph-2], $R_{b1}$ represents an aryl group, an aromatic group, a carbamoyl group, an acylamino group, a carbonyl group or a sulfonyl group; $R_{b6}$ represents an aliphatic group, an aryl group, an amino group or an acyl group; $R_{b7}$ to $R_{b9}$, $R_{b19}$ and $R_{b20}$ each independently represent a hydrogen atom, a halogen atom, a hydroxyl group, an aliphatic group, an aryl group, a heterocyclic group, an alkyloxy group, an aryloxy group, a heterocyclicoxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group or an arylthio group; and $R_{b17}$ and $R_{b18}$ each independently represent an aliphatic group or an aryl group:

Formula (E-1)

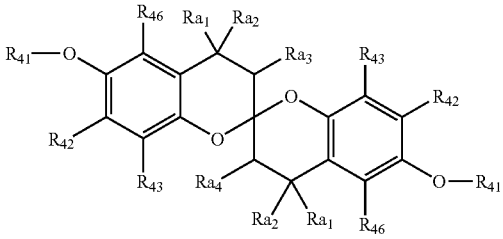

-continued

Formula (E-2)

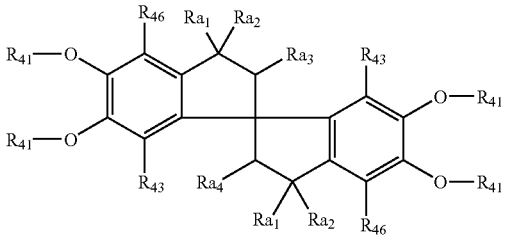

Formula (E-3)

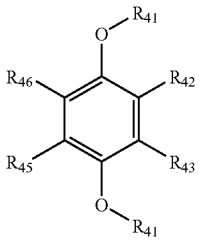

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si ($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and Ra1 to Ra4 each independently represent a hydrogen atom, or an aliphatic group:

Formula (TS-I)

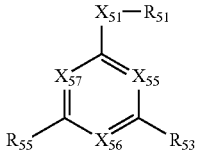

Formula (TS-II)

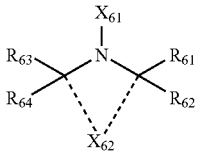

Formula (TS-III)

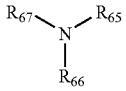

Formula (TS-IV)

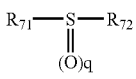

Formula (TS-V)

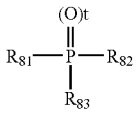

-continued

Formula (TS-VI)

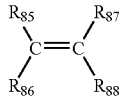

Formula (TS-VII)

$R_{91}$—$Y_{91}$ wherein, in formula (TS-I), $R_{51}$ represents a hydrogen atom, a aliphatic group, a aryl group, a hetorocyclic group, a acyl group, a aliphatic oxycarbonyl group, a aryloxycarbonyl group, an aliphatic sulfonyl group, an aryl sulfonyl group, a phosphoryl group, or —Si($R_{58}$)($R_{59}$)($R_{60}$), in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or —C($R_{52}$)═; $X_{56}$ represents —N═ or —C($R_{54}$); $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and $R_{53}$, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total number of carbon atoms of the compound represented by formula (TS-I) is 10 or more; and the compound represented by formula (TS-I) is neither identical to the compound represented by any one of formulae (Ph-1) to (Ph-2) nor the compound represented by any one of formulae (E-1) to (E-3);

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, carbamoyl group, a hydroxy group, or an oxy radical group; $X_{62}$ represents a group of non-metal atoms necessary to form a 5- to 7-membered ring; and the total number of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and both $R_{65}$ and $R_{66}$ are not hydrogen atoms at the same time;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and all of $R_{85}$, $R_{86}$, $R_{87}$, and $R_{88}$ cannot simultaneously represent a hydrogen atom; any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and wherein, in formula (TS-VII), $R_{91}$ represents an hydrophobic group having total carbon atoms of 10 or more; and Y91 represents a monovalent organic group containing an alcoholic hydroxyl group.

8. The silver halide color photographic light-sensitive material according to claim 1, characterized by containing the dye-forming coupler in an amount of 18 mass % or more but 100 mass % or less based on the total lipophilic components in a layer containing the dye-forming coupler, and containing at least one compound represented by formula (CMP) in at least one of the light-insensitive hydrophilic colloid layers;

Formula (CMP)

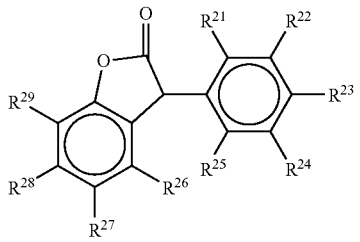

wherein, in formula (CMP), $R^{21}$ to $R^{29}$ may be the same or different, and each represents a hydrogen atom or a substituent, provided that at least one of $R^{21}$ to $R^{29}$ is a substituent, or any of $R_{21}$ to $R^{29}$ may be a divalent group, to form a dimer or a multimer, or a homopolymer or copolymer by binding to a polymer chain.

9. The silver halide color photographic light-sensitive material according to claim 1, characterized in that the azomethine dye has a solubility of $1\times10^{-8}$ mol/L to $7\times10^{-4}$ mol/L in ethyl acetate.

10. The silver halide color photographic light-sensitive material according to claim 1, characterized in that the azomethine dye has its absorption maximum wavelength in a range of 570 nm to 700 nm.

11. The silver halide color photographic light-sensitive material according to claim 1, characterized in that a silver halide emulsion layer containing at least one dye-forming coupler that forms the azomethine dye has a coating amount of total dye-forming couplers in a range of 0.18 mmol/$m^2$ to 0.28 mmol/$m^2$ and a maximum optical reflection density of 2.0 or above at a maximum absorption wavelength of the dyes after dye formation.

12. The silver halide color photographic light-sensitive material according to claim 1, characterized by containing at least one dye-forming coupler represented by formula (I);

Formula (I)

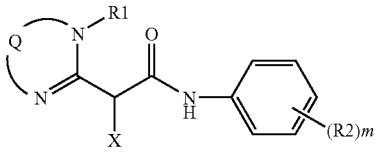

wherein Q represents a group of non-metal atoms that forms a 5- to 7-membered ring in combination with the —N═C—N(R1)—; R1 represents a substituent; R2 represents a substituent; m represents an integer of 0 or more and 5 or less; when m is 2 or more, R2s may be the same or different, and they may combine together to form a ring; and X represents a hydrogen atom, or a group capable of being split-off upon a coupling reaction with an oxidized product of a developing agent.

13. The silver halide color photographic light-sensitive material according to claim 1, characterized in that the oxidized product of the aromatic primary amine compound is an oxidation product of 4-amino-3-methyl-N-ethyl-N-(β-methanesulfonamidoethyl)aniline.

14. The silver halide color photographic light-sensitive material according to claim 1, characterized in that the dye-forming coupler that forms the azomethine dye is contained in an amount of 24 mass % to 80 mass % based on the total lipophilic components in a layer containing the dye-forming-coupler.

15. The silver halide color photographic light-sensitive material according to claim 3, characterized by having two or more light-insensitive hydrophilic colloid layers and meeting the following condition c):

c) that the two or more light-insensitive hydrophilic colloid layers are composed of a non-color-forming interlayer containing a color-mixing inhibitor and a non-color-forming interlayer containing substantially no color-mixing inhibitor, and the non-color-forming interlayer containing a color-mixing inhibitor is provided between and adjacent to the non-color-forming interlayer containing substantially no color-mixing inhibitor and a silver halide emulsion layer.

16. The silver halide color photographic light-sensitive material according to claim 3, characterized in that a total coating amount of hydrophilic colloids is 6.0 g/$m^2$ or below.

17. The silver halide color photographic light-sensitive material according to claim 3, characterized in that a total coating amount of silver is 0.45 g/$m^2$ or below.

18. The silver halide color photographic light-sensitive material according to claim 3, characterized by meeting both the conditions a) and b) as described in claim 3.

19. The silver halide color photographic light-sensitive material according to claim 3, characterized in that the dye-forming coupler that forms the azomethine dye is incorporated in a hydrophobic fine-particle dispersion of a layer containing the coupler in an amount of 18 mass % to 80 mass % based on total lipophilic components in the layer.

20. The silver halide color photographic light-sensitive material according to claim 6, characterized in that the polymer soluble in an organic solvent is contained in an amount of 5 mass % to 100 mass % based on the dye-forming coupler that forms the azomethine dye.

21. An image forming method, comprises exposing a silver halide color photographic light-sensitive material having, on a support, at least one yellow-dye-forming-coupler-containing light-sensitive silver halide emulsion layer, at least one magenta-dye-forming-coupler-containing light-sensitive silver halide emulsion layer, at least one cyan-dye-forming-coupler-containing light-sensitive silver halide emulsion layer and at least one light-insensitive hydrophilic colloid layer, and subjecting the exposed light-sensitive material to development-processing characterized in that:

at least one of the dye-forming couplers is a dye-forming coupler represented by formula (CP-III) that forms an azomethine dye having a solubility of $1\times10^{-8}$ mol/L to $5\times10^{-3}$ mol/L in ethyl acetate by reaction with an oxidized product of an aromatic primary amine compound:

Formula (C P-III)

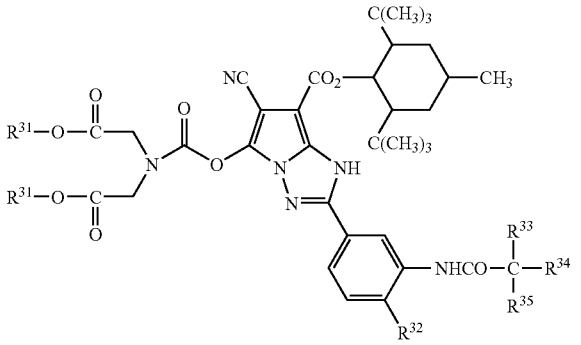

wherein $R^{31}$ represents an alkyl group; $R^{32}$ represents an alkoxy group; $R^{33}$, $R^{34}$ and $R_{35}$ each represent a hydrogen atom or an alkyl group; when $R^{33}$ an $R^{34}$ are each an alkyl group, they may combine with each other to form a 3- to 6-membered ring.

22. The image forming method according to claim 21, characterized in that the silver halide color photographic light-sensitive material contains the dye-forming coupler that forms the azomethine dye in an amount of 18 mass % to 100 mass % based on the total lipophilic components in a layer containing the dye-forming coupler.

23. The image forming method according to claim 21, characterized in that the silver halide color photographic light-sensitive material meets at least one of the following conditions that:

a) any emulsion layer, other than the light-sensitive silver halide emulsion layer present in the position most distant from the support, of at least three dye-forming-coupler-containing light-sensitive silver halide emulsion layers contains the dye-forming coupler that forms the azomethine dye; and b) at least one of the light-insensitive hydrophilic colloid layers is a dye-forming-coupler-containing light-insensitive color-forming layer and the light-insensitive color-forming layer is adjacent to at least one dye-forming-coupler-containing light-sensitive silver halide emulsion layer.

24. The image forming method according to claim 21, characterized in that the support is a reflective support, the silver halide color photographic light-sensitive material contains the dye-forming coupler that forms the azomethine dye in an amount of 18 mass % or more but less than 100 mass % based on the total lipophilic components in a layer containing the dye-forming coupler, and as the lipophilic component, at least one compound represented by any of the formulae [S-I], [S-II], [S-III], [S-IV] and [S-V] is contained;

Formula [S-I]

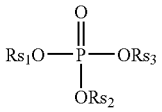

wherein $Rs_1$, $Rs_2$ and $Rs_3$ each independently represent an alkyl group, a cycloalkyl group, an alkenyl group or an aryl group, and each of these groups may be substituted; and the total number of carbon atoms contained in groups represented by $Rs_1$, $Rs_2$ and $Rs_3$ is from 12 to 60; at least one of $Rs_1$, $Rs_2$ and $Rs_3$ represents a linking group, to form a dimmer or a polymer whose order is higher than said dimer;

$Rs_4$—(COO$Rs_5$)sm Formula [S-II]

wherein $Rs_4$ represents a linking group having no aromatic group; $Rs_5$ represents an alkyl, cycloalkyl, alkenyl or alkynyl group having 20 or less carbon atoms; sm represents an integer from 2 or more and 5 or less; and when sm is 2 or more, plural —COO$Rs_5$s may be the same or different from each other;

$Rs_6$—(OCO$Rs_7$)sn Formula [S-III]

wherein $Rs_6$ represents a linking group; $Rs_7$ represents an alkyl, cycloalkyl, alkenyl or alkynyl group having 20 or less carbon atoms; sn represents an integer from 2 or more and 5 or less; and when sn is 2 or more, plural —OCO$Rs_7$s may be the same or different from each other;

Formula [S-IV]

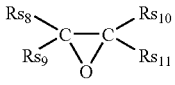

wherein $Rs_8$, $Rs_9$, $Rs_{10}$ and each independently represent a hydrogen atom, an aliphatic group, an aliphatic oxycarbonyl group, an aromatic oxycarbonyl group or a carbamoyl group, in which the total number of carbon atoms contained in Rs8, Rs9, Rs10 and Rs11 is 8 to 60; and Rs8 and Rs9, Rs8 and Rs10, or Rs10 and Rs11 may bond with each other, to form a five- to seven-membered ring, respectively; with the proviso that all of Rs8, Rs9, Rs10 and Rs11 simultaneously do not represent a hydrogen atom;

$Rs_{12}$—(COO$Rs_{13}$)sp Formula [S-V]

wherein $Rs_{12}$ represents an aromatic linking group; $Rs_{13}$ represents an alkyl, cycloalkyl, alkenyl or alkynyl group having 20 or less carbon atoms; sp represents an integer from 3 or more and 5 or less; and when sp is 2 or more, plural —COO$Rs_{13}$s may be the same or different from each other.

25. The image forming method according to claim 21, characterized in that the support is a reflective support, the silver halide color photographic light-sensitive material contains the dye-forming coupler that forms the azomethine dye in an amount of 18 mass % or more but less than 100 mass % based on the total lipophilic components in a layer containing the dye-forming coupler, and as the lipophilic component, at least one compound represented by any of the formulae [ST-I], [ST-II], [ST-III], [ST-IV] and [ST-V] is contained;

Formula [ST-I]

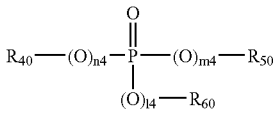

wherein $R_{40}$, $R_{50}$ and $R_{60}$ each independently represent an aliphatic group or an aromatic group; and l4, m4 and n4 each independently represent 0 or 1, with the proviso that l4, m4 and n4 simultaneously are not 1;

$R_A$—NH—$SO_2R_B$ Formula [ST-II]

wherein $R_A$ and $R_B$ each independently represent a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic oxy group, or —N($R_C$)($R_D$), in which $R_c$ and $R_D$ each independently represent a hydrogen atom, an alkyl group or an aryl group; and $R_A$ and $R_B$ each may be the same or different from each other;

HO—(J')—COOY Formula [ST-III]

wherein J' represents a divalent organic group; and Y represents an alkyl group, a cycloalkyl group, an aryl group, an alkenyl group, an alkynyl group, a cycloalkenyl group or a heterocyclic group;

$R_{51}$—O—($CH_2$-$J_5$-$CH_2O$)$_{15}$$R_{52}$ Formula [ST-IV]

wherein $R_{51}$ and $R_{52}$ each independently represent an aliphatic group or —$COR_{53}$, in which $R_{53}$ represents an aliphatic group; $J_5$ represents a divalent organic group or simply a connecting bond; and 15 represents an integer from 0 to 6; and $R_{54}$—$Y_{54}$ Formula [ST-V]

wherein $R_{54}$ represents a hydrophobic group having the total number of carbon atoms of 10 or more; and $Y_{54}$ represents a monovalent organic group containing an alcoholic hydroxyl group.

26. The image forming method according to claim 21, characterized in that the support is a reflective support, the silver halide color photographic light-sensitive material contains the dye-forming coupler that forms the azomethine dye in an amount of 18 mass % or more but less than 100 mass % based on the total lipophilic components in a layer containing the dye-forming coupler, and as the lipophilic component, at least one polymer soluble in an organic solvent is contained.

27. The image forming method according to claim 21, characterized in that the silver halide color photographic light-sensitive material contains at least one compound selected from a group consisting of the compounds represented by any of the formulae (Ph-s1), (Ph-2), (E-1) to (E-3) and (TS-I) to (TS-VII), metal complexes and ultraviolet absorbents in an emulsion layer containing the dye-forming coupler that forms the azomethine dye, and a proportion of the dye-forming coupler that forms the azomethine dye to total lipophilic components in the emulsion layer containing the dye-forming coupler that forms the azomethine dye is from 18 mass % to 99 mass %;

Formula Ph-1

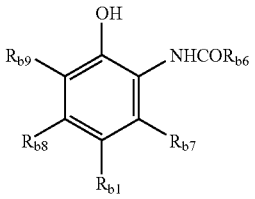

Formula Ph-2

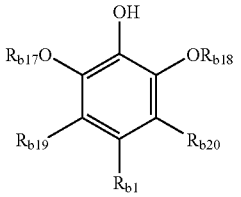

wherein, in formula [Ph-1] and [Ph-2], $R_{b1}$ represents an aryl group, an aromatic group, a carbamoyl group, an acylamino group, a carbonyl group or a sulfonyl group; $R_{b6}$ represents an aliphatic group, an aryl group, an amino group or an acyl group; $R_{b7}$ to $R_{b9}$, $R_{b19}$ and $R_{b20}$ each independently represent a hydrogen atom, a halogen atom, a hydroxyl group, an aliphatic group, an aryl group, a heterocyclic group, an alkyloxy group, an aryloxy group, a heterocyclicoxy group, an oxycarbonyl group, an acyl group, an acyloxy group, an oxycarbonyloxy group, a carbamoyl group, an acylamino group, a sulfonyl group, a sulfinyl group, a sulfamoyl group, an alkylthio group or an arylthio group; and $R_{b17}$ and $R_{b18}$ each independently represent an aliphatic group or an aryl group:

Formula (E-1)

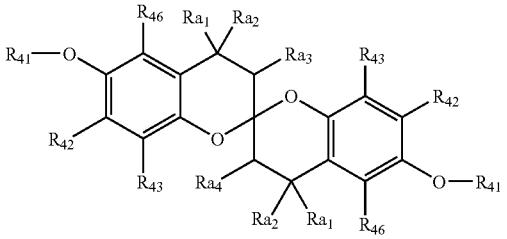

Formula (E-2)

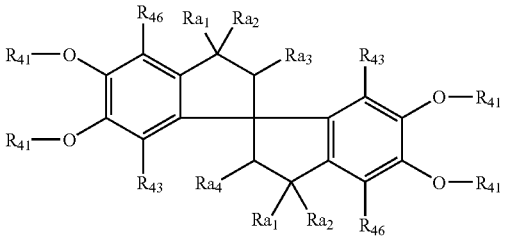

Formula (E-3)

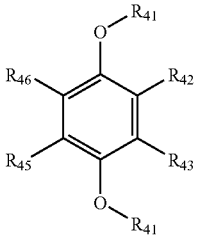

wherein, in formulae (E-1) to (E-3), $R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a —Si ($R_{47}$)($R_{48}$)($R_{49}$), in which $R_{47}$, $R_{48}$ and $R_{49}$ each independently represent an aliphatic group, an aryl group, an aliphatic oxy group, or an aryloxy group; $R_{42}$ to $R_{46}$ each independently represent a hydrogen atom, or a substituent; and Ra1 to Ra4 each independently represent a hydrogen atom, or an aliphatic group:

Formula (TS-I)

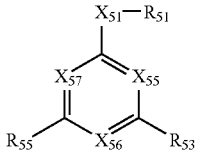

Formula (TS-II)

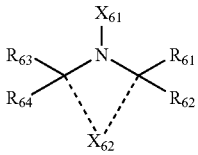

Formula (TS-III)

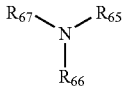

Formula (TS-IV)

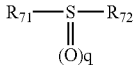

Formula (TS-V)

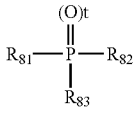

Formula (TS-VI)

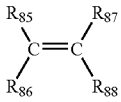

Formula (TS-VII)

wherein, in formula (TS-I), $R_{51}$ represents a hydrogen atom, an aliphatic group, an aryl group, a heterocyclic group, an acyl group, an aliphatic oxycarbonyl group, an aryloxycarbonyl group, an aliphatic sulfonyl group, an aryl sulfonyl group, a phosphoryl group, or —Si($R_{58}$)($R_{59}$)($R_{60}$), in which $R_{58}$, $R_{59}$, and $R_{60}$ each independently represent an aliphatic group, an aryl group, an aliphatic oxy group, or an aryloxy group; $X_{51}$ represents —O— or —N($R_{57}$)—, in which $R_{57}$ has the same meaning as $R_{51}$; $X_{55}$ represents —N═ or C($R_{52}$)═; $X_{56}$ represents —N═ or —C($R_{54}$)═; $X_{57}$ represents —N═ or —C($R_{56}$)═; $R_{52}$, $R_{53}$, $R_{54}$, $R_{55}$, and $R_{56}$ each independently represent a hydrogen atom, or a substituent; each combination of $R_{51}$ and $R_{52}$, $R_{57}$ and $R_{56}$, and $R_{51}$ and $R_{57}$ may combine together to form a 5- to 7-membered ring; each combination of $R_{52}$ and R53, and $R_{53}$ and $R_{54}$ may combine together to form a 5- to 7-membered ring, a spiro ring, or a bicyclo ring; each of $R_{51}$ to $R_{57}$ cannot simultaneously represent a hydrogen atom; the total number of carbon atoms of the compound represented by formula (TS-I) is 10 or more; and the compound represented by formula (TS-I) is neither identical to the compound represented by any one of formulae (Ph-1) to (Ph-2) nor the compound represented by any one of formulae (E-1) to (E-3);

wherein, in formula (TS-II), $R_{61}$, $R_{62}$, $R_{63}$, and $R_{64}$ each independently represent a hydrogen atom, or an aliphatic group; each combination of $R_{61}$ and $R_{62}$, and $R_{63}$ and $R_{64}$ may combine together to form a 5- to 7-membered ring; $X_{61}$ represents a hydrogen atom, an aliphatic group, an aliphatic oxy group, an aliphatic oxycarbonyl group, an aryl oxycarbonyl group, an acyl group, an acyloxy group, an aliphatic oxycarbonyloxy group, an aryl oxycarbonyloxy group, an aliphatic sulfonyl group, an aryl sulfonyl group, an aliphatic sulfinyl group, an aryl sulfinyl group, a sulfamoyl group, carbamoyl group, a hydroxy group, or an oxy radical group; $X_{62}$ represents a group of non-metal atoms necessary to form a 5- to 7-membered ring;

and the total number of carbon atoms of the compound represented by formula (TS-II) is 8 or more;

wherein, in formula (TS-III), $R_{65}$ and $R_{66}$ each independently represent a hydrogen atom, an aliphatic group, an aryl group, an acyl group, an aliphatic oxycarbonyl group, an aryl oxycarbonyl group, a carbamoyl group, an aliphatic sulfonyl group, or an aryl sulfonyl group; $R_{67}$ represents a hydrogen atom, an aliphatic group, an aliphatic oxy group, an aryloxy group, an aliphatic thio group, an arylthio group, an acyloxy group, an aliphatic oxycarbonyloxy group, an aryl oxycarbonyloxy group, a substituted amino group, a heterocyclic group, or a hydroxyl group; each combination of $R_{65}$ and $R_{66}$, and $R_{66}$ and $R_{67}$, and $R_{65}$ and $R_{67}$ may combine together to form a 5- to 7-membered ring except 2,2,6,6-tetraalkylpiperidine skeleton; the total number of carbon atoms of $R_{65}$ and $R_{66}$ is 7 or more; and both $R_{65}$ and $R_{66}$ are not hydrogen atoms at the same time;

wherein, in formula (TS-IV), $R_{71}$ represents a hydrogen atom, an aliphatic group, an aryl group, a heterocyclic group, Li, Na, or K; $R_{72}$ represents an aliphatic group, an aryl group, or a heterocyclic group; $R_{71}$ and $R_{72}$ may combine together to form a 5- to 7-membered ring; q represents 0, 1 or 2; and the total number of carbon atoms of $R_{71}$ and $R_{72}$ is 10 or more;

wherein, in formula (TS-V), $R_{81}$, $R_{82}$, and $R_{83}$ each independently represent an aliphatic group, an aryl group, an aliphatic oxy group, an aryloxy group, an aliphatic amino group, or an aryl amino group; t represents 0 or 1; each combination of $R_{81}$ and $R_{82}$, and $R_{81}$ and $R_{83}$ may combine together to form a 5- to 8-membered ring; and the total number of carbon atoms of $R_{81}$, $R_{82}$, and $R_{83}$ is 10 or more;

wherein, in formula (TS-VI), $R_{85}$, $R_{86}$, $R_{87}$, and $R_{88}$ each independently represent a hydrogen atom, or a substituent, and all of $R_{85}$, $R_{86}$, $R_{87}$, and $R_{88}$ cannot simultaneously represent a hydrogen atom; any two of $R_{85}$, $R_{86}$, $R_{87}$ and $R_{88}$ may combine together to form a 5- to 7-membered ring except an aromatic ring only consisting of carbon atoms as a skeleton atom; the total number of carbon atoms of the compound represented by formula (TS-VI) is 10 or more; and wherein, in formula (TS-VII), $R_{91}$ represents an hydrophobic group having total carbon atoms of 10 or more; and Y91 represents a monovalent organic group containing an alcoholic hydroxyl group.

28. The image forming method according to claim 21, characterized in that the silver halide color photographic light-sensitive material contains the dye-forming coupler that forms the azomethine dye in an amount of 18 mass % to 100 mass % based on total lipophilic components in a layer containing the dye-forming coupler, and contains at least one compound represented by the formula (CMP) in at least one of the light-insensitive hydrophilic colloid layers;

Formula (CMP)

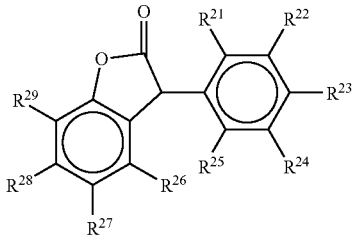

wherein, in formula (CMP), $R^{21}$ to $R^{29}$ may be same or different, and each represents a hydrogen atom or a substituent, provided that at least one of $R^{21}$ to $R^{29}$ is a substituent, or any of $R^{21}$ to $R^{29}$ may be a divalent group, to form a dimer or a multimer, or a homopolymer or copolymer by binding to a polymer chain.

29. The image forming method according to claim 21, characterized in that a silver halide emulsion layer containing at least one dye-forming coupler that forms the azomethine dye has a coating amount of total dye-forming couplers in a range of 0.18 mmol/$m^2$ to 0.28 mmol/$m^2$ and a maximum optical reflection density of 2.0 or above at a maximum absorption wavelength of the dyes after dye formation.

30. The image forming method according to claim 21, characterized in that a color development time in the development-processing is 30 seconds or below.

31. The image forming method according to claim 21, characterized in that the exposure is performed for $1\times10^{-4}$ sec or below.

32. The image forming method according to claim 23, characterized in that the silver halide color photographic light-sensitive material has two or more light-insensitive hydrophilic colloid layers and meets the following condition c):

c) that the two or more light-insensitive hydrophilic colloid layers are composed of a non-color-forming interlayer containing a color-mixing inhibitor and a non-color-forming interlayer containing substantially no color-mixing inhibitor and the non-color-forming interlayer containing a color-mixing inhibitor is provided between and adjacent to the non-color-forming interlayer containing substantially no color-mixing inhibitor and a silver halide emulsion layer.

* * * * *